US007560203B2

(12) United States Patent
Tamoto et al.

(10) Patent No.: US 7,560,203 B2
(45) **Date of Patent: *Jul. 14, 2009**

(54) ELECTROPHOTOGRAPHIC PHOTORECEPTOR, METHOD OF IMAGE FORMATION, IMAGE FORMATION APPARATUS AND PROCESS CARTRIDGE FOR IMAGE FORMATION APPARATUS

(75) Inventors: Nozomu Tamoto, Shizuoka (JP); Tatsuya Niimi, Shizuoka (JP); Tetsuro Suzuki, Shizuoka (JP); Katsuichi Ohta, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 305 days.

This patent is subject to a terminal disclaimer.

(21) Appl. No.: 10/543,927

(22) PCT Filed: Dec. 1, 2004

(86) PCT No.: PCT/JP2004/018229

§ 371 (c)(1),
(2), (4) Date: Jun. 2, 2006

(87) PCT Pub. No.: WO2005/054957

PCT Pub. Date: Jun. 16, 2005

(65) Prior Publication Data

US 2007/0154825 A1 Jul. 5, 2007

(30) Foreign Application Priority Data

| | | | |
|---|---|---|---|
| Dec. 1, 2003 | (JP) | ..... | 2003-400972 |
| Dec. 1, 2003 | (JP) | ..... | 2003-401292 |
| Nov. 8, 2004 | (JP) | ..... | 2004-323170 |
| Nov. 15, 2004 | (JP) | ..... | 2004-330043 |

(51) Int. Cl.
*G03G 5/147* (2006.01)

(52) U.S. Cl. ..... 430/58.05; 430/60; 430/58.7; 430/78; 430/59.5; 399/159

(58) Field of Classification Search ..... 430/58.05, 430/58.1, 58.7, 59.5, 60, 78, 159
See application file for complete search history.

(56) References Cited

U.S. PATENT DOCUMENTS 6,355,390 B1 * 3/2002 Yamanami et al. ..... 430/60

(Continued)

FOREIGN PATENT DOCUMENTS

JP 47 6341 4/1972

(Continued)

OTHER PUBLICATIONS

U.S. Appl. No. 12/035,016, filed Feb. 21, 2008, Iwamoto, et al.

(Continued)

*Primary Examiner*—Mark F Huff
*Assistant Examiner*—Rachel L Burney
(74) *Attorney, Agent, or Firm*—Oblon, Spivak, McClelland, Maier & Neustadt, P.C.

(57) ABSTRACT

An electrophotographic photoconductor that is excellent in the stability of image quality and can realize high durability is provided. In an electrophotographic photoconductor in which an underlying layer, a photoconductive layer, and a crosslinked-type charge transportation layer are stacked on an electrically conductive support in order, the underlying layer is composed of at least two layers being a layer containing an inorganic pigment and a layer including no inorganic pigment, and the crosslinked-type charge transportation layer is formed by curing, at least, a three-or-more-functional radical-polymerizable monomer having no charge transporting structure and a radical-polymerizable compound having one-functional charge transporting structure.

50 Claims, 13 Drawing Sheets

U.S. PATENT DOCUMENTS

| | | | | |
|---|---|---|---|---|
| 2002/0071018 | A1* | 6/2002 | Tachikawa et al. | 347/106 |
| 2004/0197116 | A1* | 10/2004 | Yoshino et al. | 399/237 |
| 2004/0248024 | A1* | 12/2004 | Suzuki et al. | 430/66 |
| 2007/0154825 | A1 | 7/2007 | Tamoto et al. | |

FOREIGN PATENT DOCUMENTS

| | | |
|---|---|---|
| JP | 51 065942 | 6/1976 |
| JP | 52 010138 | 1/1977 |
| JP | 52 082238 | 7/1977 |
| JP | 53 095033 | 8/1978 |
| JP | 53 132347 | 11/1978 |
| JP | 53 133445 | 11/1978 |
| JP | 54 002129 | 1/1979 |
| JP | 54 012742 | 1/1979 |
| JP | 54 014967 | 2/1979 |
| JP | 54 017733 | 2/1979 |
| JP | 54 021728 | 2/1979 |
| JP | 54 022834 | 2/1979 |
| JP | 56 048637 | 5/1981 |
| JP | 58 058556 | 4/1983 |
| JP | 58 093062 | 6/1983 |
| JP | 58 095351 | 6/1983 |
| JP | 58 105155 | 6/1983 |
| JP | 59 017557 | 1/1984 |
| JP | 59 093453 | 5/1984 |
| JP | 60 032054 | 2/1985 |
| JP | 60 066258 | 4/1985 |
| JP | 60 111255 | 6/1985 |
| JP | 61 239248 | 10/1986 |
| JP | 64 001728 | 1/1989 |
| JP | 64 017066 | 1/1989 |
| JP | 64 068762 | 3/1989 |
| JP | 64 068763 | 3/1989 |
| JP | 64 073352 | 3/1989 |
| JP | 64 073353 | 3/1989 |
| JP | 01 118848 | 5/1989 |
| JP | 01 118849 | 5/1989 |
| JP | 1 299874 | 12/1989 |
| JP | 02 008256 | 1/1990 |
| JP | 03 101737 | 4/1991 |
| JP | 03 141363 | 6/1991 |
| JP | 03 191361 | 8/1991 |
| JP | 03 255456 | 11/1991 |
| JP | 03 269064 | 11/1991 |
| JP | 04 170552 | 6/1992 |
| JP | 4 198367 | 7/1992 |
| JP | 04 281461 | 10/1992 |
| JP | 5 80571 | 4/1993 |
| JP | 5 80572 | 4/1993 |
| JP | 05 100461 | 4/1993 |
| JP | 5 202135 | 8/1993 |
| JP | 05 210259 | 8/1993 |
| JP | 05 210260 | 8/1993 |
| JP | 5 60503 | 9/1993 |
| JP | 06 019174 | 1/1994 |
| JP | 6 45770 | 6/1994 |
| JP | 06 208238 | 7/1994 |
| JP | 06 222600 | 8/1994 |
| JP | 06 293769 | 10/1994 |
| JP | 07 271072 | 10/1995 |
| JP | 08 110649 | 4/1996 |
| JP | 08 184979 | 7/1996 |
| JP | 8 272124 | 10/1996 |
| JP | 09 043886 | 2/1997 |
| JP | 09 190005 | 7/1997 |
| JP | 09 265202 | 10/1997 |
| JP | 09 288367 | 11/1997 |
| JP | 2718044 | 11/1997 |
| JP | 11 005919 | 1/1999 |
| JP | 2000 66425 | 3/2000 |
| JP | 2000 066425 | 3/2000 |
| JP | 2000 147814 | 5/2000 |
| JP | 3086965 | 7/2000 |
| JP | 2001 019871 | 1/2001 |
| JP | 3164426 | 3/2001 |
| JP | 3194392 | 6/2001 |
| JP | 3226110 | 8/2001 |
| JP | 3262488 | 12/2001 |
| JP | 2002 107984 | 4/2002 |
| JP | 2002 182412 | 6/2002 |
| JP | 2002 221810 | 8/2002 |
| JP | 2002 268258 | 9/2002 |
| JP | 2002 278224 | 9/2002 |
| JP | 2003 15334 | 1/2003 |
| JP | 2004302451 | * 10/2004 |

OTHER PUBLICATIONS

U.S. Appl. No. 12/047,011, filed Mar. 12, 2008, Kami, et al.
U.S. Appl. No. 11/926,748, filed Oct. 29, 2007, Yanagawa, et al.
U.S. Appl. No. 12/000,239, filed Dec. 11, 2007, Fujiwara, et al.
Enokida et al. "Polymorphism of Oxotitanium Phthalocyanines and Applications for Electrophotographic Receptors", Electrophotography—The Society Journal, vol. 29, No. 4, p. 373, English abstract only 1990.
Moser et al. "Phthalocyanine Compounds", Reinhold Publishing Corporation, p. 104 1963.
Kinoshita et al. "High Speed Organic Photoreceptor Composed of the Titanylphthalocyanine", The Annual Conference of Japan Hardcopy for the Society of Electrophotography of Japan, p. 103, with English abstract 1989.
U.S. Appl. No. 11/616,180, filed Dec. 26, 2006, Suzuki, et al.
U.S. Appl. No. 10/543,927, filed Jun. 2, 2006, Tamoto, et al.
U.S. Appl. No. 11/621,257, filed Jan. 9, 2007, Suzuki, et al.

* cited by examiner

ELECTROPHOTOGRAPHIC PHOTORECEPTOR, METHOD OF IMAGE FORMATION, IMAGE FORMATION APPARATUS AND PROCESS CARTRIDGE FOR IMAGE FORMATION APPARATUS

TECHNICAL FIELD

The present invention relates to an electrophotographic photoconductor in which, at least, an underlying layer including at least two layers being a layer containing an inorganic pigment and a layer containing no inorganic pigment, a photoconductive layer, and a crosslinked-type charge transportation layer obtained by curing a three-or-more-functional radical-polymerizable monomer having no charge transporting structure and a radical-polymerizable compound having one-functional charge transporting structure are stacked, and an image formation method, an image formation apparatus, and a process cartridge for image formation apparatus, using the same.

BACKGROUND ART

Recently, the development of information processing system machines using an electrophotographic process is remarkable, and in particular, laser printers and digital copying machines transferring information to digital signals and performing information recording by means of light are significantly improved in regard to print quality and reliability. For these rapidly spread laser printers and digital copying machines, In future, further speeding up or miniaturization as well as the attainment of high image quality will be required. Furthermore, recently, the demands of a full-color laser printer and a full-color digital copying machine capable of full-color printing are rapidly increasing. Particularly, in the case of performing full-color printing, the speeding up and the miniaturization of the apparatuses are further important problems since overlapping of toner images with at laser four colors is required.

In order to realize the speeding up and the miniaturization of the apparatuses, it is necessary to improve the sensitivity of an electrophotographic photoconductor used for them and to reduce the diameter of the photoconductor. Particularly, since at least four photoconductors are included in the apparatus in the case of a tandem type effective for satisfying both of the attainment of full-color and the speeding up, the degree of the request for the reduction in the diameters of the photoconductors is much high. However, with the progression of the reduction in the diameter of the photoconductor, the exchange frequency of a conventional photoconductor becomes much frequent, which is further serious problem, particularly, in a high-speed machine, since the photoconductor is be used in a severe condition. Therefore, not only the attainment of high sensitivity of a used photoconductor but also the attainment of very high durability thereof is essential for realizing the speeding up and the miniaturization of the apparatus.

The attainment of high sensitivity of a photoconductor necessary for responding to the speeding up of the apparatus, a charge generation material with large quantum efficiency is essential. In an organic highly-sensitive photoconductor, titanyl phthalocyanine having at least a maximum diffraction peak at 27.2° in regard to a diffraction peak (±0.2°) at a Bragg angle in a XRD (CuKα line (wavelength of 1.542 Å)) is widely used for and very effective as a charge generation material. However, there is anxiety such that background contamination significantly occurs in the photoconductor using titanyl phthalocyanine because of the deterioration of charging caused by aggregation or fatigue of the pigment. The background contamination is a phenomenon such that printing is made in a white base region in which no image should be printed normally and small black spots innumerably are generated, and has a characteristic of increasing the influence thereof by the repeated use even though it is not problematic at an initial state. Thus, the background contamination is a large factor for determining the life of a photoconductor, and since the speeding up of the apparatus can be attained by the photoconductor using titanyl phthalocyanine but the influence of background contamination becomes larger, image quality stability is poor and the satisfaction of both the speeding up and the attainment of high durability has not been realized. Therefore, in regard to the conventional photoconductor using titanyl phthalocyanine, the exchange frequency of the photoconductor is significantly large and providing stable mages over a long term has not been realized, as it is used in a high-speed machine.

For the attainment of high durability of a photoconductor, it is necessary to enhance the stability of image quality and, particularly, to suppress the generation of background contamination. For the mechanism of the generation of background contamination, the origin thereof is considered that charge with a polarity opposite to that induced at the side of an electrically conductive support leaks locally and is injected to a photoconductive layer and, further, to the surface of the photoconductor, and such portion is easy to be developed. Then, even though the background contamination on the photoconductor is not made apparent at the beginning, the background contamination is made apparent by the fatigue (deterioration of charging) of the photoconductor caused by repeated use or the increase of electrical field strength caused by wearing of the photoconductive layer, and, therefore, is a major factor for determining the life of the photoconductor.

In regard to the electrostatic fatigue of a photoconductor, the fatigue of the photoconductor progresses by repeatedly performing charging or light exposure in image formations and the lowering of a charging electric potential or the elevation of an electric potential (having the same meaning as a residual electric potential) at an exposure portion caused thereby causes the degradation of image quality. Particularly, the lowering of the charging electric potential further increases the influence of the charge leak from an electrically conductive support and facilitates to make the background contamination be apparent. In regard to the wearing of a photoconductor, as a surface layer of the photoconductor is worn away by the friction with a cleaning member, etc., and, thereby, the film thickness of the photoconductor surface layer, the degradation of image quality is caused by the elevation of electrical field strength, the increase of scratches on the photoconductor surface, etc. Particularly, as the electrical field strength elevates by the decrease of the film thickness, the generation of background contamination significantly increases.

Thus, in order to realize the speeding up, miniaturization, and long life of an image formation apparatus, it is apparent that the attainment of high sensitivity, small diameter, and high durability of an electrophotographic photoconductor used therein are needed, but the major problem on realizing them is the suppression of background contamination as mentioned above. As mentioned above, a matter originating from charge injection from an electrically conductive support, a matter originating from aggregation and coarse particles or crystallographic type of an charge generation material in a charge generation layer, and a matter originating from the increase of electrical field strength by the wearing of a layer formed on a charge transportation layer or the top surface of a photoconductor are provided as the causes of this background contamination.

In order to realize the high durability of a photoconductor, it is necessary to suppress the background contamination and, to this end, it is important to suppress the charge injection from an electrically conductive support. As a conventional technique in regard to the charge injection from an electrically conductive support being one of the causes of the generation of background contamination, a technique for providing an underlying layer or an intermediate layer between the electrically conductive support and the photoconductive layer has been suggested.

For example, an intermediate layer of cellulose nitrate-type resin, an intermediate layer of nylon-type resin, an intermediate layer of maleic acid-based resin, and an intermediate layer of polyvinyl alcohol resin are disclosed in Japanese Laid-Open Patent Application Nos. 47-6341, 60-66258, 52-10138, and 58-105155, respectively.

However, since the electric resistances of these single-layered and singularly resinous intermediate layers are high, the elevation of a residual electric potential is caused and the lowering of image concentration or the deterioration of a gradation characteristic is caused in negative or positive development. Also, since these intermediate layers indicate ionic conduction property originating from impurities, etc., the tendency that the electric resistance of the intermediate layer becomes notably high under low temperature and low humidity, whereby the residual electric potential significantly elevates, and the electric resistance of the intermediate layer is lowered under high temperature and high humidity, whereby the background contamination is easy to occur, has been found. Therefore, it is necessary to make the intermediate layer be a thin film and the actual situation is that the sufficient suppression of background contamination has not been realized.

For solving these problems, an approach of dispersing an electrically conductive additive in an intermediate layer has been suggested as a technique for controlling the electric resistance of the intermediate layer.

For example, an intermediate layer in which a carbon or a chalcogen-type material is dispersed in a curable resin, an intermediate layer of a thermally polymerized material for which a quaternary ammonium salt is added and an isocyanate-type curing agent is employed, a resinous intermediate layer to which an electrical resistance controlling agent is added, and a resinous intermediate layer to which an organometallic compound is added, are disclosed in Japanese Laid-Open Patent Application Nos. 51-65942, 52-82238, 5-210259, and 58-93062, respectively. However, in a single one of these resinous intermediate layers, the tendency that the background contamination increases is found even though the reduction of a residual electric potential is realized, and there are problems that interference fringes of light appear on an image and Moire image generates, in a recent image formation apparatus using coherent light such as laser light.

For the purpose of controlling the electrical resistance of an intermediate layer while the generation of Moire is suppressed, a photoconductor with an intermediate layer that contains filler has been suggested.

For example, a resinous intermediate layer in which an oxide of aluminum or tin is dispersed, a resinous intermediate layer in which electrically conductive particles are dispersed, an intermediate layer in which a magnetite is dispersed, and a resinous intermediate layer in which titanium oxide and tin oxide are dispersed, are disclosed in Japanese Laid-open Patent Application Nos. 58-58556, 60-111255, 59-17557, and 60-32054, respectively, and a resinous intermediate layer in which powders of a boride, nitride, fluoride, or oxide of calcium, magnesium, aluminum, etc. are dispersed, are disclosed in Japanese Laid-Open Patent Application Nos. 64-68762, 64-68763, 64-73352, 64-73353, 1-118848, and 1-118849.

Although such an intermediate layer in which filers are dispersed is effective for the suppression of Moire, it is necessary to increase the filler content for reducing the residual electric potential and it is preferable to reduce the quantity of the filler for suppressing the background contamination, but balancing of the background contamination and the residual electric potential has not been achieved yet. Further, as the content of the resin becomes lower, the adhesion property with the electrically conductive support lowers and the problem arises that peeling between the support and the intermediate layer is easy to occur, and thus there are many problems for the attainment of high durability of the photoconductor. Particularly, the influence has been critical in a belt-shaped photoconductor in which an electrically conductive support is flexible.

To solve such problems, an approach of stacking of intermediate layers is suggested. The stacking configuration is generally classified into two types, that is, one of them is a stack s such that a resinous layer in which filler is dispersed and a resinous layer that contains no filler are stacked on an electrically conductive support in order (see FIG. 1), and the other is a stack such that a resinous layer that contains no filler and a resinous layer in which filler is dispersed are stacked on an electrically conductive support in order (see FIG. 2).

As the former configuration is described in detail, on an electrically conductive support 10, an electrically conductive filler dispersion layer 21 in which low-resistant filler is dispersed is provided, the resinous layer 22 is stacked thereon, and then a photoconductive layer 30 is provided thereon, for covering up the defect of the electrically conductive support 10. These are disclosed in, for example, Japanese Laid-Open Patent Application Nos. 58-95351, 59-93453, 4-170552, 6-208238, 6-222600, 8-184979, 9-43886, 9-190005, and 9-288367. This configuration is capable of preventing the generation of Moire by the filler dispersion layer 21 that contains electrically conductive filler and can also obtain an effect of suppressing the background contamination because of having the resinous layer 22 thereon, but film thickening and film thinning will cause remarkable elevation of the residual electric potential and the increase of background contamination, respectively, and no sufficient satisfaction is obtained on realizing of the balance therebetween, since only the resinous layer 22 suppresses carrier injection from the electrically conductive support 10, similar to the case of using the aforementioned resinous layer singularly. Also, since the insulating resinous layer 22 is stacked on the filler dispersion layer 21 and it is necessary to thicken the film thickness of the filler dispersion layer 21 (equal to or greater than 10 μm) for covering up a defect of the electrically conductive support 10, it is difficult to suppress the background contamination by increasing the resistance of filler contained in the filler dispersion layer 21 because the influence of a residual electric potential significantly increases.

Also, a photoconductor in which an electrically conductive layer, an intermediate layer, and a photoconductive layer that contains titanyl phthalocyanine crystal are stacked is disclosed in Japanese Laid-Open Patent Application Nos. 5-100461, 5-210260, and 7-271072. However, it is difficult to sufficiently suppress the influence of background contamination by only stacking the electrically conductive layer and an intermediate layer. In addition to the aforementioned reason, it is because a factor of the background contamination is also included in titanyl phthalocyanine used for the photoconductor.

On the other hand, the latter configuration is a configuration such that a resinous single layer 22 for suppressing carrier injection is provided on an electrically conductive support 10, a filler dispersion layer 21 that contains filler is provided thereon, and a photoconductive layer 30 is provided thereon. This is disclosed in, for example, Japanese Laid-Open Patent Application Nos. 5-80572 and 6-19174. In this configuration, since carrier injection is suppressed by the resinous layer 22 and the filler dispersion layer 21 that contains filler and is stacked thereon has an influence given on the residual electric potential even if electrically conductive filler is not particularly contained, the suppression effect of the carrier injection is enhanced and the efficiency on the balancing between the residual electric potential and the background contamination is higher than that of the former configuration.

Thus, although a configuration such that plural underlying layers 21, 22 are stacked for function separation indicates high efficiency on satisfying the prevention of Moire, the suppression of background contamination, and further the reduction of a residual electric potential, it is necessary to thin the film of the resinous layer 22 for use and the tendency that the humidity dependence of the background contamination and the residual electric potential is large and the film thickness dependence thereof becomes large is found dependent on resin used for it, whereby it does not necessary has high stability.

Also, many investigations are made for resin used for an underlying layer and polyamide is comparatively frequently used. Among these, an approach of using an underlying layer or intermediate layer that contains N-alkoxy(methoxy)methylated nylon is disclosed. For example, an approach of containing an alkoxymethylated copolymeric nylon with the degree of alkoxymethylation of 5 through 30% in an underlying layer and an approach of containing an inorganic pigment and a cross-linked N-alkoxymethylated polyamide as a binder resin in an intermediate are disclosed in Japanese Laid-Open Patent Application Nos. 9-265202 and 2002-107984, respectively, and an approach of an underlying layer that is made of an N-alkoxymethylated nylon resin wherein each of the elemental concentrations of impurities, that is, Na, Ca, and P atoms contained in the resin is equal to or less than 10 ppm, an approach of containing an N-alkoxymethylated polyamide copolymer based on λ-amino-n-lauric acid in an intermediate layer, and an approach of containing a polyamide resin having a unit component having a certain structure in an intermediate layer, are disclosed in Japanese Patent Nos. 2718044, 3086965, and 3226110, respectively.

Thus, the approaches of stacking an underlying layer or an intermediate layer and containing N-alkoxymethylated nylon in an underlying layer or intermediate layer are publicly known, which are effective as means for suppressing the charge injection from the electrically conductive support and enhancing the background contamination suppression effect.

However, only stacking of the plural underlying layers or containing N-alkoxymethylated nylon in the underlying layer or intermediate layer is effective to the suppression of background contamination caused by the charge injection from the electrically conductive support but the influence to the residual electric potential, the Moire, the background contamination, and environmental dependence of a residual electric potential, etc. is not small. Particularly, as the electric field strength increases with the progression of photoconductor wearing, the background contamination significantly increases and the enhancement of a charge blocking function of the underlying layer or intermediate layer also under high electric field strength causes remarkable elevation of the residual electric potential, and, therefore, the suppression effect to the background contamination in repeated use of the photoconductor is not sufficient by only suppressing the charge injection from the electrically conductive support by means of the underlying layer or the intermediate layer and the high durability of the photoconductor has not been realized yet.

Furthermore, when coating is applied on the underlying layer, it is necessary to be insoluble to solvent thereof, and a defect of the coating film influences the background contamination, and, therefore, high quality of coating film and high coating property such that the deviation of film thickness is small even in a thin film are required.

Moreover, the cause of background contamination is not only charge (hole) injection from an electrically conductive support to a photoconductive layer but also cannot ignore the influence on the photoconductor as mentioned above. Particularly, the cohesiveness of conventional titanyl phthalocyanine is strong and, when it is used for a charge generation layer, the deterioration of charging and the increase of dark decay in a local portion in which agglomerates or coarse particles exist and the background contamination is made apparent even though the charge injection from an underlying layer is suppressed. Also, since the purity of titanyl phthalocyanine has a large influence, the charging deterioration is significantly caused by the containment of impurities and the increase of dark decay is caused by fatigue, whereby the resistance to the background contamination is significantly deteriorated.

Thus, in the conventional techniques, the elevation of a residual electric potential or the environmental dependence increases significantly as the background contamination is suppressed, while the background contamination suppression effect becomes insufficient as the elevation of a residual electric potential is suppressed, etc., the balancing therebetween has not been realized. Thus, the background contamination includes not only the influence of the charge injection from an electrically conductive support but also many factors such as the influence of coarse particles or impurities of titanyl phthalocyanine contained in a photoconductive layer or charge generation layer, and, however, besides them, the increase of the electric field strength by the reduction of film thickness of the photoconductor is important as a factor giving a large influence to the background contamination.

Therefore, a device to enhance the wear resistance has been made for a charge transportation layer or a protection layer formed on the top surface of a photoconductor. As conventional techniques for improving the wear resistance of a photoconductive layer, (i) the use of a curable binder for a crosslinked-type charge transportation layer (ex. see Japanese Laid-Open Patent Application No. 56-48637), (ii) the use of a polymeric charge transportation material (ex. see Japanese Laid-Open Patent Application No. 64-1728), and (iii) the dispersion of inorganic filler in a crosslinked-type charge transportation layer (ex. see Japanese Laid-Open Patent Application No. 4-281461) can be provided.

Thus, since the change of electric field over time can be made small by enhancing the wear resistance of a photoconductor, high effect for the suppression of back ground contamination can be obtained.

However, among these techniques, (i) the use of a curable binder has a tendency of facilitating to elevate the residual electric potential and to cause the lowering of image concentration by impurities such as a polymerization initiator and an unreacted residue.

Also, (ii) the use of a polymeric charge transportation material can improve the wear resistance to some extent, but has not led to sufficiently satisfy the durability required for an organic photoconductor. Also, in regard to the polymeric charge transportation material, since the polymerization and purification of the material are difficult and it is difficult to obtain high purity, the electric characteristics of the material is difficult to be stable. Furthermore, a problem on manufacture such that coating liquid becomes highly viscous may occur.

(iii) The dispersion of inorganic filler exerts high wear resistance compared to a photoconductor in which a normal low-molecular-weight charge transportation material is dispersed in an inactive polymeric molecules but there is a tendency of facilitating to elevate a residual electric potential by a charge trap existing on an inorganic filler surface and to cause the lowering of image density. Also, when the irregularities made of inorganic filler and a binder resin on a photoconductor surface is large, improper cleaning occurs, which may cause toner filming or image deletion.

These techniques (i), (ii), and (iii) may be effective for the suppression of background contamination but have a disadvantage on a residual electric potential, a cleaning property, etc., and has not led to satisfying the durability sufficiently because of the influence of an image defect caused by it.

Furthermore, a photoconductor that contains a substance obtained by curing multi-functional acrylate monomers for improving the wear resistance and damage resistance of (i) is known (ex. see Japanese Patent No. 3262488). However, in regard to this photoconductor, there is a description of the meaning of containing this substance obtained by curing multi-functional acrylate monomers in a protection layer provided on a photoconductive layer but there is an only description that a charge transportation material may be contained in this protection layer and no specific description, and further in the case of simply containing low-molecular-weight charge transportation material in a crosslinked-type charge transportation layer, there is a problem of compatibility with the aforementioned cured substance, whereby the precipitation or white turbidity phenomenon of a low-molecular-weight charge transportation material occurs and not only image concentration lowered by the elevation of an electrical potential of exposed portion but also the mechanical strength might lower. Furthermore, since, specifically, the monomers are reacted on the condition of containing a polymeric binder in regard to this photoconductor, three-dimensional network structure develops insufficiently and the crosslink density thereof is subtle, thereby having not led to be able to exert a drastic wear resistance.

As a wear resistance technique for a photoconductor replacing them, it is known that a charge transportation layer formed by using coating liquid made from monomers having a carbon-carbon double bond, a charge transportation material having a carbon-carbon double bond, and a binder resin is provided (ex. See Japanese Patent No. 3194392). It is considered that this binder resin serves to improve the adhesion property of a charge generation layer and a crosslinked-type charge transportation layer and, further, to relax the internal stress of a film at the time of curing a thick film, and is generally classified to one having a carbon-carbon double bond and having reactivity to the aforementioned charge transportation material and one having no double bond mentioned above and having no reactivity.

Although this photoconductor satisfies both a wear resistance and a good electrical characteristic and draws attention, the compatibility of a binder resin and a cured substance produced by the reaction of the aforementioned monomer and the charge transportation material is low and layer peeling occurs in a crosslinked-type charge transportation layer, thereby causing damage or the fixation of an external additive and paper powder in toner, in the case of using one having no reactivity as the binder resin. Also, as mentioned above, three-dimensional network structure develops insufficiently and the crosslink density thereof is subtle, thereby having not led to exert a drastic wear resistance. In addition, the specifically described monomer used in this photoconductor is two-functional and the wear resistance thereof has not led to satisfaction yet in these respects. Also, in the case of using a binder resin having reactivity, the molecular weight of the cured substance increases but the number of intermolecular crosslinkages is low, and it is difficult to satisfy both the bonding quantity and the crosslink density of the aforementioned charge transportation material and the electrical characteristic and the wear resistance were insufficient.

Also, a photoconductor that contains a compound for which a hole transportation compound having two or more chain-polymerizable functional groups in the same molecule is cured is known (ex See Japanese Laid-Open patent Application No. 2000-66425). Although the crosslink density of this photoconductive layer can be high, it has a high hardness, but distortion occurs in a cured substance and the internal stress thereof becomes large since a bulky hole transportation compound has two or more chain-polymerizable functional groups, whereby a crack or peeling in the cross-linked surface layer may be easy to occur in use over a long term. It is considered that the photoconductor having a crosslinked photoconductive layer for which charge transporting structures are chemically bonded in these conventional techniques has no sufficient overall characteristics in the present circumstances.

Thus, while many conventional techniques for enhancing the wear resistance of a photoconductor are disclosed and it is known that they are effective for the suppression of background contamination, the generation of an image defect such as the deterioration of resolution or gradation, image deletion, and the adhesion of foreign substances is induced even if the background contamination can be suppressed, that is, the elevation of a residual electric potential becomes easy to occur, image deletion becomes easy to be caused dependent on humidity, a photoconductor surface becomes difficult to be refaced whereby filming becomes easy to occur, etc., and the stability of image quality is greatly deteriorated, and, therefore, in fact, the attainment of high durability of a photoconductor has not been realized.

Also, only enhancing the wear resistance of a photoconductor can reduce the influence to electric field with time but the influence caused by charge injection from an electrically conductive support is facilitated by the deterioration of charging caused by the fatigue of the photoconductor, and, therefore, the effect is not sufficient. Therefore, in order to suppress the generation of background contamination by repeated use of a photoconductor and to realize the attainment of high durability of the photoconductor, it is necessary to suppress the charge injection from an electrically conductive support and to reduce the wearing of photoconductor caused by repeated use.

In order to completely suppress the generation of background contamination, it is not achieved unless not only the charge injection from an electrically conductive support is suppressed but also the reduction of film thickness of a photoconductive layer caused by repeated use is suppressed. Also, the attainment of high durability of a photoconductor can be achieved only by suppressing the aforementioned generation of background contamination, making the stability of a residual electric potential over time be high, and reducing the degradation of image quality as side effect such as filming, the adhesion of foreign substances, and image deletion caused by enhancing the wear resistance, so that high image quality can be maintained over a long term even in repeated use. However, the satisfaction of all of them has not been realized in the conventional techniques and the actual circumstance is that the high durability of a photoconductor has not been achieved yet.

DISCLOSURE OF THE INVENTION

It is a general object of the present invention to provide an electrophotographic photoconductor which is excellent in the stability of image quality even in repeated use and can realize high durability. Specifically, provided is an electrophotographic photoconductor which has a drastically high durability and high stability not only by suppressing background contamination generated by charge injection from an electrically conductive support and by suppressing the increase of background contamination facilitated by the increase of electric field strength caused by electrostatic fatigue and further wearing by repeated use over a long term, but also by controlling to minimum the generation of an image defect such as filming, the adhesion of foreign substances, image deletion, etc., caused by the elevation of a residual electric potential, charging deterioration and the improvement of a wear resistance.

Also, another object of the present invention is to provide a stable and highly durable image formation apparatus in which the photoconductor described above is used and the generation of an abnormal image such as background contamination, etc., is low even though image formation is repeatedly performed. Specifically, provided is a highly durable and highly stable high-speed image formation apparatus, solving the major problem such as background contamination and the lowering of concentration that are caused by repeated use in a negative/positive development system. Furthermore, a highly durable, highly stable, and well-handling process cartridge for image formation apparatus using the photoconductor described above is provided.

The invention is achieved by the following configurations.

(1) An electrophotographic photoconductor in which, at least, an underlying layer, a photoconductive layer, and a crosslinked-type charge transportation layer are stacked on an electrically conductive support in order, wherein the underlying layer is composed of, at least, two layers being a layer containing an inorganic pigment and a layer containing no inorganic pigment, and the crosslinked-type charge transportation layer is formed by curing, at least, a three-or-more-functional radical-polymerizable monomer having no charge transporting structure and a one-functional radical-polymerizable compound having a charge transporting structure.

(2) The electrophotographic photoconductor as described in (1) above, wherein the photoconductive layer is composed of a stacked-layer structure in which a charge generation layer and a charge transportation layer are stacked in order.

(3) The electrophotographic photoconductor as described in (1) or (2) above, wherein the layer containing no inorganic pigment in the underlying layer contains a polyamide resin.

(4) The electrophotographic photoconductor as described in (3) above, wherein the polyamide resin is N-methoxymethylated nylon.

(5) The electrophotographic photoconductor as described in (4) above, wherein the N-methoxymetylated nylon is crosslinked by heating.

(6) The electrophotographic photoconductor as described in any of (1) through (5) above, wherein a layer thickness of the layer containing no inorganic pigment in the underlying layer is less than 2.0 μm.

(7) The electrophotographic photoconductor as described in any of (1) through (6) above, wherein the layer containing an inorganic pigment in the underlying layer contains a metal oxide as the inorganic pigment.

(8) The electrophotographic photoconductor as described in (7) above, wherein the metal oxide is titanium oxide.

(9) The electrophotographic photoconductor as described in any of (1) through (8) above, wherein the inorganic pigment is a mixture of two or more kinds of inorganic pigments with different average primary particle diameters, and the relation of $0.2<(D2/D1)\leqq 0.5$ is satisfied, in which D1 is the average primary particle diameter of an inorganic pigment having a maximum average primary particle diameter and D2 is the average primary particle diameter of an inorganic pigment having a minimum average primary particle diameter.

(10) The electrophotographic photoconductor as described in (9) above, wherein the D2 is less than 0.2 μm.

(11) The electrophotographic photoconductor as described in (9) or (10) above, wherein a mixture ratio of the two or more kinds of inorganic pigments with different average primary particle diameters satisfies the relation of $0.2\leqq T2/(T1+T2)\leqq 0.8$ by weight, in which T1 is a content of an inorganic pigment having a maximum average primary particle diameter and T2 is a content of an inorganic pigment having a minimum average primary particle diameter.

(12) The electrophotographic photoconductor as described in any of (1) through (11) above, wherein the layer containing an inorganic pigment in the underlying layer contains a thermosetting resin as a binder resin.

(13) The electrophotographic photoconductor as described in (12) above, wherein the thermosetting resin is composed of an alkyd resin and melamine resin.

(14) The electrophotographic photoconductor as described in (13) above, wherein a weight ratio of the alkyd resin to the melamine resin is within a range of 1/1 through 4/1.

(15) The electrophotographic photoconductor as described in any of (1) through (14), wherein a volume ratio of an inorganic pigment contained in the layer containing an inorganic pigment to the binder resin is within a range of 1/1 through 3/1.

(16) The electrophotographic photoconductor as described in any of (1) through (15), wherein a film thickness of the layer containing an inorganic pigment is greater than a film thickness of the layer containing no inorganic pigment in the underlying layer.

(17) The electrophotographic photoconductor as described in any of (1) through (16) above, wherein the layer containing no inorganic pigment in the underlying layer is formed directly on the electrically conductive support and the layer containing an inorganic pigment is stacked thereon.

(18) The electrophotographic photoconductor as described in any of (1) through (17) above, wherein the crosslinked-type charge transportation layer is insoluble to an organic solvent.

(19) The electrophotographic photoconductor as described in any of (1) through (18) above, wherein a functional group of the three-or-more-functional radical-polymerizable monomer having no charge transporting structure used for the crosslinked-type charge transportation layer is an acryloyloxy group and/or a methacryloyloxy group.

(20) The electrophotographic photoconductor as described in any of (1) through (19) above, wherein a ratio of a molecular weight to the number of a functional group(s) (molecular weight/the number of functional group(s)) in regard to the three-or-more-functional radical-polymerizable monomer having no charge transporting structure used for the crosslinked-type charge transportation layer is equal to or less than 250.

(21) The electrophotographic photoconductor as described in any of (1) through (20) above, wherein a functional group of the one-functional radical-polymerizable compound having a charge transporting structure used for the crosslinked-type charge transportation layer is an acryloyloxy group or a methacryloyloxy group.

(22) The electrophotographic photoconductor as described in any of (1) through (21) above, wherein the charge transporting structure of the one-functional radical-polymerizable compound having a charge transporting structure used for the crosslinked-type charge transportation layer is a triarylamine structure.

(23) The electrophotographic photoconductor as described in any of (1) through (22) above, wherein the one-functional radical-polymerizable compound having a charge transporting structure used for the crosslinked-type charge transportation layer is at least one kind of compound represented by the following general formula (1) or (2).

General formula (1)

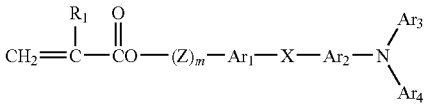

General formula (2)

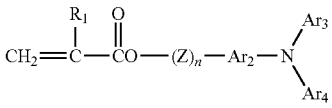

(In the formulas, $R_1$ represents a hydrogen atom, a halogen atom, an alkyl group that may have a substituent, an aralkyl group that may have a substituent, an aryl group that may have a substituent, a cyano group, a nitro group, an alkoxy group, —$COOR_7$ ($R_7$ represents a hydrogen atom, an alkyl group that may have a substituent, an aralkyl group that may have a substituent, or an aryl group that may have a substituent), a carbonyl halide group, or —$CONR_8R_9$ ($R_8$ and $R_9$ represent a hydrogen atom, a halogen atom, an alkyl group that may have a substituent, an aralkyl group that may have a substituent, or an aryl group that may have a substituent, and may be identical or different), and $Ar_1$ and $Ar_2$ represent substituted or non-substituted arylene groups and may be identical or different. $Ar_3$ and $Ar_4$ represent substituted or non-substituted aryl groups and may be identical or different. X represents a single bond, a substituted or non-substituted alkylene group, a substituted or non-substituted cycloalkylene group, a substituted or non-substituted alkylene ether group, an oxygen atom, a sulfur atom, or a vinylene group. Z represents a substituted or non-substituted alkylene group, a substituted or non-substituted alkylene ether divalent group, or an alkyleneoxycarbonyl divalent group. m and n represent integers of 0 through 3.)

(24) The electrophotographic photoconductor as described in any of (1) through (23) above, wherein the one-functional radical-polymerizable compound having a charge transporting structure used for the crosslinked-type charge transportation layer is at least one kind of compound represented by the following general formula (3).

General formula (3)

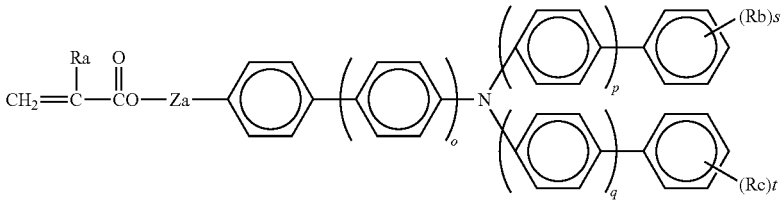

(In the formula, each of o, p, and q represents an integer of 0 or 1, Ra represents a hydrogen atom or a methyl group, and Rb and Rc are substituents other than hydrogen atoms, represent alkyl groups in which the number of carbon(s) is 1 through 6, and may be different in the case of a plural number. s and t represent integers of 0 through 3. Za represents a single bond, a methylene group, an ethylene group, or a group of the following structural formula.)

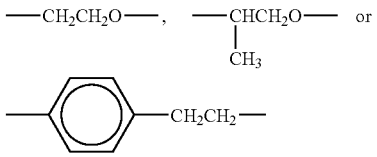

(25) The electrophotographic photoconductor as described in above (1) through (24) above, wherein a component ratio of the three-or-more-functional radical-polymerizable monomer having no charge transporting structure used for the crosslinked-type charge transportation layer is 30 through 70% by weight of a total quantity of the crosslinked-type charge transportation layer.

(26) The electrophotographic photoconductor as described in any of (1) through (25) above, wherein a component ratio of the one-functional radical-polymerizable compound having a charge transporting structure used for the crosslinked-type charge transportation layer is 30 through 70% by weight of a total quantity of the crosslinked-type charge transportation layer.

(27) The electrophotographic photoconductor as described in (1) through (26) above, wherein curing of the crosslinked-type charge transportation layer is carried out by means of heating or light energy irradiation means.

(28) The electrophotographic photoconductor as described in (1) above, wherein the photoconductive layer contains a titanyl phthalocyanine crystal which has a crystallographic type, at least, having a maximum diffraction peak at 27.2°, further having main peaks at 9.4°, 9.6°, and 24.0°, having a peak at 7.3° as a diffraction peak at a smallest angle side, having no peak between the peak at 7.3° and the peak at 9.4°, and further having no peak at 26.3°, in regard to a diffraction peak (±0.2°) at a Bragg angle 2θ of characteristic X rays (wavelength of 1.542 Å) of CuKα, and in which an average particle size of primary particles is equal to or less than 0.25 μm.

(29) The electrophotographic photoconductor as described in (28) above, wherein dispersion of titanyl phthalocyanine with the crystallographic type is performed until an average particle size thereof is equal to or less than 0.3 μm and a standard deviation thereof is equal to or less than 0.2 μm, then, filtration is performed with a filter of which an effective pore size is equal to or less than 3 μm, and the photosensitive layer or the charge generation layer is coated using dispersion liquid in which an average particle size of primary particles is equal to or less than 0.25 μm.

(30) The electrophotographic photoconductor as described in (28) or (29) above, wherein the titanyl phthalocyanine crystal is such that crystal transformation of an amorphous titanyl phthalocyanine or low crystalline titanyl phthalocyanine which has, at least, a maximum diffraction peak at 7.0° through 7.5°, a half value width of which diffraction peak is equal to or greater than 1°, in regard to a diffraction peak (±0.2°) at a Bragg angle 2θ of characteristic X rays (wavelength of 1.542 Å) of CuKα, and in which an average particle size of primary particles is equal to or less than 0.1 μm, is performed with an organic solvent under the presence of water, and titanyl phthalocyanine after the crystal transformation is separated with an organic solvent and filtered before an average particle size of primary particles after the crystal transformation grows to be greater than 0.25 μm.

(31) The electrophotographic photoconductor as described in (28) through (30) above, wherein the titanyl phthalocyanine crystal is synthesized using a raw material containing no halide.

(32) The electrophotographic photoconductor as described in (28) through (31) above, wherein the titanyl phthalocyanine crystal is obtained by performing crystal transformation of an amorphous titanyl phthalocyanine or low crystalline titanyl phthalocyanine with an organic solvent under the presence of water, and the amorphous titanyl phthalocyanine or low crystalline titanyl phthalocyanine used in the crystal transformation for the titanyl phthalocyanine crystal is made by an acid-paste method and sufficiently washed with ion-exchanged water, in which pH of ion-exchanged water after the washing is 6 through 8 and/or a specific conductivity of ion-exchanged water is equal to or less than 8.

(33) The electrophotographic photoconductor as described in any of (28) through (32) above, wherein the titanyl phthalocyanine crystal is obtained by performing crystal transformation of an amorphous titanyl phthalocyanine or low crystalline titanyl phthalocyanine with an organic solvent under the presence of water, and a quantity of the organic solvent used in the crystal transformation for the titanyl phthalocyanine crystal is equal to or greater than 30 times (weight ratio) of that of the amorphous titanyl phthalocyanine or low crystalline titanyl phthalocyanine.

(34) The electrophotographic photoconductor as described in any of (28) through (33) above, wherein the photoconductive layer contains a polymeric charge transportation material.

(35) An image formation method in which, at least, charging, image-wise light exposure, development, and transcription are repeatedly performed using an electrophotographic photoconductor as described in any of (1) through (34) above.

(36) An image formation apparatus having, at least, charging means, light exposure means, development means, transcription means, and an electrophotographic photoconductor, wherein the electrophotographic photoconductor is an electrophotographic photoconductor as described in any of (1) through (34) above.

(37) The image formation apparatus as described in (36) above, wherein a plurality of image formation elements composed of, at least, the charging means, the light exposure means, the development means, the transcription means, and the electrophotographic photoconductor are arranged.

(38) The image formation apparatus as descried in (36) or (37) above, wherein an alternating superposed voltage is applied to the charging means used for the image formation apparatus.

(39) The image formation apparatus having, at least, charging means, light exposure means, development means, transcription means, and an electrophotographic photoconductor, as described in any of (36) through (38) above, wherein a linear velocity of the photoconductor at the time of image formation is equal to or greater than 250 mm/sec.

(40) The image formation apparatus as described in (39) above, having, at least, charging means, light exposure means, development means, transcription means, and an electrophotographic photoconductor, wherein the linear velocity of the photoconductor at the time of image formation is equal to or greater than 300 mm/sec.

(41) The image formation apparatus as described in any of (36) through (40) above, wherein the image formation apparatus has a process cartridge for image formation apparatus in which, at least, the electrophotographic photoconductor and at least one mean selected from the charging means, the light exposure means, development means, and cleaning means are integrated, and the process cartridge for image formation apparatus can be attached to and detached from a body of the apparatus at will.

(42) A process cartridge for image formation apparatus in which, at least, the electrophotographic photoconductor and at least one mean selected from the charging means, the light exposure means, development means, and cleaning means are integrated, wherein the electrophotographic photoconductor is an electrophotographic photoconductor as described in any of (1) through (34).

According to the present invention, the generation of background contamination can be suppressed even in repeated use for a long term, change of en electric potential at a light-exposed portion over time is also very small, and the generation of an image defect such as image deletion and filming can be also suppressed, by having an underlying layer in which at least two layers being a layer containing an inorganic pigment and a layer containing no inorganic pigment are stacked and by having on the surface of a photoconductor, at least, a crosslinked-type charge transportation layer formed by curing a three-or-more-functional radical-polymerizable monomer having no charge transporting structure and a one-functional radical-polymerizable compound having a charge transporting structure, so that an electrophotographic photoconductor that can stably output an image with a high image quality over a long term is provided.

Also, an image formation apparatus in which there is little generation of background contamination, there is a few side effect such as image deletion, and an image with high image quality can be stably output over a long term, even though image formation is performed repeatedly is provided by using the photoconductor as described above. Also, since the attainment of high durability and attainment of high stability of a photoconductor can be thus realized, miniaturization and speeding up of an image formation apparatus are attained and, particularly, it can be effectively used for a tandem-type image formation apparatus and a high-speed image formation apparatus.

DESCRIPTION OF REFERENCE NUMERALS

Figure 1:
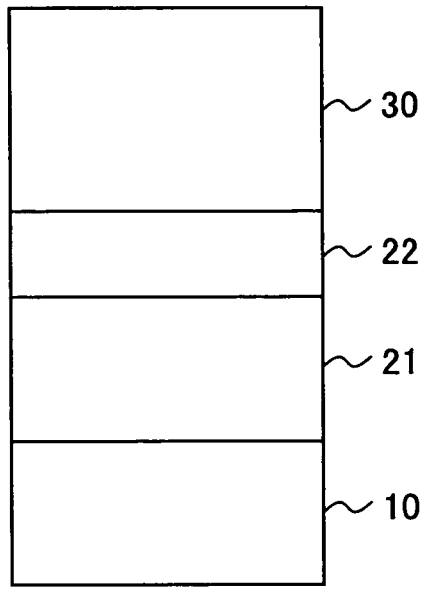
FIG. 1 is an explanatory drawing for an example of the configuration of a stacked-layer photoconductor.
Figure 2:
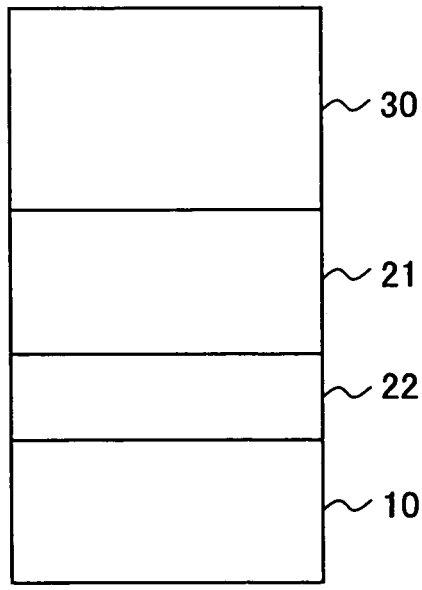
FIG. 2 is an explanatory drawing for an example of the configuration of another stacked-layer photoconductor.

10 Electrically conductive support
21 Filler dispersion layer
22 Resin layer
25 Underlying layer 1
26 Underlying layer 2
30 Photoconductive layer
40 Crosslinked-type charge transportation layer
45 Charge transportation layer
50 Charge generation layer
101, 101C, 101M, 101Y, 101K Photoconductor
102, 102C, 102M, 102Y, 102K Charging roller (Charging means, Charging member)
103 Image-wise light exposure part (Light exposure means)
103C, 103M, 103Y, 103K Laser light
104, 104C, 104M, 104Y, 104K Development unit (Development means, Development member)
105, 105C, 105M, 105Y, 105K Cleaning blade (Cleaning means, Cleaning member)
106 Fur brush
107 Medium subjected to transcription
108 Paper feeding control roller
109 Resistive roller
110 Transcription conveyance belt
111 Transcription charger
113 Pre-transcription charger
114 Separation charger
115 Separation claw
116 Pre-cleaning charger
119 Charge elimination lamp
121 Gap formation member
122 Metal shaft
123 Image formation area
124 Non image formation are
131C, 131M, 131Y, 131K Transcription bias application member
132 Fixation device
136C, 136M, 136Y, 136K Image formation element

BEST MODE FOR CARRYING OUT THE INVENTION

The inventors has found that there can be no side effect of the elevation of a residual electric potential and the durability to background contamination caused by repeated use can be drastically improved by stacking on an electrically conductive support an underlying layer for which at least two layers being a layer containing an inorganic pigment and a layer containing no inorganic pigment are stacked, a photoconductive layer, and a crosslinked-type charge transportation layer for which at least, a three-or-more-functional radical-polymerizable monomer having no charge transporting structure and a one-functional radical-polymerizable compound having a charge transporting structure are cured.

An electrophotographic photoconductor used for the present invention is illustrated in detail with reference to the drawings.

Figure 3:
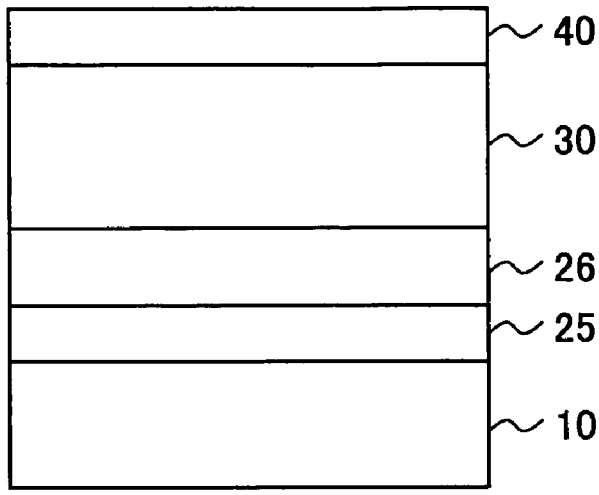
FIG. 3 is an explanatory drawing for an example of the configuration of an electrophotographic photoconductor used for the present invention.

FIG. 3 is a cross-sectional view of an example of the configuration of an electrophotographic photoconductor used for the present invention, which has a configuration such that at least two underlying layers 25, 26 being a layer containing no inorganic pigment and a layer containing an inorganic pigment, a photoconductive layer 30 containing titanyl phthalocyanine crystal having a specific crystallographic type in which an average particle size is equal to or less than 0.25 μm, and, further, a crosslinked-type charge transportation layer 40 formed by curing, at least, a three-or-more-functional radical-polymerizable monomer having no charge transporting structure and a one-functional radical-polymerizable compound having a charge transporting structure are stacked on an electrically conductive support 10.

Figure 4:
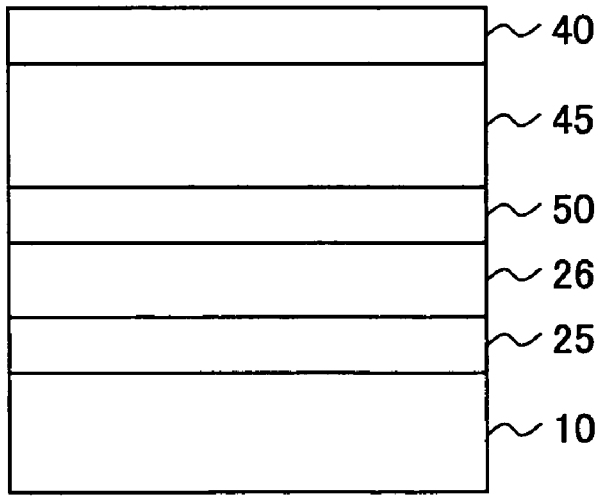
FIG. 4 is an explanatory drawing for an example of the configuration of another electrophotographic photoconductor used for the present invention.

FIG. 4 is a cross-sectional view of another example of the configuration of an electrophotographic photoconductor used for the present invention, which has a configuration such that at least two underlying layers 25, 26 being a layer containing no inorganic pigment and a layer containing an inorganic pigment, a charge generation layer 50 based on a charge generation material such as titanyl phthalocyanine crystal having a specific crystallographic type in which the average particle size of primary particles is equal to or less than 0.25 μm, a charge transportation layer 45 based on a charge transportation material, and, further, a crosslinked-type charge transportation layer 40 formed by curing, at least, a three-or-more-functional radical-polymerizable monomer having no charge transporting structure and a one-functional radical-polymerizable compound having a charge transporting structure are stacked on an electrically conductive support 10 in order.

By making a photoconductive layer be a stacked-layer structure, there is an effect of suppressing the movement of a charge injected from the electrically conductive support 10 toward the surface thereof, and the dispersion stability of the charge generation material is easily maintained, so that a further effect of suppressing background contamination is obtained.

As the electrically conductive support, one for which an electrically conductive material with a volumetric resistivity equal to or less than $10^{10}$ Ωcm, for example, a metal such as aluminum, nickel, chromium, nichrome, copper, gold, silver, and platinum, and a metal oxide such as tin oxide and indium oxide is applied to a film-shaped or cylindrical-shaped plastic or paper by means of vapor deposition or sputtering, a plate of aluminum, an aluminum alloy, nickel, stainless, or the like, a pipe for which an unfinished pipe is made by applying a technique such as extrusion or drawing to it and, subsequently, surface treatment such as cutting, super finishing, and polishing is provided, etc., can be used. Also, an endless nickel belt and an endless stainless belt can be used as the electrically conductive support.

Otherwise, one for which electrically conductive powder is dispersed in a proper binder resin and coating is made on the support, can be also used as the electrically conductive support in the present invention. As the electrically conductive powder, carbon black, acetylene black, metal powder of aluminum, nickel, iron, nichrome, copper, zinc, silver, or the like and metal oxide powder of electrically conductive tin oxide, ITO (indium tin oxide), or the like, can be provided.

Also, as a binder resin that is simultaneously used, thermoplastic resins, thermosetting resins, and photo-setting resins, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly(vinylidene chloride), polyallylate resin, phenoxy resin, polycarbonate, cellulose acetate resin, ethylcellulose resin, poly(vinyl butyral), poly(vinyl formal), poly(vinyltoluene), poly(N-vinylcarbazole), acrylic resin, silicone resin, epoxy resin, melamine resin, urethane resin, phenol resin, and alkyd resins can be provided. Such an electrically conductive layer can be provided by dispersing the electrically conductive powder and the binder resin in a proper solvent such as tetrahydrofuran, dichloromethane, ethyl methyl ketone, and toluene and by applying them.

Furthermore, one made by providing on a proper cylindrical substrate an electrically conductive of a heat-shrinkable tubing that contains the aforementioned electrically conductive powder in a material such as poly(vinyl chloride), poly(propylene), polyester, poly(styrene), poly(vinylidene chloride), poly(ethylene), chlorinated rubber, and Teflon (Registered trademark), can be used well as the electrically conductive support in the present invention.

Next, the underlying layer is described. The underlying layer in the present invention has a configuration such that at least two underlying layers being a layer containing no inorganic pigment and a layer containing an inorganic pigment are stacked. The underlying layer has many roles such as to suppress the injection of anti-polar charge induced in an electrically conductive support at the time of charging of a photoconductor, to prevent Moire, to mask a defect of an unfinished pipe, and to improve the adhesion property of the photoconductive layer. In the case of one normal underlying layer, it is shown that a residual electric potential tends to rise as charge injection from an electrically conductive support is suppressed, and, on the contrary, as the residual electric potential is lowered, the background contamination deteriorates. In regard to such a trade-off relation, as the result of forming a plural underlying layer to separate functions required for the underlying layer, the effect of suppressing the background contamination can be significantly improved without influencing the residual electric potential, the charging property, the Moire, the adhesion property, etc., so mach, and very large effect to the attainment of high durability of a photoconductor can be obtained without side effect to the Moire and the adhesion property.

First, an underlying layer containing no inorganic pigment that is primarily intended to suppress charge injection from an electrically conductive support in the underlying layers is described. This underlying layer is a layer having a function of preventing an anti-polar charge induced in the electrically conductive support at the time of charging for a photoconductor from injecting to a photoconductive layer and a layer that is primarily intended to suppress background contamination. Also, it has the effect of enhancing masking property against a defect of an unfinished pipe, which enhances the suppression effect to the background contamination. Therefore, since it is required that the movement of a charge is suppressed in order to achieve these objects, it is made of only a resin with high insulating property without containing an inorganic pigment.

As a layer for suppressing charge injection, anodic an oxide coating represented by an aluminum oxide layer, an inorganic insulating layer represented by SiO, a layer formed by a glassy network of an metal oxide as described in Japanese Laid-Open Patent Application No. 3-191361, a layer composed of polyphosphazene as described in Japanese Laid-Open Patent Application No. 3-141363, a layer composed of an aminosilane reaction product as described in Japanese Laid-Open Patent Application No. 3-101737, and, in addition, a layer composed of an insulating binder resin, a layer composed of a curable binder resin, etc., can be provided. Among these, a layer composed of an insulating binder resin or curable binder resin that can be formed by a wet-type coating method can be used well. Further, in regard to the underlying layer, since an underlying containing an inorganic pigment and a binder resin, a photoconductive layer, etc., are stacked thereon, when they are provided by a wet-type coating method, it is important that it is composed of a material or has a configuration which have insolubility to coating solvent and do not affect the coated film.

In the present invention, as a resin used for the underlying layer containing no inorganic pigment that is primarily intended to suppress the background contamination, any of conventional publicly known resins may be used, but a binder resin having an insulating property is particularly used since it is necessary to suppress the charge injection. As one example of the binder resins, thermoplastic resins such as polyamides, polyesters, and vinyl chloride-vinyl acetate copolymer, and also, thermosetting resins, for example, a thermosetting resin for which a compound containing a plurality of active hydrogens (a hydrogen of —OH group, —$NH_2$ group, —NH group, etc.,) and a compound containing plural isocyanate groups and/or a compound containing plural epoxy groups are thermally polymerized, etc., can be used.

In this case, as the compound containing plural active hydrogens, for example, poly(vinyl butyral), phenoxy resin, phenol resin, polyamides, polyesters, polyethylene glycol, polypropylene glycol, polybutylene glycol, acrylic resins containing an active hydrogen such as a hydroxyethyl methacrylate group, etc., can be provided. As a compound containing plural isocyanate groups, for example, tolylene diisocyanate, hexamethylene diisocyanate, diphenylmethane diisocyanate, etc., and prepolymers thereof, etc., can be provided, and as a compound having plural epoxy groups, bisphenol A type epoxy resin, etc., can be provided. Also, a thermosetting resin for which an oil-free alkyd resin and an amino resin, for example, butylated melamine resin, etc., are thermally polymerized, and further, a photo-setting resin such as the combination of a resin having an unsaturated bond such as a polyurethane having an unsaturated bond and an unsaturated polyester, and a photo-polymerization initiator such as a thioxanthone-type compound and methyl benzylformate can be used as the binder resin. Since the insulating properties of such an alcohol-soluble resin and a thermosetting resin are high and, further, a ketone-type solvent is frequently used for liquid applied to an upper layer so that a film is not dissolved at the time of coating and the uniformity of a film is maintained, they are excellent in the stability and uniformity of the effect of background contamination suppression.

In the present invention, polyamides are preferable among these resins and, particularly, N-methoxymethylated nylon is most preferable among these. In regard to the polyamide resins, not only the effect of suppressing the charge injection is high but also the influence to a residual electric potential is relatively low. Therefore, the effect of suppressing the charge injection from an electrically conductive support is drastically enhanced, which is very effective for the suppression of background contamination. Also, these polyamide resins are alcohol-soluble resins and show insolubility to ketone-type solvents, and since a uniform thin film can be also formed in dip coating, they are excellent in coating properties. Particularly, in order to minimize the influence of the elevation of a residual electric potential, since it is required to make this underlying layer be a thin film and, further, the uniformity of the film thickness is required, the coating properties will be significant in the stability of image quality.

However, in general, since the humidity dependence of alcohol-soluble resins such as polyamide-type resins is high and, thereby, the resistance becomes high under the low humidity circumstance and the resistance becomes low under the high humidity circumstance causing the lowering of charging, the problem is that the environmental dependence of the elevation of a residual electric potential is high. Among polyamide resins, N-methoxymethylated nylon shows a high insulating property, is very excellent in the blocking property of a charge injected from an electrically conductive support, the influence of it to the residual electric potential is small, further, the environmental dependence of it is much reduced, a stable image quality can be always maintained even though operation conditions of an image formation apparatus are changed, and, therefore, it is most preferably used. In addition, in the case of using N-methoxymethylated nylon, since the dependence of the residual electric potential on a film thickness is small, the elevation and environmental dependence of the residual electric potential can be reduced and the effect of highly suppressing background contamination can be obtained.

The substitution ratio of alkoxymethyl groups in N-methoxymethylated nylon is not particularly limited but is preferably equal to or greater than 15 mol %. The aforementioned effect due to the use of N-methoxymethylated nylon is influenced by the degree of methoxymethylation, and when the substitution ratio of methoxymethyl groups is lower than it, the humidity dependence tends to increase and, in the case of alcoholic solution thereof, white turbidity tends to be produced, whereby the stability of coating liquid over time may be slightly low.

In the present invention, although N-methoxymethylated nylon can be singularly used, a crosslinking agent or a acidic catalyst can be added in some cases. Herein, if N-methoxymethylated nylon is crosslinked by heating, etc., a further underlying layer, when a charge generation layer, or the like is coated on this layer, coated film is not dissolved so that stable film formation is attained, whereby the effect of suppressing background contamination is sufficiently exerted. As the crosslinking agent, commercially available materials such as conventional publicly known melamine resin and isocyanate resins can be used, and as the catalyst, acidic catalyst can be used and general-purpose catalysts such as tartaric acid can be used. Herein, since the insulating property of an underlying layer is lowered by the addition of an acidic catalyst and there is a possibility of reducing the effect of suppressing background contamination, the loading has to be very small. The loading is preferably equal to or less than 5 wt % of a resin. Also, another binder resin can be mixed in some cases. As the binder resin the can be mixed, a polyamide resin that shows alcohol-solubility is used and the stability of liquid over time may be enhanced.

Also, an electrically conductive polymer, a resin or low-molecular-weight compound with accepting (donating) property in conformity with charging polarity, and otherwise, each kind of additive can be added, which may be effective to the lowering of a residual electric potential. However, when an upper layer is stacked by dip coating, since those additives may be extracted, the loadings thereof has to be minimum.

As the coating solvent, a general organic solvent can be used, but since polyamide-type resins such as N-methoxymethylated nylon is alcohol-soluble, an alcoholic solvent such as methanol, ethanol, propanol, butanol, etc., or a mixture solvent thereof is used.

The aforementioned underlying layer is coated by conventional publicly known dip coating, spray coat, ring coat, bead coat, nozzle coat methods, etc. After coating, the film formation is completed by heating for drying, but, in the case of curing, curing treatment such as heating and light irradiation can be also performed according to need.

The film thickness of the aforementioned underlying layer containing no inorganic pigment is appropriately equal to or greater then 0.1 μm and less than 2.0 μm, preferably equal to or greater then 0.3 μm and equal to or less than 1.0 μm. If the film thickness of this underlying layer is larger than it, the elevation of a residual electric potential is easily generated by the repeat of charging and light exposure and if the film thickness is too thin, the effect of suppressing background contamination becomes poor. If the film thickness of the underlying layer containing no inorganic pigment is less than 2.0 μm, the side effect of the elevation of a residual electric potential in repeated use can be reduced, which is effective for the improvement of the stability of image quality.

Next, in the underlying layers in the present invention, an underlying layer containing an inorganic pigment, intended to prevent Moire and to enhance the adhesion property of a photoconductive layer and effective for reducing charging deterioration and a residual electric potential which are caused by fatigue is described. The underlying layer containing an inorganic pigment is primarily intended to prevent Moire by the contained inorganic pigment, can prevent the injection of charge from an electrically conductive support and reduce the elevation of a residual electric potential and dark decay by fatigue, and further has a function of enhancing the adhesion property with a photoconductive layer. This underlying layer also has the effect of suppressing background contamination but a function of preventing Moire or enhancing the adhesion property with a photoconductive layer is required. Therefore, It is preferable to increase the surface roughness of the underlying layer, which is achieved by dispersing the inorganic pigment.

The aforementioned Moire is one kind of image defect, such that interference fringes called as Moire are formed on an image by means of light interference inside a photoconductive layer when writing is performed by means of coherent light such as laser light. Basically, since the generation of Moire is prevented due to the light scattering of incident laser light by this underlying layer, it is necessary to contain a material with a high refractive index. In order to prevent the Moire, a configuration such that an inorganic pigment is dispersed in a binder resin is most effective. As the used inorganic pigment, a white pigment is effectively used, and a metal oxide, for example, titanium oxide, calcium fluoride, zinc oxide, calcium oxide, silicon oxide, magnesium oxide, aluminum oxide, tin oxide, etc., is used well. When a metal oxide as the inorganic pigment is contained in the layer containing an inorganic pigment, the influence of the elevation of a residual electric potential and charge deterioration caused by fatigue is small and the effect of highly suppressing Moire can be obtained.

Also, on the viewpoint of the lowering of a residual electrical potential, it is preferable that the underlying layer has a function of moving charge that is the same polarity as that of charge charged on the surface of a photoconductor, to the side of an electrically conductive support, and the inorganic pigment effects such a role. For example, in the case of negatively-charged type photoconductor, the underlying layer can much lower a residual electric potential by having an electron conductive property. As these inorganic pigments, the aforementioned metal oxides are preferably used, and, however, while the effect of lowering a residual electric potential becomes high by using a low resistant inorganic pigment such as an electrically conductive metal oxide or increasing the addition ratio of an inorganic pigment to a binder resin to more than necessary, the effect of suppressing background contamination may be lowered. In the case of using a high resistant metal oxide, it is effective for the suppression of background contamination but a residual electric potential tends to rise.

Therefore, it is necessary to balance between the suppression of background contamination and the lowering of a residual electric potential by appropriately using them or by adjusting the loading thereof dependent on the layer structure or film thickness of the underlying layer in a photoconductive layer. Among the aforementioned inorganic pigment, an electrically conductive pigment such as tin oxide is effective for suppressing the generation of a residual electric potential but the influence of background contamination may increase.

In the present invention, since plural underlying layers are formed and functional separation is made, the inorganic pigment can be more widely selected, but the resistance of an inorganic pigment contained in the underlying layer containing the inorganic pigment has no small effect on background contamination or a residual electric potential even if having an underlying layer containing no inorganic pigment. Therefore, for suppressing background contamination, it is preferable to use a metal oxide with a resistance higher than that of an electrically conductive metal oxide, whereby the influence to a residual electric potential and the background contamination is made minimum, and as a pigment excellent in the effect of preventing Moire, titanium oxide is most preferable. As used titanium oxide, high purity is more preferable for reducing the elevation of a residual electric potential.

In regard to an inorganic pigment used for the present invention, high purity is preferable for reducing the elevation of a residual electric potential. The purity thereof is preferably equal to or greater than 99.0%, more preferably, equal to or greater than 99.5%. The average primary particle diameter of an inorganic pigment for the present invention is preferably 0.01 μm through 0.8 μm, more preferably, 0.05 μm through 0.5 μm. However, when only the inorganic pigment with an average primary particle diameter equal to or less than 0.1 μm is used, it is effective to reduce background contamination but the effect of preventing Moire tens to lower, and, on the other hand, when only the metal oxide with an average primary particle diameter greater than 0.4 μm is used, the effect of preventing Moire is excellent but the effect of suppressing background contamination slightly tends to lower. In this case, the reduction of background contamination and the reduction of Moire may be able to be balanced by mixing and using inorganic pigments having different average primary particle diameters, and the effect of lowering a residual electric potential may be also found, which is effective.

In the present invention, when two or more kinds of inorganic pigments with different average primary particle diameters are mixed, it is preferable to satisfy the relation of $0.2<(D2/D1)\leqq 0.5$, in which D1 is the average primary particle diameter of an inorganic pigment having a maximum average primary particle diameter and D2 is the average primary particle diameter of an inorganic pigment having a minimum average primary particle diameter. Thus, while the effect of preventing Moire is maintained, the effect of suppressing background contamination can be significantly enhanced. Also, the effect of lowering a residual electric potential can be simultaneously obtained. Additionally, in this case, the average primary particle diameter D2 of an inorganic pigment having a minimum average primary particle diameter is preferably less than 0.2 μm. Thereby, the effect of suppressing background contamination can be further enhanced.

Also, the mixture ratio of these two or more kinds of inorganic pigments with different average primary particle diameter preferably satisfies the relation of $0.2\leqq T2/(T1+T2)\leqq 0.8$ by weight, in which T1 is the content of an inorganic pigment having a maximum average primary particle diameter and T2 is the content of an inorganic pigment having a minimum average primary particle diameter. Thereby, while the effect of preventing Moire is maintained, the effect of suppressing background contamination can be significantly enhanced. Also, the effect of lowering a residual electric potential can be simultaneously obtained. If $T2/(T1+T2)$ is less than 0.2, the effect of suppressing background contamination may be lowered, and if $T2/(T1+T2)$ is greater than 0.8, the effect of preventing Moire may be lowered.

As a binder resin used for these underlying layers containing an inorganic pigment, general-purpose resins that have been conventionally used for an underlying layer can be used, but a binder resin showing insolubility to a solvent used at the time of stacking an upper layer on this underlying layer is suitable. As the binder resin of these layers containing an inorganic pigment, water-soluble resins such as poly(vinyl alcohol), casein, and poly(sodium acrylate), alcohol-soluble resins such as polyamides, copolymerized nylon and methoxymethylated nylon, and a curable resins in which a three-dimensional network structure is formed, such as polyurethane, phenol resin, alkyd-melamine resins composed of an alkyd resin and melamine resin, and epoxy resin, can be provided. Among these resins, since as curable resins such as thermosetting resins is cured, the influence of resin extraction caused by an organic solvent when an upper layer (a photoconductive layer) is coated on the underlying layer, and, therefore, the stability of coating property can be enhanced, thereby it is most preferably used. That is, a photoconductor with high stability of image quality can be stably manufactured. Among the aforementioned curable resins, alkyd-melamine resins are preferable from the viewpoint of a residual electric potential and environmental stability. When the thermosetting resin is composed of an alkyd resin and melamine resin, the influence to the elevation of a residual electric potential is small, the environmental dependence is reduced, and the high stability is realized.

However, in this case, unless the ratio of a curing agent to a base resin is proper, volumetric shrinkage caused by thermal cure is enhanced, so that a defect of a coated film may easily occur or a residual electric potential may rise. Particularly, since a defect of coated film for an underlying layer causes leak of charge so as to facilitate the generation of a black spot or background contamination, caution is needed. Also, the elevation of a residual electric potential tends to increase with increasing the content ratio of a curing agent. In the present invention, when an alkyd-melamine resin is used as a resin for an underlying layer, the content ratio of an alkyd resin to melamine resin is preferably within a range of 1/1 through 4/1 in weight ratio. Thereby, the generation of a defect of a coated film can be reduced, the influence of the elevation of a residual electric potential can be reduced, and there is an effect of suppressing background contamination.

The content ratio of an inorganic pigment to a binder resin is necessarily adjusted dependent on the kind of used inorganic pigment, the layer structure, and the film thickness of an underlying layer containing no inorganic pigment, but the range of the volume ratio of an inorganic pigment to a binder resin is preferably 1/1 through 3/1 for balancing back ground contamination and a residual electric potential. Thereby, balancing the suppression of background contamination and the lowering of a residual electric potential is attained. If the volume ratio of them is less than 1/1, not only the ability to prevent Moire is reduced but also the elevation of a residual electric potential in repeated use may increase. On the other hand, when the volume ratio is greater than 3/1, not only the binding ability of a binder resin is lowered but also the surface property of a coated film deteriorates so that the film formation property of an upper layer may be affected. In regard to this affection, when a photoconductive layer is configured to be a stacked-layer type and a thin layer such as a charge generation layer is formed as an upper layer, the uniformity of the film thickness of a charge generation layer is lowered, and, thereby, the local deterioration of charging occur, so that the effect of suppressing background contamination may be reduced. Furthermore, when the volume ratio of them is greater than 3/1, the ratio of covering the surface of an inorganic pigment with a binder resin is reduced, and it may directly contact a charge generation material so as to affect background contamination.

The film thickness of an underlying layer containing an inorganic pigment is necessarily adjusted dependent on the kind of used inorganic pigment, the layer structure, and the film thickness of an underlying layer containing no inorganic pigment, but it is appropriately 1 through 10 μm, preferably, 2 through 6 μm for balancing background contamination and a residual electric potential, when titanium oxide is used as the inorganic pigment. If the film thickness is less than 1 μm, the effect of preventing Moire may be reduced or charging deterioration caused by fatigue may increase, and if it increases beyond necessity, the elevation of a residual electric potential may be caused. Also, when an electrically conductive metal oxide is used as the inorganic pigment, the influence of a residual electric potential is low, even if the film thickness increases, and it is appropriately 3 through 20 μm, preferably, 5 through 15 μm. Also, in the present invention, the film thickness of an underlying later containing an inorganic pigment is preferably greater than that of an underlying layer containing no inorganic pigment. Thereby, charging deterioration by fatigue can be suppressed, which is effective for the suppression of background contamination. Also, the quality of coated film and the uniformity of the film thickness in regard to an underlying layer containing an inorganic pigment and a binder resin are improved. Further, the effect of preventing Moire can be sufficiently obtained, which is effective for the stability of image quality.

The inorganic pigment are dispersed with a solvent and a binder resin by a conventional publicly known method, for example, ball-mill, sand mill, AttrIter, etc., so that coating liquid can be obtained. The binder resin may be added before the dispersion or may be added after the dispersion as a resin solution. Also, a drug, a solvent, an additive, an accelerator, etc., necessary for curing (crosslinking) can be added and effective according to need. These coating liquids are used and the formation on an electrically conductive support are made using a conventional publicly known method, for example, dip coating, spray coating, ring coating, bead coating, nozzle coating methods, etc. After coating, the manufacture can be made by drying or heating, if necessary, by drying or curing with curing treatment such as light irradiation.

In the present invention, a configuration such that the functions of an underlying layer is separated and at least two layers are stacked is employed for balancing the suppression of background contamination, the reduction of a residual electric potential and dark decay by fatigue, the prevention of Moire, the adhesion property of a photoconductive layer. In this case, two layer structures can be conceivable dependent on whether the underlying layer containing an inorganic pigment is formed as an upper layer or a lower layer of the underlying layer containing no inorganic pigment.

In a layer structure such that the former underlying layer containing an inorganic pigment is formed between an underlying layer containing no inorganic pigment formed on an electrically conductive support and a photoconductive layer, while the effect of highly suppressing background contamination is exerted, the influences of the elevation of a residual electric potential and charging deterioration caused by fatigue are very small and it is excellent in electrostatic stability. Also, the adhesion property with the photoconductive layer is improved and the availability for attaining high durability of a photoconductor is high. In this case, even though an electrically conductive metal oxide is not particularly used, the influence to a residual potential is small and titanium oxide can be effectively used as the inorganic pigment among the aforementioned metal oxides. Thereby, while the influence to a residual electric potential is reduced, the effect of highly suppressing background contamination can be obtained. Thus, when the layer containing no inorganic pigment in the underlying layers is directly on the electrically conductive support and a layer containing an inorganic pigment is stacked thereon, the effect of suppressing background contamination is high and the elevation of a residual electric potential in the initial stage and in repeated use can be suppressed, so that the improvement of background contamination and the lowering of a residual electric potential can be balanced. Moreover, a further effect can be obtained in regard to the suppression of dark decay caused by fatigue, the adhesion property of a photoconductive layer, and masking property for a defect or dirt of an electrically photoconductor.

On the other hand, when the latter underlying layer containing an inorganic pigment is formed between an electrically conductive support and an underlying layer containing no inorganic pigment, the effect of suppressing background contamination can be sufficiently obtained, but the influences of the elevation of a residual electric potential and charging deterioration caused by fatigue increase. They can be suppressed by much increasing the addition ratio of an inorganic pigment to a binder resin or by adding an electrically conductive inorganic pigment to enhance the electrical conductivity. As an inorganic pigment used for the purpose of it, an electrically conductive pigment such as tin oxide is preferable from the viewpoint of a residual electric potential. In the present invention, the former configuration is appropriate, since it has a large effect of the suppression of background contamination, and can satisfy a residual potential caused by fatigue and the stability of a charging property over time, and further is excellent in the masking property for a defect of an electrically conductive support and the adhesion property of a photoconductive layer, whereby the effect of the present invention can be further enhanced.

Next, the photoconductive layer is described. Although the photoconductive layer may be a photoconductive layer with a single-layer structure that includes a charge generation material and a charge transportation material, a stacked-layer type composed of a charge generation layer and a charge transportation layer as mentioned above shows excellent properties in the sensitivity, the durability, the suppression of background contamination and is used well in the present invention.

A charge generation layer is a layer based on a charge generation material. As the charge generation material, an inorganic material and an organic material can be used. As the inorganic material, crystalline selenium, amorphous selenium, selenium-tellurium, a selenium-tellurium-halogen, a selenium-arsenic compound, cadmium sulfide, cadmium sulfide-selenium, and amorphous silicon, etc., can be provided. In regard to the amorphous silicon, one such that the dangling bond thereof is terminated with a hydrogen atom or a halogen atom or one in which a boron atom, phosphorus atom, or the like is doped is used well.

On the other hand, as the organic material, well-known materials can be used. For example, azoic pigments such as disazo pigments, asymmetric disazo pigments, trisazo pigments, azo pigments having a carbazole skeleton (described in Japanese Laid-Open Patent Application No. 53-95033), azo pigments having a distyrylbenzene skeleton (described in Japanese Laid-Open Patent Application No. 53-133445), azo pigments having a triphenylamine skeleton (described in Japanese Laid-Open Patent Application No. 53-132347), azo pigments having a diphenylamine skeleton, azo pigments having a dibenzothiophene skeleton (described in Japanese Laid-Open Patent Application No. 54-21728), azo pigments having a fluorenone skeleton (described in Japanese Laid-Open Patent Application No. 54-22834), azo pigments having an oxadiazole skeleton (described in Japanese Laid-Open Patent Application No. 54-12742), azo pigments having a bis(stilbene) skeleton (described in Japanese Laid-Open Patent Application No. 54-17733), azo pigments having a distyryloxadiazole skeleton (described in Japanese Laid-Open Patent Application No. 54-2129), and azo pigments having a distyrylcarbazole skeleton (described in Japanese Laid-Open Patent Application No. 54-14967), azulenium salt pigments, a methine squarate pigment, perylene-based pigments, anthraquinone-based or polycyclic quinone-based pigments, quinoneimine-based pigments, diphenylmethane or triphenylmethane-based pigements, benzoquinone or naphthoquinone-based pigments, cyanine or azomethine-based pigments, indigoid-based pigments, bis(benzimidazole)-based pigments, and phthalocyanine-based pigments such as metal phthalocyanine represented by the following formula General formula (N)

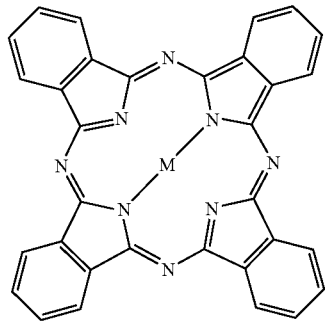

and no-metal phthalocyanine, etc., can be provided.

In the formula, M (central metal) represents an element of a metal or no metal (a hydrogen). M (central metal) provided here is composed of a chemical element such as H, Li, Be, Na, Mg, Al, Si, K, Ca, Sc, Ti, V, Cr, Mn, Fe, Co, Ni, Cu, Zn, Ga, Ge, Y, Zr, Nb, Mo, Tc, Ru, Rh, Pd, Ag, Cd, In, Sn, Sb, Ba, Hf, Ta, W, Re, Os, Ir, Pt, Au, Hg, Tl, La, Ce, Pr, Nd, Pm, Sm, Eu, Gd, Tb, Dy, Ho, Er, Tm, Yb, Lu, Th, Pa, U, Np, and Am, or two or more kinds of elements such as oxides, chlorides, fluorides, hydroxides, and bromides. The central metal is not limited to these elements.

The charge generation material having a phthalocyanine skeleton in the present invention has only to have, at least, a basic skeleton of the general formula (N), and may be one having a multimer structure such as a dimmer and a trimer or may also be one having a higher-order polymeric structure. Also, one such that there are various substituent groups in the basic skeleton is allowed. Among these various phthalocyanine, oxotitanyl phthalocyanine having TiO as the central metal, no-metal phthalocyanine, chlorogallium phthalocyanine, etc., are particularly preferable for photoconductor properties.

Also, it is known that these phthalocyanines have various crystal systems and, for example, have α, β, γ, m, Y, etc.,—type polycrsytal systems, in the case of oxotitanyl phthalocyanine and have polycrsytal systems of α, β, γ, etc,. polycrsytal systems. Even in phthalocyanines having identical central metals, various properties change with the change of the crystal systems thereof. It has been reported that the properties of photoconductors for which phthalocyanine-based pigments having these various crystal systems are used, also change with them [(ELECTROGRAPHY—The Society Journal, Vol. 29, No. 4 (1990))]. Accordingly, the selection of the crystal systems of phthalocyanines is very important for photoconductor properties, and, among these, particularly, Y-type oxotitanyl phthalocyanine is effective and useful for the attainment of high sensitivity. Additionally, these charge generation material can be singularly or as a mixture of two or more kinds.

Also, in an electrophotographic photoconductor in which, at least, a plurality of underlying layers, a photoconductive layer, and a crosslinked-type charge transportation layer are stacked on an electrically conductive support in order, wherein, preferably, the photoconductive layer comprises a titanyl phthalocyanine crystal which has a crystallographic type, at least, having a maximum diffraction peak at 27.2°, further having main peaks at 9.4°, 9.6°, and 24.0°, having a peak at 7.3° as a diffraction peak at a smallest angle side, having no peak between the peak at 7.3° and the peak at 9.4°, and further having no peak at 26.3°, in regard to a diffraction peak (±0.2°) at a Bragg angle 2θ of characteristic X rays (wavelength of 1.542 Å) of CuKα, and in which an average particle size of primary particles is equal to or less than 0.25 μm, and the crosslinked-type charge transportation layer is formed by curing, at least, a three-or-more-functional radical-polymerizable monomer having no charge transporting structure and a one-functional radical-polymerizable compound having a charge transporting structure.

Thereby, the charge injection from an electrically conductive support can be suppressed without a side effect such as a residual electric potential and the environmental dependence, and aggregated particles in a charge generation layer can be reduced while the high sensitivity is maintained, and the wearing resistance can be drastically improved without the image quality degradation caused by filming and a scratch even in repeated use, and as the result, background contamination can be suppressed in the long term. Further, an electrophotographic photoconductor can be obtained such that the stability of a residual potential and charging property is also high and an image with high quality can be stably fed.

The titanyl phthalocyanine with a crystallographic type indicated here is described in Japanese Laid-Open Patent Application No. 2001-19871 and a charge generation material used for the present invention and a photoconductor and image formation apparatus using it are disclosed. A highly stable electrophotographic photoconductor such that the deterioration of charging property is little even in repeated use while the high sensitivity is not lost, can be obtained using this phthalocyanine crystal. However, when used repeatedly for a very long term, the increase of background contamination is caused and it was not satisfied with respect to the lifetime of a photoconductor. This cause is considered that the factor of background contamination cause by charge injected from an electrically conductive support has not been addressed even though the factor of background contamination originating from a charge generation layer is improved. On the other hand, although a configuration such that plural underlying layers or an intermediate layer stacked between an electrically conductive support and a photoconductive layer is a technique described in Japanese Laid-Open Patent Application No. 5-80572, as described above, the influence of the generation of a heat carrier in the photoconductive layer is large in combination with a photoconductive layer having high sensitivity, and background contamination could not completely be prevented. This tendency has been a significant problem when a charge generation material having absorption at a longer wavelength represented by titanyl phthalocyanine as used for the present invention is used.

Thus, although a method of suppressing background contamination is disclosed for each of the charge generation layer and the underlying layer, plural factors of background contamination exist and, it is impossible to endure under the situation of repeated use for a long term, unless they are simultaneously suppressed. That is because there is a very small factor of background contamination such that a photoconductor is fatigued in repeated use even though it is not problematic at the initial stage, and the factor of background contamination grows with the progression of the deterioration of a component material. Therefore, it is necessary to exclude the factor of background contamination, if possible, from the initial stage and to enhance the stability against the fatigue of a photoconductor in repeated use. However, no method for solving them simultaneously and attaining drastically high durability has been disclosed.

The present invention can drastically suppress background contamination and attain the high durability and the high stability and further the speeding up and the miniaturization, as the result of performing an investigation for the stabilization of image quality by reducing side effect to a residual electric potential and the environmental dependence and by thoroughly excluding the factors of background contamination of all the layers, that is, the underlying layers, the charge generation layer, and the surface layer.

First, a synthesis method for a titanyl phthalocyanine having a particular crystallographic type that is preferably used in the present invention is described.

Firstly, a synthesis method for a crude synthetic of titanyl phthalocyanine crystal is described. A synthetic method for phthalocyanines is known from a long time ago, which is described in Frank H. Moser and Arthur L. Thomas "PHTHALOCYANINE COMPOUNDS" (1963), "The Phthalocyanines" (1983), Japanese Laid-Open Patent Application No. 6-293769, etc.

For example, the first method is a method of heating a mixture of a phthalic anhydride, a metal or metal halide, and urea under the presence or absence of a solvent with a high boiling point. In this case, a catalyst such as ammonium molybdate is used in combination according to need. The second method is a method of heating a phthalonitrile and a metal halide under the presence or absence of a solvent with a high boiling point. This method is used for phthalocyanines that cannot be produced by the first method, for example, aluminum phthalocyanines, indium phthalocyanines, oxovanadium phthalocyanines, oxotitanium phthalocyanines, zirconium phthalocyanines, etc. The third method is a method of firstly reacting phthalic anhydride or a phthalonitrile and ammonia to produce, for example, an intermediate, for example, 1,3-diiminoisoindoline, etc., and subsequently reacting it with a metal halide in a solvent with a high boiling point. The fourth method is a method of reacting a phthalonitrile and a metal alkoxide under the presence of urea, etc. Particularly, the four method is a very useful method as a method of synthesizing a material for electrophotograph, since chlorination (halogenation) to a benzene ring does not occur, and is used very effectively in the present invention.

Thus, as a synthesis method for titanyl phthalocyanine crystal that is preferably used for the present invention, a method that uses no titanium halide as a raw material is used well, as described in Japanese Laid-Open Patent Application No. 6-293769. The greatest merit of this method is that a synthesized titanyl phthalocyanine crystal is halide-free. When a titanyl phthalocyanine crystal contains a titanyl halide phthalocyanine crystal as an impurity, an adverse effect such as the deterioration of a photosensitivity and the deterioration of a charging property is often applied to the electrostatic properties of a photoconductor using it (Japan Hardcopy '89 Collected Papers, p. 103, 1989). In the present invention, a halide-free titanyl phthalocyanine crystal as described in Japanese Laid-Open Patent Application No. 2001-19871 is also used effectively. When a titanyl phthalocyanine crystal is synthesized using a raw material containing no halide, the influence of the deterioration of a photosensitivity and the deterioration of a charging property to the electrostatic properties of a photoconductor can be reduced and it is effective for the suppression of background contamination.

Next, the synthesis method of an amorphous phthalocyanine (low crystalline titanyl phthalocyanine) is described. This method is a method such that after a phthalocyanine dissolved in sulfuric acid and dilution with water is performed to re-precipitate, and one called as an acid-paste method or an acid-slurry method can be used.

As a specific method, titanyl phthalocyanine is re-precipitated by dissolving the aforementioned crude synthetic in 10 through 50 times quantity of concentrated sulfuric acid, removing an insoluble matter filtration according to need, and slowly throwing it into sufficiently cooled water or ice-water with a quantity of 10 through 50 times of that of the sulfuric acid. After filtering precipitated titanyl phthalocyanine, washing and filtration with ion-exchanged water are performed and this operation is sufficiently repeated until filtered liquid is neutral. Finally, after washing with clean ion-exchanged water, filtration is performed to obtain water paste in which the concentration of a solid content is approximately 5 through 15 wt %.

Then, it is important to wash with ion-exchanged water sufficiently so as to remain as little concentrated sulfuric acid as possible. Specifically, ion-exchanged water after washing preferably shows physical values as follows. That is, if the amount of remaining sulfuric acid is represented quantitatively, it can be represented by pH or specific conductivity of ion-exchanged water after washing. In the case of being represented by pH, the pH is desirably within a range of 6 through 8. If it is within this range, the amount of remaining sulfuric acid can be judged to be such that the properties of a photoconductor are not affected. This pH value can be conveniently measured by a commercially available pH meter. Also, in the case of being represented by a specific conductivity, it is desirable to be equal to or less than 8. If it is within this range, the amount of remaining sulfuric acid can be judged to be such that the properties of a photoconductor are not affected. This specific conductivity can be measured by a commercially available electrical conductivity meter. The lower limit of the specific conductivity results in a specific conductivity of ion-exchanged water used for washing. In any of measurement, a range departing from the aforementioned range is undesirable since the amount of remaining sulfuric acid is large so that the charging property of a photoconductor is lowered and the photosensitivity is deteriorated.

On the other hand, when the titanyl phthalocyanine crystal is obtained by performing crystal transformation of amorphous titanyl phthalocyanine or low crystalline titanyl phthalocyanine with an organic solvent under the presence of water, in which crystal transformation for the titanyl phthalocyanine crystal the used amorphous titanyl phthalocyanine or low crystalline titanyl phthalocyanine is prepared by an acid-paste method, and which is sufficiently washed with ion-exchanged water, and pH of ion-exchanged water after washing is between 6 and 8 and/or the specific conductivity of ion-exchanged water is equal to or less than 8, the amount of remaining sulfuric acid can be reduced to a level that does not influence the properties of a photoconductor and it is effective for suppressing the deterioration of charging and the deterioration of sensitivity and, consequently, is also effective to the suppression of background contamination.

Thus manufactured is an amorphous titanyl phthalocyanine (low crystalline titanyl phthalocyanine) that is preferably used for the present invention. Then, it is preferable that the amorphous titanyl phthalocyanine (low crystalline titanyl phthalocyanine) has, at least, a maximum diffraction peak at 7.0 through 7.5°, in regard to a diffraction peak (±0.2°) at a Bragg angle 2θ of characteristic X rays (wavelength of 1.542 Å) of CuKα. Particularly, the half value width of the diffraction peak is preferably equal to or greater than 1°. Furthermore, the average particle size of primary particles is preferably equal to or less than 0.1 μm.

Next, the method of crystal transformation is described.

The crystal transformation is a process of transforming the amorphous titanyl phthalocyanine (low crystalline titanyl phthalocyanine) into a titanyl phthalocyanine crystal, at least, having a maximum diffraction peak at 27.2°, further having main peaks at 9.4°, 9.6°, and 24.0°, having a peak at 7.3° as a diffraction peak at the side of the smallest angle, having no peak between the peak at 7.3° and the peak at 9.4°, and having no peak at 26.3°, in regard to a diffraction peak (±0.2°) at a Bragg angle 2θ of characteristic X rays (wavelength of 1.542 Å) of CuKα.

The specific method is such that the aforementioned crystallographic type is obtained by mixing and stirring the aforementioned amorphous titanyl phthalocyanine (low crystalline titanyl phthalocyanine) with an organic solvent under the presence of water without drying it.

Then, as the used organic solvent, any organic solvent can be used if a desired crystallographic type is obtained, but if one kind selected from tetrahydrofuran, toluene, methylene chloride, carbon disulfide, ortho-dichlorobenzene, and 1,1,2-trichloroethane is particularly selected, a good result can be obtained. Preferably, these organic solvents are used singularly, but two or more kinds of these organic solvents can be mixed or they can be mixed with another solvent to be used. The quantity of the aforementioned organic solvent used for the crystal transformation is preferably equal to or greater than 10 times of the amorphous titanyl phthalocyanine (low crystalline titanyl phthalocyanine), desirably equal to or greater than 30 times of it. This is because the effects of making the crystal transformation to occur quickly and sufficiently and of sufficiently removing impurities contained in the amourphous titanyl phthalocyanine (low crystalline titanyl phthalocyanine) are exerted.

That is, when the titanyl phthalocyanine crystal is obtained by performing crystal transformation of an amorphous titanyl phthalocyanine or low crystalline titanyl phthalocyanine with an organic solvent under the presence of water, in which the crystal transformation for the titanyl phthalocyanine crystal, the quantity of the used organic solvent is equal to or greater than 30 times (weight ratio) of that of the amorphous titanyl phthalocyanine or low crystalline titanyl phthalocyanine, the crystal transformation can be certainly performed for a short time and remove of impurities contained in the amourphous titanyl phthalocyanine (low crystalline titanyl phthalocyanine) is allowed, as the result, the deterioration of sensitivity and the deterioration of charging are suppressed and the background contamination durability is effectively improved.

Additionally, although the amourphous titanyl phthalocyanine (low crystalline titanyl phthalocyanine) used here is produced by the acid-paste method, it is desirable to use one washed with sulfuric acid sufficiently, as mentioned above. When the crystal transformation is performed on a condition such that sulfuric acid remains, a sulfate ion remains in a crystal particle, and even though an operation such as water washing treatment is applied to a completed crystal, it cannot be completely removed. When a sulfate ion remains, no preferred result can be obtained, so that the sensitivity lowering of a photoconductor and the degradation of a charging property is caused, etc. For example, a method of performing the crystal transformation by throwing a titanyl phthalocyanine dissolved in sulfuric acid into an organic solvent with ion-exchanged water is described in Japanese Laid-Open Patent Application No. 8-110649 (comparison example). Then, although a crystal with a X-ray diffraction spectrum similar to that of the titanyl phthalocyanine crystal obtained in the present invention can be obtained, the concentration of a sulfate ion in a titanyl phthalocyanine is high and a light decay characteristic (photosensitivity) is bad, so that it is not good as a method for producing a titanyl phthalocyanine according to the present invention. The aforementioned crystal transformation method is a crystal transformation method based on Japanese Laid-Open Patent Application No. 2001-19871.

In regard to a charge generation material contained in an electrophotographic photoconductor according to the present invention, the effect of suppressing background contamination is enhanced and by making the particle size of the titanyl phthalocyanine crystal be smaller, which is effective to the stability of image quality and the attainment of long lifetime. The production method is described as follows.

As a method for controlling the particle size of a titanyl phthalocyanine crystal contained in a photoconductive layer, generally, two methods can be provided. One is a method of synthesizing a crystal that contains no particle larger than 0.25 μm when a titanyl phthalocyanine particle is synthesized, and the other is a method of removing a crude large particle larger than 0.25 μm after a titanyl phthalocyanine crystal is dispersed. Of course, the use of both in combination has higher effect.

First, a synthesis method for a fine particle of a titanyl phthalocyanine crystal is described.

In order to making the particle size of a titanyl phthalocyanine crystal smaller, it is found in the observation of the inventors that, in regard to the aforementioned amorphous titanyl phthalocyanine (low crystalline titayl phthalocyanine), although a primary particle diameter is equal to or less than 0.1 μm (the majority of which is approximately 0.01 through 0.05 μm) (see FIG. 5, the scale bar indicates 0.2 μm), the crystal is transformed with crystal growth in the crystal transformation. Usually, in the crystal transformation of this kind, a sufficient time period for crystal transformation is ensured so as to prevent a raw material from remaining, and after the crystal transformation is sufficiently carried out, filtration is carried out so as to obtain a titanyl phthalocyanine crystal having a desired crystallographic type. Therefore, in spite of using a raw material having a sufficiently small primary particle as the raw material, a crystal with a large primary particle (generally, 0.3 through 0.5 μm) is obtained as the crystal after crystal transformation (see FIG. 6, the scale bar indicates 0.2 μm).

When thus produced titanyl phthalocyanine crystal is dispersed, the dispersion is carried out by the application of strong shear and, further, the dispersion is carried out by the application of strong energy for crushing a primary particle according to need, in order to make the particle size after dispersion be small (equal to or less than 0.25 μm, preferably equal to or less than 0.2 μm). As the result, a part of the particle is converted to a crystallographic type that is not a desired crystallographic type as mentioned above.

Figure 5:
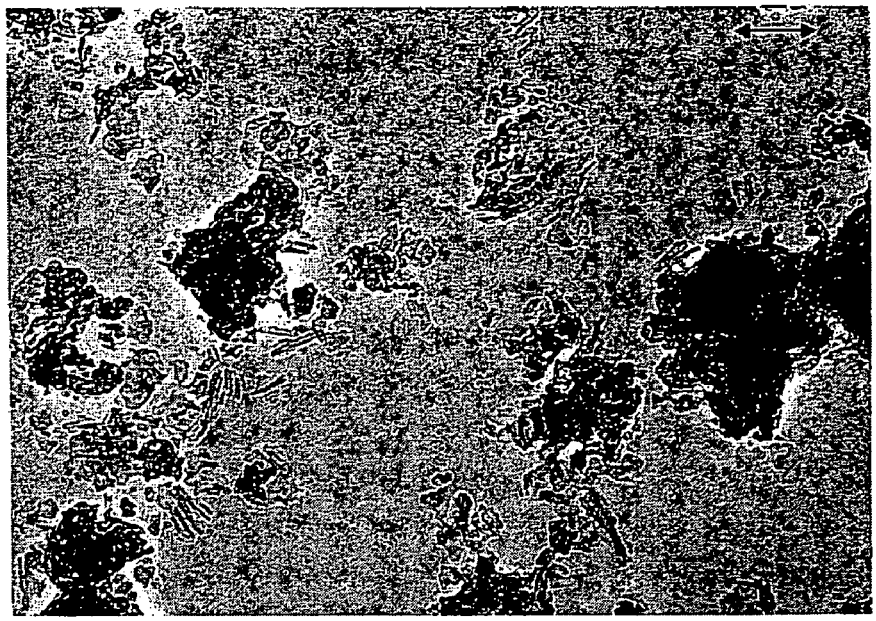
FIG. 5 shows a TEM image of an amorphous titanyl phthalocyanine.

On the other hand, the present invention is intended to obtain a titanyl phthalocyanine crystal with as small primary particle size as possible by assessing a point of time at which the crystal transformation is completed, in an area at which crystal growth hardly occur at the time of the crystal transformation (an area at which the size of an amorphous titanyl phthalocyanine particle observed in FIG. 5 is kept to be comparable smallness, generally equal to or less than 0.25 μm, after the crystal transformation). The particle size after the crystal transformation increases in proportion to a time period for the crystal transformation. Therefore, as mentioned above, it is important to raise the efficiency of the crystal transformation so as to attain the completion for a short time. To this end, some important points can be listed.

One is to select an appropriate solvent for crystal transformation so as to raise the efficiency of the crystal transformation, as mentioned above. Another is to use strong stirring for sufficiently contacting water paste of a titanyl phthalocyanine (a raw material produced as mentioned above: amorphous titanyl phthalocyanine (low crystalline titanyl phthalocyanine)) with a solvent in order to complete the crystal transformation for a short time. Specifically, the crystal transformation for a short time can be realized by a technique such as stirring means using a propeller with very strong stirring force and intensive stirring (dispersion) means such as a homogenizer (homomixer). Due to these conditions, the crystal transformation is sufficiently carried out while a raw material does not remain, and a titanyl phthalocyanine crystal at a condition such that crystal growth does not occur can be obtained. In this case, the attainment of an appropriate quantity of an organic solvent used for the crystal transformation is also effective means. Specifically, it is desirable to use an organic solvent equal to or greater than 10 times, preferably equal to or greater than 30 times, of the slid content of an amorphous titanyl phthalocyanine (low crystalline titanyl phthalocyanine). Thereby, the crystal transformation for a short time is ensured and impurities contained in the amorphous titanyl phthalocyanine can be certainly removed.

Also, since the crystal particle size and the time period of crystal transformation are in a proportional relationship as mentioned above, a method such that when a predetermined reaction (crystal transformation) is completed, the reaction is immediately stopped, is also effective means. As the means, adding a large amount of solvent immediately in which the crystal transformation is difficult to occur after the crystal transformation is carried out is provided as mentioned above. As the solvent in which the crystal transformation is difficult to occur, alcoholic solvents, ester-type solvents, etc., are provided. The crystal transformation can be stopped by adding these solvents to the crystal transformation solvent by approximately 10 times thereof.

The primary particle diameter of thus produced crystal is smaller, which is advantageous to the suppression of background contamination, but it is so small that a side effect may occur, as the next process relating to the manufacture of a titanyl phthalocyanine pigment (pigment filtration process) and the dispersion stability in dispersion liquid are considered. That is, when the primary particle is very fine, the problem occurs such that filtration time period is very long in a process for filtering it. Also, when the primary particle is too fine, since the surface area of a pigment particle in the dispersion liquid is large, the possibility of re-aggregation of particles is high and the generation of background contamination may be facilitated. Therefore, the particle size of a pigment particle is preferably within a range of approximately 0.05 μm through 0.2 μm.

Figure 7:
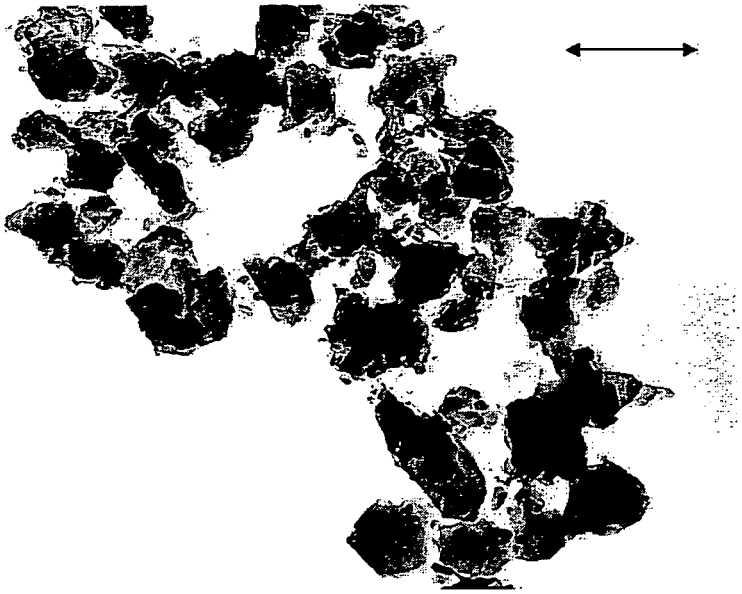
FIG. 7 shows a TEM image of a crystalline titanyl phthalocyanine where crystal transformation has been performed for a short time.

In FIG. 7, a TEM image of a titanyl phthalocyanine crystal in the case of carrying out crystal transformation for a short time is shown (in the figure, the scale bar indicates 0.2 μm).

Figure 6:
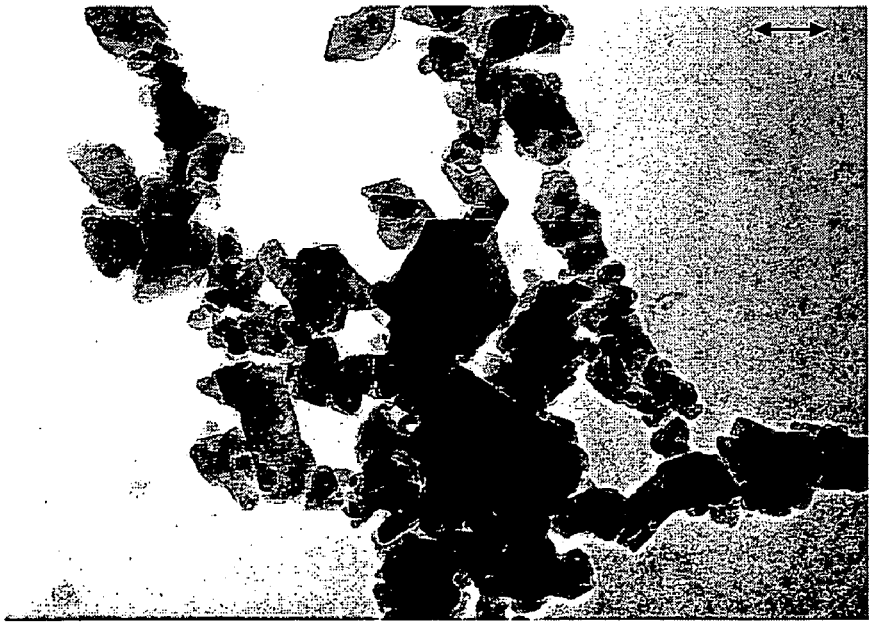
FIG. 6 shows a TEM image of a crystalline titanyl phthalocyanine.

Unlike in the case of FIG. 6, the particle size is small and almost uniform and no crude larger particle as observed in FIG. 6 is found at all. When thus produced titanyl phthalocyanine crystal is dispersed, since the primary particle of a titanyl phthalocyanine after synthesis is sufficiently small, a desired average particle size (equal to or less than 0.25 μm, preferably equal to or less than 0.2 μm) can be obtained without applying strong shear necessary for dispersing titanyl phthalocyanine containing a crude large particle shown in FIG. 6. As the result, a disadvantage such that a part of the particle is converted to a crystallographic type different from a desired crystallographic type by excessive dispersion can be suppressed.

The average particle size mentioned here is a volume-averaged particle diameter and is obtained by an ultra-centrifugal automatic particle size distribution measuring apparatus: CAPA-700 (produced by Horiba Seisakujo). Then, it is calculated as a particle diameter (Median system) corresponding to 50% of a cumulative distribution. However, since a slight amount of crude large particles may not be able to detected by this method, it is important to obtain the size by directly observing a titanyl phthalocyanine crystal powder or dispersion liquid thereof using an electron microscope in order to obtain it in greater detail.

As the result of investigating a fine defect by observing the dispersion liquid, the aforementioned phenomenon can be explained as follows. Normally, when several or more % of extremely large particles exists, the existence thereof can be detected in a method of measuring an average particle size, but the measurement is below the detection limit in the case of a small amount equal to or less approximately 1% of the whole. As the result, only the measurement of an average particle size could not detect the existence of a crude lager particle and an interpretation with respect to a fine defect as mentioned above was made be difficult.

Figure 8:
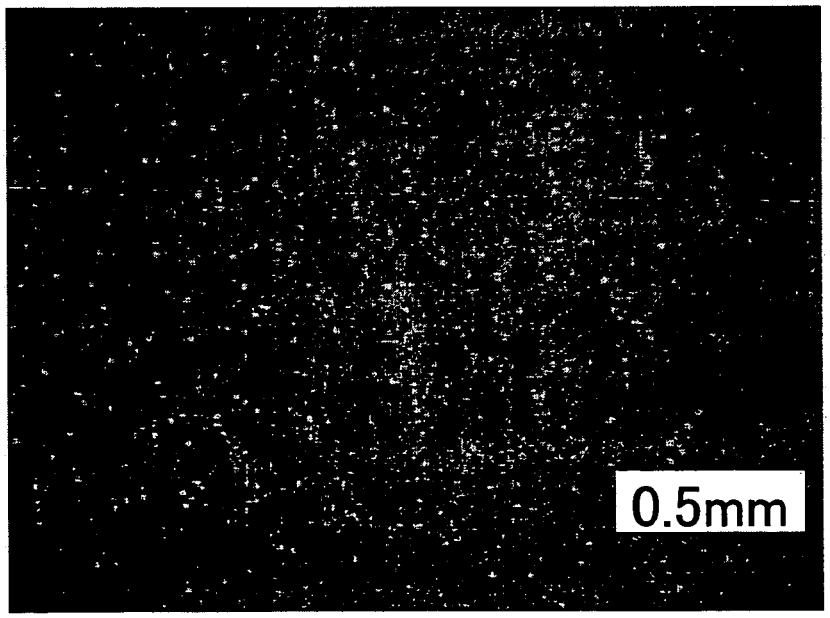
FIG. 8 shows a photograph of crystalline titanyl phthalocyanine dispersion liquid for which a dispersion time is short.
Figure 9:
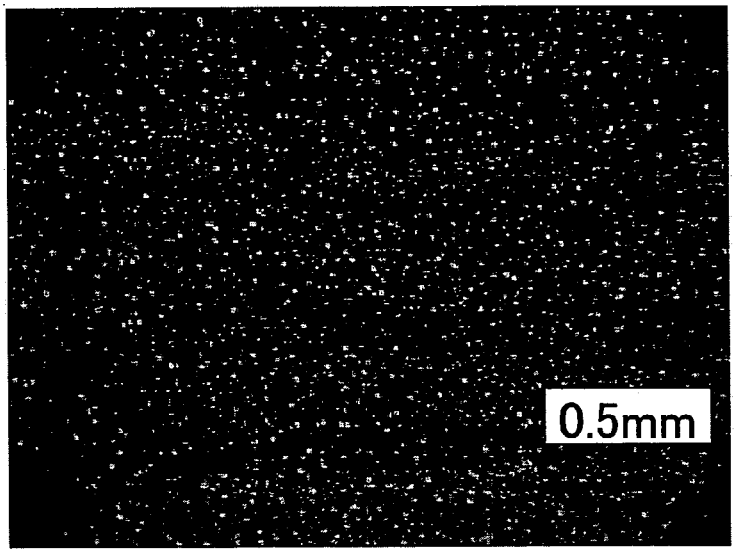
FIG. 9 shows a photograph of crystalline titanyl phthalocyanine dispersion liquid for which a dispersion time is long.

In FIG. 8 and FIG. 9, photographs in which two kinds of dispersion liquid are observed and only the dispersion time period is changed while the dispersion conditions are fixed, are shown. A photograph of dispersion liquid in which the dispersion time period is short on the same condition, and an appearance such that a number of crude large particles observed as black particles remain in FIG. 8, compared to FIG. 9 in which the dispersion time period is long, is observed.

Figure 10:
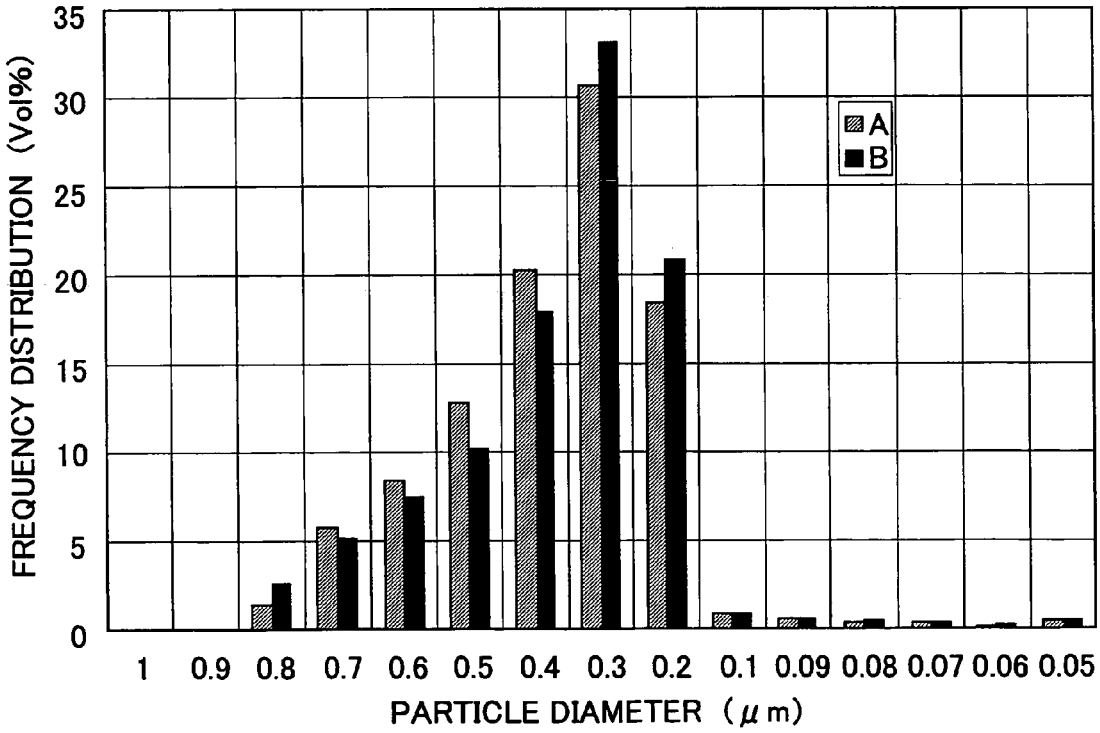
FIG. 10 is such that the results of FIG. 8 and FIG. 9 are graphed.

The average particle diameter and particle size distribution of these two kinds of dispersion liquid was measured by a commercially available particle size distribution measuring apparatus (an ultra-centrifugal automatic particle size distribution measuring apparatus, CAPA-700, produced by Horiba Seisakujo) according to a publicly known method. The result thereof is shown in FIG. 10. "A" in FIG. 10 corresponds to the dispersion liquid shown in FIG. 8 and "B" corresponds to the dispersion liquid shown in FIG. 9. As comparing both of them, a difference with respect to the particle size distributions thereof is hardly found. Also, both average particle diameter values are obtained to be 0.29 μm in regard to "A" and 0.28 μm in regard to "B", and it cannot be judged that there is an explicit difference between both of them, taking errors of measurement into consideration.

Therefore, the remainder of a small amount of crude large particles cannot be detected by only the publicly known standard for average diameter particle (average particle size) and it is difficult to make the relation with background contamination be clear. The existence of the small amount of crude large particle can be recognized by only observing coating liquid at the level of microscope, and, thereby, the relation with background contamination can be clear.

From thus result, a method is understood to be effective such that a proper crystal transformation solvent is selected as described above in order to suppress the aggregation and to make a primary particle produced at the time of crystal transformation to be as small as possible, and, a strong stirring for sufficiently contacting titanyl phthalocyanine water paste (a raw material produced as mentioned above) with a solvent is used in order to raise the efficiency of crystal transformation and to complete the crystal transformation for a short time.

A titanyl phthalocyanine crystal with a small average primary particle size (equal to or less than 0.25 μm, preferably equal to or less than 0.2 μm) can be obtained by employing such a crystal transformation method. In addition to a technique described in Japanese Laid-Open Patent Application No. 2001-19871, the use of a technique as described above (a crystal transformation method for obtaining a fine titanyl phthalocyanine crystal) in combination according to need is effective means for enhancing the effect of the present invention.

Subsequently, the crystal-transformed titanyl phthalocyanine crystal is immediately filtered and separated from the crystal transformation solvent. This filtration is performed using a filer with a proper size. Then, it is most preferred to use vacuum filtration.

Afterward, the separated titanyl phthalocyanine crystal is subjected to drying by heating according to need. As a dryer used for the drying by heating, any of publicly known one can be used, but in the case of performing under the atmosphere, an air-blowing type dryer is preferable. Further, drying under reduced pressure is also very effective means in order to facilitate drying speed and to significantly exert the effect of the present invention. Particularly, it is effective to a material which is decomposed at elevated temperature or of which the crystallographic type is changed. Particularly, it is effective to dry at the condition of a degree of vacuum higher than 10 mmHg.

Thus obtained titanyl phthalocyanine crystal having a particular crystallographic type is significantly useful as a charge generation material for electrophotographic photoconductor. However, it had disadvantages such that the crystallographic type is unstanle as mentioned above and the crystallographic type is easy to convert when dispersion liquid is produced. However, as the present invention, dispersion liquid in which the average particle diameter is small can be produced without the application of excessive shear at the time of producing the dispersion liquid, and the crystallographic type can be very stably produced, (without changing a synthesized crystallographic type) by synthesizing the primary particles to be as small as possible.

For the production of the dispersion liquid, a general method is used, and it is obtained by dispersing the aforementioned titanyl phthalocyanine crystal, if necessary, with a binder resin, in a proper solvent, using ball-mill, AttrIter, sand mill, beads mill, ultrasonic wave, etc. Then, the binder resin is selected based on the electrostatic characteristics of a photoconductor, etc., and, also, the solvent is selected based on the wettability thereof to a pigment, the dispersion property of a pigment, etc.

As mentioned above, it is known that a titanyl phthalocyanine crystal, at least, having a maximum diffraction peak at 27.2°, in regard to a diffraction peak (±0.2°) at a Bragg angle 2θ of CuKα line (wavelength of 1.542 Å) is easily crystal-converted to another crystallographic type by stress such as thermal energy and mechanical shear.

In regard to a titanyl phthalocyanine crystal used for the present invention, this tendency is also unchanged. That is, in order to produce the dispersion liquid containing fine particles, although the devise of dispersion method is necessary, the stability of crystallographic type and the miniaturization of particles tend to be in a trade-off relation. Although there are methods of avoiding it by optimizing dispersion conditions, any of them significantly narrow the production conditions and a more convenient method is desired. For solving this problem, the following method is also effective means.

That is, it is a method such that the particles made be as small as possible without occurring of crystal conversion are produced, and, subsequently, filtration is performed with a proper filter so as to remove a crude large particle. This method is very effective means in that a small amount of remaining crude large particle that cannot be observed by visual observation (or cannot be detected by a particle size measurement) can be also removed and the particle size distribution is narrowed. Specifically, dispersion liquid is completed by performing an operation of filtering the dispersion liquid produced as mentioned above with a filter with an effective pore size equal to or less than 3 μm, preferably equal to or less than 1 μm. Dispersion liquid that contains only a titanyl phthalocyanine crystal with a small particle size (equal to or less than 0.25 μm, preferably equal to or less than 0.2 μm) can be also produced by this method, and the degree of allowance against background contamination can be raised by installing a photoconductor produced by it in an electrophotographic apparatus, and it is effective to the attainment of high durability of a photoconductor.

Thus, by performing dispersion until the particle size of a crystal-type titanyl phthalocyanine is equal to or less than 0.3 μm and the standard deviation thereof is equal to or less than 0.2 μm, subsequently by performing filtration with a filter with an effective pore size equal to or less than 3 μm, and performing the coating of a photosensitive layer or a charge generation layer using dispersion liquid in which the average particle size of primary particles is equal to or less than 0.25 μm, due to this method, titanyl phthalocyanine aggregate can be excluded and a photoconductive layer or a charge generation layer that contains titanyl phthalocyanine in which the average particle size of primary particles is equal to or less than 0.25 μm can be formed, which are effective to the suppression of background contamination.

Also, when the titanyl phthalocyanine crystal particle is such that crystal transformation of an amorphous titanyl phthalocyanine or low crystalline titanyl phthalocyanine which has, at least, a maximum diffraction peak at 7.0° through 7.5°, a half value width of which diffraction peak is equal to or greater than 1°, in regard to a diffraction peak (±0.2°) at a Bragg angle 2θ of characteristic X rays (wavelength of 1.542 Å) of CuKα, and in which an average particle size of primary particles is equal to or less than 0.1 μm, is performed with an organic solvent under the presence of water, and titanyl phthalocyanine after the crystal transformation is separated with an organic solvent and filtered before an average particle size of primary particles after the crystal transformation grows to be greater than 0.25 μm, a crude large particle that is contained in a crystal growth process can be excluded and a photoconductive layer containing titanyl phthalocyanine in which the average particle size of primary particles is equal to or less than 0.25 μm can be formed, which are effective to the suppression of background contamination.

Then, if the particle size of filtered dispersion liquid is too large or the particle size distribution is too wide, a loss with the filtration may become large or excessive clogging may occur so that filtration is impossible. Therefore, it is desirable to perform dispersion until the average particle size reaches 0.3 μm or less and the standard deviation thereof reaches 0.2 μm or less in the dispersion liquid before the filtration. A disadvantage may occur such that the loss by filtration becomes large if the average particle size is greater than 0.3 μm and filtration time period becomes long if the standard deviation is greater than 0.2 μm.

Although the filter for filtering dispersion liquid is dependent on the size of a crude large particle to be eliminated, according to investigations of the inventors, the presence of a crude large particle, at least, equal to or greater than 3 μm influences an image in a photoconductor used in an image formation apparatus that requires a resolution of approximately 600 dpi. Therefore, a filter with an effective pore size equal to or less than 3 μm should be used, and it is more preferable to use a filter with an effective pore size equal to or less than 1 μm.

The finer the effective pore size is, it has more effect to the elimination of a crude large particle, but if it is too fine, since the problems occurs such that a necessary pigment particle itself is filtered, it takes much time to filtrate, the clogging of a filter occurs, and too much loading is applied in the case of liquid-feeding using a pump, etc., it is necessary to select a filter having a proper effective pore diameter. Additionally, as the material of a filter used here, of course, one having a resistance to a solvent used for the dispersion liquid to be filtered is used.

Also, a crude large particle can be removed and further background contamination occurring in a photoconductor for which dispersion liquid is used can be reduced by adding such a filtration operation of dispersion liquid. As mentioned above, the finer the used filter is, the effect is larger (more certain), but a disadvantage such that a pigment particle it self may be filtered may occur in some cases. In such a case, the disadvantage can be eliminated and the obtained effect is very high, by using the aforementioned synthesis technique of titanyl phthalocyanine for which a primary particle is miniaturized, in combination.

That is, i) the shortening of dispersion time period and the reduction of dispersion stress can be attained and the possibility of crystal conversion in dispersion becomes small by synthesizing miniaturized titanyl phthalocyanine and using it. ii) Since the size of a crude large particle remaining after dispersion is smaller than the case of no miniaturization, a smaller filter can be used and the effect of eliminating a crude large particle becomes moren certain. Also, the quantity of eliminated titanyl phthalocyanine particles is reduced and a change of the composition of dispersion liquid is small before and after the filtration so that stable production is allowed. iii) As the result, a produced photoconductor is stable and an electrophotographic photoconductor with a high resistance to background contamination can be produced.

As a binder resin used for a charge generation layer according to need, polyamides, polyurethanes, epoxy resins, polyketones, polycarbonates, silicone resins, acrylic resins, poly(vinyl butyral), poly(vinyl formal), polyvinylketones, polystyrene, porysulfones, poly(N-vinylcarbazole), polyacrylamides, poly(vinyl benzale), polyesters, phenoxy resins, vinyl chloride-vinyl acetate copolymer, poly(vinyl acetate), poly(phenyleneoxide), polyamides, poly(vinyl pyridine), cellulose-type resins, casein, poly(vinyl alcohol), poly(vinyl pyrrolidone), etc., are provided. Among these, poly(vinyl butyral) is most preferably used. The content of a binder resin used for a charge generation layer is appropriately 0 through 500 parts by weight, preferably 0 through 200 parts by weight, more preferably 10 through 300 parts by weight per 100 parts by weight of a charge generation material. Also, according to need, each kind of additives such as a leveling agent such as dimethylsilicone oil and methylphenylsilicone oil, a sensitizer, and a dispersing agent can be added.

As a solvent used for the formation of a charge generation layer, for example, isopropanol, acetone, ethyl methyl ketone, cyclohexanone, tetrahydrofuran, dioxane, ethylcellosolve, ethyl acetate, methyl acetate, dichloromethane, dichloroethane, monochlorobenzene, cyclohexane, toluene, xylene, ligroin, etc., can be provided. However, when a charge generation later is stacked on a not-crosslinked underlying layer, it is preferable to use a solvent other than alcohols since the surface of the underlying layer may be dissolved. Particularly, a ketone-type solvent, an ester-type solvent, and an ether-type solvent are used well. As a solvent that can be stably used among these, a ketone-type solvent such as ethyl methyl ketone and an acetone is preferable. These may be used singularly or two kinds or more thereof may be mixed and used.

Also, coating liquid for the formation of a charge generation layer is based on a charge generation material, a solvent, and a binder resin, but any of additives such as another charge generation material, a sensitizer, a dispersing agent, a surface active agent, and a silicone oil may be contained in the charge generation layer.

The charge generation layer is formed by dispersing a charge generation material such as the aforementioned titanyl phthalocyanine, if necessary, with a binder resin in a proper solvent using ball-mill, AttrIter, sand mill, ultrasonic wave, etc., coating it on an electrically conductive support, and drying it. The addition of the binder resin may be either before the dispersion or after the dispersion.

As a coating method of coating liquid for charge generation layer, a method such as dip coating method, spray coat, bead coat, nozzle coat, spinner coat, and ring coat, can be used. The film thickness of a charge generation layer is appropriately 0.01 through 5 μm, preferably 0.1 through 1.2 μm, and further preferably 0.05 through 2 μm.

A charge transportation layer is formed by dissolving or dispersing a charge transportation material and a binder resin in a proper solvent, coating it on a charge generation layer, and drying it. Also, if necessary, a plasticizer, a leveling agent, an antioxidant, etc., can be added.

As a charge transportation material, hole transportation materials and electron transportation materials are provided. As an electron transportation material, for example, electron accepting materials such as chloroanil, bromoanil, tetracyanoethylene, tetracyanoquinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and benzoquinone derivatives can be provided.

As a hole transportation material, poly(N-vinylcarbazole) and derivatives thereof, poly(γ-carbazolylethyl glutamate) and derivatives thereof, pyrene-formaldehyde condensate and derivatives thereof, poly(vinylpyrene), poly(vinylphenanthrene), polysilane, oxazole derivatives, oxadiazole derivatives, imidazole derivatives, monoarylamine derivatives, diarylamine derivatives, triarylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bis(stilbene) derivatives, enamine derivatives, etc., and other publicly-known materials can be provided. These charge transportation materials are used singularly or two or more kinds of them are mixed and used.

As a binder resin, thermoplastic and thermosetting resins, such as poly(styrene), styrene-acrylonitrile copolymer, styrene-butadiene copolymer, styrene-maleic anhydride copolymer, polyesters, poly(vinyl chloride), vinyl chloride-vinyl acetate copolymer, poly(vinyl acetate), poly(vinylidene chloride), polyallylate resin, phenoxy resins, polycarbonates, cellulose acetate resin, ethylcellulose resin, poly(vinyl butyral), poly(vinyl formal), poly(vinyltoluene), poly(N-vinylcarbazole), acrylic resins, silicone resins, epoxy resins, melamine resin, urethane resins, phenol resins, and alkyd resins As the binder resin used in combination with the charge transportation material, a thermoplastic resin and a thermosetting resin, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly(vinylidene chloride), polyallylate resin, phenoxy resin, polycarbonate, cellulose acetate resin, ethylcellulose resin, poly(vinyl butyral), poly(vinyl formal), poly(vinyltoluene), poly(N-vinylcarbazole), acrylic resins, silicone resin, epoxy resins, melamine resin, urethane resins, phenol resins, and alkyd resins can be provided.

Also, a polymeric charge transportation material having both a function as a charge transportation material and a function as a binder resin for a charge transportation layer is also used well. A charge transportation layer composed of the polymeric charge transportation material is excellent in a wear resistance. As a polymeric charge transportation material, a publicly-known material can be used, and particularly, polycarbonates that contains a triarylamine structure in a main chain and/or side chain thereof are used well.

Among these, polymeric charge transportation material represented by formulas (I) through (X) are used well, and they are illustrated below and specific examples are shown.

Formula (I)

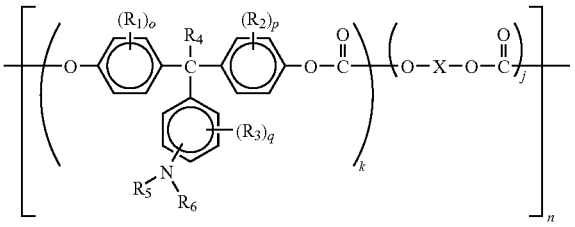

In formula (I), each of $R_1$, $R_2$, and $R_3$ independently represents a substituted or non-substituted alkyl group or a halogen atom, $R_4$ represents a hydrogen atom or a substituted or non-substituted alkyl group, $R_5$, and $R_6$ represent substituted or non-substituted aryl groups, each of o, p, and q independently represents an integer of 0 through 4, k and j represent a composition, wherein $0.1 \leqq k \leqq 1$ and $0 \leqq j \leqq 0.9$, and n represents the number of repeating units and is an integer of 5 through 5000. X represents an aliphatic divalent group, a cycloaliphatic divalent group, or a divalent group represented by the following general formula. Additionally, formula (I) is described in the form of an alternating copolymer in regard to two copolymerized species but may be a random copolymer.

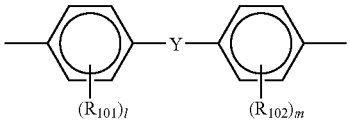

Each of $R_{101}$ and $R_{102}$ independently represents a substituted or non-substituted alkyl group, aryl group, or a halogen atom. l and m represent integers of 0 through 4, and Y represents a single bond, a linear, branched, or cyclic alkylene group in which the number of carbon atoms is 1 through 12, —O—, —S—, —SO—, —$SO_2$—, —CO—, —CO—O-Z-O—CO— (Z represents an aliphatic divalent group in the formula.), or

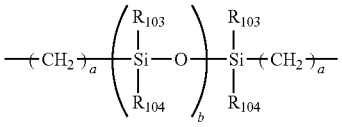

(a represents an integer of 1 through 20, b represents an integer of 1 through 2000, $R_{103}$ and $R_{104}$ represent substituted or non-substituted alkyl group or aryl group. ). Herein, $R_{101}$ and $R_{102}$ or $R_{103}$ and $R_{104}$ may be identical or different.

Formula (II)

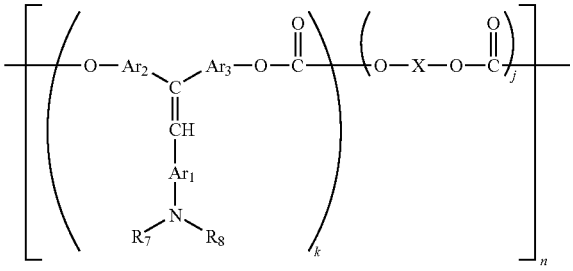

In formula (II), $R_7$ and $R_8$ represent substituted or non-substituted aryl groups, and $Ar_1$, $Ar_2$, and $Ar_3$ represent identical or different arylene groups. X, k, j, and n are the same as the case of formula (I). Additionally, formula (II) is described in the form of an alternating copolymer in regard to two copolymerized species but may be a random copolymer.

Formula (III)

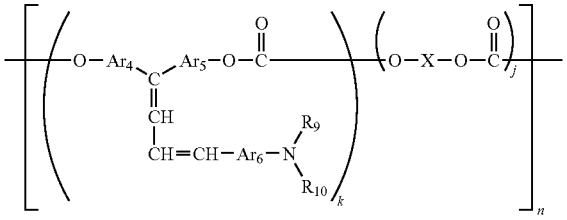

In formula (III), $R_9$ and $R_{10}$ represent substituted or non-substituted aryl groups, and $Ar_4$, $Ar_5$, and $Ar_6$ represent identical or different arylene groups. X, k, j, and n are the same as the case of formula (I). Additionally, formula (III) is described in the form of an alternating copolymer in regard to two copolymerized species but may be a random copolymer.

Formula (IV)

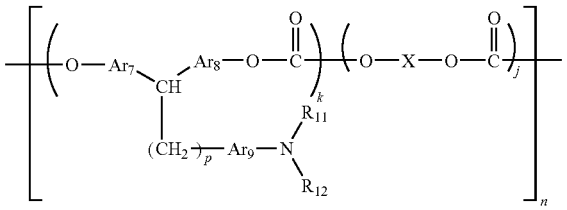

In formula (IV), $R_{11}$ and $R_{12}$ represent substituted or non-substituted aryl groups, $Ar_7$, $Ar_8$, and $Ar_9$ represent identical or different arylene groups, and p represents an integer of 1 through 5. X, k, j, and n are the same as the case of formula (I). Additionally, formula (IV) is described in the form of an alternating copolymer in regard to two copolymerized species but may be a random copolymer.

Formula (V)

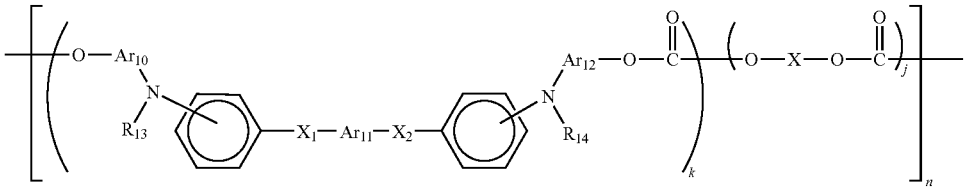

In formula (V), $R_{13}$ and $R_{14}$ represent substituted or non-substituted aryl groups, $Ar_{10}$, $Ar_{11}$, and $Ar_{12}$ represent identical or different arylene groups, and $X_1$ and $X_2$ represent substituted or non-substituted ethylene groups or substituted or non-substituted vinylene groups. X, k, j, and n are the same as the case of formula (I). Additionally, formula (V) is described in the form of an alternating copolymer in regard to two copolymerized species but may be a random copolymer.

Formula (VI)

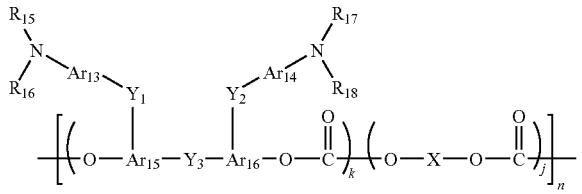

In formula (VI), $R_{15}$, $R_{16}$, $R_{17}$, and $R_{18}$ represent substituted or non-substituted aryl groups, $Ar_{13}$, $Ar_{14}$, $Ar_{15}$, and $Ar_{16}$ represent identical or different arylene groups, and $Y_1$, $Y_2$, and $Y_3$ represent single bonds, substituted or non-substituted alkylene groups, substituted or non-substituted cycloalkylene groups, substituted or non-substituted alkyleneether groups, oxygen atoms, sulfur atoms, or vinylene groups and may be identical or different. X, k, j, and n are the same as the case of formula (I). Additionally, formula (VI) is described in the form of an alternating copolymer in regard to two copolymerized species but may be a random copolymer.

Formula (VII)

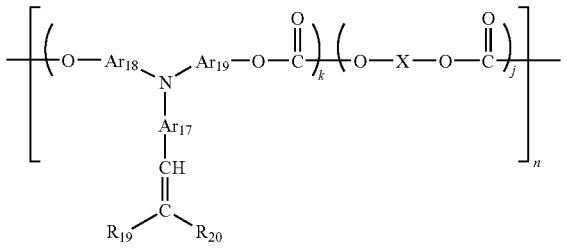

In formula (VII), $R_{19}$ and $R_{20}$ represent hydrogen atoms or substituted or non-substituted aryl groups and $R_{19}$ and $R_{20}$ may form a ring. $Ar_{17}$, $Ar_{18}$, and $Ar_{19}$ represent identical or different arylene groups. X, k, j, and n are the same as the case of formula (I). Additionally, formula (VII) is described in the form of an alternating copolymer in regard to two copolymerized species but may be a random copolymer.

Formula (VIII)

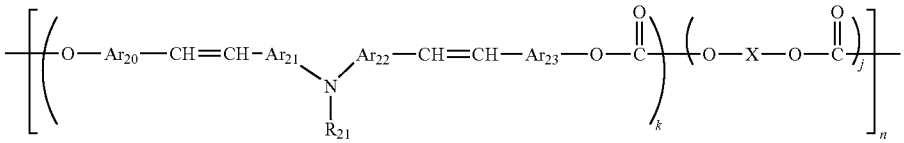

In formula (VIII), $R_{21}$ represents a substituted or non-substituted aryl group and $Ar_{20}$, $Ar_{21}$, $Ar_{22}$, and $Ar_{23}$ represent identical or different arylene groups. X, k, j, and n are the same as the case of formula (I). Additionally, formula (VIII) is described in the form of an alternating copolymer in regard to two copolymerized species but may be a random copolymer.

Formula (IX)

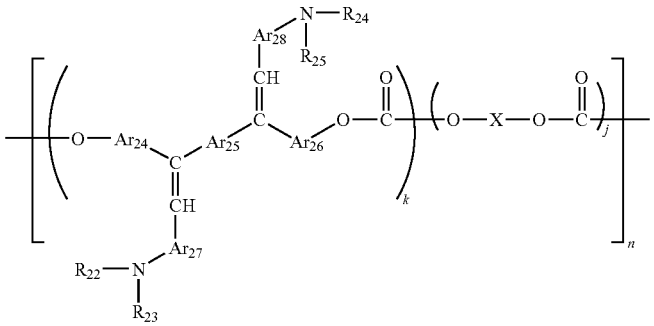

In formula (IX), $R_{22}$, $R_{23}$, $R_{24}$, and $R_{25}$ represent substituted or non-substituted aryl groups, and $Ar_{24}$, $Ar_{25}$, $Ar_{26}$, $Ar_{27}$, and $Ar_{28}$ represent identical or different arylene groups. X, k, j, and n are the same as the case of formula (I). Additionally, formula (IX) is described in the form of an alternating copolymer in regard to two copolymerized species but may be a random copolymer.

Formula (X)

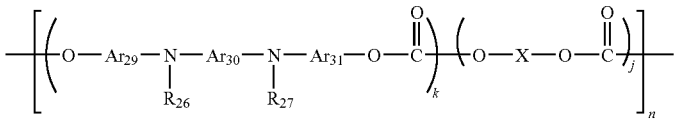

In formula (X), $R_{26}$ and $R_{27}$ represent substituted or non-substituted aryl groups, and $Ar_{29}$, $Ar_{30}$, and $Ar_{31}$ represent identical or different arylene groups. X, k, j, and n are the same as the case of formula (I). Additionally, formula (X) is described in the form of an alternating copolymer in regard to two copolymerized species but may be a random copolymer.

The quantity of a charge transportation material is appropriately 20 through 300 parts by weight, preferably 40 through 150 parts by weight, per 100 parts by weight of a binder resin. Also, the film thickness of a charge transportation layer is preferably 5 through 100 μm, more preferably approximately 10 through 40 μm.

As a solvent used here, tetrahydrofuran, dioxane, toluene, dichloromethane, monochlorobenzene, cyclohexanone, ethyl methyl ketone, acetone, etc., are used. Among these, the use of a non-halogen-type solvent is desirable from the intention of the reduction of load to the environment, etc., and specifically, cyclic ethers such as tetrahydrofuran, dioxolane, and dioxane, aromatic hydrocarbons such as toluene and xylene, and derivatives thereof are used well, also from the aspect of the suppression effect of background contamination.

In the present invention, a plasticizer or a leveling agent may be added into the charge transportation layer. As the palsticizer, a plasticizer used for a general resin, such as dibutyl phthalate and dioctyl phthalate, can be directly used and the usage thereof is appropriately 0 through 30% by weight of a binder resin. As the leveling agent, silicone oils such as dimethylsilicone oil and methylphenylsilicone oil and a polymer oligomer having a perfluoroalkyl group in a side chain thereof are used and the usage thereof is appropriately 0 through 1% by weight of a binder resin.

Although the case of a photoconductive layer with a stacked-layer structure is thus far described, a photoconductive layer in the present invention may be a single layer structure. In order to make a photoconductive layer be a single layer structure, the photoconductive layer is configured by providing a single layer that contains, at least, the aforementioned charge generation material and a binder resin and, as the binder resin, a material provided for the explanation of the charge generation layer or the charge transportation layer can be used well.

Also, high photosensitivity, high charge transporting property, and low residual electric potential are realized by using a charge transportation material in combination for a single-layered photoconductive layer, and it can be used well. Then, either a hole transportation material or an electron transportation material is selected for the used charge transportation material dependent on the polarity of charging of a photoconductor surface. Further, the aforementioned polymeric charge transportation material has the functions of both a binder resin and a charge transportation material and, therefore, is well used for a single-layered photoconductive layer.

In an electrophotographic photoconductor according to the present invention, a crosslinked-type charge transportation layer that is primary intended to enhance the wear resistance of the photoconductor is stacked on the top surface of the photoconductor. Thereby, the increase of electric field strength in repeated use can be suppressed, which is effective to the suppression of background contamination. Also, it has effect of reducing the generation of an image defect and is effective and useful for realizing the high durability, since the elevation of a residual electric potential is little, the damage resistance of the photoconductor surface is high, and filming, etc., is not easy to occur.

The crosslinked-type charge transportation layer is formed for the purpose of balancing the stability over time and the durability by reducing the influence of wear occurred in repeated use of the photoconductor, enhancing the stability over time against background contamination, and further enhancing the electrostatic stability or the stability of image quality.

Damage formed on a photoconductor surface and foreign substances (toner, an external additive for toner, carrier, paper powder, etc.) adhering to the surface deteriorates the cleaning property of a photoconductor and significantly deteriorates the stability of image quality. Therefore, in order to realize the high durability of a photoconductor, it is important not only to raise the wear resistance but also to minimize damage of a photoconductor surface and the influence of filming and, to this end, it is preferable to form a smooth surface layer with high hardness and high elasticity.

A crosslinked-type charge transportation layer formed on the surface according to the present invention has a crosslinking structure for which a three-or-more-functional radical-polymerizable monomer is cured so that a three-dimensional network structure develops, a surface layer with high hardness and high elasticity, of which the crosslink density is very high, is obtained, and uniformity, high smoothness, high wear resistance, and damage resistance are attained. Thus, although it is important to increase the crosslink density of a photoconductor surface, that is, the number of crosslinkage per unit volume, internal stress caused by a volumetric shrinkage generates since a large number of bonds are instantaneously formed in a curing reaction. Since the larger the film thickness of the crosslinked-type charge transportation layer is, the internal stress increases more, a crack or film peeling is easy to occur when the whole of the charge transportation layer is cured. Even though the phenomenon does not initially occur, it may be easy to occur over time by being repeatedly used in an electrophotographic process and being subjected to the influences of a hazard or heat variation in charging, development, transcription, or cleaning.

As a method for solving this problem, approaches of softening a cured resin layer such as (1) introducing a polymeric component into a crosslinked layer and a crosslinking structure, (2) using a great amount of one-functional and two-functional radical-polymerizable monomer, and (3) using a multi-functional monomer having a flexible group are provided, but any of them make the crosslink density of a crosslinked layer be low and a drastic wear resistance does not be attained.

On the other hand, in a photoconductor according to the present invention, the aforementioned crack and film peeling do not occur and very high wear resistance is attained by providing on a charge transportation layer a crosslinked-type charge transportation layer with a film thickness equal to or greater than 1 μm and equal to or less than 10 μm and with a high crosslink density in which a three-dimensional network structure has been developed. The allowability against the aforementioned problem is further improved and, in addition, the selection of a material for cross link density increase which leads to further improvement of wear resistance, by making the film thickness of such a crosslinked-type charge transportation layer be a film thickness of equal to or greater than 2 μm and equal to or less than 8 μm.

The reason why a crack and film peeling can be suppressed by a photoconductor according to the present inventions is that the internal stress does not increase since the film of a crosslinked-type charge transportation layer can be thinned, the internal stress of a srosslinked charge transportation layer on the surface can be relaxed by having a charge transportation layer as an underlying layer, etc.

Therefore, it is not necessary to contain a great amount of a polymeric material in a crosslinked-type charge transportation layer and damage or toner filming are not easy to occur which is caused by no compatibility with a cured substance produced at this time and produced by a reaction of the polymeric material and a radical-polymerizable composition (a radical-polymerizable monomer and a radical-polymerizable compound having a charge transporting structure).

Furthermore, when a charge transportation layer is cured by light energy irradiation by the film thickness of the whole of the layer, the internal light transmittance is limited by the absorption of the charge transporting structure so that a phenomenon such that curing reaction does not sufficiently proceed may occurs. When a crosslinked-type charge transportation layer according to the present invention is a thin film equal to or less than 10 μm, particularly, the curing reaction internally and uniformly proceeds and high wear resistance is also maintained internally as well as the surface. Also, in regard to the formation of a crosslinked-type charge transportation layer according to the present invention, a one-functional radical-polymerizable compound having a charge transporting structure as well as the aforementioned three functional radical-polymerizable monomer is further contained and it is incorporated in a crosslinkage when the aforementioned three-or-more-functional radical-polymerizable monomer is cured.

On the other hand, when a low-molecular-weight charge transportation material having no functional group is contained in a crosslinked surface layer, the precipitation of a low-molecular-weight charge transportation material or white turbidity phenomenon occurs due to the low compatibility thereof and the mechanical strength of a crosslinked surface layer lowers. On the other hand, when a two or more functional charge transportation compound is used as a main component, it is fixed in a crosslinking structure by plural bonds so that the crosslink density becomes higher, but the distortion of a cured resin structure becomes very high, which causes the internal stress of the crosslinked-type charge transportation layer to increase, since the charge transporting structure is very bulky.

Moreover, a photoconductor according to the present invention has a good electrical characteristic, whereby the repeat stability is excellent and high durability and high stability are attained. This originates from using a one-functional radical-polymerizable compound having a charge transporting structure as a component material of the crosslinked-type charge transportation layer so as to be fixed like a pendant between crosslinkages. As mentioned above, a charge transportation material having a functional group causes precipitation or white turbidity phenomenon, and the deterioration of electrical characteristics in repeated use such as the lowering of sensitivity and the elevation of a residual electric potential is significant. When a two or more functional charge transportation compound is used as a main component, since it is fixed in a crosslinking structure by plural bonds, an intermediate structure (a cationic radical) at the time of charge transportation cannot be stably held and the lowering of sensitivity and the elevation of a residual electric potential caused by charge trap are easy to occur. The deterioration of these electrical characteristics presents as the lowering of image concentration, thin character image, etc. Further, the design of a conventional photoconductor with a few charge traps and high mobility as an underlying charge transportation layer is applicable in a photoconductor according to the present invention, so that the electric side effect of a crosslinked-type charge transportation layer can be suppressed to the minimum.

Furthermore, in the formation of the aforementioned crosslinked-type charge transportation layer according to the present invention, since the crosslinked-type charge transportation layer is insoluble to an organic solvent, the high wear resistance is exerted sufficiently, the damage resistance is high, and an image defect such as filming and film peeling can be reduced so that a highly durable and highly stable electrophotographic photoconductor can be provide.

A crosslinked-type charge transportation layer according to the present invention is formed by curing a three-or-more-functional radical-polymerizable monomer having no charge transporting structure and a one-functional radical-polymerizable compound having a charge transporting structure, and a three-dimensional network structure develops in the whole of the layer and it has a high crosslink density, but the crosslink density may become locally low or n aggregate of fine cured substances which is crosslinked to be highly dense may be formed, dependent on a content (for example, an additive such as a one-or-two-functional monomer, a polymeric binder, an antioxidant, a leveling agent, and a plasticizer, and a component dissolving and mixing from an underlying layer) except the aforementioned component and curing conditions.

Such a crosslinked-type charge transportation layer, inn which the bonding strength between the cured substances is weak, shows solubility to an organic solvent, and becomes easy to cause a local wearing or an escape at the unit of a fine cured substance in repeated use in an electrophotographic process. An intrinsic three-dimensional network structure develops and a high degree of crosslinking is possessed by making a crosslinked-type charge transportation layer be insoluble to an organic solvent as the present invention and, in addition, since a chain reaction proceeds in a wide range and a cured substance becomes high-molecular-weight, the drastic improvement of wear resistance is attained.

Next, the component materials of coating liquid for crosslinked-type charge transportation layer in the present invention are described.

A three-or-more-functional radical-polymerizable monomer having no charge transporting structure used for the present invention refers to a monomer having neither a hole transportation structure such as triarylamines, hydrazones, pyrazoline, and carbazole nor an electron transportation structure such as a condensed polycyclic quinones, diphenoquinone, and electron-withdrawing aromatic rings with a cyano group or a nitro group, and having three-or-more-functional radical-polymerizable functional groups. The radical-polymerizable functional group is any of ones having a carbon-carbon double bond and being a radical-polymerizable group. As the radical-porymerizable functional group, for example, 1-substituted ethylene functional groups and 1,1-substituted ethylene functional groups described below are provided.

(1) 1-substituted Ethylene Functional Group

As the 1-substituted ethylene functional group, for example, a functional group represented by the following formula:

$$CH_2{=}CH{-}X_1{-} \qquad \text{formula 10}$$

can be provided. (Herein, In the formula, $X_1$ represents an arylene group such as phenylene group and naphthylene group which may have a substituent, an alkenylene group which may have a substituent, —CO— group, —COO— group, —CON($R_{10}$)— group, ($R_{10}$ represents hydrogen, an alkyl group such as methyl group and ethyl group, an aralkyl group such as benzyl group, naphthylmethyl group, and phenethyl group, and an aryl group such as phenyl group and naphthyl group.) or —S— group.

As these substituents are specifically exemplified, vinyl group, styryl group, 2-methyl-1,3-butadienyl group, vinylcarbonyl group, acryloyloxy group, acryloylamide group, vinylthioether group, etc., can be provided.

(2) 1,1-substituted Ethylene Functional Group

As the 1,1-substituted ethylene functional group, for example, a functional group represented by the following formula:

$$CH_2{=}C(Y){-}X_2{-} \qquad \text{formula 11}$$

can be provided.

(Herein, in formula 11, Y represents an alkyl group which may have a substituent, an aralkyl group which may have a substituent, an aryl group such as phenyl group and naphthyl group which may have a substituent, a halogen atom, cyano group, nitro group, an alkoxy group such as methoxy group and ethoxy group, —$COOR_{11}$ group ($R_{11}$ represents a hydrogen atom, an alkyl group such as methyl group and ethyl group which may have a substituent, an aralkyl group such as benzyl group and phenethyl group which may have a substituent, an aryl group such as phenyl group and naphthyl group which may have a substituent, or —$CONR_{12}R_{13}$ ($R_{12}$ and $R_{13}$ are an hydrogen atom, an alkyl group such as methyl group and ethyl group which may have a substituent, an aralkyl group such as benzyl group, naphthylmethyl group, and phenethyl group which may have a substituent, or an aryl group such as phenyl group and naphthyl group which may have a substituent, and may be identical or different.)), and, also, $X_2$ represents the same substitutent as $X_1$ in abovementioned formula 10, a single bond, or an alkylene group. Herein, at least one of Y and $X_2$ is oxycarbonyl group, cyano group, an alkenylene group or an aromatic ring.)

As these substituents are specifically exemplified, α-acryloyloxy chloride group, methacryloyloxy group, α-cyanoethylene group, α-cyanoacryloyloxy group, α-cyanophenylene group, methacryloylamino group, etc., can be provided.

Herein, as a substituent for further substituting these substituents $X_1$, $X_2$, and Y, for example, a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group, an aralkyl group such as benzyl group and phenethyl group, etc., can be provided.

Among these radical-polymerizable functional groups, acryloyloxy group and methacryloyloxy group are particularly useful. When the functional group(s) of a three-or-more-functional radical-polymerizable monomer having no charge transporting structure used for the crosslinked-type charge transportation layer is/are an acryloyloxy group and/or a methcryloyloxy group, high hardness can be obtained so as to contribute to the improvement of the wear resistance and the influence of a residual electric potential is small so as to have a high effect to image stabilization. A compound having three or more acryloyloxy groups can be obtained, for example, by carrying out esterification reaction or transesterification reaction using a compound having three or more hydroxyl groups in the molecule thereof and an acrylic acid (an acrylate salt), an acryloyl halide, or an acrylate ester. Also, a compound having three or more methacryloyloxy groups can be similarly obtained. Also, the radical-porymerizable functional groups of a monomer having three-or-more-functional radical-porymerizable functional groups may be identical or different.

As a specific three-or-more-functional radical-porymerizable monomer having no charge transporting structure, the following ones are exemplified but it is not limited to these compounds.

That is, as the aforementioned radical-porymerizable monomer used in the present invention, for example, trimethylolpropane triacrylate (TMPTA), trimethylolpropane trimethacrylate, trimethylolpropane alkylene-modified triacrylate, trimethylolpropane ethyleneoxy-modified (EO-modified, below) triacrylate, trimethylolpropane propyleneoxy-modified (PO-modified, below) triacrylate, trimethylolpropane caprolactone-modified triacrylate, trimethylolpropane alkylene-modified trimethacrylate, penta-erythritol triacrylate, penta-erythritol tetraacrylate (PETTA), glycerol triacrylate, glycerol epichlorohydrin-modified (ECH-modified, below) triacrylate, glycerol EO-modified triacrylate, glycerol PO-modified triacrylate, tris(acryloxyethyl)isocyanurate, di-penta-erythritol hexaacrylate (DPHA), di-penta-erythritol caprolactone-modified hexaacrylate, di-penta-erythritol hydroxypentaacrylate, alkylated di-penta-erythritol pentaacrylate, alkylated di-penta-erythritol tetraacrylate, alkylated di-penta-erythritol triacrylate, dimethylolpropane tetraacrylate (DTMPTA), penta-erythritol ethoxytetraacrylate, phosphoric acid EO-modified triacrylate, and 2,2,5,5-tetrahydroxymethylcyclopentanone tetraacrylate, etc., can be provided and these may be used singularly or two or more kinds thereof may be used in combination.

Also, as a three-or-more-functional radical-porymerizable monomer having no charge transporting structure used for the present invention, it is desired that the ratio of the molecular weight to the number of a functional group(s) (molecular weight/number of functional group(s)) in the monomer is equal to or less than 250, in order to form a dense crosslinkage in the crosslinked-type charge transportation layer. Thereby, high hardness can be obtained to contribute to the improvement of the wear resistance and the damage resistance and is very effective for the attainment of high durability. Also, if this ratio is greater than 250, the crosslinked-type charge transportation layer is soft and the wear resistance slightly deteriorates, and, therefore, in regard to the monomer having an EO-, PO-, caprolactone-modified group or the like among the monomers exemplified above, etc., it is not preferable to use one having an extremely long modified group singularly.

Also, the component ratio of the three-or-more-functional radical-porymerizable monomer having no charge transporting structure used for the crosslinked-type charge transporta tion layer is 20 through 80% by weight, preferably 30 through 70% by weight, of the total amount of the crosslinked-type charge transportation layer. When the monomer component is less than 20% by weight, the density of a three dimensional crosslinkage in the crosslinked-type charge transportation layer is low and the drastic improvement of the wear resistance tends not be attained compared to the case of using a conventional thermoplastic binder resin. Also, when it is greater than 80% by weight, the content of the charge transportation compound is lowered and the degradation of the electrostatic characteristics occurs. A range of 30 through 70% by weight is most preferable, taking the balance of both characteristics into consideration, although it may not be necessarily appropriate, since required electrostatic characteristics and wear resistance are different depend on a used process and, accordingly, the film thickness of the crosslinked-type charge transportation layer of the photoconductor is different. That is, when the component ratio of the three-or-more-functional radical-porymerizable monomer having no charge transporting structure used for the crosslinked-type charge transportation layer is 30 through 70% by weight of the total amount of the crosslinked-type charge transportation layer, it is possible to balance the wear resistance of a photoconductor and the residual electric potential or sensitivity thereof, which is very effective in the use in a high-speed machine.

The one-functional radical-polymerizable compound having a charge transporting structure used for the crosslinked-type charge transportation layer in the present invention refers to a compound having a hole transportation structure such as triarylamines, hydrazones, pyrazoline, and carbazole or an electron transportation structure such as condensed polycyclic quinones, diphenoquinone, and electron-withdrawing aromatic rings having a cyano group or a nitro group, and having one radical-polymerizable functional group. As this radical-polymerizable functional group, ones described in regard to the aforementioned radical-polymerizable monomer can be provided and an acryloyloxy group and a methacryloyloxy group are particularly useful. When the functional group of the one-functional radical-polymerizable compound having a charge transporting structure used for the crosslinked-type charge transportation layer is an acryloyloxy group or a methacryloyloxy group, the wear resistance and the electron transportation property can be balanced, which is very effective to the attainment of high durability and electrostatic stabilization.

Also, when the charge transporting structure of the one-functional radical-polymerizable compound having a charge transporting structure used for the crosslinked-type charge transportation layer is a triarylamine structure, the mobility of charge is improved and a further effect to the attainment of high sensitivity and the lowering of a residual electric potential of a photoconductor can be obtained.

When the one-functional radical-polymerizable compound having a charge transporting structure used for the crosslinked-type charge transportation layer is at least one kind of compound represented by the structure of the following general formula (1) or (2), the electrical characteristics such as sensitivity and a residual electric potential are maintained well. That is, a further effect to the attainment of high sensitivity of a photoconductor and the lowering of a residual electric potential thereof can be obtained and the highly stable output of a high quality image is realized.

General formula (1)

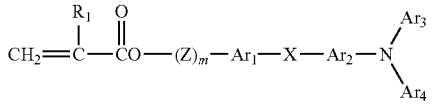

General formula (2)

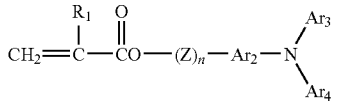

(In the formulas, $R_1$ represents a hydrogen atom, a halogen atom, an alkyl group which may have a substituent, an aralkyl group which may have a substituent, an aryl group which may have a substituent, cyano group, nitro group, an alkoxy group, —$COOR_7$ ($R_7$ represents a hydrogen atom, an alkyl group which may have a substituent, an aralkyl group which may have a substituent, or an aryl group which may have a substituent), a carbonyl halide group, or —$CONR_8R_9$ ($R_8$ and $R_9$ represent a hydrogen atom, a halogen atom, an alkyl group which may have a substituent, an aralkyl group which may have a substituent, or an aryl group which may have a substituent, and may be identical or different), $Ar_1$ and $Ar_2$ represent a substituted or non-substituted arylene group and may be identical or different. $Ar_3$ and $Ar_4$ represent a substituted or non-substituted aryl group and may be identical or different. X represents a single bond, a substituted or non-substituted alkylene group, a substituted or non-substituted cycloalkylene group, a substituted or non-substituted alkylene ether group, an oxygen atom, a sulfur atom, or a vinylene group. Z represents a substituted or non-substituted alkylene group, a substituted or non-substituted alkylene ether divalent group, or alkyleneoxycarbonyl divalent group. m and n represent an integer of 0 through 3.)

Specific examples of ones represented by the aforementioned general formulas (1) and (2) are shown below.

In aforementioned general formulas (1) and (2), in regard to substituents for $R_1$, for example, methyl group, ethyl group, propyl group, butyl group, etc., as the alkyl group, phenyl group and naphthyl group, etc., as the aryl group, and, benzyl group, phenethyl group, naphthylmethyl group, etc., as the aralkyl group, methoxy group, ethoxy group, propoxy group, etc., as the alkoxy group can be provided, and these may be substituted with a halogen atom, nitro group, cyano group, an alkyl group such as methyl group and ethyl group, an alkoxy group such as methoxy group and ethoxy group, an aryloxy group such as phenoxy group, an aryl group such as phenyl group and naphthyl group, an aralkyl group such as benzyl group and phenethyl group, etc.

Among substituents of $R_1$, a hydrogen atom and a methyl group are particularly preferable.

$Ar_3$ and $Ar_4$ are substituted or non-substituted aryl groups and, as the aryl group, a condensed polycyclic hydrocarbon group, a not-condensed cyclic hydrocarbon group, and a heterocyclic group can be provided.

As the condensed polycyclic hydrocarbon group, preferably, ones in which the number of carbons that form a ring thereof is equal to or less than 18, for example, pentanyl group, indenyl group, naphthyl group, azulenyl group, heptalenyl group, biphenylenyl group, as-indacenyl group, s-indacenyl group, fluorenyl group, acenaphthylenyl group, pleiadenyl group, acenaphthenyl group, phenalenyl group, phenanthryl group, anthryl group, fluoranthenyl group, acephenanthrylenyl group, aceanthrylenyl group, triphenylenyl group, pyrenyl group, chrysenyl group, and naphthacenyl group, etc., can be provided.

As the not-condensed cyclic hydrocarbon group, monovalent groups of a monocyclic hydrocarbon compound such as benzene, diphenyl ether, poly(ethylene-diphenyl ether), diphenyl thioether, and diphenylsulfone, monovalent groups of a not-condensed polycyclic hydrocarbon compound such as biphenyl, polyphenyl, a diphenylalkane, a diphenylalkene, a diphenylalkyne, triphenylmethane, distyrylbenzene, a 1,1-diphenylcycloalkane, a polyphenylalkane, and a polyphenylalkene, and monovalent groups of a ring assembly hydrocarbon compound such as 9,9-diphenylfluorene can be provided.

As the heterocyclic group, monovalent groups of carbazole, dibenzofuran, dibenzothiophene, oxadiazole, thiadiazole, etc., can be provided.

Also, the aryl group represented by $Ar_3$ or $Ar_4$ may have a substituent, for example, as shown below.

(1) A halogen atom, cyano group, nitro group, etc.

(2) An alkyl group

It is preferably $C_1$-$C_{12}$, inter alia $C_1$-$C_8$, more preferably $C_1$-$C_4$ straight or branched alkyl group, and, further, these alkyl groups may have a fluorine atom, hydroxyl group, cyano group, a $C_1$-$C_4$ alkoxy group, phenyl group, or a phenyl group substituted with a halogen atom, a $C_1$-$C_4$ alkyl group, or a $C_1$-$C_4$ alkoxy group. Specifically, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group, etc., can be provided.

(3) An alkoxy groups (—$OR_2$), wherein $R_2$ represents an alkyl group defined in (2).

Specifically, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group, etc., can be provided.

(4) An aryloxy group, wherein, as the aryl group, phenyl group and naphthyl group can be provided. It may contain a $C_1$-$C_4$ alkoxy group, a $C_1$-$C_4$ alkyl group, or a halogen atom as a substituent. Specifically, phenoxy group, 1-naphthyloxy group, 2-naphthyloxy group, 4-methoxyphenoxy group, 4-methylphenoxy group, etc., can be provided.

(5) An alkylmercapto group or an arylmercapto group

Specifically, methylthio group, ethylthio group, phenylthio group, p-methylphenylthio group, etc., can be provided.

(6) Groups represented by the following general formula:

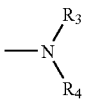

(In the formula, each of $R_3$ and $R_4$ is independently a hydrogen atom, an alkyl group defined in aforementioned (2), or an aryl group. As the aryl group, for example, phenyl group, biphenyl group, and naphthyl group can be provided and these may contain a $C_1$-$C_4$ alkoxy group, a $C_1$-$C_4$ alkyl group, or a halogen atom as a substituent. $R_3$ and $R_4$ may collectively form a ring.)

Specifically, amino group, diethylamino group, N-methyl-N-phenylamino group, N,N-diphenylamino group, N,N-di(tolyl)amino group, dibenzylamino group, piperidino group, morpholino group, pyrrolidino group, etc., can be provided.

(7) An alkylenedioxy group and an alkylenedithio group such as methylenedioxy group, methylenedithio group, etc., can be provided.

(8) A substituted or non-substituted styryl group, a substituted or non-substituted β-phenylstyryl group, diphenylaminophenyl group, ditolylaminophenyl group, etc.

The arylene group represented by aforementioned $Ar_1$ or $Ar_2$ is a divalent group derived from the aryl groups represented by aforementioned $Ar_3$ and $Ar_4$.

Aforementioned X represents a single bond, a substituted or non-substituted alkylene group, a substituted or non-substituted cycloalkylene group, a substituted or non-substituted alkylene ether group, an oxygen atom, a sulfur atom, or vinylene group.

The substituted or non-substituted alkylene group is $C_1$-$C_{12}$, preferably $C_1$-$C_8$, more preferably $C_1$-$C_4$ straight or branched alkylene group and, further, these alkylene groups may have a fluorine atom, hydroxyl group, cyano group, a $C_1$-$C_4$ alkoxy group, a phenyl group, or a phenyl group substituted with a halogen atom, a $C_1$-$C_4$ alkyl group, or a $C_1$-$C_4$ alkoxy group. Specifically, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, 4-biphenylethylene group, etc., can be provided.

The substituted or non-substituted cycloalkylene group is a $C_5$-$C_7$ cyclic alkylene group and these cyclic alkylene group may have a fluorine atom, hydroxyl group, a $C_1$-$C_4$ alkyl group, or a $C_1$-$C_4$ alkoxy group. Specifically, cyclohexylidene group, cyclohexylene group, 3,3-dimethylcyclohexylidene group, etc., can be provided.

The substituted or non-substituted alkylene ether group represents ethyleneoxy, propyleneoxy, ethylene glycol, propylene glycol, diethylene glycol, tetraethylene glycol, or tripropylene glycol, and alkylene ether groups are provided. The alkylene group may have a substituent such as hydroxyl group, methyl group, and ethyl group.

The vinylene group is represented by the following general formula.

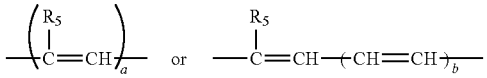

Herein, $R_5$ represents hydrogen, an alkyl group (being the same alkyl group as that defined in aforementioned (2)), an aryl group (being the same aryl group as that represented by aforementioned $Ar_3$ or $Ar_4$), a represents 1 or 2, and b represents 1 through 3.

Aforementioned Z represents a substituted or non-substituted alkylene group, a substituted or non-substituted alkylene ether divalent group, or alkyleneoxycarbonyl divalent group.

As the substituted or non-substituted alkylene group, ones similar to the alkylene group as aforementioned X can be provided.

As the substituted or non-substituted alkylene ether divalent group, divalent groups of the alkylene ether groups of aforementioned X above can be provided.

As the alkyleneoxycarbonyl divalent group, a caprolactone-modified divalent group can be provided.

Also, as the one-functional radical-polymerizable compound having a charge transporting structure used for the crosslinked-type charge transportation layer, more preferably, a compound with the structure of the following general formula (3) can be provided.

General formula (3)

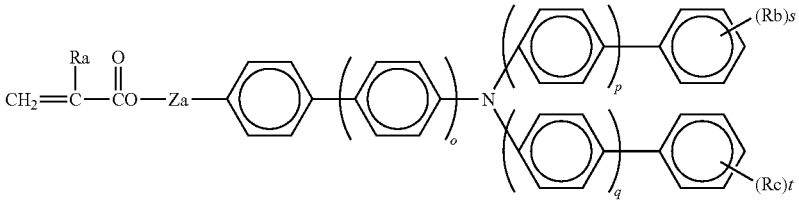

(In the formula, each of o, p, and q represents an integer of 0 or 1, Ra represents a hydrogen atom or a methyl group, Rb and Rc represent a substituent except a hydrogen atom and an alkyl group in which the number of carbon(s) is 1 through 6, and in the case of a plural number, may be different. s and t represent an integer of 0 through 3. Za represents a single bond, a methylene group, an ethylene group, or a compound represented by the following general formula.)

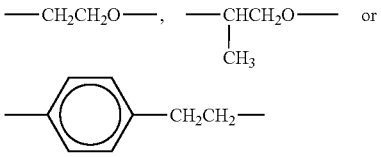

In the compound represented by aforementioned general formula, a compound in which a substituent of Rb or Rc is, particularly, methyl group or ethyl group is preferable. When the one-functional radical-polymerizable compound having a charge transporting structure is at least one kind of compound represented by the following general formula (3), a further effect to the attainment of high sensitivity of a photoconductor and the lowering of a residual electric potential thereof can be obtained and the highly stable output of high quality image is realized.

It is guessed that, the one-functional radical-polymerizable compound having a charge transporting structure of the aforementioned general formulas (1) and (2), especially (3), used for the present invention does not become a terminal structure but is incorporated in a chaining polymer, since the carbon-carbon double bond opens toward both sides thereof to polymerize, and in the polymer of which a crosslinkage is formed by the polymerization with the three-or-more-functional radical-polymerizable monomer, exists in a main chain of the polymer and exists in a crosslinking chain between the main chains (as this crosslinking chain, there are an intermolecular crosslinking chain between one polymer molecule and another polymer molecule and an intramolecular crosslinking chain for which one portion of a main chain at a folded state in one polymer molecule and another portion originating from a monomer polymerized at a position away from there in the main chain are crosslinked.), however, whether it exists in the main chain or exists in the crosslinking chain, a triarylamine structure pending from a chain part has at least three aryl groups arranged in the radial directions from a nitrogen atom and is bulky but does not directly bonds to the chain part and pends from the chain part via a carbonyl group, etc., so as to be fixed at a flexible condition in regard to the steric positioning thereof, so that the structural distortion in the molecule is small since these triarylamine structures can be sterically arranged to be appropriately adjacent to each other in the polymer, and, in the case of being in the surface layer of an electrophotographic photoconductor, an intramolecular structure that is comparatively free from the breaking of a charge transportation route can be taken.

Specific examples of the one-functional radical-polymerizable compound having a charge transporting structure in the present invention are shown below but it is not limited to compounds with these structures.

No. 1

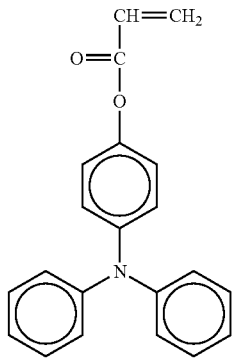

No. 2

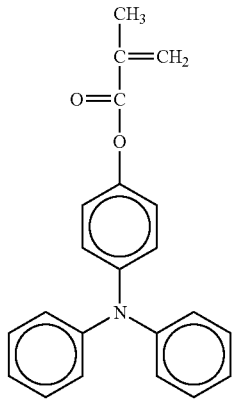

-continued
No. 3
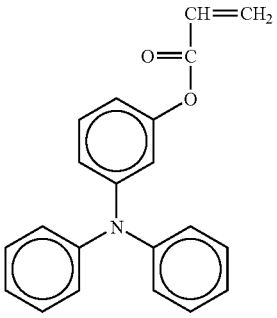
No. 4
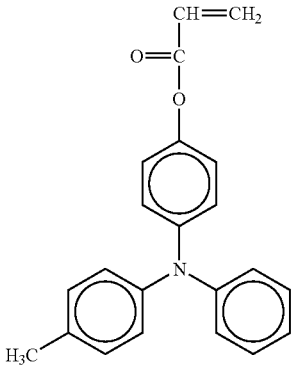
No. 5
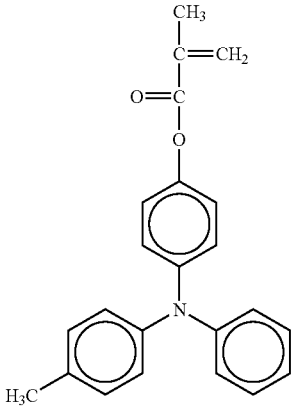
No. 6
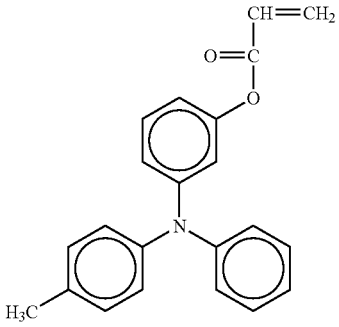
-continued
No. 7
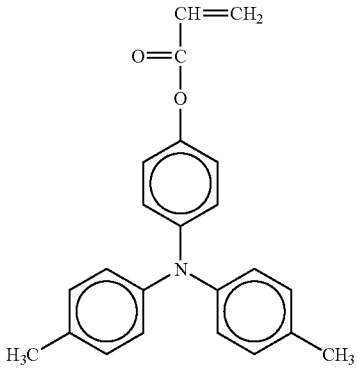
No. 8
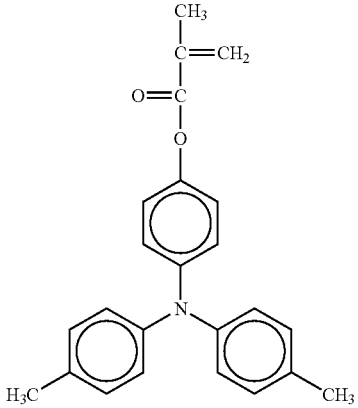
No. 9
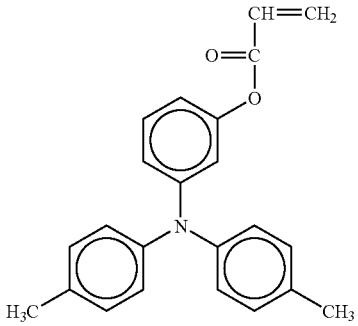
No. 10
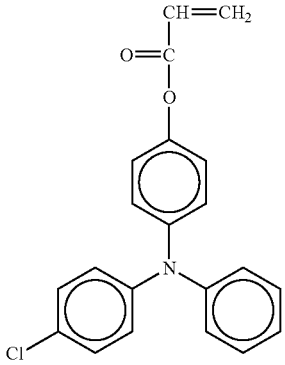

-continued
No. 11
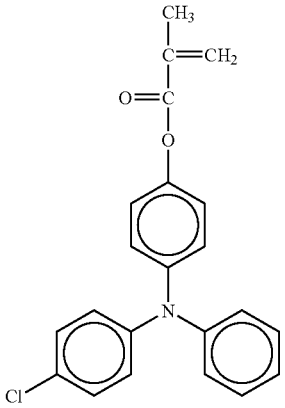
No. 12
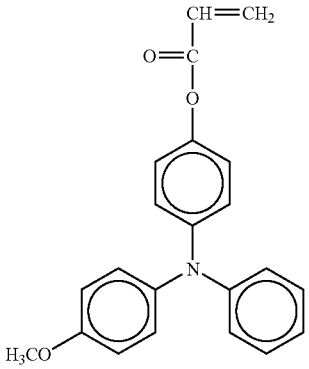
No. 13
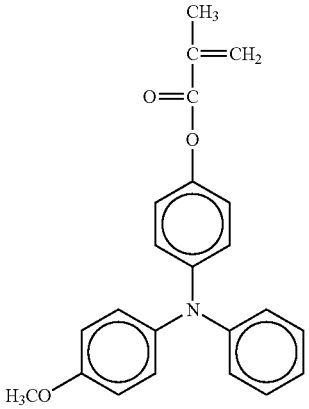
No. 14
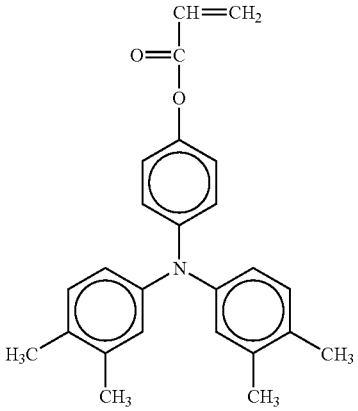
-continued
No. 15
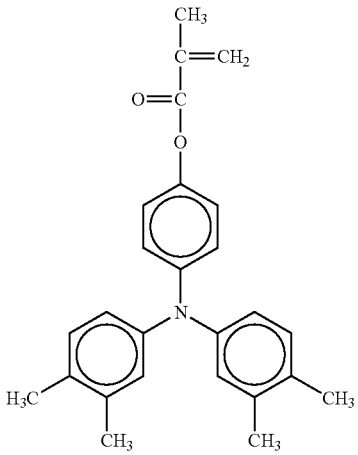
No. 16
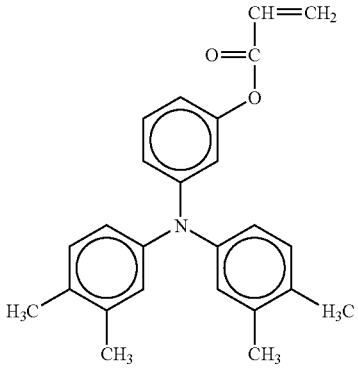
No. 17
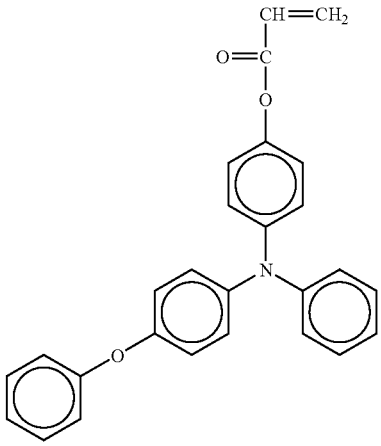

-continued
No. 18
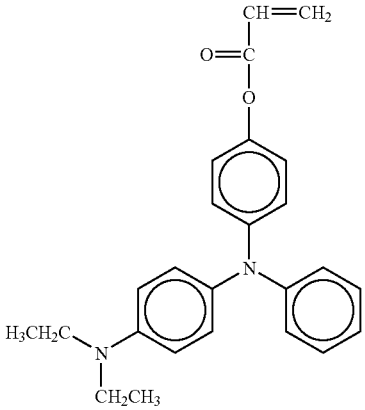
No. 19
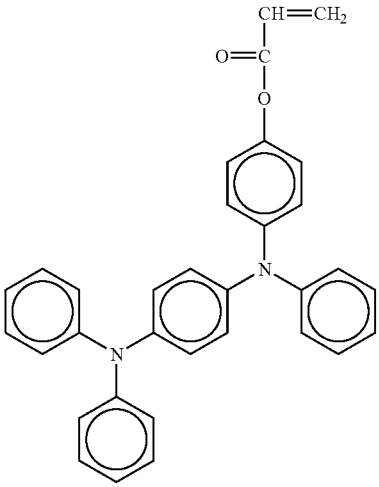
No. 20
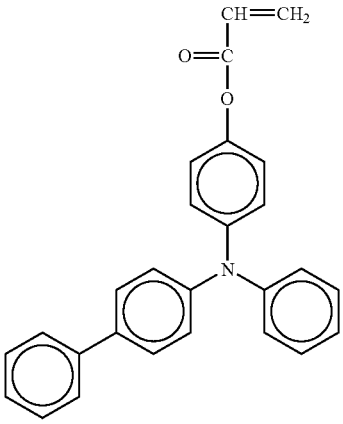
-continued
No. 21
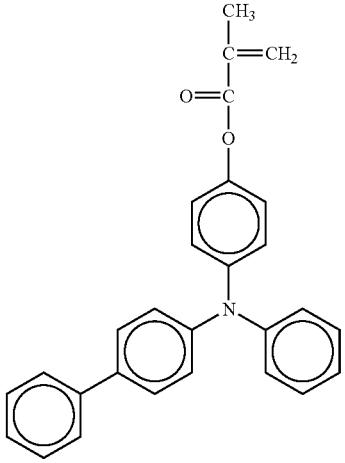
No. 22
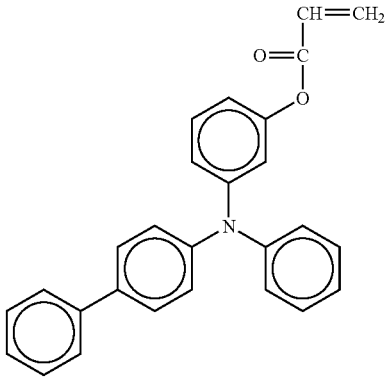
No. 23
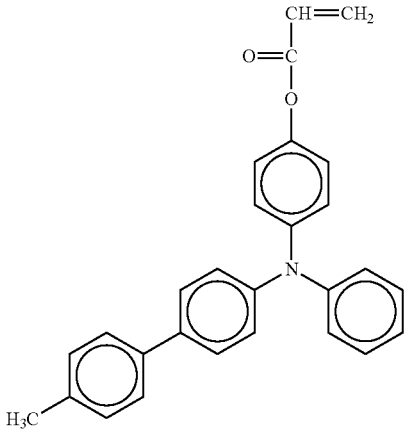

-continued
No. 24
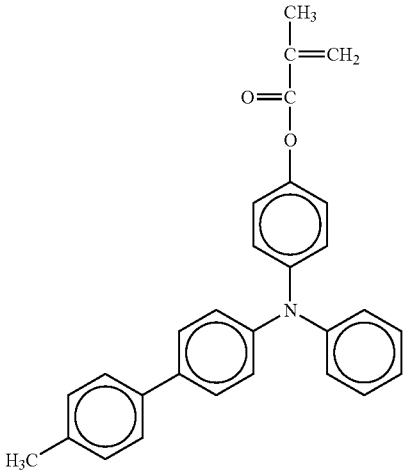
No. 25
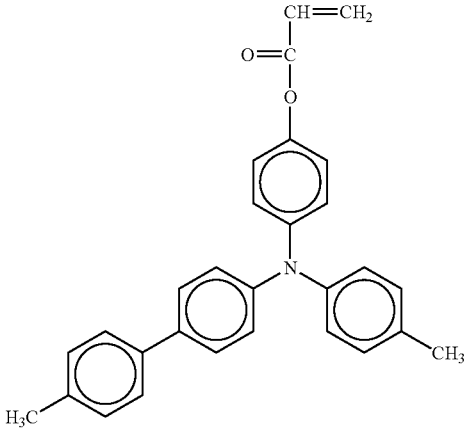
No. 26
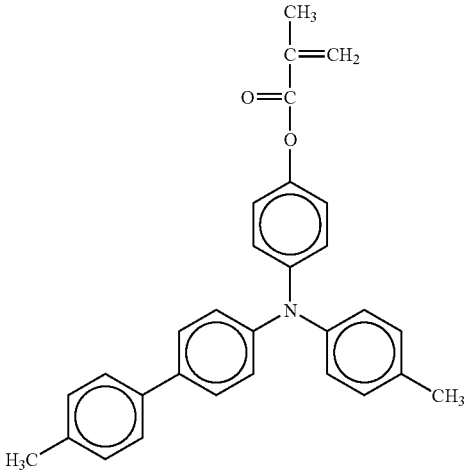
-continued
No. 27
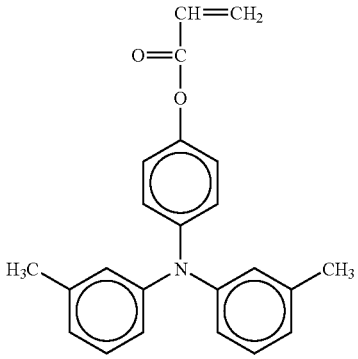
No. 28
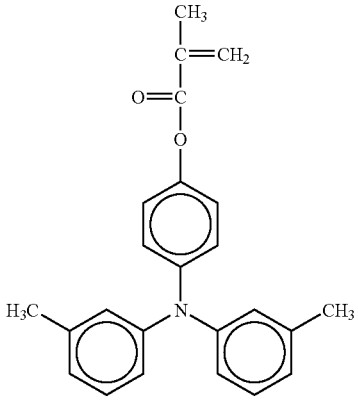
No. 29
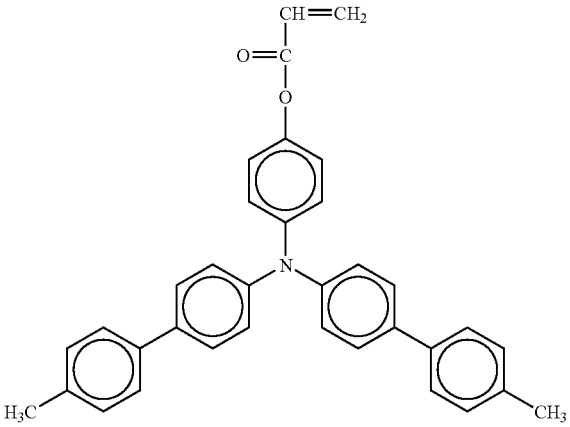
No. 30
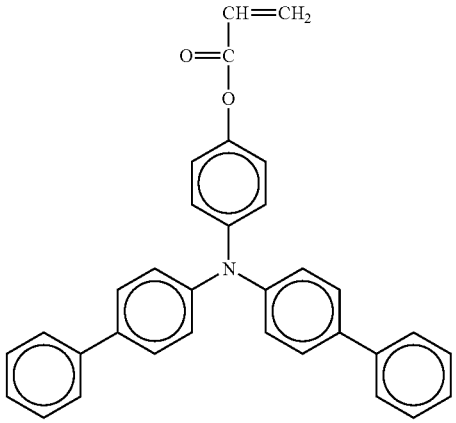

-continued
No. 31
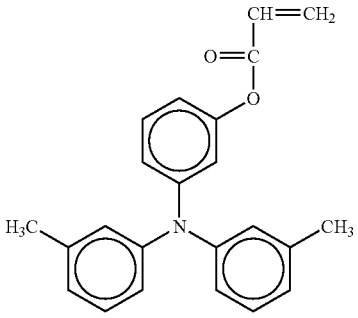
No. 32
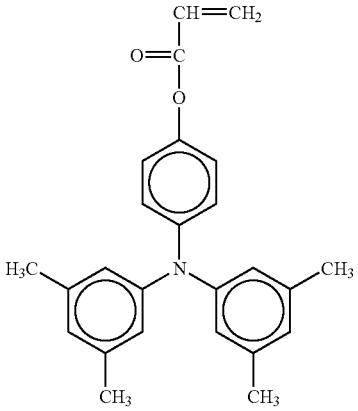
No. 33
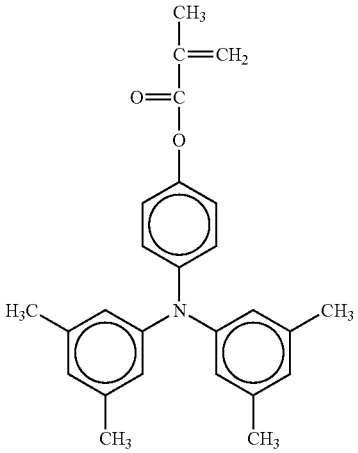
No. 34
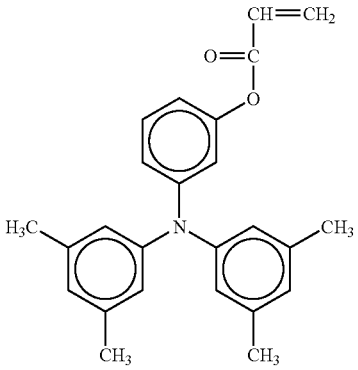
-continued
No. 35
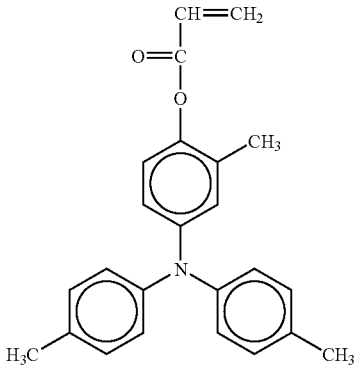
No. 36
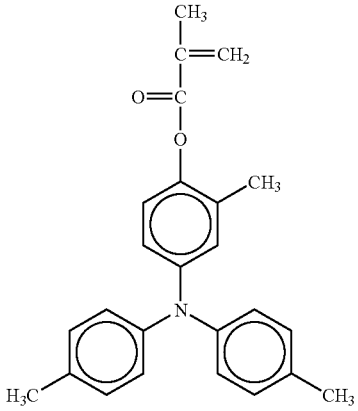
No. 37
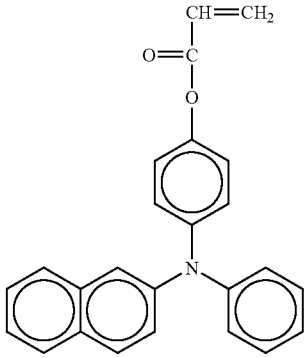
No. 38
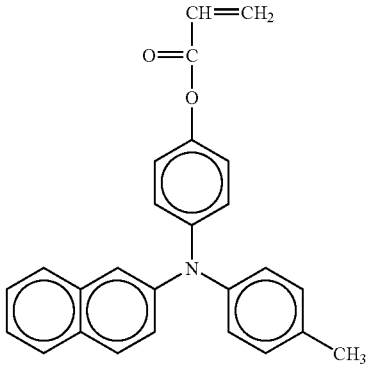

-continued
No. 39
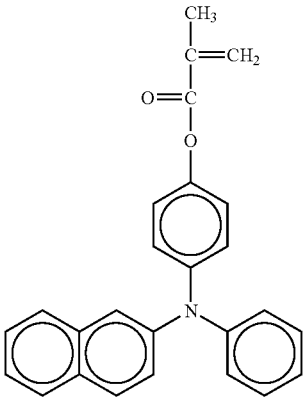
No. 40
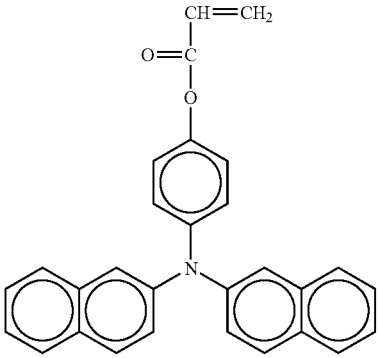
No. 41
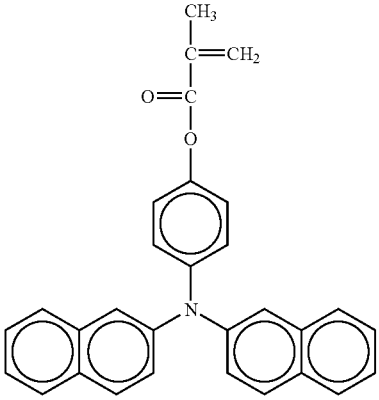
-continued
No. 42
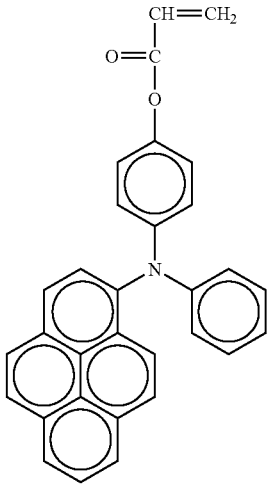
No. 43
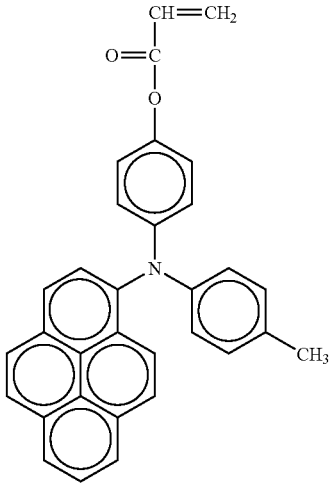
No. 44
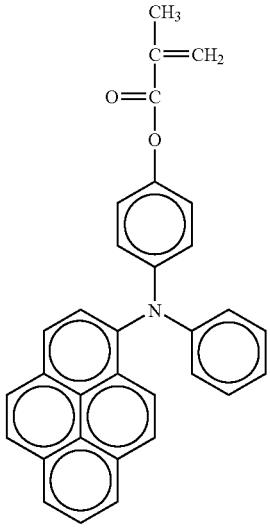

-continued
No. 45
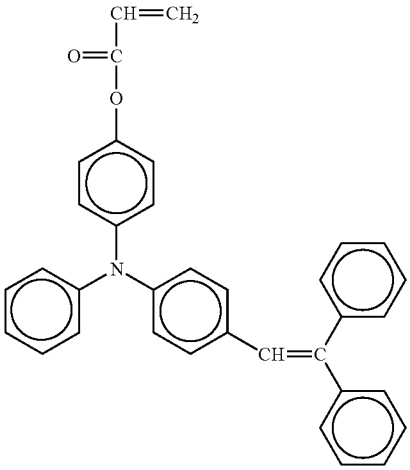
No. 46
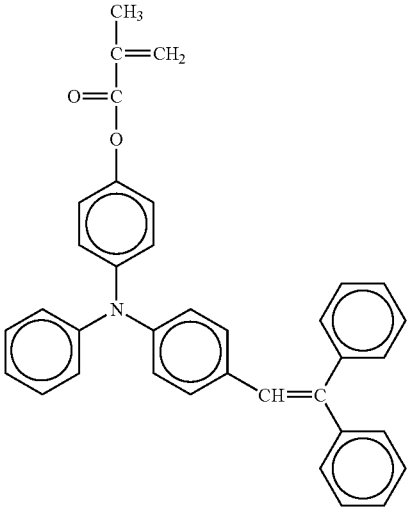
No. 47
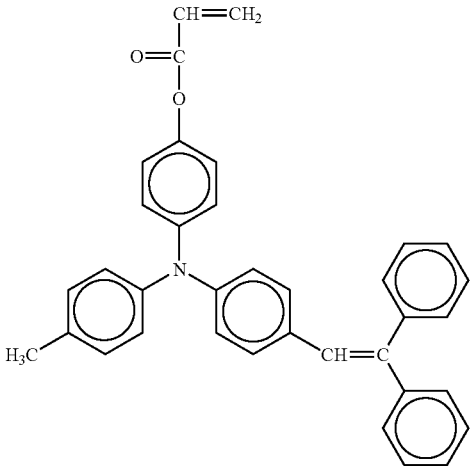
-continued
No. 48
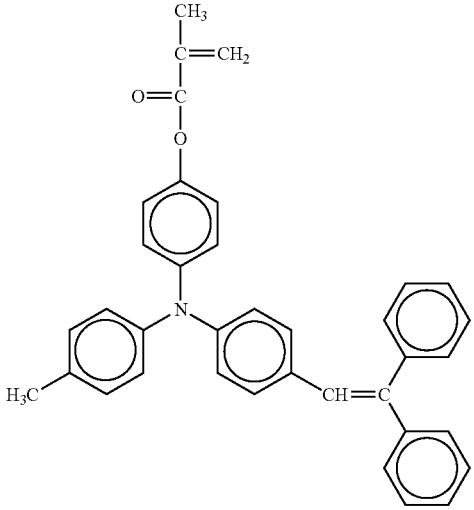
No. 49
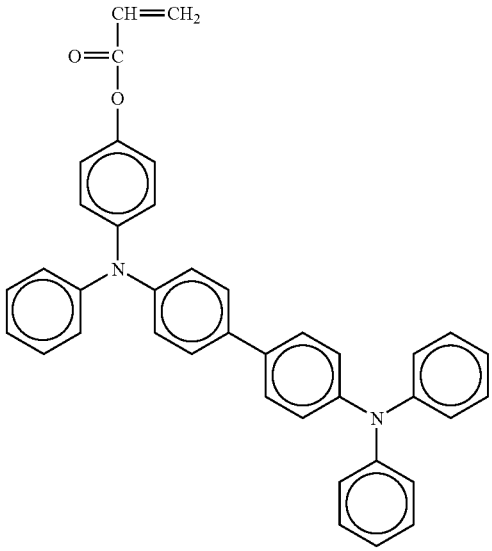

-continued
No. 50
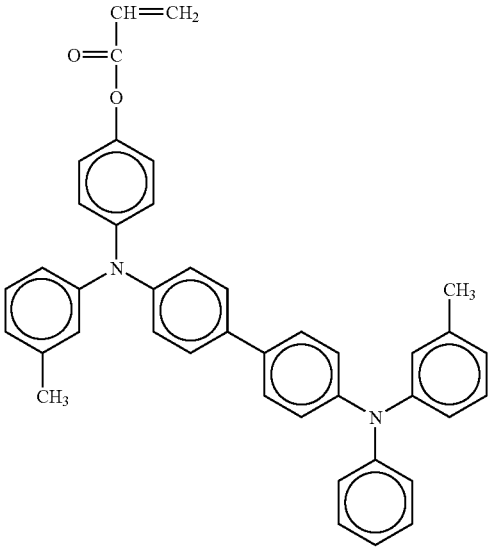
No. 51
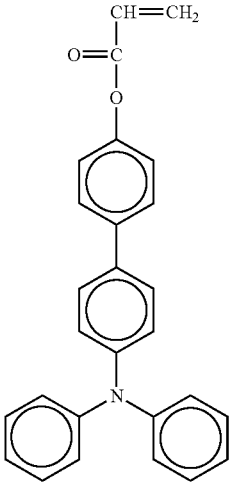
No. 52
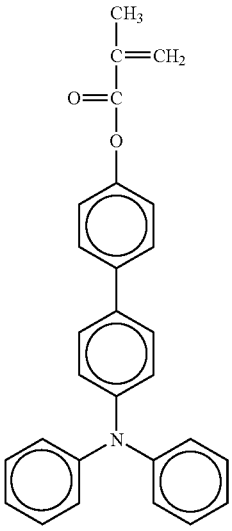
-continued
No. 53
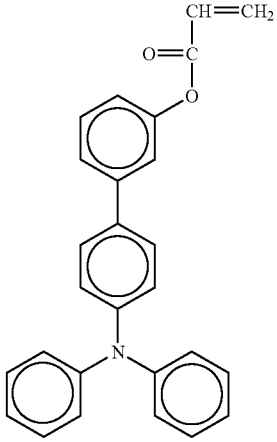
No. 54
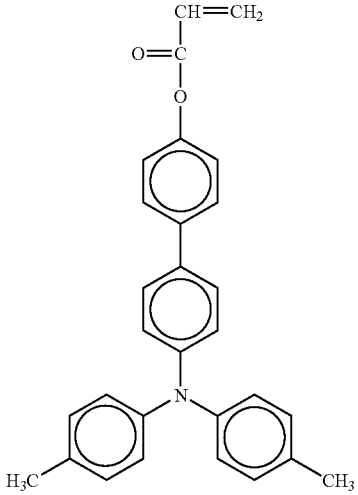
No. 55
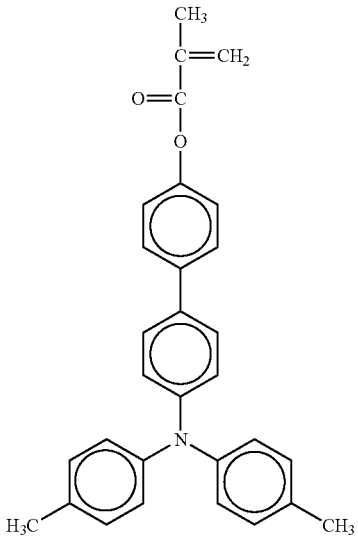

-continued
No. 56
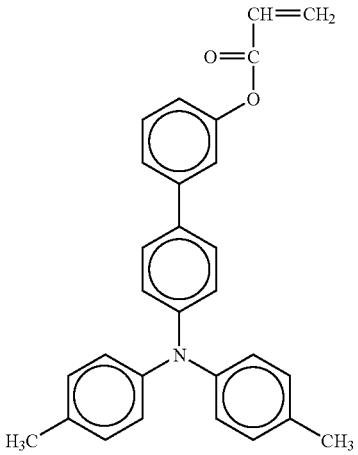
No. 57
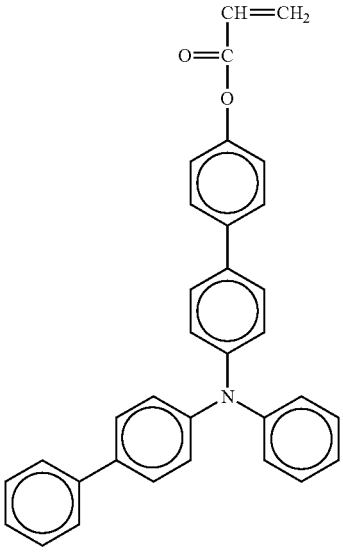
No. 58
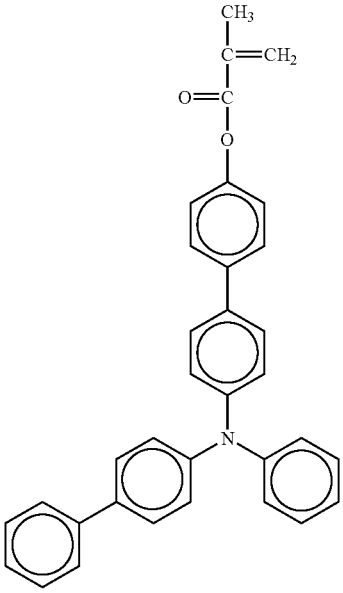
-continued
No. 59
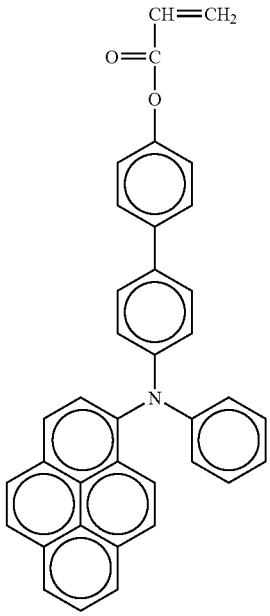
No. 60
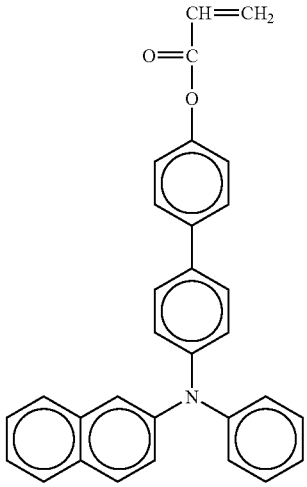
No. 61
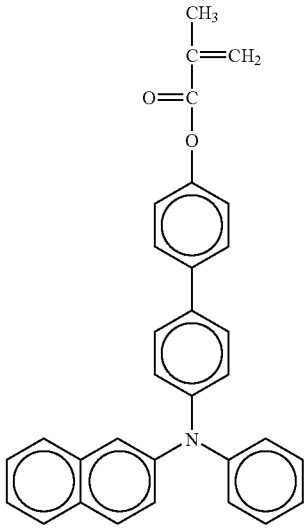

-continued
No. 62
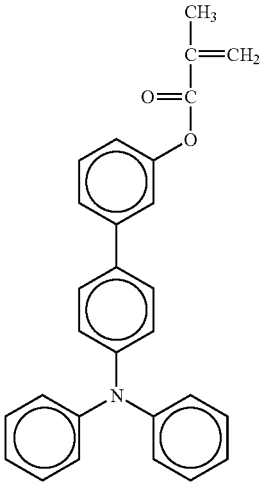
No. 63
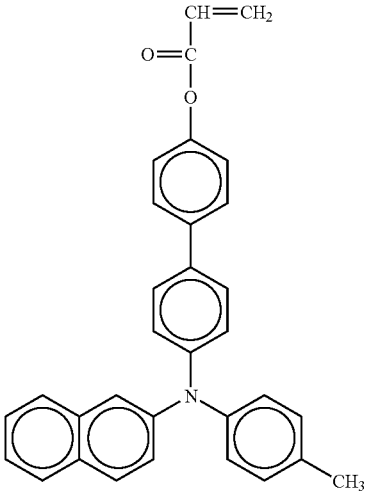
No. 64
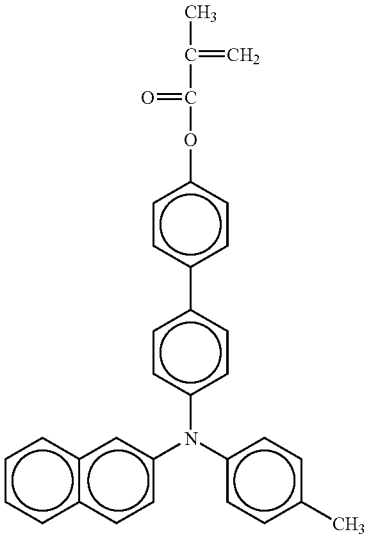
-continued
No. 65
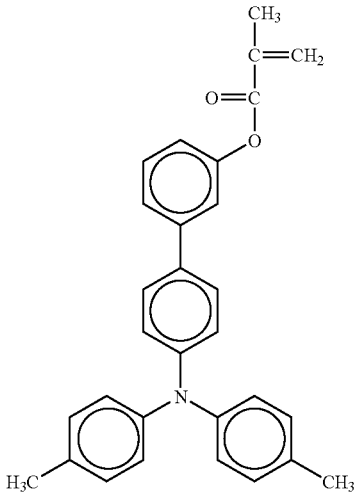
No. 66
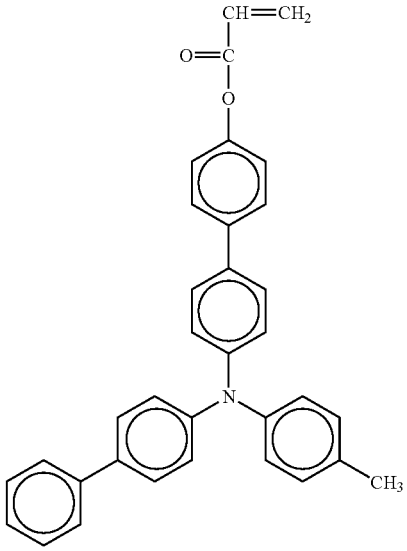
No. 67
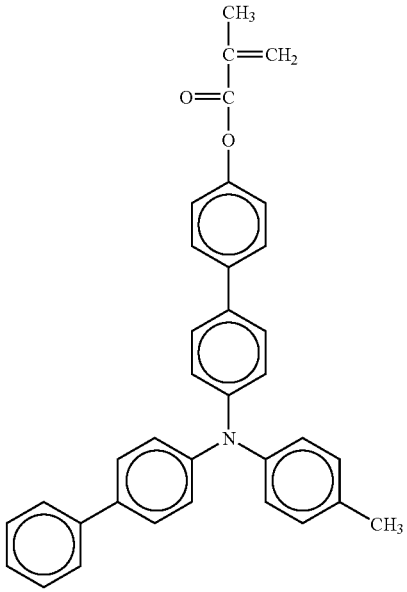

-continued
No. 68
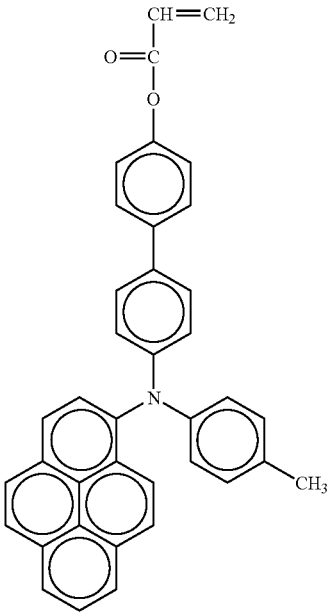
-continued
No. 70
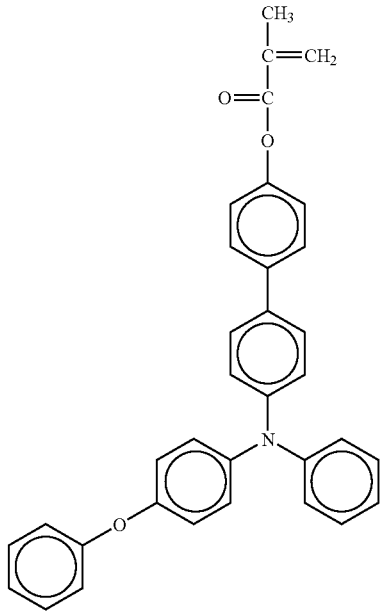
No. 69
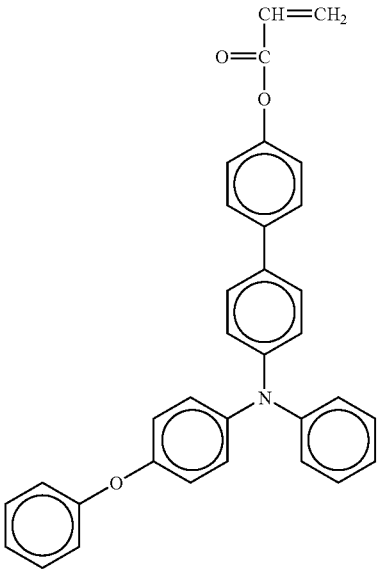
No. 71
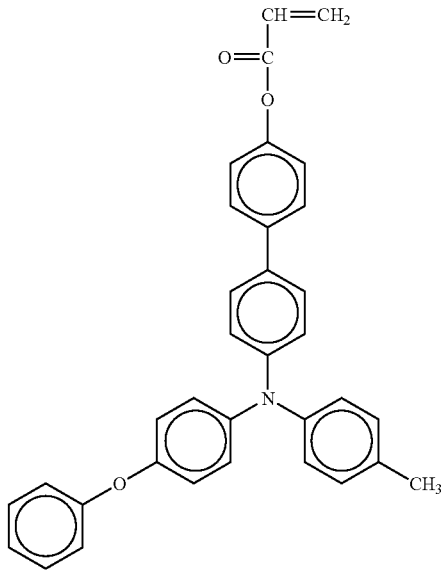

-continued
No. 72
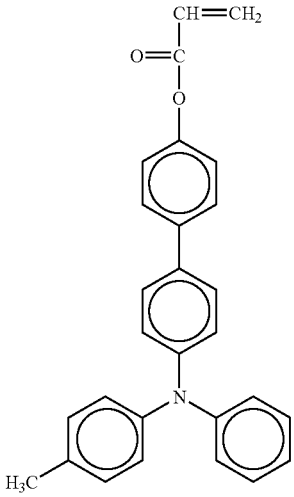
No. 73
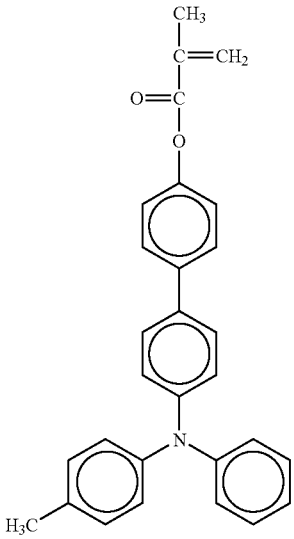
No. 74
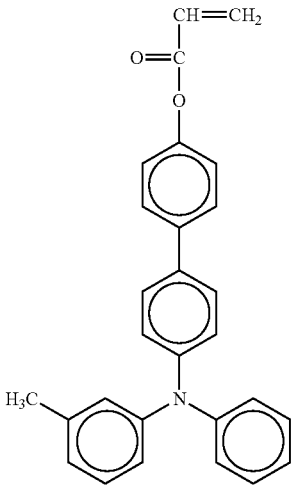
-continued
No. 75
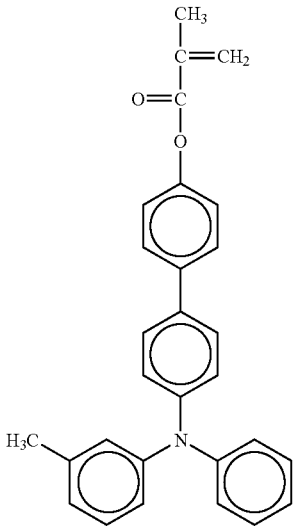
No. 76
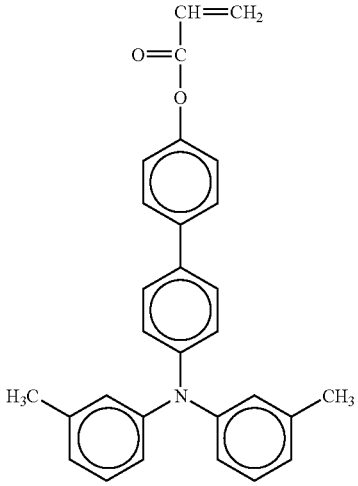
No. 77
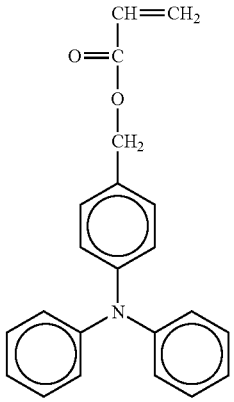

-continued
No. 78
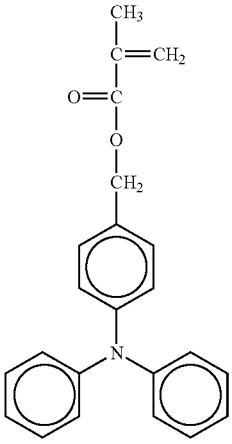
No. 79
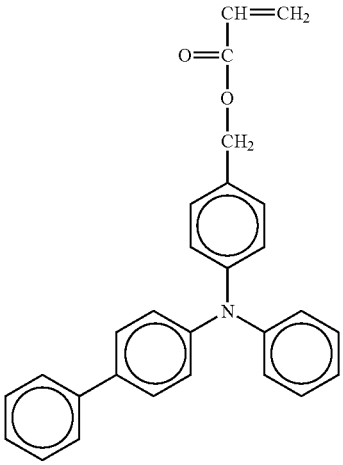
No. 80
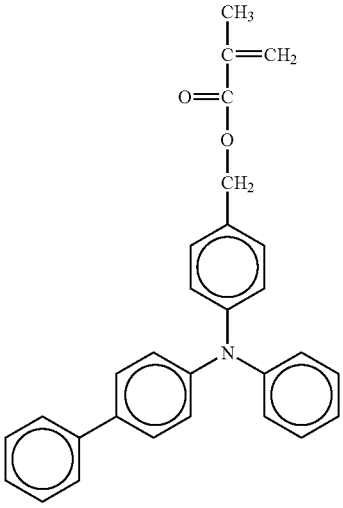
-continued
No. 81
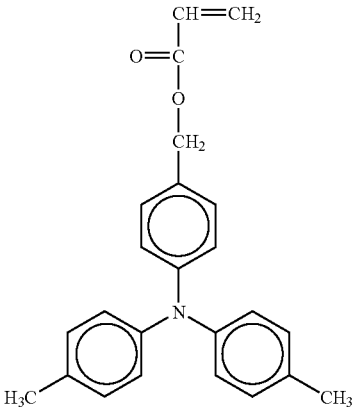
No. 82
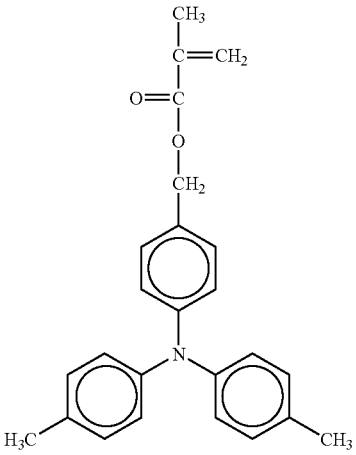
No. 83
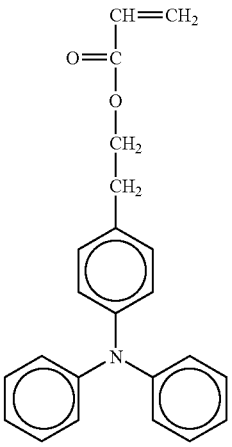

-continued
No. 84
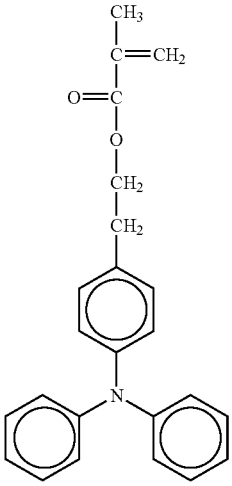
No. 85
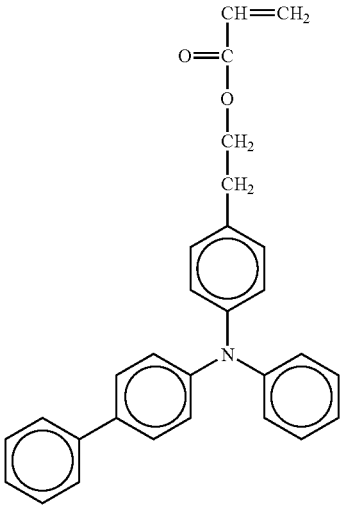
No. 86
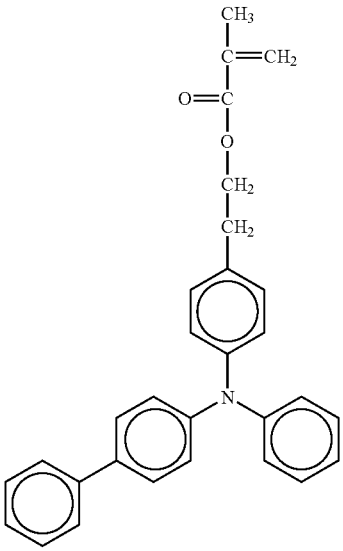
-continued
No. 87
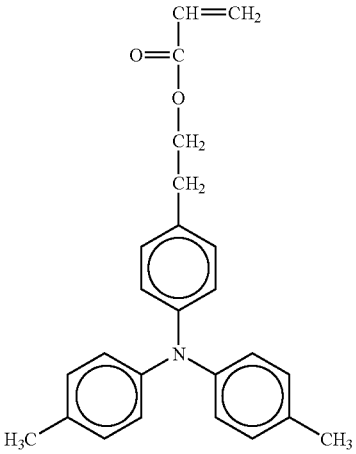
No. 88
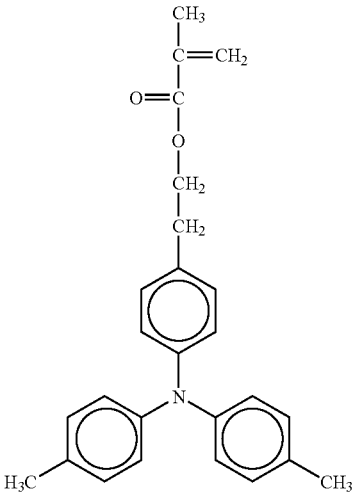
No. 89
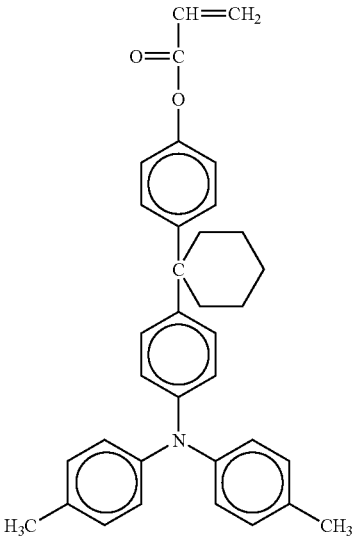

-continued
No. 90
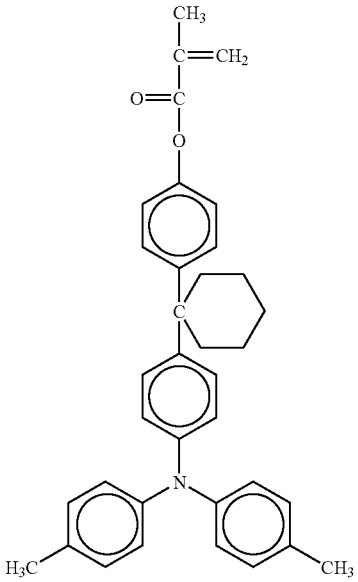
-continued
No. 92
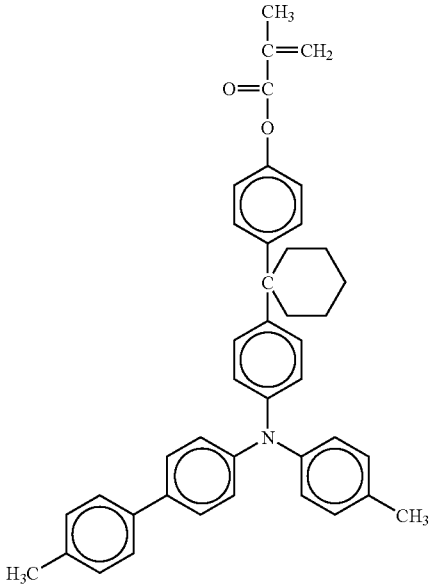
No. 91
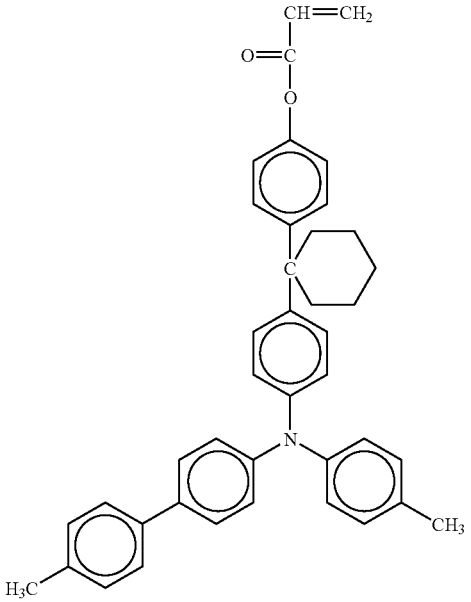
No. 93
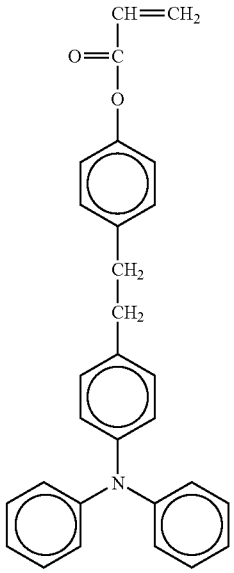

-continued
No. 94
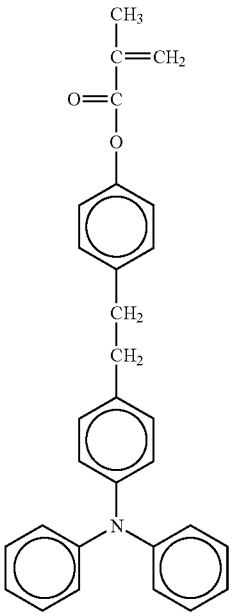
No. 95
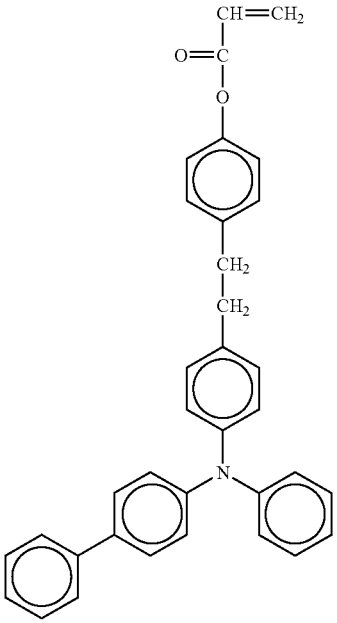
-continued
No. 96
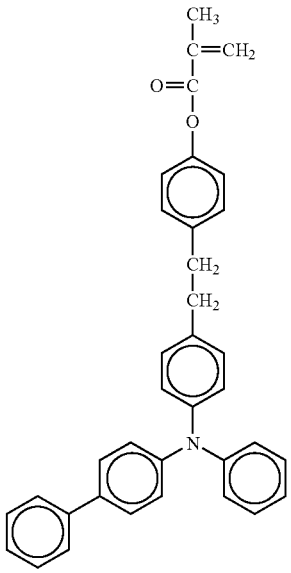
No. 97
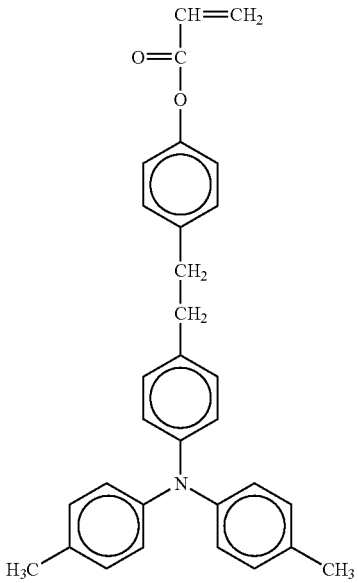

-continued
No. 98
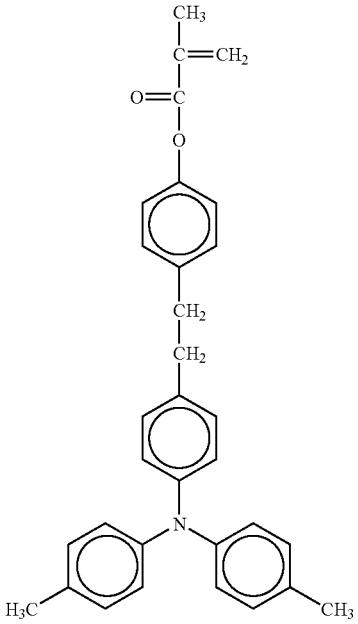
-continued
No. 100
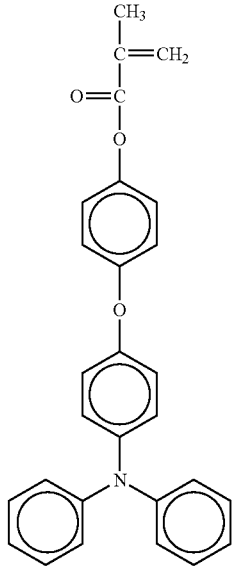
No. 99
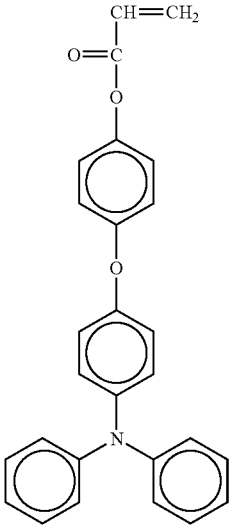
No. 101
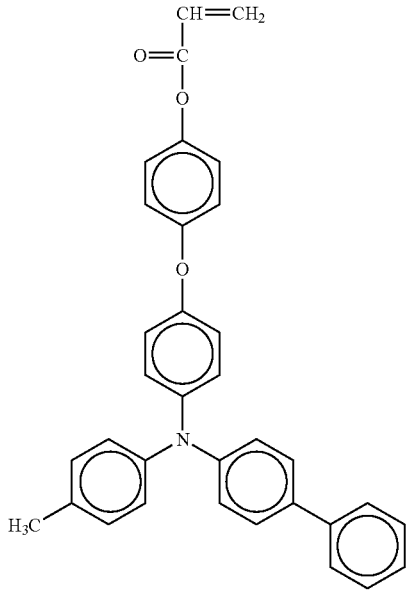

-continued
No. 102
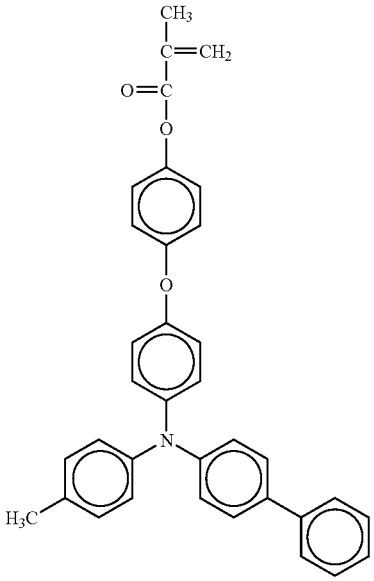
-continued
No. 104
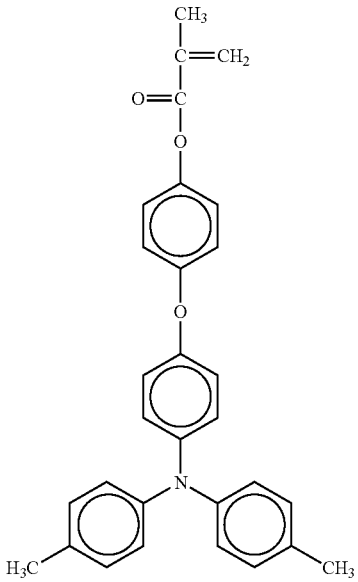
No. 103
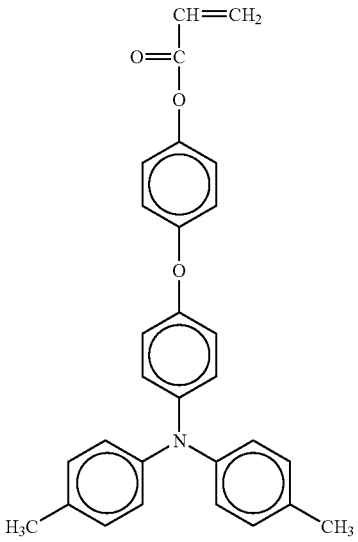
No. 105
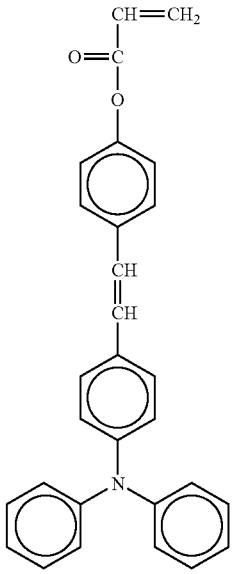

-continued
No. 106
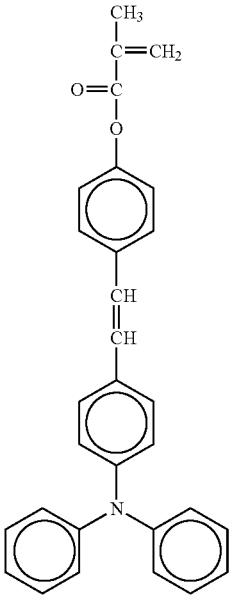
-continued
No. 108
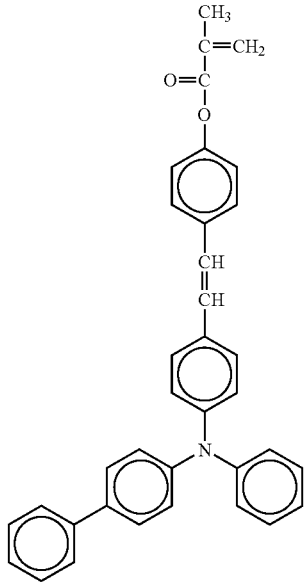
No. 107
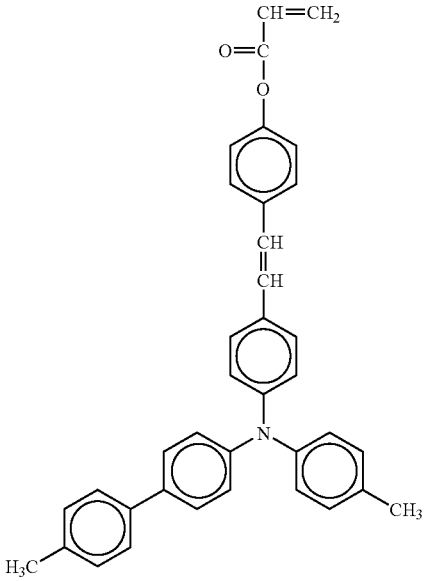
No. 109
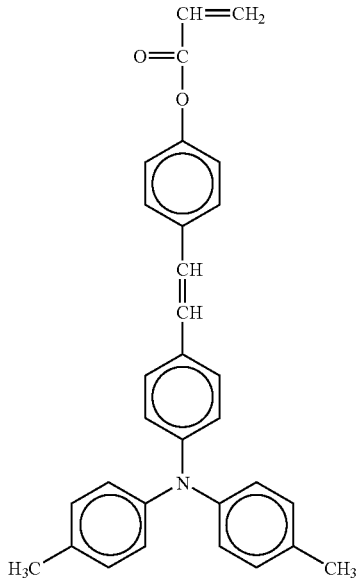

-continued
No. 110
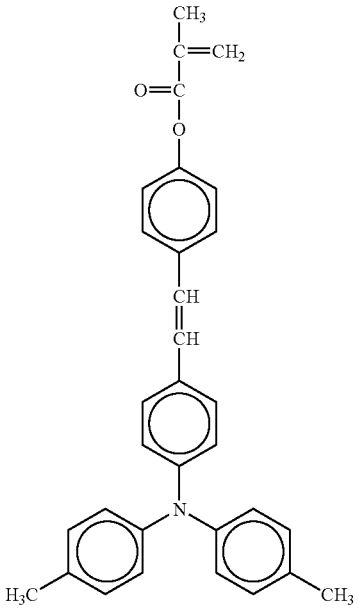
No. 111
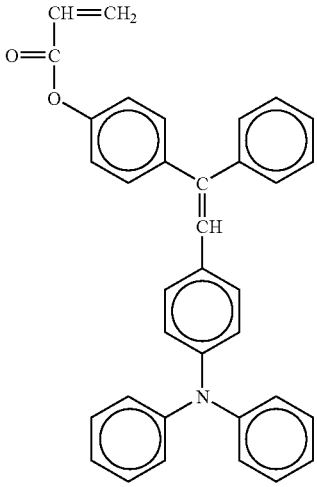
No. 112
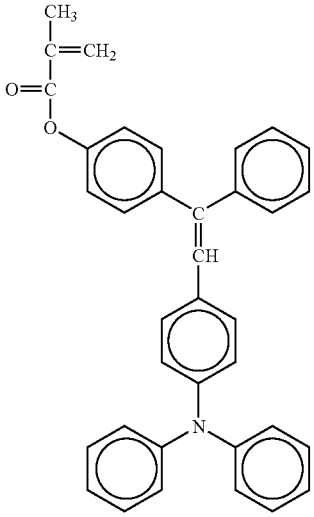
-continued
No. 113
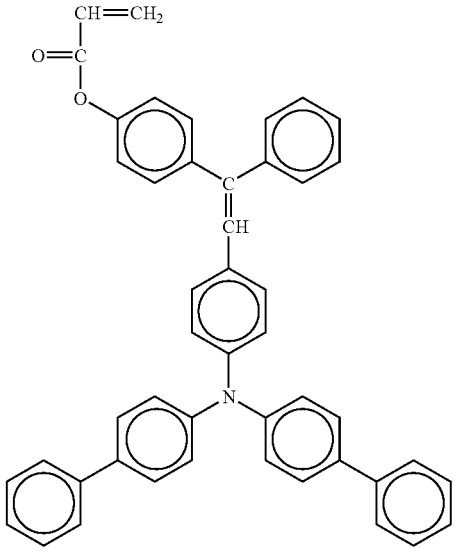
No. 114
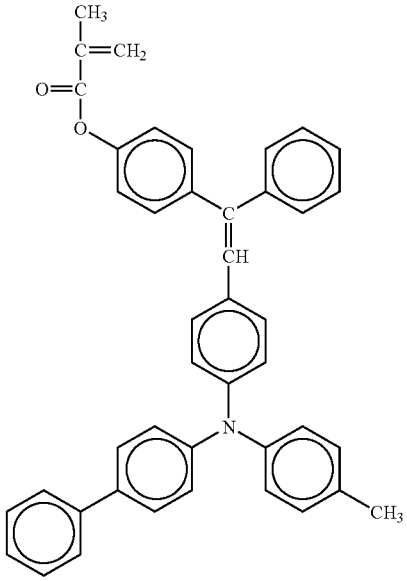
No. 115
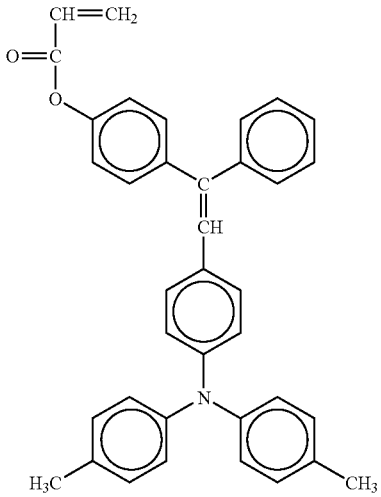

-continued
No. 116
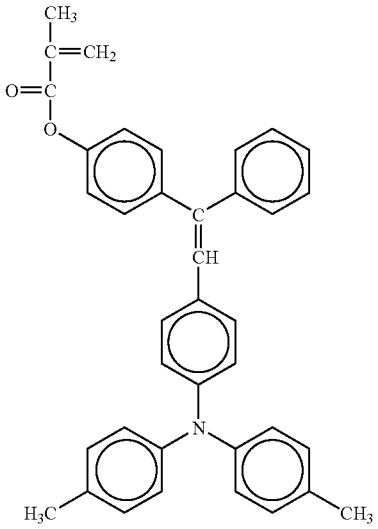
-continued
No. 118
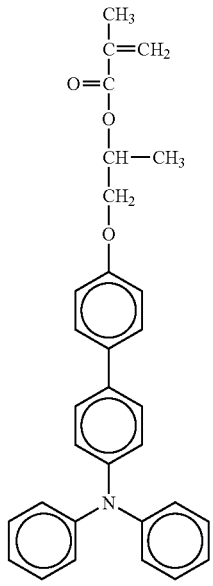
No. 117
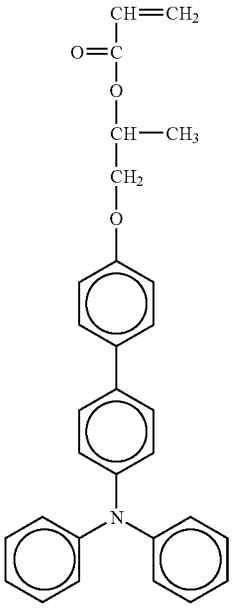
No. 119
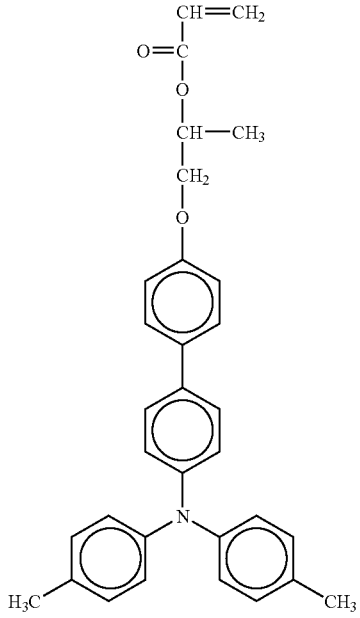

-continued
No. 120
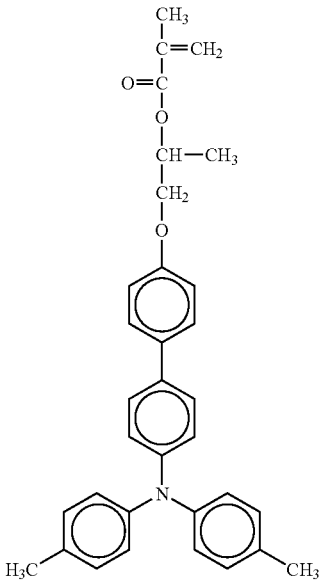
-continued
No. 122
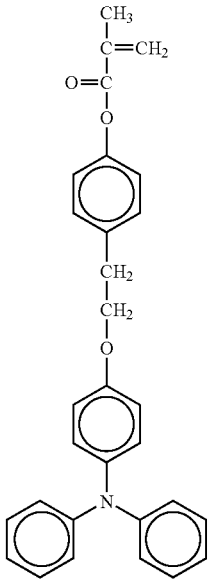
No. 121
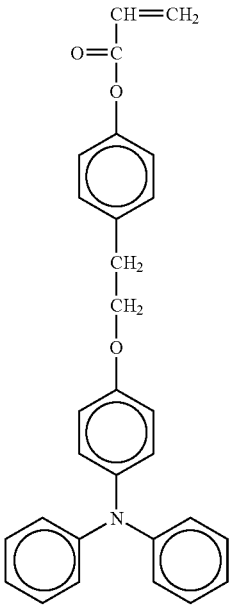
No. 123
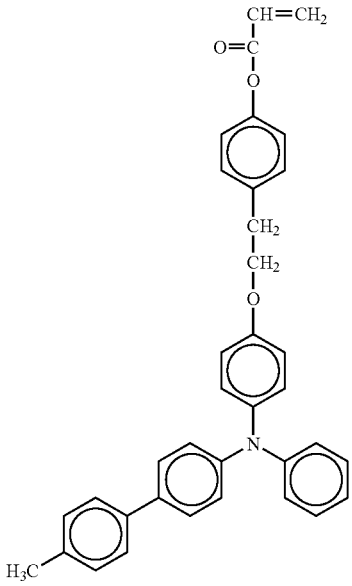

-continued
No. 124
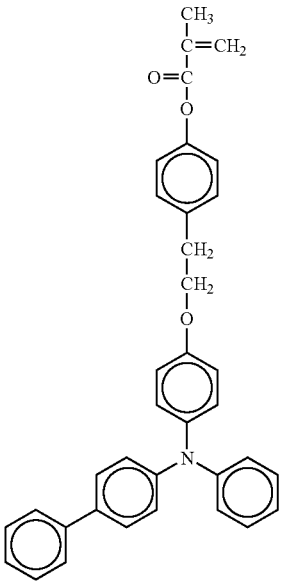
No. 125
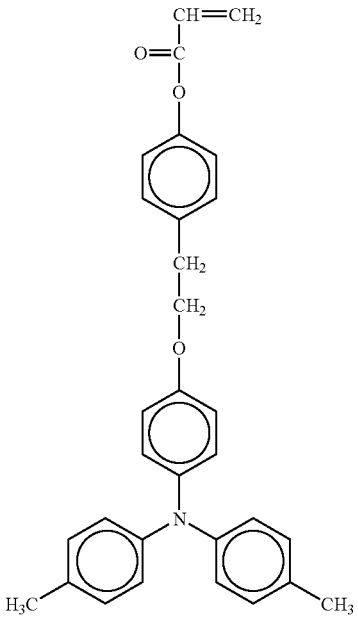
-continued
No. 126
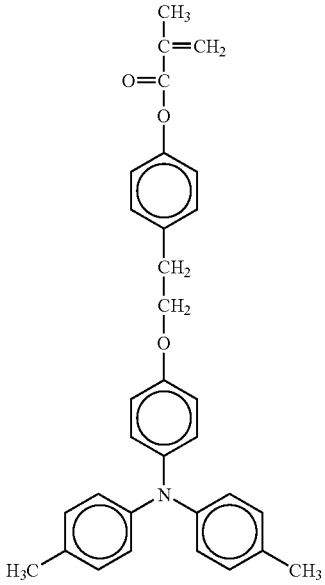
No. 127
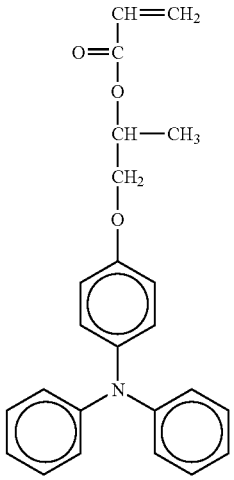
No. 128
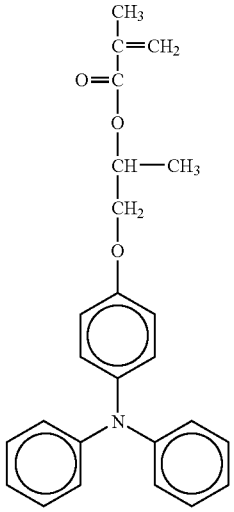

-continued
No. 129
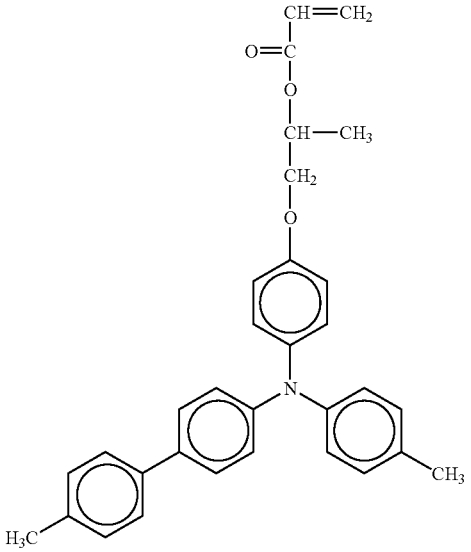
No. 130
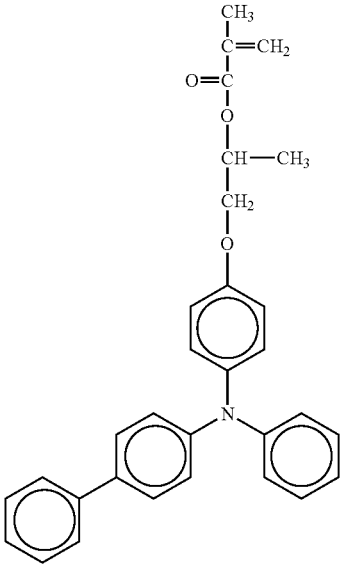
No. 131
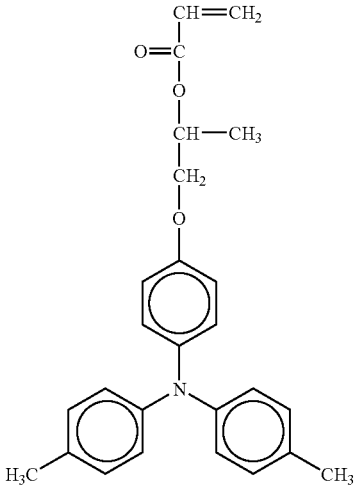
-continued
No. 132
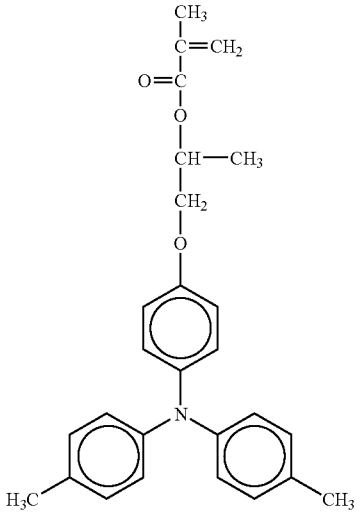
No. 133
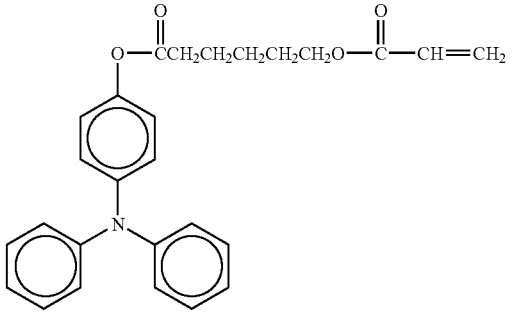
No. 134
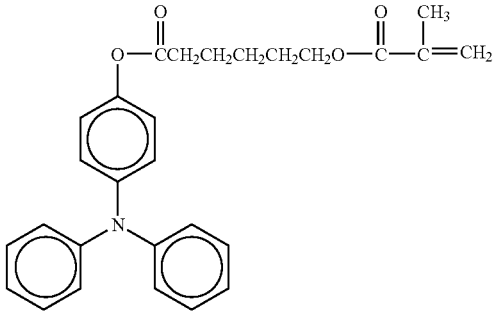
No. 135
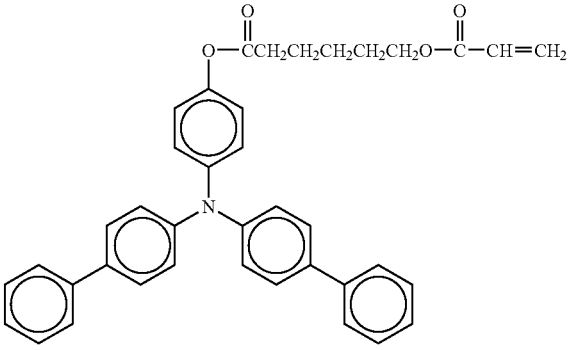

-continued
No. 136
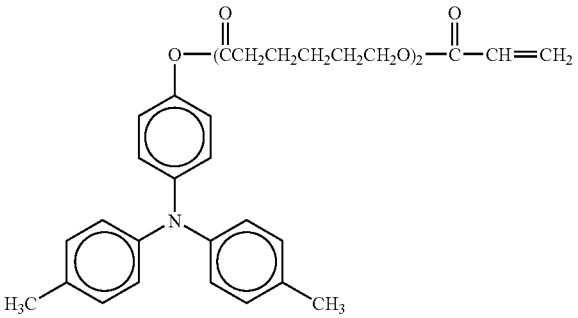
No. 137
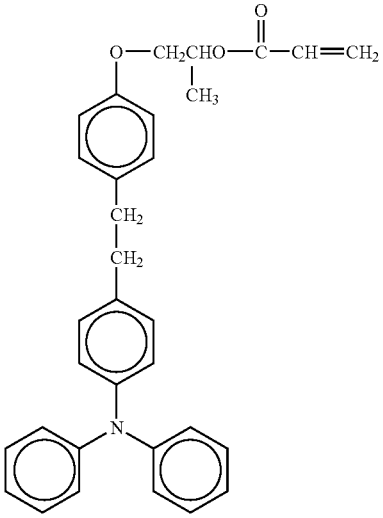
No. 138
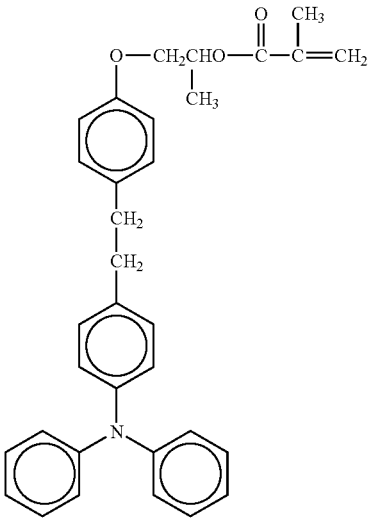
-continued
No. 139
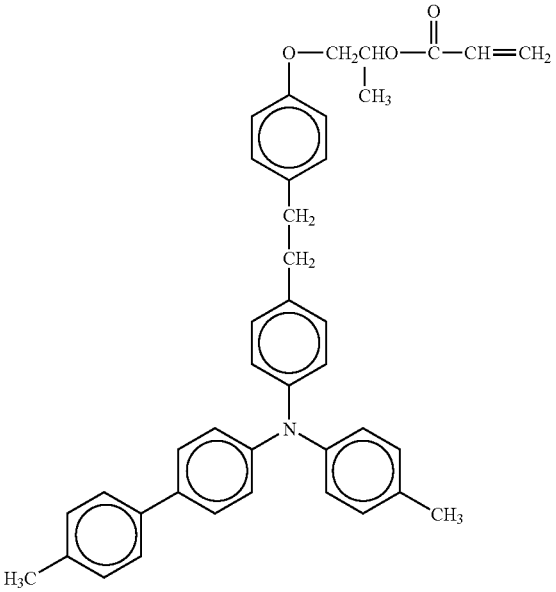
No. 140
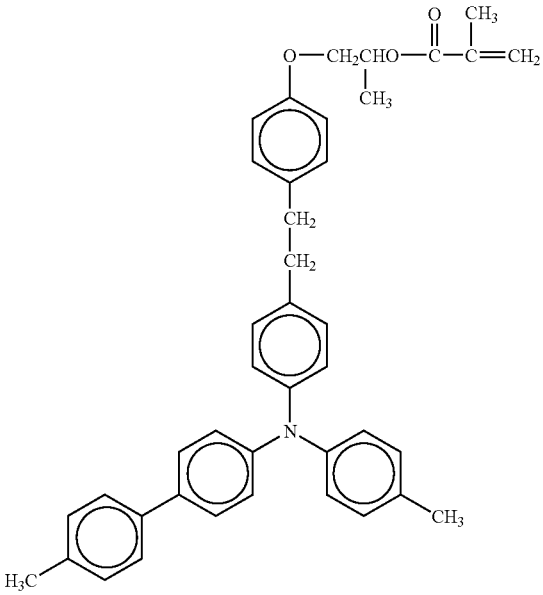

-continued
No. 141
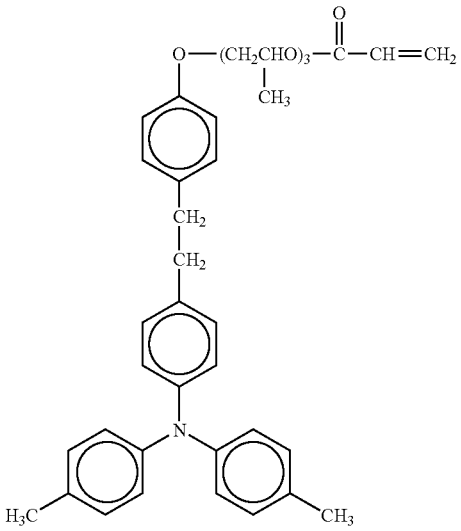
No. 142
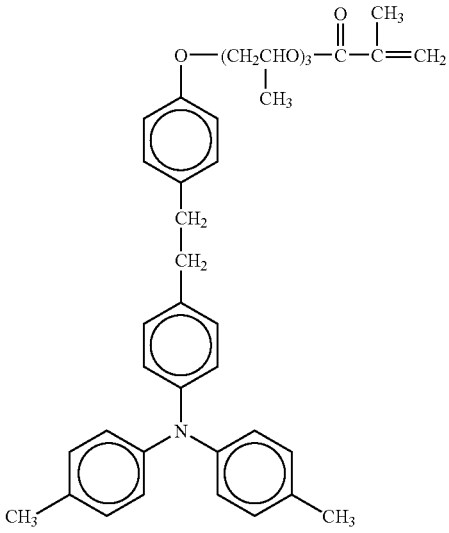
No. 143
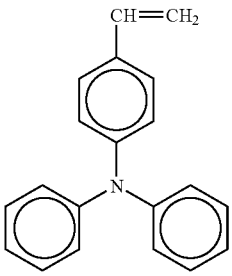
-continued
No. 144
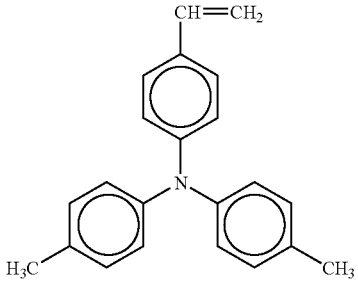
No. 145
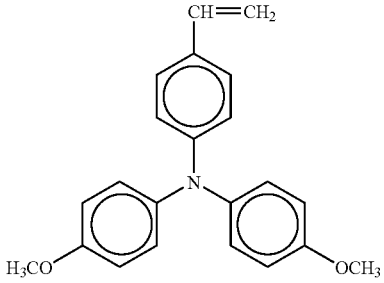
No. 146
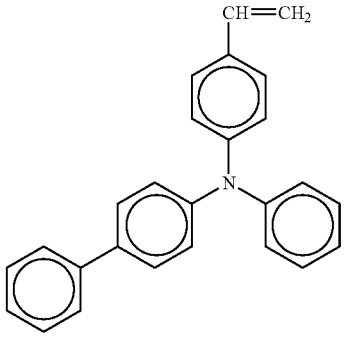
No. 147
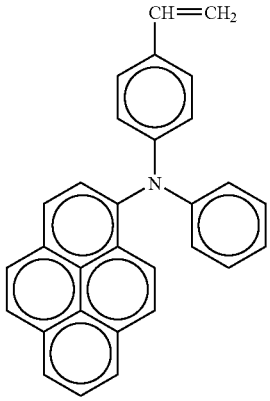
No. 148
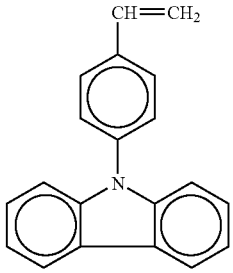

-continued
No. 149
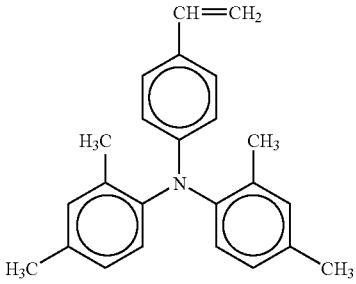
No. 150
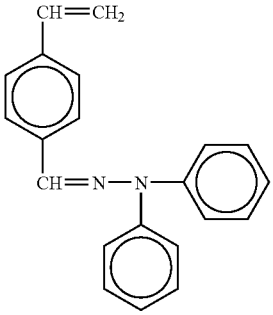
No. 151
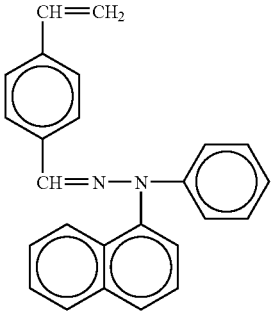
No. 152
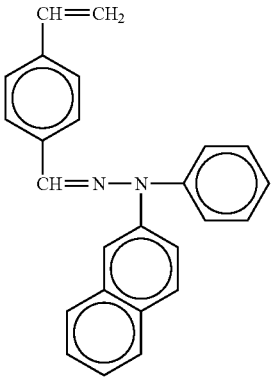
No. 153
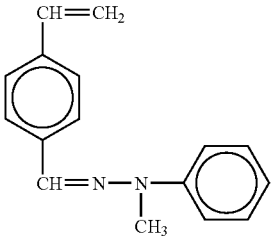
-continued
No. 154
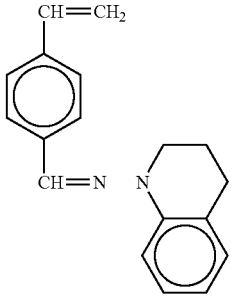
No. 155
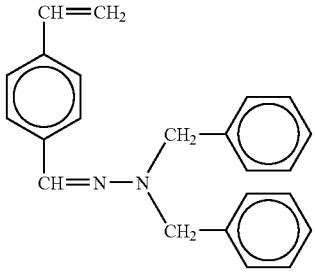
No. 156
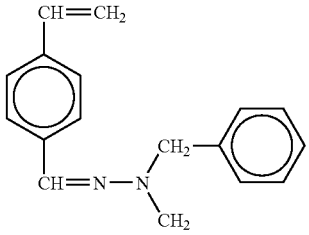
No. 157
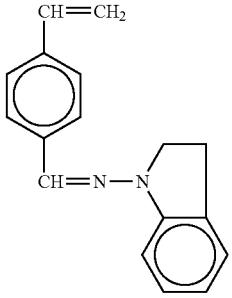
No. 158
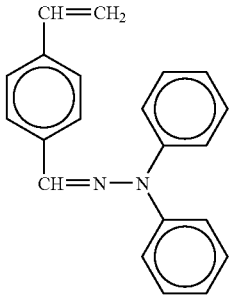

-continued

No. 159

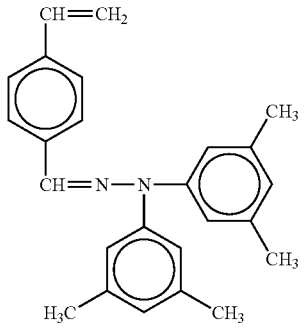

No. 160

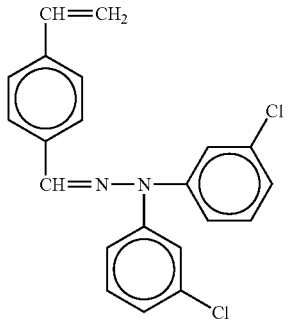

Also, the one-functional radical-polymerizable compound having a charge transporting structure used for the present invention is important for giving charge transportation ability to the crosslinked-type charge transportation layer, and the this component is 20 through 80% by weight, preferably 30 through 70% by weight of the crosslinked-type charge transportation layer. If this component is less then 20% by weight, the charge transportation ability of the crosslinked-type charge transportation layer cannot be sufficiently maintained and the deterioration of electrical characteristics such as the lowering of sensitivity and the elevation of a residual electric potential tends to appear in repeated use. Also, if it is greater than 80% by weight, the content of the three functional monomer having no charge transporting structure is reduced and the lowering of the density of crosslinkage is caused, so that the high wear resistance tends not to be exerted. A range of 30 through 70% by weight is most preferable, taking the balance of both characteristics into consideration, although it may not be necessarily appropriate, since required electrostatic characteristics and wear resistance are different depend on a used process and, accordingly, the film thickness of the crosslinked-type charge transportation layer of a photoconductor according to the present invention is different. That is, when the component ratio of the one-functional radical-porymerizable compound having a charge transporting structure used for the aforementioned crosslinked-type charge transportation layer is 30 through 70% by weight of the total amount of the crosslinked-type charge transportation layer, it is possible to balance the wear resistance of a photoconductor and the residual electric potential or sensitivity thereof, which is very effective in the use in a high-speed machine.

The crosslinked-type charge transportation layer constituting an electrophotographic photoconductor according to the present invention is one for which, at least, the three-or-more-functional radical-polymerizable monomer having no charge transporting structure and the one-functional radical-polymerizable compound having a charge transporting structure are cured, and otherwise, a one-functional or two-functional radical-polymerizable monomer or a radical-polymerizable oligomer can be used in combination for the purpose of giving a function such as viscosity adjustment at the time of coating, stress relaxation for the crosslinked-type charge transportation layer, the reduction of surface energy, and the reduction of a coefficient of friction. As these radical-polymerizable monomer and oligomer, well-known ones can be used.

As the one-functional radical monomer, for example, 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethylene glycol acrylate, phenoxytetraethylene glycol acrylate, cetyl acrylate, isostearyl acrylate, stearyl acrylate, styrene monomer, etc., can be provided.

As two-functional radical-polymerizable monomer, for example, 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, EO-modified bisphenol F diacrylate, neopentylglycol diacrylate, etc, can be provided.

As the functional monomer, for example, ones substituted with a fluorine atom such as octafluoropentyl acrylate, 2-perfluorooctylethyl acrylate, 2-perfluorooctylethyl methacrylate, and 2-perfluoroisononylethyl acrylate, and vinyl monomers, acrylates and methacrylates which have a polysiloxane group, such as acryloyl poly(dimethylsiloxane)ethyl, methacryloyl poly(dimethylsiloxane)ethyl, acryloyl poly(dimethylsiloxane)propyl, acryloyl poly(dimethylsiloxane)butyl, and diacryloyl poly(dimethylsiloxane)diethyl, which have 20 through 70 siloxane repeated units, and are described in Japanese Examined Patent Application No. 5-60503 and Japanese Examined Patent Application No. 6-45770, can be provided.

As the radical-polymerizable oligomer, for example, epoxyacrylate-type, urethane acrylate-type, and polyester acrylate-type oligomers can be provided.

Herein, if a great amount of one-functional or two-functional radical-polymerizable monomer or radical-polymerizable oligomer is contained, the three-dimensional crosslink density of the crosslinked-type charge transportation layer substantially lowers, so that the deterioration of the wear resistance is caused. Therefore, the content of the monomer or oligomer is regulated to be equal to or less than 50 parts by weight, preferably equal to or less than 30 parts by weight, per 100 parts by weight of the three-or-more-functional radical-polymerizable monomer.

Also, although the crosslinked-type charge transportation layer in the present invention is one for which, at least, the three-or-more-functional radical-polymerizable monomer having no charge transporting structure and the one-functional radical-polymerizable compound having a charge transporting structure are cured, a polymerization initiator may be contained in coating liquid for crosslinked-type charge transportation layer in order to effectively promote this curing reaction, according to need.

As a thermal polymerization initiator, peroxide-type initiators such as 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3,-di-t-butyl peroxide, t-butyl hydroperoxide, cumene hydroperoxide, lauroyl peroxide, and 2,2-bis(4,4-di-t-butylperoxycyclohexyl) propane, and azoic initiators such as azobis(isobutylnitrile), azobis(cyclohexanecarbonitrile), azobis(methyl isobutyrate), azobis(isobutylamidine hydrochloride), and 4,4'-azobis(4-cyanovaleric acid) can be provided.

As a photo-polymerization initiator, acetophenone-based or ketal-type photo-polymerization initiators such as diethoxyacetophenone, 2,2-dimethoxy-1,2-diphenylethane-1-one, 1-hydroxycyclohexyl phenyl ketone, 4-(2-hydroxyethoxy)phenyl (2-hydroxy-2-propyl) ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl)oxime, benzoin ether-type photo-polymerization initiators such as benzoin, benzoin methyl ether, benzoin ethyl ether, benzoin isobutyl ether, and benzoin isopropyl ether, benzophenone-based photo-polymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoylbenzene, thioxanthone-based photo-polymerization initiators such as 2-isopropylthioxanthone, 2-chlorothioxanthone, 2,4-dimethylthioxanthone, 2,4-diethylthioxanthone, and 2,4-dichlorothioxanthone, and other photo-polymerization initiators such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxy ester, 9,10-phenanthrene, acridine-based compounds, triazine-based compounds, and imidazole-based compounds, can be provided. Also, one having photo-polymerization promoting effect can be used singularly or in combination with the photo-polymerization initiator. For example, triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone, etc., can be provided.

In regard to these polymerization initiators, one kind thereof may be used or two or more kinds thereof may be mixed and used. The content of the polymerization initiator is 0.5 through 40 parts by weight, preferably 1 through 20 parts by weight per 100 parts by weight of the total content having a radical polymerizing property.

Moreover, coating liquid for the formation of the crosslinked-type charge transportation layer in the present invention can contain an additive such as each kind of plasticizer (that is added for the purpose of stress relaxation or the improvement of an adhesive property), a leveling agent, and a low-molecular-weight charge transportation material having no radical reactivity, according to need. For these additives, well-known ones can be used, and, as the plasticizer, ones used for a general resin, such as dibutyl phthalate and dioctyl phthalate are available, the usage of which is controlled to be equal to or less than 20% by weight, preferably equal to or less than 10% by weight of the total solid content of coating liquid. Also, as the leveling agent, silicone oils such as dimethylsilicone oil and methylphenylsilicone oil and a polymer or oligomer having a perfluoroalkyl group in a side chain thereof can be used, the usage of which is appropriately equal to or less than 3% by weight of the total solid content of coating liquid.

A crosslinked-type charge transportation layer in the present invention is formed by applying and curing on the aforementioned photoconductive layer or charge transportation layer coating liquid that contains, at least, the aforementioned three-or-more-functional radical-polymerizable monomer having no charge transporting structure and the aforementioned one-functional radical-polymerizable compound having a charge transporting structure. When the radical-polymerizable monomer is liquid, another component is dissolved in such coating liquid and it can be applied but is diluted with a solvent according to need and applied.

As a solvent used at this time, alcohols such as methanol, ethanol, propanol, and butanol, ketones such as acetone, ethyl methyl ketone, isobutyl methyl ketone, and cyclohexanone, esters such as ethyl acetate and butyl acetate, ethers such as tetrahydrofuran, dioxane, propylether, halogenics such as dichloromethane, dichloroethane, trichloroethane, and chlorobenzene, aromatics such as benzene, toluene, and xylene, and cellosolves such as methylcellosolve, ethylcellosolve, and cellosolve acetate, etc., can be provided. These solvents are used singularly or two or more kinds thereof may be mixed and used. The rate of dilution with the solvent depends on the solubility of the composition, a coating method, and objective film thickness and is arbitrary. The coating can be performed by a dip coating method, a spray coat method, a bead coat method, a ring coat method, or the like.

In the present invention, coating liquid for the formation of crosslinked-type charge transportation layer is applied and, subsequently, cured by applying external energy so as to form a crosslinked-type charge transportation layer, and, as the external energy used at this time, heat, light, and radiation rays are provided.

As a method of applying heat energy, heating is performed from the side of a coated surface or the side of the support by using gas such as air and nitrogen, vapor, each kind of thermal medium, infrared rays, or electromagnetic waves. The heating temperature is preferably equal to or greater than 100° C. and equal to or less than 170° C., and if it is less than 100° C., the reaction rate is low so that curing reaction does not perfectly complete. At a temperature greater than 170° C., the curing reaction promotes inhomogeneously, so that large distortion or a large number of unreacted residues or reaction termination terminals is generated in the crosslinked-type charge transportation layer. In order to promote the curing reaction homogeneously, a method of heating at a comparatively low temperature less than 100° C. and subsequently heating up to 100° C. or greater so as to complete the reaction is also useful.

As the light energy, an UV irradiation light source such as a high-pressure mercury-vapor lamp and a metal halide lamp which have emission wavelength mainly in a ultraviolet light region can be used, but the selection of a visible light source is allowed in accordance with the absorption wavelength of a radical-polymerizable content or a photo-polymerization initiator. The quantity of irradiation light is preferably equal to or greater than 50 $mW/cm^2$ and equal to or less than 1,000 $mW/cm^2$, and if it is less than 50 $mW/cm^2$, it takes a long time for the curing reaction. If it is greater than 1,000 $mW/cm^2$, the reaction promotes inhomogeneously, so that local wrinkle generates on a surface of the crosslinked-type charge transportation layer or a large number of unreacted residues or reaction termination terminals generate. Also, the internal stress becomes high due to rapid crosslinking so as to cause a crack or a film peeling. As the energy of radiation rays, the use of an electron beam can be provided. Among these energies, it is useful to use the thermal or light energy because of the easiness of reaction rate control and the simplicity of an apparatus. Also, when the curing of a crosslinked-type charge transportation layer is carried out by heating or light energy irradiation means, the curing reaction sufficiently proceeds and the high wear resistance can be maintained for the long term, which is effective to the attainment of high durability and high stability.

The film thickness of a crosslinked-type charge transportation layer in the present invention is preferably equal to or greater than 1 μm and equal to or less than 10 μm, more preferably equal to or greater than 2 μm and equal to or less than 8 μm. If it is greater than 10 μm, a crack or film peeling is easy to occur as mentioned above, and if it is equal to or less than 8 μm, since the degree of allowance thereof is further improved, the crosslink density can increase and, further, the material selection or curing condition setting for increasing the wear resistance is allowed. On the other hand, the radical polymerization reaction is easily inhibited by oxygen, that is, the crosslinking tends not to proceed or is easily inhomogeneous on a surface contacting the atmosphere due to the influence of radical trapping by oxygen. This influence significantly appears in the case of a surface layer less than 1 μm, and in the crosslinked-type charge transportation layer equal to or less than this film thickness, the deterioration of wear resistance or inhomogeneous wearing is easy to occur. Also, the mixing of a charge transportation layer component of an underlying layer occurs at the time of coating a crosslinked-type charge transportation layer. If the film thickness of a coated crosslinked-type charge transportation layer is small, the mixing substance spreads over the whole layer so as to cause the inhibition of curing reaction or the reduction of crosslink density. Because of these reasons, the crosslinked-type charge transportation layer with a film thickness equal to or greater than 1 μm in the present invention has a good wear resistance and damage resistance, but if a portion locally eliminated to an underlying charge transportation layer is produced in repeated use, the wear at the portion increases and the concentration nonuniformity of a halftone image resulting from the variation of a charging property or sensitivity is easy to occur. Therefore, it is desired that the film thickness of the crosslinked-type charge transportation layer is equal to or greater than 2 μm in order to attain longer lifetime and high quality image.

In the configuration of an electrophotographic photoconductor according to the present invention such that a charge generation layer, a charge transportation layer, and a crosslinked-type charge transportation layer are stacked in order, it is characterized that when the crosslinked-type charge transportation layer with the top surface is insoluble to an organic solvent, a drastic wear resistance and damage resistance is attained. As a method of testing this solubility to an organic solvent, a judgment is made by dropping a drop of an organic solvent with a high dissolving property to a polymeric material on a surface of the photoconductor, for example, tetrahydrofuran, dichloromethane, etc., and observing a change in the shape of the photoconductor surface after air-drying by a stereoscopic microscope. In a photoconductor with high solubility, a change such as a phenomenon of being concave at a central portion of the liquid drop and, on the contrary, being raised at a periphery thereof, a phenomenon such that a charge transportation material precipitates to generate white turbidity or clouding due to the crystallization, a phenomenon such that the surface swells and, subsequently, contracts so as to generate wrinkle is found. In contrast, the phenomena as mentioned above are not found and no change to before the dropping appears in an insoluble photoconductor.

In the configuration according to the present invention, in order to make the crosslinked-type charge transportation layer be insoluble to an organic solvent, it is important to control (1) the adjustment of a coating liquid composition for crosslinked-type charge transportation layer and a content ratio therein, (2) the adjustment of dilution solvent and solid content concentration of coating liquid for crosslinked-type charge transportation layer, (3) the selection of a method of coating a crosslinked-type charge transportation layer, (4) the control of curing conditions for a crosslinked-type charge transportation layer, (5) making an underlying charge transportation layer be difficult to dissolve, etc., but it is not attained by one factor thereof.

As the coating liquid composition for crosslinked-type charge transportation layer, when a large amount of an additive such as a binder resin having no radical-polymerizable functional group, an antioxidant, and a plasticizer is contained beside the aforementioned three-or-more-functional radical-polymerizable monomer having no charge transporting structure and one-functional radical-polymerizable compound having a charge transporting structure, the reduction of crosslink density and phase separation of a cured substance produced by the reaction and the aforementioned additive occur and a tendency to be soluble to an organic solvent is high. Specifically, it is important to control the total content thereof to the total solid content in the coating liquid to be equal to or less than 20% by weight. Also, in order not to make the crosslink density be low, it is desired that the total content of a one-functional or two-functional radical-polymerizable monomer, a reactive oligomer, and a reactive polymer is also equal to or less than 20% by weight of the three functional radical-polymerizable monomer.

Furthermore, when a large amount of a two or more functional radical-polymerizable compound having a charge transporting structure is contained, since a bulky structure is fixed in a crosslink structure via plural bonds thereof, the distortion is easy to occur and it easily becomes an aggregate of fine cured substances. It may become soluble to an organic solvent because of this cause. The content of a two or more functional radical-polymerizable compound having a charge transporting structure is preferably equal to or less than 10% by weight of the one-functional radical-polymerizable compound having a charge transporting structure, although it depends on the structure of the compound.

In regard to a dilution solvent for coating liquid for crosslinked-type charge transportation layer, when a solvent with a slow evaporation rate is used, the remaining solvent may inhibit the curing or the mixing quantity of an underlying layer component may increase, so as to cause inhomogeneous curing or the reduction of curing density. Therefore, it tends to be soluble to an organic solvent. Specifically, tetrahydrofuran, a mixed solvent of tetrahydrofuran and methanol, ethyl acetate, ethyl methyl ketone, ethylcellosolve, etc., are useful and selected in accordance with a coating method.

Also, in regard to the concentration of a solid content, if it is too low because of a similar reason, it tends to be soluble to an organic solvent. On the contrary, the upper limit of the concentration is confined based on the confinement of the film thickness and the viscosity of coating liquid. Specifically, it is desirable to use in a range of 10 through 50% by weight. As a coating method for a crosslinked-type charge transportation layer, because of a similar reason, an approach of reducing the content of solvent at the time of coated film formation and a time period of contacting a solvent is preferable and, specifically, a spray coat method and a ring coat in which the amount of coating liquid is confined are preferable. In order to suppress the mixing quantity of an underlying layer component, it is also effective to use a polymeric charge transportation material for a charge transportation layer and to provide an intermediate layer that is insoluble to a coating solvent for a crosslinked-type charge transportation layer.

Additionally, if a polymeric charge transportation material is contained in a photoconductive layer, the inhibition of crosslinking can be eliminated which is caused by penetrating a charge transportation material contained in the photoconductive layer into a crosslinked-type charge transportation layer when the crosslinked-type charge transportation layer is formed on the photoconductive layer (in the case of a stacked-layer type, a charge transportation layer), and which is effective to the attainment of high durability and the stabilization of image quality.

In regard to a curing conditions for a crosslinked-type charge transportation layer, when heating or light irradiation energy is low, the curing is not perfectly complete and the solubility to an organic solvent is raised. On the contrary, when curing is made by very high energy, the curing reaction is inhomogeneous, so that a non-crosslinking portion and a radical termination portion tend to increase and an aggregate of fine cured substances is easily generated. Therefore, it may be soluble to an organic solvent. In order to be inactive to an organic solvent, as thermal curing conditions, 100 through 170° C. and 10 minutes through 3 hours are preferable, and as the conditions of curing with UV light irradiation, 50 through 1,000 mW/cm$^2$, 5 seconds through 5 minutes, and controlling the temperature rise to be equal to or less than 50° C. so as to suppress inhomogeneous curing reaction are desirable.

As exemplifying a method for making a crosslinked-type charge transportation layer constituting an electrophotographic photoconductor according to the present invention be insoluble to an organic solvent, for example, when an acrylate monomer having three acryloyloxy groups and a triarylamine compound having one acryloyloxy group are used for coating liquid, the usage of them is 7:3 through 3:7, and coating liquid is prepared by adding 3 through 20% by weight of a ploymerization initiator to the total amount of these acrylate compounds and further adding a solvent. For example, in a charge transportation layer as an underlying layer of the crosslinked-type charge transportation layer, when a triarylamine-type donor as a charge transportation material and a polycarbonate as a binder resin are used and a surface layer is formed by spray coating, tetrahydrofuran, 2-butanone, ethyl acetate, etc., are preferable as a solvent for the aforementioned coating liquid and the usage thereof is 3 times through 10 times quantity of the total amount of the acrylate compounds.

Next, the prepared coating liquid mentioned above is applied, by means of spray, etc., on a photoconductor for which an underlying layer, a charge generation layer, and the aforementioned charge transportation layer are stacked on a support such as an aluminum cylinder in order. Subsequently, curing is made by performing air-drying or drying at comparatively low temperature for a short time (25 through 80° C., 1 through 10 minutes) and UV irradiation or heating.

In the case of UV irradiation, a metal halide lamp, etc., is used, wherein the illuminance equal to or greater than 50 mW/cm$^2$ and equal to or less than 1,000 mW/cm$^2$, time period of approximately 5 seconds through 5 minutes are preferable and drum temperature is controlled not to exceed 50° C.

In the case of thermal curing, heating temperature is preferable 100 through 170° C., and when, for example, an air-blowing type oven is used as heating means and heating temperature is set at 150° C., heating time is 20 minutes through 3 hours.

After curing is completed, further heating for the reduction of remaining solvent at 100 through 150° C. for 10 minutes through 30 minutes is made so as to obtain a photoconductor according to the present invention.

In the present invention, an antioxidant can be added into each layer such as a crosslinked-type charge transportation layer, a charge transportation layer, a charge generation layer, an underlying layer, and an intermediate layer, for the improvement of an environmental resistance and, inter alia, for the purpose of preventing the degradation of photosensitivity and the elevation of a residual electric potential.

As the antioxidant that can be used for the present invention, the following ones can be provided.

(Phenol-based Compounds)

2,6-di-t-butyl-p-crezol, butylated hydroxyanisole, 2,6-di-t-butyl-4-ethylphenol, stearyl β-(3,5-di-t-butyl-4-hydroxyphenyl)propionate, 2,2'-methylene-bis(4-methyl-6-t-butylphenol), 2,2'-methylene-bis(4-ethyl-6-t-butylphenol), 4,4'-thiobis(3-methyl-6-t-butylphenol), 4,4'-butylidene-bis(3-methyl-6-t-butylphenol), 1,1,3-tris(2-methyl-4-hydroxy-5-t-butylphenyl)butane, 1,3,5-trimethyl-2,4,6-tris(3,5-di-t-butyl-4-hydroxybenzyl)benzene, tetrakis[methylene-3-(3',5'-di-t-butyl-4'-hydroxyphenyl)propionate]methane, bis[3,3'-bis(4'-hydroxy-3'-t-butylphenyl)butyric acid] glycol ester, tocopherols, etc.

(Paraphenylenediamines)

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, etc.

(Hydroquinones)

2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, etc.

(Organic Sulfur Compounds)

dilauryl 3,3'-thiodipropionate, distearyl 3,3'-thiodipropionate, ditetradecyl 3,3'-thiodipropionate, etc.

(Organic Phosphorus Compounds)

triphenylphosphine, tri(nonylphenyl)phosphine, tri(dinonylphenyl)phosphine, tricresylphosphine, tri(2,4-dibutylphenoxy)phosphine, etc.

These compounds are known as antioxidants for rubbers, plastics, fats and fatty oils, etc., and a commercially available product thereof can be easily obtained. The content of an antioxidant in the present invention is 0.01 through 10% by weight of the total weight of a layer to which it is added.

Next, an image formation apparatus according to the present invention is illustrated in detail using the drawings.

Figure 11:
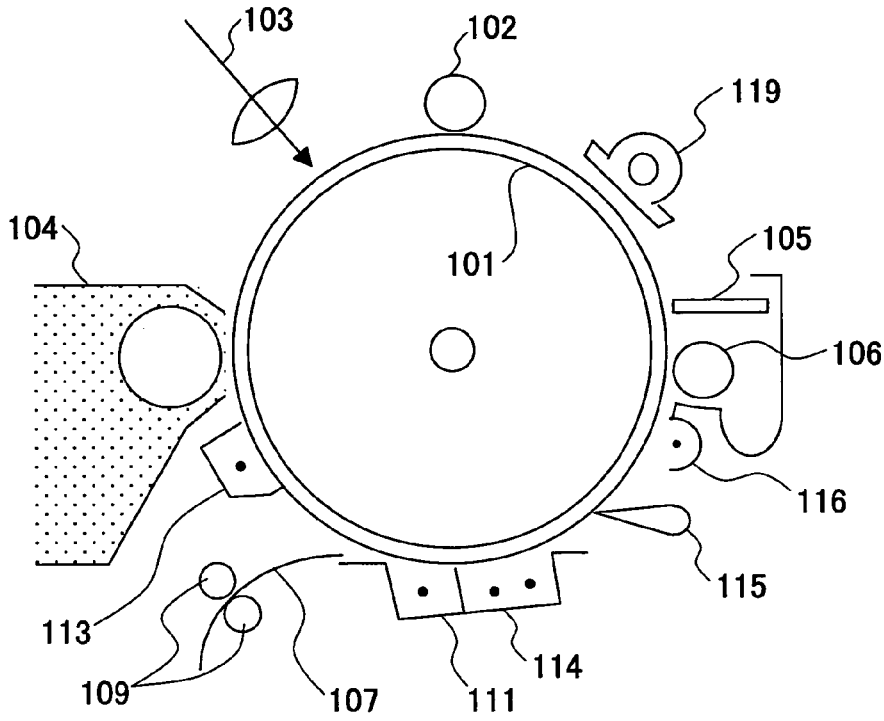
FIG. 11 is an explanatory drawing of an image formation process and image formation apparatus according to the present invention.

FIG. 11 is a schematic diagram illustrating an image formation process and image formation apparatus according to the present invention and variations described below are encompassed in the scope of the present invention.

In FIG. 11, a photoconductor 101 has at least two underlying layers being a layer containing no inorganic pigment and a layer containing an inorganic pigment on an electrically conductive support and a photoconductive layer and a particular crosslinked-type charge transportation layer are stacked. The photoconductive layer contains a titanyl phthalocyanine crystal which, at least, has a maximum diffraction peak at 27.2°, further has main peaks at 9.4°, 9.6°, and 24.0°, has a peak at 7.3° as a diffraction peak at a smallest angle side, has no peak between the peak at 7.3° and the peak at 9.4°, and, further, has no peak at 26.3°, in regard to a diffraction peak (±0.2°) at a Bragg angle 2θ of CuKα line (wavelength of 1.542 Å), and in which an average primary particle size is equal to or less than 0.25 μm. The crosslinked-type charge transportation layer is formed by curing, at least, a three-or-more-functional radical-polymerizable monomer having no charge transporting structure and a one-functional radical-polymerizable compound having a charge transporting structure. Thereby, the generation of background contamination originating from a photoconductor is almost completely suppressed and an image formation method that can attain ultra-high durability is provided. Also, a side effect such as the elevation of an electric potential at a light-exposed portion and an environmental dependence is reduced and the drastic improvement of a background contamination resistance is realized, so that an image formation apparatus that can provide stably high quality for the long term can be obtained. Further, in a tandem-type image formation apparatus that superposes toner images with at least four colors, a particularly great advantage can be obtained with respect to the miniaturization of the apparatus and a printing speed by using a photoconductor according to the present invention having high sensitivity, high stability, and high durability.

Additionally, when the linear speed of the photoconductor at the time of image formation is equal to or greater than 300 mm/sec, since it has high sensitivity and, simultaneously, the suppression of background contamination is realized even in repeated use for the long term so as to be able to attain high durability and to stabilize image quality, the exchange frequency of the photoconductor is greatly reduced even though it is used in a high-speed image formation apparatus, and a particular great advantage is obtained.

The photoconductor 101 shows a drum-like shape but may be a sheet-shaped one or an endless belt-shaped one. For a charging roller 102, a pre-transcription charger 113, a transcription charger 111, a separation charger 114, and a pre-cleaning charger 116, publicly known means such as a corotron, a scorotron, a solid charging device (solid state charger), a charging roller, and a transcription roller are used.

Figure 12:
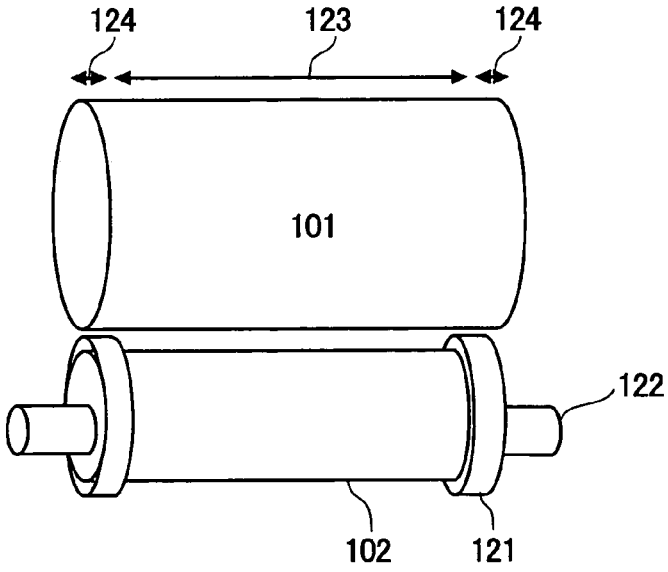
FIG. 12 is an explanatory drawing of an example in which a photoconductor and a charging member are in accordance with a proximate arrangement manner.

As a charging method, a corona discharge method represented by a conventionally publicly known scorotron, a contact charging method in which a charging roller or a charging brush contacts a photoconductor, and a proximate arrangement method in which a photoconductor and a charging member have a air space (gap) equal to or less than 200 82 m, preferably equal to or less than 100 μm in an image formation area (see FIG. 12) are preferably used. In FIG. 12, 121 is a gap formation member, 122 is a metal shaft, 123 is an image formation area, and 124 is a non-image formation area. If this air gap is too large, charging tends to be unstable, and if it is too small, when remaining toner exists in the photoconductor 101, there is a possibility of contaminating a surface of the charging member 102. Therefore, the air gap is in a range of 10 through 200 μm, preferably 30 through 100 μm.

Such a charging method has a disadvantage of causing electric breakdown of a photoconductor since high voltage is applied, but, since a photoconductor used for the present invention has plural underlying layers and, further, the photoconductive layer contains no crude large particle of a charge generation material, the voltage resistance of the photoconductor is extremely high. Therefore, the resistance to the electric breakdown of the photoconductor is high, so that image quality deterioration caused by the electric breakdown is suppressed and the attainment of longer lifetime of the photoconductor is realized. Also, at the time of voltage application, an alternating voltage can be superposed on a direct voltage. In this case, it is possible to reduce charging nonuniformity, which is effective to the reduction of background contamination.

Although charging is applied to a photoconductor by such a charging member, since background contamination originating from a photoconductor easily occurs in a normal image formation apparatus, the strength of electric field applied to a photoconductor is set to be lower (equal to or less than 40 V/μm, preferably equal to or less than 30 V/μm). This is because the generation of background contamination depends on the strength of electric field and when the strength of electric field rises, the probability of the generation of background contamination rises. However, the reduction of the strength of electric field applied to the photoconductor reduces the efficiency of light carrier generation and reduces the photosensitivity. Also, since the strength of electric field applied between a photoconductor surface and an electrically conductive support is reduced, the translatory property of light carrier produced in the photoconductive layer is reduced and the diffusion due to Coulomb repulsion becomes high, thereby resulting in the deterioration of resolution. On the other hand, since the probability of generating background contamination can be extremely reduced by using an electrophotographic photoconductor according to the present invention, it is not necessary to reduce the strength of electric field needlessly and it can be used under electric field strength equal to or greater than 40 V/μm. Therefore, the amount of gain in optical extinction of the photoconductor can be sufficiently gotten, a large allowance can be yielded to a phenomenon (potential) described below, and development can be performed without reducing the resolution.

An image-wise light exposure part 103 is used in order to form an electrostatic latent image on a uniformly charged photoconductor 1. For the image-wise light exposure part 103, a light source that can get high luminance, such as a light-emitting diode (LED), semiconductor laser (LD), and electroluminescence (EL), is used.

For a light source for a charge elimination lamp 119, etc., general light emitters such as a fluorescent lamp, a tungsten lamp, a halogen lamp, a mercury vapor lamp, a sodium vapor lamp, a light-emitting diode (LED), semiconductor laser (LD), and electroluminescence (EL) can be used. Then, in order to make irradiation with only light of a desired wavelength region, each kind of filter such as a sharp cut filter, a bandpass filter, a near-infrared cut filter, a dichroic filter, an interference filter, and a color conversion filter can be also used. Among these light sources, the light emitting diode and the semiconductor laser is used well since the irradiation energy thereof is high and light of a long wavelength as 600 through 800 nm is possessed, whereby a phthalocyanine pigment as the aforementioned charge generation material shows high sensitivity. Such a light source, etc., is provided in a process such as a transcription process, a charge elimination process, a cleaning process, and pre-light exposure, in which light irradiation is used in combination, as well as in a process indicated in FIG. 11, ao that a photoconductor is irradiated with the light.

Next, a development unit 104 is used for visualizing an electrostatic latent image formed on the photoconductor 101. As a development method, a one-component development method and a two-component development method, which use dry-type toner, and a wet-process development method, which uses wet-type toner, can be provided. When positive (negative) charging is applied on an electrophotographic photoconductor and image-wise light exposure is performed, a positive (negative) electrostatic latent image is formed on a surface of the photoconductor. When this is developed with negatively (positively) polar toner (charge detecting fine particles), a positive image can be obtained, and, when it is developed with positively (negatively) polar toner, a negative image can be obtained. For such development means, a publicly known method is applied and for charge elimination means, a publicly known method is used.

Next, a transcription charger 111 is used for transcribing a toner image visualized on the photoconductor to a medium subjected to transcription 107 such as a transcription paper and a recording paper of which the conveyance is once stopped by resistive rollers 109. Also, a pre-transcription charger 113 may be used in order to perform the transcription well. As these transcription means, electrostatic transcription means using a transcription charger and a bias roller, mechanical transcription means such as an adhesion transcription method and a pressure transcription method, and magnetic transcription means are available. As the electrostatic transcription means, the aforementioned charging means are available.

Next, as means for separating the medium subjected to transcription 107 from the photoconductor 101, a separation charger 114 and a separation claw 115 are used. As other separation means, an electrostatic adsorption induced separation, side end belt separation, a tip grip conveyance, and curvature separation, etc., are used. As the separation charger 114, the aforementioned charging means are available.

Although toner developed on the photoconductor 101 by the development unit 104 is transcribed on the medium subjected to transcription 107, not all of it is transcribed but toner remaining on the photoconductor 101 is yielded. Next, a fur brush 106 and a cleaning blade 105 are used for cleaning the photoconductor on which the toner remains after the transcription. Such toner is removed from the photoconductor by the fur brush 106 and the cleaning blade 105. Cleaning may be performed by only a cleaning brush and, for the cleaning brush, a publicly known one such as a fur brush and a mag-fur brush is used. Also, a pre-cleaning charger 116 may be used in order to perform cleaning more efficiently. As other cleaning means, web-means and a magnetic brush means etc., are provided, and a single mean may be used or plural means may be used together.

Next, charge elimination means are used for the purpose of eliminating a latent image on the photoconductor according to need. As the charge elimination means, a charge elimination lamp 119 and a charge elimination charger are used, and the aforementioned light source for light exposure and the aforementioned charging means can be used, correspondingly.

Otherwise, for a process such as original copy reading, paper feeding, fixing, and paper delivering, which is not adjacent to the photoconductor, a publicly known one can be used.

The electrophotographic process illustrated in the above figure exemplifies an embodiment of the present invention and, of course, other embodiments are allowed.

Figure 13:
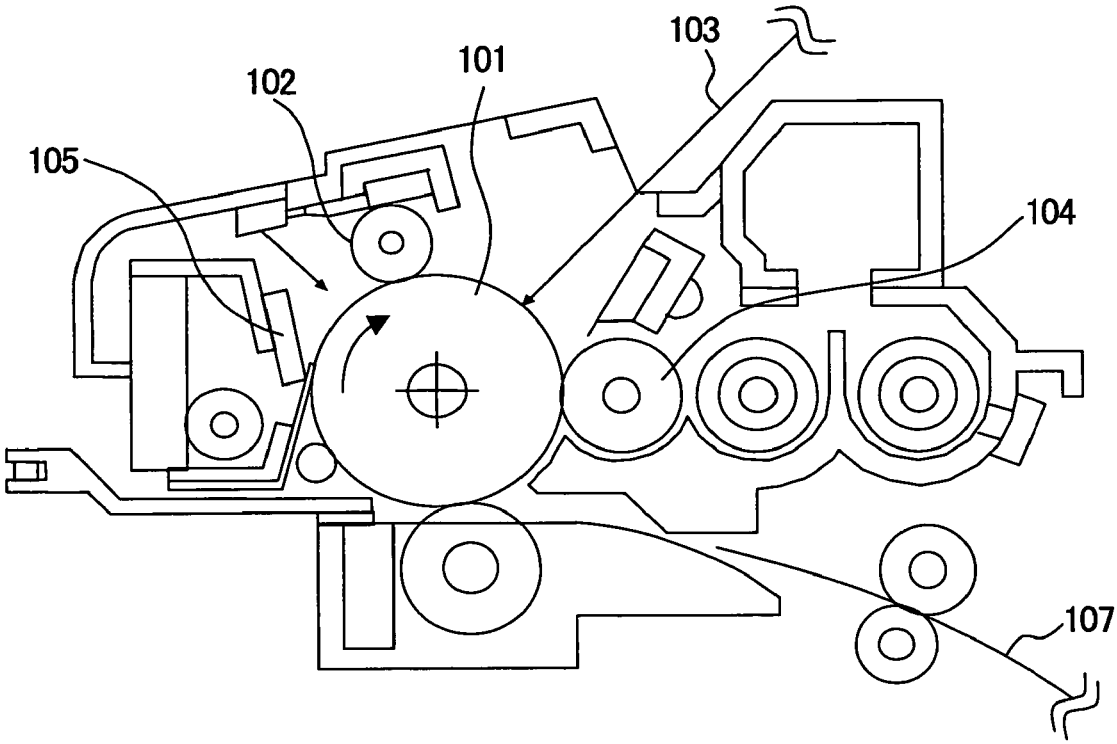
FIG. 13 is an explanatory drawing of one example of a process cartridge according to the present invention.

The image formation means as described above may be fixedly incorporated in a copying machine, a facsimile, or a printer, but may be incorporated in these apparatuses in the form of a process cartridge. A process cartridge is one device (component) that incorporates a photoconductor and, further, includes charging means, light-exposure means, development means, cleaning means, charge elimination means, etc. Although a number of the shapes of a process cartridge, etc., as a general example, one shown in FIG. 13 is provided. The photoconductor 101 is configured by stacking, at least, plural underlying layers, a photoconductive layer, and a particular crosslinked-type charge transportation layer on an electrically conductive support. The photoconductive layer contains a titanyl phthalocyanine crystal which, at least, has a maximum diffraction peak at 27.2°, further, has main peaks at 9.4°, 9.6°, and 24.0°, has a peak at 7.3° as a diffraction peak at a smallest angle side, has no peak between the peak at 7.3° and the peak at 9.4°, and further has no peak at 26.3°, in regard to a diffraction peak (±0.2°) at a Bragg angle 2θ of CuKα line (wavelength of 1.542 Å) and in which an average primary particle size is equal to or less than 0.25 μm. The crosslinked-type charge transportation layer is formed by curing, at least, a three-or-more-functional radical-polymerizable monomer having no charge transporting structure and a one-functional radical-polymerizable compound having a charge transporting structure.

Thus, since a photoconductor having high durability is used, long lifetime can be also attained for a process cartridge for image formation apparatus so as to e able to contribute to resource saving. Also, when a photoconductor and its surrounding in which a trouble occurs most easily in the use of an image formation apparatus for the long term are made be a process cartridge, only the part can be easily exchanged, which, therefore, contributes to resource saving in regard to the whole of an image formation apparatus and, simultaneously, easily contributes to the attainment of long lifetime.

Furthermore, even though a photoconductor having high durability is used, the improvement of the stability of image quality cannot be realized if the lifetime of each kind of member around a photoconductor is short, but the exchange or maintenance of them is facilitated by making a process cartridge, so that further longer lifetime for an image formation apparatus is realized.

Figure 14:
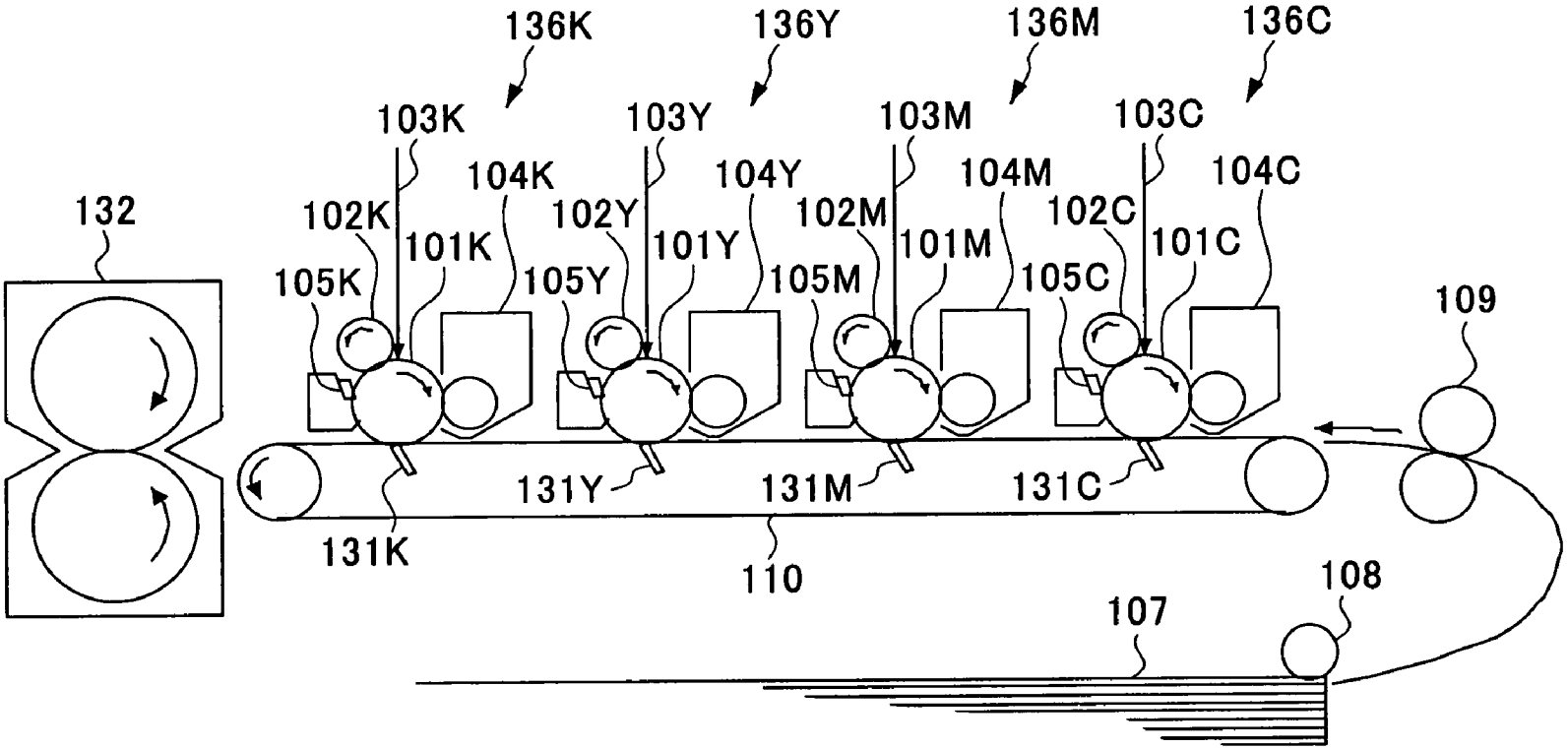
FIG. 14 is an explanatory drawing of a tandem-type full-color electrophotographic apparatus according to the present invention.

FIG. 14 is a schematic diagram of illustrating a tandem-type full-color electrophotographic apparatus according to the present invention and variations as mentioned below is encompassed in the scope of the present invention. In FIG. 14, reference numerals 101C, 101M, 101Y, 101K indicate drum-shaped photoconductors, at least, plural underlying layers are formed on an electrically conductive support of each photoconductor, a photoconductive layer contains a titanyl phthalocyanine crystal which, at least, has a maximum diffraction peak at 27.2°, further, has main peaks at 9.4°, 9.6°, and 24.0°, has a peak at 7.3° as a diffraction peak at a smallest angle side, has no peak between the peak at 7.3° and the peak at 9.4°, and further has no peak at 26.3°, in regard to a diffraction peak (±0.2°) at a Bragg angle 2θ of CuKα line (wavelength of 1.542 Å) and in which an average primary particle size is equal to or less than 0.25 μm, and a crosslinked-type charge transportation layer is formed by curing, at least, a three-or-more-functional radical-polymerizable monomer having no charge transporting structure and a one-functional radical-polymerizable compound having a charge transporting structure.

These photoconductors 101C, 101M, 101Y, 101K rotate along directions denoted by arrows in the figure and around them, at least, charging members 102C, 102M, 102Y, 102K, development members 104C, 104M, 104Y, 104K, and cleaning members 105C, 105M, 105Y, 105K are arranged in the order of the rotation. The charging members 102C, 102M, 102Y, 102K are charging members that constitute a charging device for uniformly charging a photoconductor surface. From the outside of the photoconductor between the charging member 102C, 102M, 102Y, 102K and the development member 104C, 104M, 104Y, 104K, laser light 103C, 103M, 103Y, 103K from light exposure members not shown in the figure irradiate so as to form electrostatic latent images on the photoconductors 101C, 101M, 101Y, 101K. A transcription conveyance belt 110 directly contacts the photoconductors 101C, 101M, 101Y, 101K between the development member 104C, 104M, 104Y, 104K and cleaning member 105C, 105M, 105Y, 105K in each of image formation units 136C, 136M, 136Y, 136K, and transcription bias application members 131C, 131M, 131Y, 131K such as a transcription brush for applying a transcription bias are arranged on a surface (reverse surface) at the reverse side of the transcription conveyance belt 110 at the side of the photoconductors. In the respective image formation units 136C, 136M, 136Y, 136K, the colors of toner inside the development devices are different and, all the structures except them are similar.

In a color electrophotograhic apparatus with a configuration shown in FIG. 14, the operation for image formation is carried out as follows. First, in each of image formation unit 136C, 136M, 136Y, 136K, the photoconductors 101C, 101M, 101Y, 101K are charged by charging members 102C, 102M, 102Y, 102K that rotate along the arrow directions (directions of co-rotating with the photoconductor), and then, electrostatic latent images corresponding to created images with the respective colors are formed by means of laser light 103C, 103M, 103Y, 103K from light exposure parts (not shown in the figure) arranged outside the photoconductors.

Next, toner images are formed by developing the latent images by the development members 104C, 104M, 104Y, 104K. The development members 104C, 104M, 104Y, 104K are development members for performing development with C (cyan), M (magenta), Y (yellow), and K (black) toners, respectively, and the toner images with the respective colors created on the four photoconductors 101C, 101M, 101Y, 101K are superposed on the medium subjected to transcription 107. The medium subjected to transcription 107 is fed from a tray by a paper feeding control roller 108, once stopped by a pair of resistive roller 109, and sent to the transcription conveyance belt 110 in timing with image formation on the aforementioned photoconductors. The medium subjected to transcription 107 supported on the transcription conveyance belt 110 is conveyed, and the transcription of the toner images with the respective colors is performed at the direct contact positions (transcription portion) with respective photoconductors 101C, 101M, 101Y, 101K.

The toner images on the photoconductors are transcribed on the medium subjected to transcription 107 due to electric field resulting from the electric potential difference between a transcription bias applied to the transcription bias application member 131C, 131M, 131Y, 131K and the photoconductor 101C, 101M, 101, 101K. Then, the medium subjected to transcription 107 on which the four color toner images are superposed by passing through four transcription portions is conveyed to a fixation device 132, in which the toner is fixed, and ejected to a paper ejection part not shown in the figure. Also, remaining toner that remains on the respective photoconductors 101C, 101M, 101Y, 101K without being transcribed at the transcription portions is recovered by the cleaning devices 105C, 105M, 105Y, 105K.

Additionally, in an example of FIG. 12, although image formation elements are arranged in the order of C (cyan), M (magenta), Y (yellow) and K (black) from the upstream side of the conveyance directions of the medium subjected to transcription to the downstream side thereof, it is not limited to this order and the order of colors is set arbitrarily. Also, when an only black original copy is created, to provide a mechanism for stopping the image formation elements (136C, 136M, 136Y) except a black color one is particularly effectively utilized in the present invention. Further, although the charging member directly contacts the photoconductor in FIG. 14, the abrasion loss of both of them can be reduced and toner filming to the charging member is little by providing a charging mechanism as shown in FIG. 12 and providing a proper gap (approximately 100 through 200 μm) between both of them, which can be used well.

The image formation means as mentioned above, may be fixedly incorporated in a copying machine, a facsimile, or a printer, but the respective electrophotographic elements may be incorporated in these apparatuses in the form of a process cartridge. A process cartridge is one device (component) that incorporates a photoconductor and, further, includes charging means, light-exposure means, development means, cleaning means, charge elimination means, etc.

EXAMPLES

The present invention is explained by providing examples below, but the present invention is not limited to the examples. Additionally, all "part(s)" is/are part(s) by weight.

First, a synthesis example of a one-functional compound having a charge transporting structure used for the present invention is described.

Synthesis Example of One-functional Compound having a Charge Transporting Structure A one-functional compound having a charge transporting structure in the present invention is synthesized by a method described in, for example, Japanese Patent No. 3164426. Also, one example of it is described below.

(1) The synthesis of a hydroxyl-group-substituted triarylamine compound (represented by the following structural formula B)

240 parts of sulfolane were added into 113.85 parts (0.3 mol) of a methoxy-group-substituted triarylamine compound (represented by the following structural formula A) and 138 parts (0.92 mol) of sodium iodide and heating to 60° C. was performed in nitrogen gas stream. 99 parts (0.91 mol) of chlorotrimethylsilane were dropped into the liquid for 1 hour and stirring for 4 and half hours was performed at the temperature of approximately 60° C. so as to complete the reaction. Approximately 1500 parts of toluene were added into the reaction liquid, which was cooled to the room temperature and washed with water or an aqueous solution of sodium carbonate repeatedly. Then, solvent was removed from the toluene solution and the purification by a column chromatographic treatment (adhesion medium; silica gel, developing solvent; toluene:ethyl acetate=20:1) was carried out. Cyclohexane was added into obtained pale-yellow oil so as to precipitate a crystal. Thus, 88.1 parts (yield=80.4%) of a white crystal of the following structural formula B were obtained. The melting point thereof was 64.0 through 66.0° C.

Also, the values of elemental analysis thereof are shown in Table 1 described below.

Structural formula A

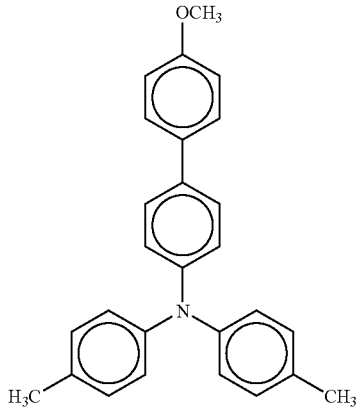

Structural formula B

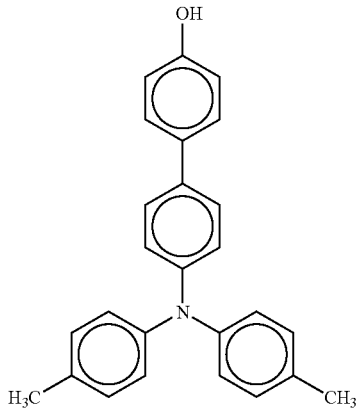

TABLE 1

| | Values of elemental analysis (%) | | |
|---|---|---|---|
| | C | H | N |
| Found value | 85.06 | 6.41 | 3.73 |
| Calculated value | 85.44 | 6.34 | 3.83 |

(2) Triarylamino-group-substituted acrylate compound (illustrated compound No. 54 in Table 1)

82.9 parts (0.227 mol) of the hydroxyl-group-substituted triarylamine compound (structural formula B) obtained in (1) above were dissolved in 400 parts of tetrahydrofuran and an aqueous solution of sodium hydroxide (NaOH: 12.4 parts, water: 100 parts) was dropped in nitrogen gas stream. The solution was cooled to 5° C. and 25.2 parts (0.272 mol) of acryloyl chloride were dropped for 40 minutes. Then, stirring for 3 hours was performed at 5° C. to complete the reaction. Water was poured into the reaction liquid and extraction was performed with toluene. The extracted liquid was washed with an aqueous solution of sodium bicarbonate or water repeatedly. Then, solvent was removed from the toluene solution and the purification by a column chromatographic treatment (adhesion medium; silica gel, developing solvent; toluene) was carried out. n-hexane was added into obtained colorless oil so as to precipitate a crystal. Thus, 80.73 parts (yield=84.8%) of a white crystal of illustrated compound No. 54 was obtained.

The melting point thereof was 117.5 through 119.0° C. The values of elemental analysis thereof are shown in Table 2 described below.

TABLE 2

| | Values of elemental analysis (%) | | |
|---|---|---|---|
| | C | H | N |
| Found value | 83.13 | 6.01 | 3.16 |
| Calculated value | 83.02 | 6.00 | 3.33 |

Next, a method of manufacturing an electrophotographic photoconductor is described.

Example 1

Coating liquid for underlying layer 1, coating liquid for underlying layer 2, coating liquid for charge generation layer, coating liquid for charge transportation layer, and coating liquid for crosslinked-type charge transportation layer which had the following compositions, were applied and dried on an aluminum cylinder with a diameter of 30 mm in order, so that an underlying layer 1 with 0.7 μm, an underlying layer 2 with 3.5 μm, a charge generation layer, a charge transportation layer with 19 μm, and a crosslinked-type charge transportation layer with 5.0 μm were stacked to manufacture an electrophotographic photoconductor. This is referred to as electrophotographic photoconductor 1. The applied film of the crosslinked-type charge transportation layer was cured by performing light irradiation on the conditions of a metal halide lamp: 160 W/cm, an irradiation intensity: 500 mW/cm$^2$, and irradiation time period: 60 seconds after air-drying for 20 minutes from spray coating. Herein, after the application of each layer, drying to the touch was performed and, subsequently, drying by heating was performed at 130° C. for the underlying layer 1, at 130° C. for the underlying layer 2, at 130° C. for the charge generation layer, at 130° C. for the charge transportation layer, and at 130° C. for the crosslinked-type charge transportation layer.

| (Coating liquid for underlying layer 1) | |
|---|---|
| N-methoxymethylated nylon (FR101 produced by Namariichi Co., Ltd.) | 5 parts |
| Methanol | 70 parts |
| n-butanol | 30 parts |

| (Coating liquid for underlying layer 2) | |
|---|---|
| Titanium oxide (CR-EL produced by Ishihara Sangyo Kaisha, Ltd., average primary particle diameter: approximately 0.25 μm) | 60 parts |
| Alkyd resin [Beckolite M6401-50-S (Solid content 50%), produced by Dainippon Ink and Chemicals, Incorporated] | 12 parts |
| Melamine resin [Superbeckamine L-145-60 (Solid content 60%) produced by Dainippon Ink and Chemicals, Incorporated] | 7 parts |
| 2-butanone | 70 parts |

The volume ratio of the inorganic pigment to the binder resins is approximately 2/1. Also, the weight ratio of the alkyd resin to the melamine resin is approximately 1.5/1.

| (Coating liquid for charge generation layer) | |
|---|---|
| Bisazo pigment of the following structural formula (I) | 2.5 parts |
| Polyvinyl butyral (XYHL produced by UCC) | 0.5 parts |
| Cyclohexanone | 200 parts |
| Ethyl methyl ketone | 80 parts |

-continued

Structural formula (I)

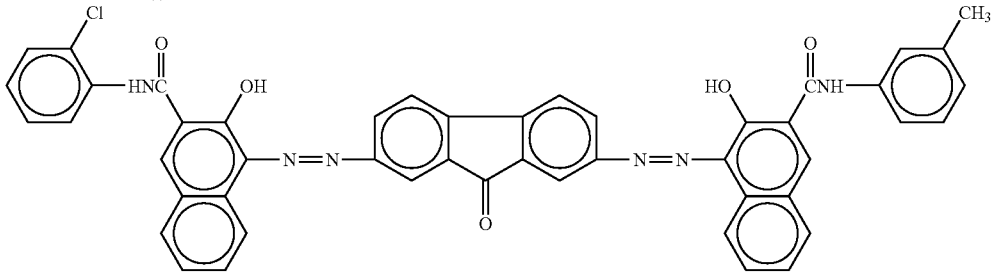

(Coating liquid for charge transportation layer)

| | |
|---|---|
| Polycarbonate (TS-2050 produced by Teijin Chemicals Ltd.) | 10 parts |
| Charge transportation material of the following structural formula | 7 parts |

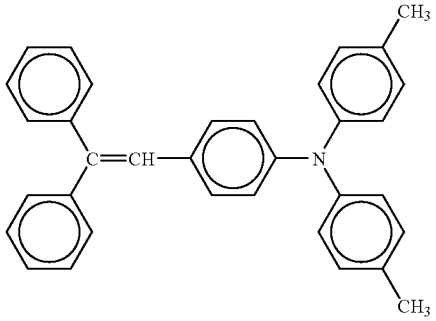

| | |
|---|---|
| Tetrahydrofuran | 100 parts |
| Tetrahydrofuran solution of silicone oil (KF50 (100 cs) produced by Shin-Etsu Chemical Co., Ltd.) | 0.2 parts |

(Coating liquid for crosslinked-type charge transportation layer)

| | |
|---|---|
| Three-or-more-functional radical-polymerizable monomer having no charge transporting structure (Trimethylolpropane triacrylate (KAYARAD TMPTA produced by Nippon Kayaku Co., Ltd.) Molecular weight: 296, Number of functional groups: 3 functionalities, Molecular weight/Number of functional groups = 99) | 10 parts |
| One-functional radical-polymerizable compound having a charge transporting structure (Illustrated compound No. 54) | 10 parts |
| Photo-polymerization initiator (1-hydroxycyclohexyl phenyl ketone (Irgacure 184 produced by Ciba Specialty Chemicals)) | 1 part |
| Tetrahydrofuran | 100 parts |

Example 2

An electrophotographic photoconductor 2 was manufactured similar to example 1 in all except that the coating liquid for underlying layer 2 was changed to coating liquid of the following composition in example 1.

| (Coating liquid for underlying layer 2) | |
|---|---|
| Titanium oxide (CR-EL produced by Ishihara Sangyo Kaisha, Ltd., average primary particle diameter: approximately 0.25 μm) | 80 parts |
| Alkyd resin [Beckolite M6401-50-S (Solid content 50%), produced by Dainippon Ink and Chemicals, Incorporated] | 14 parts |
| Melamine resin [Superbeckamine L-145-60 (Solid content 60%) produced by Dainippon Ink and Chemicals, Incorporated] | 6 parts |
| 2-butanone | 90 parts |

The volume ratio of the inorganic pigment to the binder resins is approximately 2.5/1. Also, the weight ratio of the alkyd resin to the melamine resin is approximately 2/1.

Example 3

An electrophotographic photoconductor 3 was manufactured similar to example 1 in all except that the film thickness of the underlying layer 1 was made be 0.4 μm in example 1.

Example 4

An electrophotographic photoconductor 4 was manufactured similar to example 1 in all except that the film thickness of the underlying layer 1 was made be 2.0 μm in example 1.

Example 5

An electrophotographic photoconductor 5 was manufactured similar to example 1 in all except that the coating liquid for underlying layer 2 was changed to the following composition and the film thickness thereof was made be 6 μm in example 1.

| (Coating liquid for underlying layer 2) | |
|---|---|
| Zinc oxide (SAZEX4000 produced by Sakai Chemical Industry Co., Ltd.) | 60 parts |
| Alkyd resin [Beckolite M6401-50-S (Solid content 50%), produced by Dainippon Ink and Chemicals, Incorporated] | 14 parts |
| Melamine resin [Superbeckamine L-121-60 (Solid content 60%) produced by Dainippon Ink and Chemicals, Incorporated] | 8 parts |
| 2-butanone | 90 parts |

The volume ratio of the inorganic pigment to the binder resins is approximately 1.3/1. Also, the weight ratio of the alkyd resin to the melamine resin is approximately 1.5/1.

Example 6

An electrophotographic photoconductor 6 was manufactured similar to example 5 in all except that an underlying layer 2 with a film thickness of 8 μm was formed on the electrically conductive support and an underlying layer 1 of 0.5 μm was stacked thereon in example 5.

Comparison 1

An electrophotographic photoconductor 7 was manufactured similar to example 1 in all except that the underlying layer 1 was not formed in example 1.

Comparison 2

An electrophotographic photoconductor 8 was manufactured similar to example 1 in all except that the underlying layer 2 was not formed in example 1.

Comparison 3

An electrophotographic photoconductor 9 was manufactured similar to example 1 in all except that neither the underlying layer 1 nor the underlying layer 2 was formed in example 1.

Comparison 4

An electrophotographic photoconductor 10 was manufactured similar to example 1 in all except that the coating liquid for underlying layer 2 was changed to the following composition in example 1.

| (Coating liquid for underlying layer 2) | |
|---|---|
| Alkyd resin [Beckolite M6401-50-S (Solid content 50%), produced by Dainippon Ink and Chemicals, Incorporated] | 14 parts |
| Melamine resin [Superbeckamine L-121-60 (Solid content 60%) produced by Dainippon Ink and Chemicals, Incorporated] | 8 parts |
| 2-butanone | 140 parts |

No inorganic pigment is added. The weight ratio of the alkyd resin to the melamine resin is approximately 1.5/1.

Example 7

An electrophotographic photoconductor 11 was manufactured similar to example 1 in all except that the coating liquid for underlying layer 1 was changed to the following composition in example 1.

| (Coating liquid for underlying layer 1) | |
|---|---|
| N-methoxymethylated nylon (FR101 produced by Namariichi Co., Ltd.) | 5 parts |
| Methanol solution of tartaric acid (Solid content 10%) | 3 parts |
| Methanol | 70 parts |
| n-butanol | 30 parts |

Example 8

An electrophotographic photoconductor 12 was manufactured similar to example 5 in all except that the coating liquid for underlying layer 1 was changed to the following composition in example 5.

| (Coating liquid for underlying layer 1) | |
|---|---|
| N-methoxymethylated nylon (FR101 produced by Namariichi Co., Ltd.) | 5 parts |
| Melamine resin [Superbeckamine L-145-60 (Solid content 60%) produced by Dainippon Ink and Chemicals, Incorporated] | 8 parts |
| Methanol solution of tartaric acid (Solid content 10%) | 5 parts |
| Methanol | 120 parts |
| n-butanol | 50 parts |

Example 9

An electrophotographic photoconductor 13 was manufactured similar to example 1 in all except that the coating liquid for underlying layer 1 was changed to the following composition in example 1.

| | |
|---|---|
| Copolymer nylon (Amilan CM8000 produced by Toray Industries, Inc.) | 5 parts |
| Methanol | 70 parts |
| n-butanol | 30 parts |

Example 10

An electrophotographic photoconductor 14 was manufactured similar to example 9 in all except that the film thickness of the underlying layer 1 was made be 0.4 μm in example 9.

Example 11

An electrophotographic photoconductor 15 was manufactured similar to example 9 in all except that the film thickness of the underlying layer 1 was made be 1.1 μm in example 9.

Example 12

An electrophotographic photoconductor 16 was manufactured similar to example 1 in all except that the three-or-more-functional radical-polymerizable monomer having no charge transporting structure contained in coating liquid for crosslinked-type charge transportation layer was changed to the following monomer and the one-functional radical-polymerizable compound having a charge transporting structure was changed to 10 parts of illustrated compound No. 138 in example 1.

| | |
|---|---|
| Three-or-more-functional radical-polymerizable monomer having no charge transporting structure<br>Penta-erythritol tetraacrylate (SR-295 by produced by Kayaku Sartomer Co., Ltd.) Molecular weight: 352, Number of functional groups: 4 functionalities, Molecular weight/Number of functional groups = 88 | 10 parts |

Example 13

An electrophotographic photoconductor 17 was manufactured similar to example 1 in all except that the three-or-more-functional radical-polymerizable monomer having no charge transporting structure contained in coating liquid for crosslinked-type charge transportation layer was changed to the following monomer and the film thickness of the crosslinked-type charge transportation layer was made be 7.0 μm in example 1.

| | |
|---|---|
| Three-or-more-functional radical-polymerizable monomer having no charge transporting structure<br>Caprolactone-modified di-penta-erythritol hexaacrylate<br>(KAYARAD DPCA-120 produced by Nippon Kayaku Co., Ltd.)<br>Molecular weight: 1947, Number of functional groups: 6 functionalities, Molecular weight/Number of functional groups = 325 | 10 parts |

Example 14

An electrophotographic photoconductor 18 was manufactured similar to example 1 in all except that the three-or-more-functional radical-polymerizable monomer having no charge transporting structure contained in coating liquid for crosslinked-type charge transportation layer was changed to the following monomer, the photo-polymerization initiator was changed to 1 part of the following compound, and the film thickness of the crosslinked-type charge transportation layer was made be 9.0 μm in example 1.

| | |
|---|---|
| Three-or-more-functional radical-polymerizable monomer having no charge transporting structure<br>Caprolactone-modified di-penta-erythritol hexaacrylate<br>(KAYARAD DPCA-60 produced by Nippon Kayaku Co., Ltd.)<br>Molecular weight: 1263, Number of functional groups: 6 functionalities, Molecular weight/Number of functional groups = 211 | 10 parts |

-continued

| | |
|---|---|
| Photo-polymerization initiator<br>2,2-dimethoxy-1,2-diphenylethane-1-one<br>(Irgacure 651 produced by Ciba Specialty Chemicals) | 1 part |

Example 15

An electrophotographic photoconductor 19 was manufactured similar to example 1 in all except that the radical-polymerizable compound having a charge transporting structure contained in coating liquid for crosslinked-type charge transportation layer was changed to 9 parts of one-functional illustrated compound No. 54 and 1 part of two-functional compound of the following structure and the film thickness of the crosslinked-type charge transportation layer was made be 6.0 μm in example 1.

| | |
|---|---|
| One-functional radical-polymerizable compound having a charge transporting structure<br>(Illustrated compound No. 54) | 9 parts |
| Two-functional radical-polymerizable compound having a charge transporting structure | 1 part |

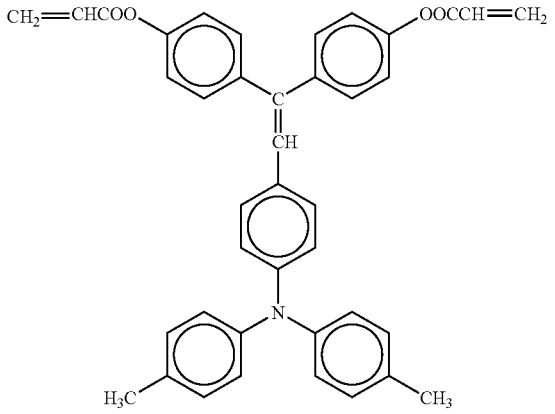

Comparison 5

An electrophotographic photoconductor 20 was manufactured similar to example 1 in all except that the three-or-more-functional radical-polymerizable monomer having no charge transporting structure contained in coating liquid for crosslinked-type charge transportation layer was changed to 10 parts of two-functional radical-polymerizable monomer having no charge transporting structure of the following structural formula and the film thickness of the crosslinked-type charge transportation layer was made be 6.0 μm in example 1.

| | |
|---|---|
| Two-functional radical-polymerizable monomer having no charge transporting structure<br>1,6-hexanediol diacrylate (produced by Wako Pure Chemical Industries, Ltd.)<br>Molecular weight: 226, Number of functional groups: 2 functionalities, Molecular weight/umber of functional groups = 113 | 10 parts |

Comparison 6

An electrophotographic photoconductor 21 was manufactured similar to example 1 in all except that the one-functional radical-polymerizable compound having a charge transporting structure being a component of coating liquid for crosslinked-type charge transportation layer was not contained, the amount of the three-or-more-functional radical-polymerizable monomer having no charge transporting structure was changed to 20 parts, and the film thickness of the crosslinked-type charge transportation layer was made be 4.5 μm in example 1.

Comparison 7

An electrophotographic photoconductor 22 was manufactured similar to example 1 in all except that the one-functional radical-polymerizable compound having a charge transporting structure being a component of coating liquid for crosslinked-type charge transportation layer was not contained, instead, 10 parts of low-molecular-weight charge transportation material of the following structural formula contained in coating liquid for charge transportation layer was contained, and the film thickness of the crosslinked-type charge transportation layer was made be 5.5 μm in example 1.

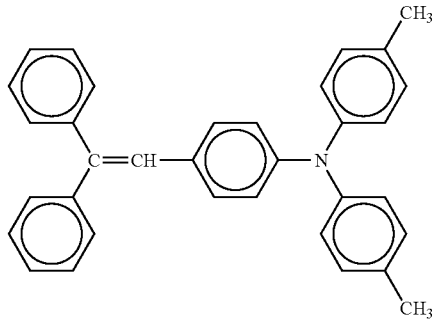

Example 16

An electrophotographic photoconductor 23 was manufactured similar to example 1 in all except that the coating liquid for charge transportation layer was changed to the following composition in example 1.

| (Coating liquid for charge transportation layer) | |
|---|---|
| Polymeric charge transportation material of the following composition (weight-average molecular weight: approximately 135000) | 10 parts |
| Methylene chloride | 100 parts |

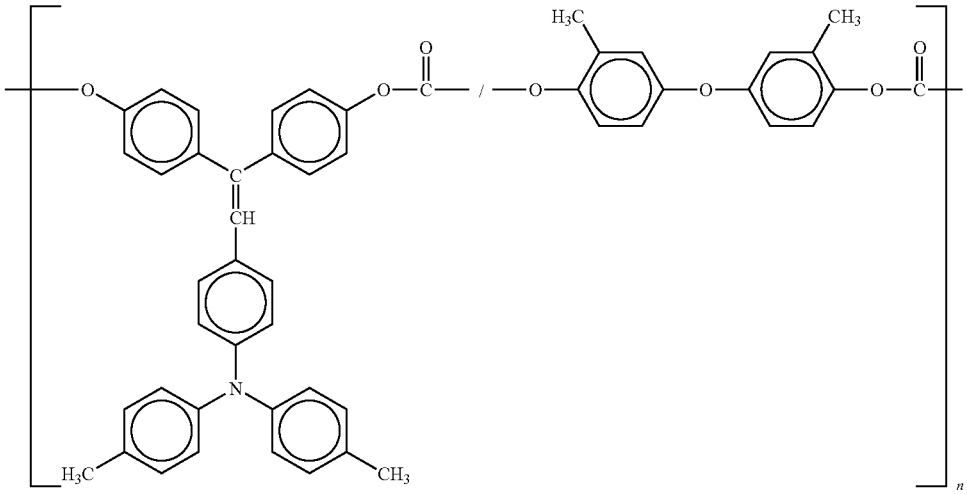

Comparison 8

An electrophotographic photoconductor 24 was manufactured similar to example 1 in all except that the crosslinked-type charge transportation layer was changed to a charge transportation layer containing an organic pigment of the following composition and the film thickness thereof was changed to 6.0 μm in example 1.

| (Coating liquid for charge transportation layer containing an inorganic pigment) | |
|---|---|
| Alumina (average primary particle diameter: 0.4 μm, Sumicorundum AA-03 produced by Sumitomo Chemical Co., Ltd.) | 2 parts |
| Wetting dispersing agent (Solid content 50%, BYK-P104 produced by BYK-Chemie) | 0.025 parts |
| Polycarbonate (TS-2050 produced by TEIJIN CHEMICALS LTD., viscosity-average molecular weight: 50000) | 10 parts |
| Charge transportation material of the following structural formula | 7 parts |
| Cyclohexanone | 500 parts |
| Tetrahydrofuran | 150 parts |

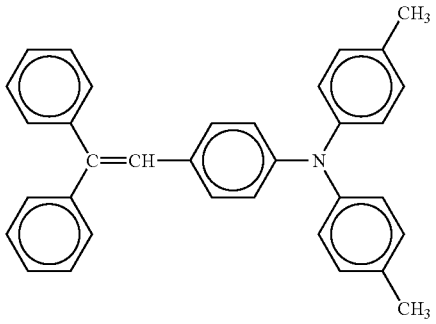

Comparison 9

An electrophotographic photoconductor 25 was manufactured similar to example 1 in all except that the film thickness of the charge transportation layer was made be 19 μm and coating liquid for protective layer of the following composition was applied and dried on the charge transportation layer so as to provide a protective layer with 5 μm in example 1.

| (Coating liquid for protective layer) | |
|---|---|
| Methyltrimethoxysilane | 100 parts |
| 3% acetic acid | 20 parts |
| Charge transportation material of the following structure | 35 parts |

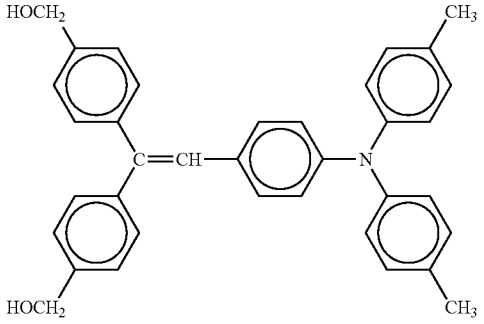

Comparison 10

An electrophotographic photoconductor 26 was manufactured similar to example 1 in all except that the film thickness of the charge transportation layer was made be 24 μm and the crosslinked-type charge transportation layer provided on the top surface was not formed in example 1.

Example 17

An electrophotographic photoconductor 27 was manufactured similar to example 1 in all except that the coating liquid for underlying layer 1 was changed to coating liquid of the following composition in example 1.

| (Coating liquid for underlying layer 1) | |
|---|---|
| Alkyd resin [Beckolite M6401-50-S (Solid content 50%), produced by Dainippon Ink and Chemicals, Incorporated] | 14 parts |
| Melamine resin [Superbeckamine L-121-60 (Solid content 60%) produced by Dainippon Ink and Chemicals, Incorporated] | 8 parts |
| 2-butanone | 110 parts |

Comparison 11

An electrophotographic photoconductor 28 was manufactured similar to example 1 in all except that the coating liquid for underlying layer 1 was changed to coating liquid of the following composition in example 1.

| (Coating liquid for underlying layer 1) | |
|---|---|
| Titanium oxide (CR-EL produced by Ishihara Sangyo Kaisha, Ltd., average primary particle diameter: approximately 0.25 μm) | 15 parts |
| N-methoxymethylated nylon (FR101 produced by Namariichi Co., Ltd.) | 5 parts |
| Methanol | 70 parts |
| n-butanol | 30 parts |

Example 18

An electrophotographic photoconductor 29 was manufactured similar to example 1 in all except that the coating liquid for underlying layer 2 was changed to coating liquid of the following composition in example 1.

| (Coating liquid for underlying layer 2) | |
|---|---|
| Titanium oxide (CR-EL produced by Ishihara Sangyo Kaisha, Ltd., average primary particle diameter: approximately 0.25 μm) | 45 parts |
| Titanium oxide (PT-401M produced by Ishihara Sangyo Kaisha, Ltd., average primary particle diameter: approximately 0.07 μm) | 35 parts |
| Alkyd resin [Beckolite M6401-50-S (Solid content 50%), produced by Dainippon Ink and Chemicals, Incorporated] | 16 parts |
| Melamine resin [Superbeckamine L-145-60 (Solid content 60%) produced by Dainippon Ink and Chemicals, Incorporated] | 9 parts |
| 2-butanone | 100 parts |

The volume ratio of the inorganic pigment to the binder resins is approximately 2/1. Also, the weight ratio of the alkyd resin to the melamine resin is approximately 1.5/1. D2/D1 is 0.28 and the mixture ratio of the inorganic pigments is approximately 0.44.

Example 19

An electrophotographic photoconductor 30 was manufactured similar to example 1 in all except that the coating liquid for underlying layer 2 was changed to coating liquid of the following composition in example 1.

| (Coating liquid for underlying layer 2) | |
|---|---|
| Titanium oxide (CR-EL produced by Ishihara Sangyo Kaisha, Ltd., average primary particle diameter: approximately 0.25 μm) | 40 parts |
| Titanium oxide (TTO-F1 produced by Ishihara Sangyo Kaisha, Ltd., average primary particle diameter: approximately 0.04 μm) | 40 parts |
| Alkyd resin [Beckolite M6401-50-S (Solid content 50%), produced by Dainippon Ink and Chemicals, Incorporated] | 16 parts |
| Melamine resin [Superbeckamine L-145-60 (Solid content 60%) produced by Dainippon Ink and Chemicals, Incorporated] | 9 parts |
| 2-butanone | 100 parts |

The volume ratio of the inorganic pigment to the binder resins is approximately 2/1. Also, the weight ratio of the alkyd resin to the melamine resin is approximately 1.5/1. D2/D1 is 0.16 and the mixture ratio of the inorganic pigments is approximately 0.5.

Example 20

An electrophotographic photoconductor 31 was manufactured similar to example 1 in all except that the coating liquid for underlying layer 2 was changed to coating liquid of the following composition in example 1.

| (Coating liquid for underlying layer 2) | |
|---|---|
| Titanium oxide (CR-EL produced by Ishihara Sangyo Kaisha, Ltd., average primary particle diameter: approximately 0.25 μm) | 65 parts |
| Alkyd resin [Beckolite M6401-50-S (Solid content 50%), produced by Dainippon Ink and Chemicals, Incorporated] | 14 parts |
| Melamine resin [Superbeckamine L-145-60 (Solid content 60%) produced by Dainippon Ink and Chemicals, Incorporated] | 13 parts |
| 2-butanone | 80 parts |

The volume ratio of the inorganic pigment to the binder resins is approximately 1.5/1. Also, the weight ratio of the alkyd resin to the melamine resin is approximately 0.9/1.

Example 21

An electrophotographic photoconductor 32 was manufactured similar to example 1 in all except that the coating liquid for underlying layer 2 was changed to coating liquid of the following composition in example 1.

| (Coating liquid for underlying layer 2) | |
|---|---|
| Titanium oxide (CR-EL produced by Ishihara Sangyo Kaisha, Ltd., average primary particle diameter: approximately 0.25 μm) | 50 parts |
| Alkyd resin [Beckolite M6401-50-S (Solid content 50%), produced by Dainippon Ink and Chemicals, Incorporated] | 25 parts |
| Melamine resin [Superbeckamine L-145-60 (Solid content 60%) produced by Dainippon Ink and Chemicals, Incorporated] | 10 parts |
| 2-butanone | 70 parts |

The volume ratio of the inorganic pigment to the binder resins is approximately 0.9/1. Also, the weight ratio of the alkyd resin to the melamine resin is approximately 2/1.

Example 22

An electrophotographic photoconductor 32 was manufactured similar to example 1 in all except that the coating liquid for underlying layer 2 was changed to coating liquid of the following composition in example 1.

| (Coating liquid for underlying layer 2) | |
|---|---|
| Titanium oxide (CR-EL produced by Ishihara Sangyo Kaisha, Ltd., average primary particle diameter: approximately 0.25 μm) | 125 parts |
| Alkyd resin [Beckolite M6401-50-S (Solid content 50%), produced by Dainippon Ink and Chemicals, Incorporated] | 16 parts |
| Melamine resin [Superbeckamine L-145-60 (Solid content 60%) produced by Dainippon Ink and Chemicals, Incorporated] | 9 parts |
| 2-butanone | 140 parts |

The volume ratio of the inorganic pigment to the binder resins is approximately 3.1/1. Also, the weight ratio of the alkyd resin to the melamine resin is approximately 1.5/1.

Comparison 12

An electrophotographic photoconductor 34 was manufactured similar to example 1 in all except that the coating liquid for underlying layer 2 was changed to coating liquid of the following composition in example 1.

| (Coating liquid for underlying layer 2) | |
|---|---|
| Organic pigment (silicone resin fine particle produced by Ge Toshiba Silicone, average primary particle diameter: approximately 0.5 μm) | 80 parts |
| Alkyd resin [Beckolite M6401-50-S (Solid content 50%), produced by Dainippon Ink and Chemicals, Incorporated] | 16 parts |
| Melamine resin [Superbeckamine L-145-60 (Solid content 60%) produced by Dainippon Ink and Chemicals, Incorporated] | 9 parts |
| 2-butanone | 140 parts |

The volume ratio of the inorganic pigment to the binder resins is approximately 2/1. Also, the weight ratio of the alkyd resin to the melamine resin is approximately 1.5/1.

Comparison 13

An electrophotographic photoconductor 35 was manufactured similar to example 6 in all except that the coating liquid for underlying layer 2 was changed to coating liquid of the following composition and the film thickness of the underlying layer 2 was changed to be 3.0 μm in example 6.

| (Coating liquid for underlying layer 2) | |
|---|---|
| Alkyd resin [Beckolite M6401-50-S (Solid content 50%), produced by Dainippon Ink and Chemicals, Incorporated] | 10 parts |
| Melamine resin [Superbeckamine L-145-60 (Solid content 60%) produced by Dainippon Ink and Chemicals, Incorporated] | 6 parts |
| 2-butanone | 90 parts |

No inorganic pigment is added. The weight ratio of the alkyd resin to the melamine resin is approximately 1.4/1.

Comparison 14

An electrophotographic photoconductor 36 was manufactured similar to example 6 in all except that the coating liquid for underlying layer 1 was changed to coating liquid of the following composition and the film thickness of the underlying layer 1 was made be 1.0 μm in example 6.

| (Coating liquid for underlying layer 1) | |
|---|---|
| Titanium oxide (CR-EL produced by Ishihara Sangyo Kaisha, Ltd., average primary particle diameter: approximately 0.25 μm) | 15 parts |
| N-methoxymethylated nylon (FR101 produced by Namariichi Co., Ltd.) | 5 parts |
| Methanol | 70 parts |
| n-butanol | 30 parts |

Examples 1 Through 22 and Comparisons 1 Through 14

In regard to electrophotographic photoconductors 1 through 36 manufactured as described above, the appearances were visually observed so as to judge the presence or absence of a crack or film peeling. Next, as a test of solubility to an organic solvent, a drop of tetrahydrofuran (abbreviated as THF below) or dichloromethane (abbreviated as MDC below) was dropped and the change of a surface shape was observed after air-drying. The results are shown in Table 3.

TABLE 3

| Example/ Comparison | Results of surface observation and solubility test: Photo-conductor No. | Surface observation | Solubility test: THF | Solubility test: MDC |
|---|---|---|---|---|
| Example 1 | 1 | Good | Insoluble | Insoluble |
| Example 2 | 2 | Good | Insoluble | Insoluble |
| Example 3 | 3 | Good | Insoluble | Insoluble |

TABLE 3-continued

| Example/ Comparison | Results of surface observation and solubility test: Photo-conductor No. | Surface observation | Solubility test: THF | Solubility test: MDC |
|---|---|---|---|---|
| Example 4 | 4 | Good | Insoluble | Insoluble |
| Example 5 | 5 | Good | Insoluble | Insoluble |
| Example 6 | 6 | Good | Insoluble | Insoluble |
| Comparison 1 | 7 | Good | Insoluble | Insoluble |
| Comparison 2 | 8 | Good | Insoluble | Insoluble |
| Comparison 3 | 9 | Good | Insoluble | Insoluble |
| Comparison 4 | 10 | Good | Insoluble | Insoluble |
| Example 7 | 11 | Good | Insoluble | Insoluble |
| Example 8 | 12 | Good | Insoluble | Insoluble |
| Example 9 | 13 | Good | Insoluble | Insoluble |
| Example 10 | 14 | Good | Insoluble | Insoluble |
| Example 11 | 15 | Good | Insoluble | Insoluble |
| Example 12 | 16 | Good | Insoluble | Insoluble |
| Example 13 | 17 | Good | Insoluble | Insoluble |
| Example 14 | 18 | Good | Insoluble | Insoluble |
| Example 15 | 19 | Good | Insoluble | Insoluble |
| Comparison 5 | 20 | A crack was generated. | Insoluble | Insoluble |
| Comparison 6 | 21 | Good | Insoluble | Insoluble |
| Comparison 7 | 22 | Clouding caused by precipitation of charge transportation material was observed. | Soluble | Soluble |
| Example 16 | 23 | Good | Insoluble | Insoluble |
| Comparison 8 | 24 | Good | Soluble | Soluble |
| Comparison 9 | 25 | Good | Insoluble | Insoluble |
| Comparison 10 | 26 | Good | Soluble | Soluble |
| Example 17 | 27 | Good | Insoluble | Insoluble |
| Comparison 11 | 28 | Good | Insoluble | Insoluble |
| Example 18 | 29 | Good | Insoluble | Insoluble |
| Example 19 | 30 | Good | Insoluble | Insoluble |
| Example 20 | 31 | Good | Insoluble | Insoluble |
| Example 21 | 32 | Good | Insoluble | Insoluble |
| Example 22 | 33 | Good | Insoluble | Insoluble |
| Comparison 12 | 34 | Good | Insoluble | Insoluble |
| Comparison 13 | 35 | Good | Insoluble | Insoluble |
| Comparison 14 | 36 | Good | Insoluble | Insoluble |

From the results of Table 3, in regard to the photoconductors according to the present invention shown in examples 1 through 22, a crack or film peeling was not generated at the time of formation of the crosslinked-type charge transportation layer and good photoconductors in appearance were obtained. On the other hand, in the photoconductor of comparison 5 using a two-functional radical-polymerizable compound having a charge transporting structure as a crosslinked-type charge transportation layer component, a crack was generated at the time of formation of a crosslinked-type charge transportation layer. Also, it was found that when a radical-polymerizable compound having a charge transporting structure was not contained but a low-molecular-weight charge transportation material was contained like comparison 7, the charge transportation material precipitated and the crosslink therein was insufficient. Also, as seen in comparisons 8 and 10, it was confirmed that when the surface layer was not cured, both of them exhibited solubility.

Also, the electrophotographic photoconductors of examples 1 through 22 and comparisons 1 through 14 manufactured as described above were attached to a process cartridge, which was set into a remodeled machine of tandem-type full-color laser printer. As an image-wise-light-exposure light source, semiconductor laser of 655 nm (image writing by a polygon mirror) was used, and a charging member was arranged closely to the photoconductor by winding an insulating tape with a thickness of 50 μm on non-image formation areas near both ends of a charging roller. Then, a DC bias was 750(−V), on which an AC bias (Vpp (peak to peak): 1.8 kV, Frequency: 900 Hz) was superposed, and a development bias was 500 (−V). The process cartridges having each photoconductor sample were set to a cyan station, a magenta station, a cyan station, and a black station, which were filled with the same developer, and totally 100,000 image outputs were performed repeatedly while the stations were subjected to rotation by 10,000 copies, and then, image evaluation was performed. They were performed at a test environment of 23° C. and 60% RH. Herein, image evaluation level was represented by the following four levels.

◎ very good level

○ non-problematic level although some image quality degradation was found

Δ level in which an image defect was apparently recognized

X level in which the influence of an image defect is high and image quality was very bad Also, the abrasion loss was calculated from the difference of film thickness between before and after the test.

These results are shown in Table 4-1 and Table 4-2.

TABLE 4-1

| | | Image evaluation results (1) | | | | |
|---|---|---|---|---|---|---|
| | | 23° C. 60% RH | | | | |
| | | | | After 100,000 printings | | |
| | Photo | Initial | | | | Abrasion |
| Example/ Comparison | conductor No. | VL (−V) | Image evaluation | VL (−V) | Image evaluation | loss (μm) |
| Example 1 | 1 | 90 | ◎ Good | 90 | ◎ Good | 0.6 |
| Example 2 | 2 | 80 | ◎ Good | 80 | ◎ Good | 0.6 |
| Example 3 | 3 | 85 | ◎ Good | 85 | ◎ Good | 0.6 |
| Example 4 | 4 | 120 | ○ Image concetraion reduction | 130 | ○ Image concetraion reduction | 0.6 |
| Example 5 | 5 | 75 | ◎ Good | 75 | ○ Background contamination | 0.6 |
| Example 6 | 6 | 125 | ○ Image concetraion reduction | 140 | ○ Image concetraion reduction | 0.6 |
| Comparison 1 | 7 | 75 | ◎ Good | 75 | Δ Background contamination Δ Black spot caused by electric breakdown | 0.7 |
| Comparison 2 | 8 | 130 | X Moire ○ Background contamination ○ Image concetraion reduction | 150 | X Moire Δ Background contamination ○ Image concetraion reduction | 0.6 |
| Comparison 3 | 9 | 125 | X Moire X Background contamination ○ Image concetraion reduction | 140 | X Moire X Background contamination (Termination at 10,000 copies) | 0.1 (10,000 copies) |
| Comparison 4 | 10 | 180 | X Moire Δ Image concetraion reduction | 220 | X Moire X Image concetraion reduction (Termination at 10,000 copies) | 0.1 (10,000 copies) |
| Example 7 | 11 | 80 | ◎ Good | 80 | ◎ Good | 0.6 |
| Example 8 | 12 | 95 | ◎ Good | 95 | ◎ Good | 0.6 |
| Example 9 | 13 | 110 | ◎ Good | 110 | ◎ Good | 0.6 |
| Example 10 | 14 | 95 | ◎ Good | 95 | ○ Background contamination | 0.6 |
| Example 11 | 15 | 140 | ○ Image concetraion reduction | 150 | ○ Image concetraion reduction | 0.6 |
| Example 12 | 16 | 90 | ◎ Good | 95 | ◎ Good | 0.5 |
| Example 13 | 17 | 85 | ◎ Good | 85 | ○ Background contamination | 1.7 |

TABLE 4-1-continued

| | | Image evaluation results (1) | | | | |
|---|---|---|---|---|---|---|
| | | 23° C. 60% RH | | | | |
| | | | | After 100,000 printings | | |
| | Photo | Initial | | | | Abrasion |
| Example/ Comparison | conductor No. | VL (−V) | Image evaluation | VL (−V) | Image evaluation | loss (μm) |
| Example 14 | 18 | 90 | ◎ Good | 90 | ◎ Good | 1 |
| Example 15 | 19 | 95 | ◎ Good | 95 | ◎ Good | 1.5 |

TABLE 4-2

| | | | Image evaluation results (2) | | | |
|---|---|---|---|---|---|---|
| Comparison 5 | 20 | 70 | ◎ Good | 70 | X Background contamination | 4.1 |
| Comparison 6 | 21 | 180 | Δ Image concetraion reduction | 220 | X Image concetraion reduction (Termination at 10,000 copies) | 0.0 (10,000 copies) |
| Comparison 7 | 22 | 105 | Δ Background contamination | 130 | X Background contamination Δ Resolution reduction | 2.9 |
| Example 16 | 23 | 85 | ◎ Good | 85 | ◎ Good | 0.5 |
| Comparison 8 | 24 | 90 | ◎ Good | 135 | X Background contamination Δ Filming Δ Line-shaped image defect | 4.8 |
| Comparison 9 | 25 | 100 | ◎ Good | 100 | Δ Resolution reduction Δ Filming | 0.9 |
| Comparison 10 | 26 | 65 | Δ Spot-shaped image defect | 75 | Δ Spot-shaped image defect X Background contamination (Termination at 10,000 copies) | Incapable measurement due to adhesion of foreign substances |
| Example 17 | 27 | 110 | ○ Image concetraion reduction | 110 | ○ Image concetraion reduction | 0.6 |
| Comparison 11 | 28 | 85 | ○ Background contamination | 85 | Δ Background contamination | 0.6 |
| Example 18 | 29 | 80 | ◎ Good | 80 | ◎ Good | 0.6 |
| Example 19 | 30 | 90 | ○ Moire | 90 | ○ Moire | 0.6 |
| Example 20 | 31 | 110 | ○ Image concetraion reduction | 110 | ○ Image concetraion reduction | 0.6 |
| Example 21 | 32 | 140 | ○ Image concetraion reduction | 140 | ○ Image concetraion reduction | 0.6 |
| Example 22 | 33 | 80 | ◎ Good | 80 | ○ Background contamination | 0.6 |
| Comparison 12 | 34 | 160 | Δ Image concetraion reduction | 200 | X Image concetraion reduction Δ Background contamination | 0.6 |
| Comparison 13 | 35 | 170 | X Moire Δ Image concetraion reduction | 210 | X Moire X Image concetraion reduction (Termination at 10,000 copies) | 0.1 (10,000 copies) |
| Comparison 14 | 36 | 100 | ○ Background contamination | 100 | X Background contamination | 0.6 |

The electrophotographic photoconductors according to the present invention had high wear resistance and maintained good image quality with a little background contamination, and further, the cleaning property was good and a side effect such as filming and image deletion was not found, even though printings running to 100,000 copies were performed. on the other hand, In the case of the underlying layer being a single layer, no underlying layer being formed, or both underlying layers containing an inorganic pigment, the background contamination resistance lowered drastically. On the other hand, in the case of both underlying layers containing no inorganic pigment, Moire generated initially or image concentration lowered due to the significant elevation of an electric potential at light exposure portion, so that image quality degradation was caused. Also, in the crosslinked-type charge transportation layer being the top surface layer, when a two-functional radical-polymerizable monomer was used instead of the three-or-more-functional radical-polymerizable monomer having no charge transporting structure or a low-molecular-weight charge transportation material was contained instead of the one-functional radical-polymerizable monomer having a charge transporting structure, the wear resistance lowered drastically and the generation of background contamination was found significantly. Furthermore, in the case of containing no one-functional radical-polymerizable compound having a charge transporting structure, significant elevation of an electric potential at light exposure portion was caused and the image concentration lowered. In the present invention, an electrophotographic photoconductor such that the suppression of background contamination and the improvement of wear resistance were realized and an image with high image quality can be stably obtained for the long term without filming, insufficient cleaning, or the generation of an iamge defect such as the adhesion of foreign substances, and an image formation apparatus using it, were realized by combining the underlying layers composed of at least two layers being a layer containing an inorganic pigment and a layer containing no inorganic pigment and, further, the crosslinked-type charge transportation layer obtained by curing the three-or-more-functional radical-polymerizable monomer having a charge transporting structure and the one-functional radical-polymerizable compound having a charge transporting structure on the top surface.

Next, comparison synthesis examples of charge generation materials used for the present invention and synthesis examples of the present invention are described.

Comparison Synthesis Example 1

A pigment was prepared based on Japanese Laid-Open Patent Application No. 2001-19871. That is, 29.2 parts of 1,3-diiminoisoindoline and 200 parts of sulfolane are mixed and 20.4 parts of titanium tetrabutoxide were dropped in nitrogen gas stream. After the completion of the dropping, gradual temperature elevation to 180° C. was carried out and the reaction was carried out with stirring for 5 hours while the reaction temperature was kept to be between 170° C. and 180° C. After the completion of the reaction, standing to cool was made, subsequently a precipitate was filtered, and powder was washed with chloroform until it became blue, then washed with methanol several times, further washed with hot water at 80° C. several time, and subsequently dried, so as to obtain a crude titanyl phthalocyanine. The crude titanyl phthalocyanine was dissolved into 20 times quantity of concentrated sulfuric acid, dropping to 100 times quantity of ice water was made with stirring, and a precipitated crystal was filtered and then washing with water was repeated until liquid after washing was neutral (the pH value of ion-exchanged water after washing was 6.8.) so as to obtain a wet cake (water paste) of titanyl phthalocyanine pigment. After 40 parts of the obtained wet cake (water paste) were thrown into 200 parts of tetrahydrofuran and stirring for 4 hours was performed, filtration and drying were performed so as to obtain titanyl phthalocyanine powder. This is referred to as pigment 1. The concentration of a solid content in the aforementioned wet cake was 15 wt %. The weight ratio of crystal transformation solvent to the wet cake was 33 times. Additionally, no halide was used for a raw material for comparison synthesis example 1.

Figure 15:
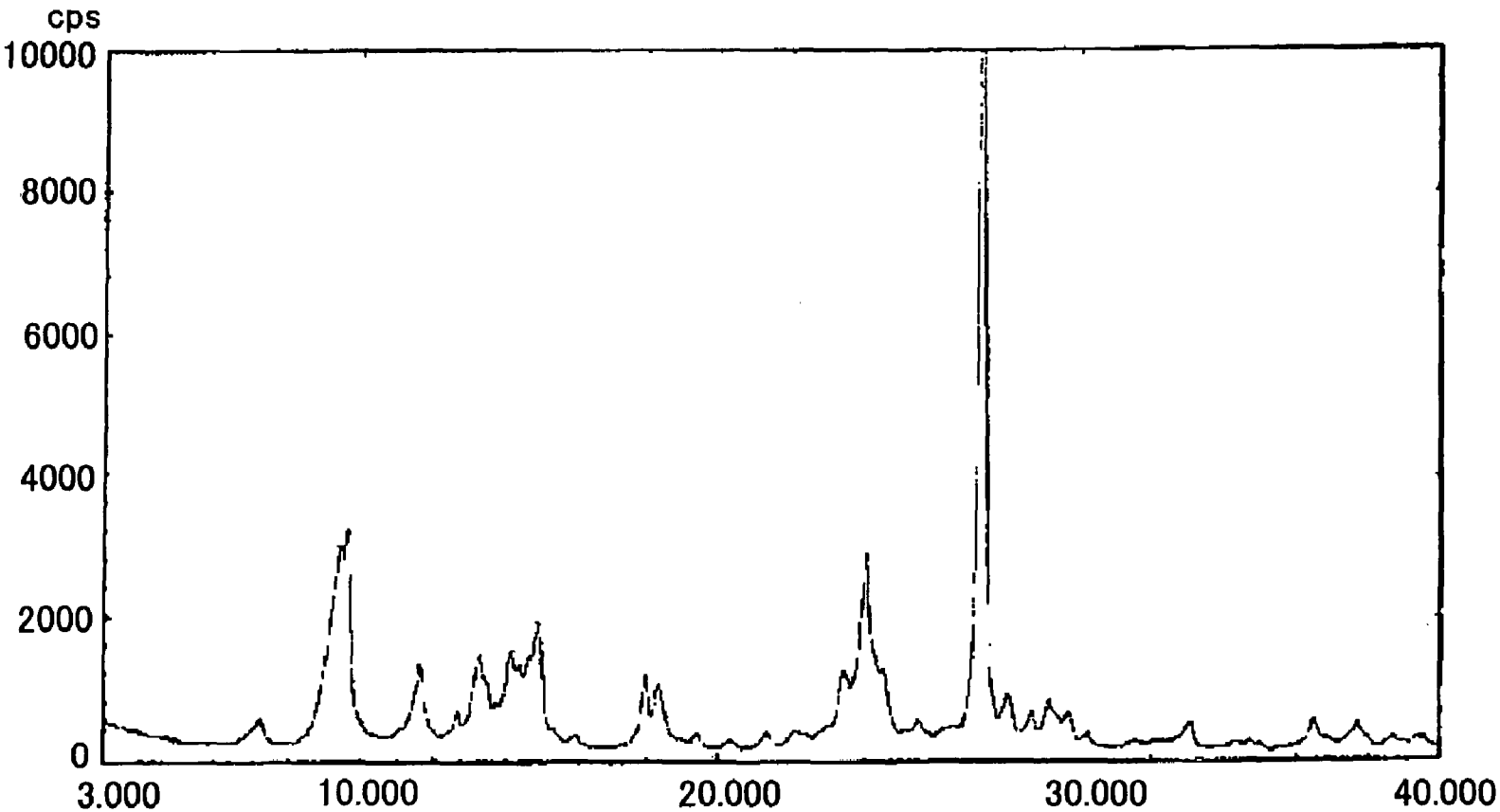
FIG. 15 is a drawing of an X-ray diffraction spectrum of titanyl phthalocyanine powder obtained in comparison synthesis example 1.

As a X-ray diffraction spectrum for the obtained titanyl phthalocyanine powder was measured on the following conditions, titanyl phthalocyanine powder having a maximum diffraction peak at 27.2±0.2° and a peak at 7.3±0.2° on the smallest angle side, having no peak between the peak at 7.3° and a peak at 9.4°, and having no peak at 26.3°, in regard to a Bragg angle 2θ of characteristic X rays (wavelength of 1.542 Å) of Cu-Kα, was obtained. The result is shown in FIG. 15.

Figure 16:
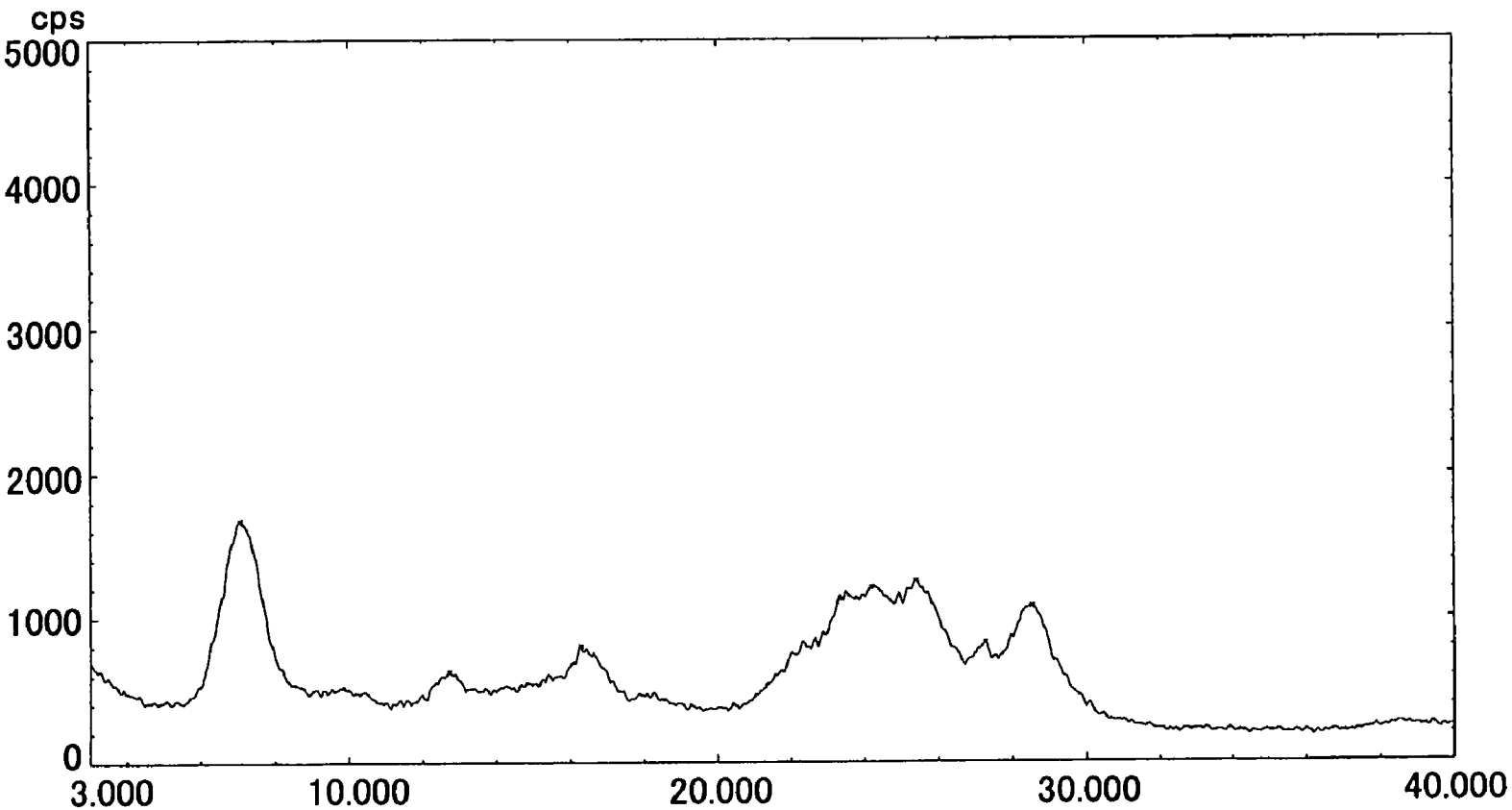
FIG. 16 is a drawing of an X-ray diffraction spectrum of dry powder from aqueous paste obtained in synthesis example 1.

Also, a portion of the water paste obtained in comparison synthesis example 1 was dried at 80° C. under reduced pressure (5 mmHg) for 2 days so as to obtain low crystalline titanyl phthalocyanine powder. An X-ray diffraction spectrum for dried powder from the water paste is shown in FIG. 16.

(Measurement Conditions of X-ray Diffraction Spectrum)
X-ray tube lamp: Cu
Voltage: 50 kV
Current: 30 mA
Scanning rate: 2°/minute
Scanning range: 3° through 40°
Time constant: 2 seconds Comparison Synthesis Example 2

A pigment was prepared based on a method described in example 1 of Japanese Laid-Open Patent Application No. 1-299874 (Japanese Patent No. 2512081). That is, the previous wet cake prepared in comparison synthesis example 1 was dried, 1 part of dried substance was added into 50 parts of polyethylene glycol, and sand-mill was performed with 100 parts of glass beads. After crystal conversion, washing with dilute sulfuric acid and washing with aqueous solution of ammonium hydroxide were performed in order, and drying was performed to obtain a pigment. This is referred to as pigment 2. No halide was used for a raw material for comparison synthesis example 2.

Comparison Synthesis Example 3

A pigment was prepared based on a method described in manufacture example 1 of Japanese Laid-Open Patent Application No. 3-269064 (Japanese Patent No. 2584682). That is, the previous wet cake prepared in comparison synthesis example 1 was dried, and after 1 part of dried substance was stirred for 1 hour (50° C.) in mixture solvent of 10 parts of ion-exchanged water and 1 part of monochlorobenzene, washing with methanol and washing with ion-exchanged water were performed and drying was performed to obtain a pigment. This is referred to as pigment 3. No halide was used for a raw material for comparison synthesis example 3.

Comparison Synthesis Example 4

A pigment was prepared based on a method described in a manufacture example of Japanese Laid-Open Patent Application No. 2-8256 (Japanese Examined Patent Application No. 7-91486). That is, 9.8 parts of phthalodinitrile and 75 parts of 1-chloronaphthalene were mixed with stirring, and 2.2 parts of titanium tetrachloride were dropped in nitrogen gas stream. After the completion of the dropping, gradual temperature elevation to 200° C. was carried out, and the reaction was carried out with stirring for 3 hours while the reaction temperature was kept to be between 200° C. and 220° C. After the completion of the reaction, standing to cool to 130° C. was made and hot filtration was performed, then powder was washed with 1-chloronaphthalene until it became blue, then washed with methanol several times, further washed with hot water at 80° C. several time, and subsequently dried, so as to obtain a pigment. This is referred to as pigment 4. A halide was used for a raw material for comparison synthesis example 4.

Comparison Synthesis Example 5

A pigment was prepared based on a method described in synthesis example 1 of Japanese Laid-Open Patent Application No. 64-17066 (Japanese Examined Patent Application No. 7-97221). That is, a crystal transformation treatment at 100° C. for 10 hours was performed for 5 parts of α-type TiOPc with 10 parts of common salt and 5 parts of acetophenone in a sand grinder. This was washed with ion-exchanged water and with methanol, purified with aqueous solution of dilute sulfuric acid, washed with ion-exchanged water until an acid component was lost, and subsequently dried, so as to obtain a pigment. This is referred to as pigment 5. A halide was used for a raw material for comparison synthesis example 5.

Comparison Synthesis Example 6

A pigment was prepared based on a method described in example 1 of Japanese Laid-Open Patent Application No. 11-5919 (Japanese Patent No. 3003664). That is, after 20.4 parts of o-phthalodinitrile and 7.6 parts of titanium tetrachloride were heated and reacted at 200° C. for 2 hours in 50 parts of quinoline, the solvent was removed by means of steam distillation, purification was made with 2% aqueous solution of hydrochloric acid, then 2% aqueous solution of sodium hydroxide, and washing with methanol and washing with N,N-dimethylformamide and subsequently drying were performed, so as to obtain titanyl phthalocyanine. 2 parts of this titanyl phthalocyanine was dissolved into 40 parts of 98% sulfuric acid at 5° C. little by little, and the mixture thereof was stirred for approximately 1 hour while temperature equal to or less than 5° C. was kept. Subsequently, the solution of sulfuric acid was slowly poured into 400 parts of ice water that was stirred on high speed and a precipitated crystal was filtered. The crystal was washed with distilled water until no acid remained, so as to a wet cake. Stirring for approximately 5 hours was applied to the cake in 100 parts of THF, and after filtration, washing with THF, and drying were performed, a pigment was obtained. This is referred to as pigment 6. A halide was used for a raw material for comparison synthesis example 6.

Comparison Synthesis Example 7

A pigment was prepared based on a method described in synthesis example 2 of Japanese Laid-Open Patent Application No. 3-255456 (Japanese Patent No. 3005052). That is, 10 parts of the wet cake prepared in the previous comparison synthesis example 1 were mixed into 15 parts of sodium chloride and 7 parts of diethylene glycol, and a milling treatment was carried out by an automatic mortar under the heating at 80° C. for 60 hours. Then, sufficient washing with water was performed in order to completely remove sodium chloride and diethylene glycol contained in the treated product. After it was dried under reduced pressure, 200 parts of cyclohexanone and glass beads with a diameter of 1 mm were added and a treatment by means of sand mill was carried out for 30 minutes, so as to obtain a pigment. This is referred to as pigment 7. No halide was used for a raw material for comparison synthesis example 7.

Comparison Synthesis Example 8

A pigment was prepared based on a method of manufacturing a titanyl phthalocyanine crystal in Japanese Laid-Open Patent Application No. 8-110649. That is, after 58 parts of 1,3-diiminoisoindoline and 51 parts of titanium tetrabutoxide were reacted in 300 parts of α-chloronaphthalene at 210° C. for 5 hours, washing with α-chloronaphthalene and washing with dimethylformamide (DMF) were performed in order. Subsequently, washing with hot DMF, with hot water, and with methanol and drying was performed so as to obtain 50 parts of titanyl phthalocyanine. 4 parts of the phthalocyanine was added into 400 parts of concentrated sulfuric acid that had been cooled to 0° C. and, subsequently, stirring at 0° C. for 1 hour was performed. After it was confirmed that phthalocyanine was completely dissolved, the addition into a mixture liquid of 800 parts of water/800 parts of toluene that had been cooled to 0° C. was made. After stirring was made at room temperature for 2 hours, a precipitated phthalocyanine crystal was filtered and separated from the mixture liquid and washing with methanol and washing with water were performed in order. After the neutrality of water after washing was confirmed, a phthalocyanine crystal was filtered and separated from washing water and dried so as to obtain 2.9 parts of titanyl phthalocyanine crystal. This is referred to as pigment 8. No halide was used for a raw material for comparison synthesis example 8.

Synthesis Example 1

Water paste of a titanyl phthalocyanine pigment was synthesized according to the method of comparison synthesis example 1, and crystal transformation was carried out as follows, so as to obtain a phthalocyanine crystal in which a primary particle is smaller than that of comparison synthesis example 1.

400 parts of tetrahydrofuran were added to 60 parts of the water paste before crystal transformation obtained in comparison synthesis example 1, intense stirring (2000 rpm) was carried out by a homomixer (Kenisu, MARK II f model) under room temperature, and when paste color, being navy blue, changed to ice blue (20 minutes after start of stirring), the stirring was stopped and, immediately, filtration under reduced pressure was performed. A crystal obtained by a filtration apparatus was washed with tetrahydrofuran so as to wet cake of pigment. This was dried at 70° C. under reduced pressure (5 mmHg) for 2 days, so as to obtain 8.5 parts of a titanyl phthalocyanine crystal. This is referred to as pigment 9. No halide was used for a raw material for synthesis example 1. The concentration of solid content of the aforementioned wet cake was 15 wt %. The weight ratio of crystal transformation solvent to the wet cake was 44 times.

A portion of titanyl phthalocyanine before crystal transformation (water paste) prepared in comparison synthesis example 1 was diluted with ion-exchanged water so as to be approximately 1% by weight, a surface was skimmed by a copper net treated to be electrically conductive, and the size of titanyl phthalocyanine particle was observed by a transmission electron microscope (TEM, Hitachi: H-9000NAR) at 75000-fold magnification. An average particle size was obtained as follows.

A TEM picture of a TEM image observed as described above was taken and 30 imaged titanyl phthalocyanine particles (needle-like shape) were arbitrarily chosen, and the length of each major axis was measured. The arithmetic mean of the lengths of major axes of 30 measured individuals was obtained as an average particle size.

The average particle size in regard to the water paste in comparison synthesis example 1 obtained by the aforementioned method was 0.06 μm.

Also, the titanyl phthalocyanine crystals after crystal transformation and immediately before the filtration in comparison synthesis example 1 and in synthesis analysis 1 were diluted with tetrahydrofuran to be approximately 1% by weight and the observations were performed similarly to the aforementioned method. Average particle sizes obtained as mentioned above are shown in Table 1. Additionally, in titanyl phthalocyanine crystals manufactured in comparison synthesis example 1 and in synthesis example 1, not all crystal shapes were identical (a shape close to a triangle, a shape close to a quadrangle, etc.). Therefore, calculation was preformed by regarding the length of the longest diagonal line of the crystal as the length of major axis.

| | Average particle size (μm) | Remarks |
|---|---|---|
| Comparison synthesis example 1 (pigment 1) | 0.31 | Large particles of approximately 0.3-0.4 μm are contained. |
| Synthesis example 1 (pigment 9) | 0.12 | The size of crystals is nearly uniform. |

From Table 5, in regard to pigment 1 prepared in comparison synthesis example 1, not only the average particle size is large but also a crude large particle was contained. On the other hand, in regard to pigment 9 prepared in synthesis example 1, it is found that not only the average particle size is small but also the size of an individual primary particle is nearly uniform.

In regard to the above mentioned pigments prepared in comparison synthesis examples 2 through 8, X-ray diffraction spectra thereof were measured by a method similar to that mentioned above, and it was confirmed that they were similar to the spectra described in the respective publications. Also, the X-ray diffraction spectrum of a pigment prepared in synthesis example 1 was coincide with the spectrum of a pigment prepared in comparison synthesis example 1. Table 6 shows the peak position characteristics of respective X-ray diffraction spectra and of an X-ray diffraction spectrum of a pigment obtained in comparison synthesis example 1.

| Synthesis example | Pigment | Largest peak position | Smallest angle peak position | Peak at 9.4° | Peak at 9.6° | Peak at 7.4°~9.4° | Peak at 24.0° | Peak at 26.3° |
|---|---|---|---|---|---|---|---|---|
| Comparison synthesis example 1 | Pigment 1 | 27.2° | 7.3° | Presence | Presence | Absence | Presence | Absence |
| Comparison synthesis Presence example 2 | Pigment 2 | 27.2° | 7.3° | Absence | Absence | Absence | Presence | Absence |
| Comparison synthesis example 3 | Pigment 3 | 27.2° | 9.6° | Presence | Presence | Absence | Presence | Absence |
| Comparison synthesis example 4 | Pigment 4 | 27.2° | 7.4° | Absence | Presence | Absence | Absence | Absence |
| Comparison synthesis example 5 | Pigment 5 | 27.3° | 7.3° | Presence | Presence | Presence (7.5°) | Presence | Absence |
| Comparison synthesis example 6 | Pigment 6 | 27.2° | 7.5° | Absence | Presence | Presence (7.5°) | Presence | Absence |
| Comparison synthesis example 7 | Pigment 7 | 27.2° | 7.4° | Absence | Absence | Presence (9.2°) | Presence | Presence |
| Comparison synthesis example 8 | Pigment 8 | 27.2° | 7.3° | Presence | Presence | Absence | Presence | Absence |
| Synthesis example 1 | Pigment 9 | 27.2° | 7.3° | Presence | Presence | Absence | Presence | Absence |

Next, a method for preparing dispersion liquid for applying a charge generation layer using a charge generation material synthesized as mentioned above is explained.

Dispersion Liquid Preparation Example 1

Dispersion liquid 1 was prepared as coating liquid for charge generation layer by performing dispersion of pigment 1 manufactured in comparison synthesis example 1 on the formulation of the following composition and on the conductions shown below.

| | |
|---|---|
| Titanyl phthalocyanine pigment (pigment 1) | 15 parts |
| Poly(vinyl butyral) (BX-1: produced by Sekisui Chemical Co., Ltd.) | 10 parts |
| 2-butanone | 280 parts |

The pigment and 2-butanone that had dissolved poly(vinyl butyral) were all thrown into a commercially available beads-mill dispersion machine and dispersion was performed for 30 minutes by using a PSZ ball with a diameter of 0.5 mm, at the number of revolutions of a rotor being 1200 r.p.m., so as to prepare dispersion liquid. This is referred to as dispersion liquid 1.

Dispersion Liquid Preparation Examples 2 through 8

Dispersion liquids were prepared by using pigments 2 through 8 prepared in comparison synthesis examples 2 through 8, respectively, instead of pigment 1 used in dispersion liquid preparation example 1, on the same conditions as dispersion liquid preparation example 1. These are referred to as dispersion liquids 2 through 8, respectively, corresponding to the pigment numbers.

Dispersion Liquid Preparation Example 9

Dispersion liquid was prepared by using pigment 9 prepared in synthesis example 1, instead of pigment 1 used in dispersion liquid preparation example 1, on the same conditions as dispersion liquid preparation example 1. This is referred to as dispersion liquid 9.

Dispersion Liquid Preparation Example 10

Filtration of dispersion liquid 1 prepared in dispersion liquid preparation example 1 was performed using a cotton wound cartridge filter, TCW-1-CS (effective pore size of 1 μm) produced by Advantec Co., Ltd. In the filtration, a pump was used so that the filtration was performed on a pressurized state. This is referred to as dispersion liquid 10.

Dispersion Liquid Preparation Example 11

Pressurized filtration was performed similarly to dispersion liquid preparation example 10 except that the filter used in dispersion liquid preparation example 10 was changed to a cotton wound cartridge filter, TCW-3-CS (effective pore size of 3 μm) produced by Advantec Co., Ltd., so as to prepare dispersion liquid. This is referred to as dispersion liquid 11.

Dispersion Liquid Preparation Example 12

Pressurized filtration was performed similarly to dispersion liquid preparation example 10 except that the filter used in dispersion liquid preparation example 10 was changed to a cotton wound cartridge filter, TCW-5-CS (effective pore size of 5 μm) produced by Advantec Co., Ltd., so as to prepare dispersion liquid. This is referred to as dispersion liquid 12.

Dispersion Liquid Preparation Example 13

Dispersion was performed similarly to dispersion liquid preparation example 1 in all except that the number of revolutions of a rotor was changed to 1000 r.p.m. for 20 minutes on the dispersion conditions in dispersion liquid preparation example 1. This is referred to as dispersion liquid 13.

Dispersion Liquid Preparation Example 14

Filtration of the dispersion liquid prepared in dispersion liquid preparation example 13 was performed using a cotton wound cartridge filter, TCW-1-CS (effective pore size of 1 μm) produced by Advantec Co., Ltd. In the filtration, a pump was used so that the filtration was performed on a pressurized state.

The particle size distribution of titanyl phthalocyanine particles in the dispersion liquid prepared as mentioned above was measured by HORIBA, Ltd.: CAPA-700. The results are shown in Table 7.

| Dispersion liquid No. | Pigment No. | Average particle diameter (μm) | Standard deviation (μm) |
|---|---|---|---|
| Dispersion liquid 1 | Pigment 1 | 0.29 | 0.18 |
| Dispersion liquid 2 | Pigment 2 | 0.28 | 0.19 |
| Dispersion liquid 3 | Pigment 3 | 0.31 | 0.20 |
| Dispersion liquid 4 | Pigment 4 | 0.30 | 0.20 |
| Dispersion liquid 5 | Pigment 5 | 0.27 | 0.19 |
| Dispersion liquid 6 | Pigment 6 | 0.29 | 0.20 |
| Dispersion liquid 7 | Pigment 7 | 0.27 | 0.18 |
| Dispersion liquid 8 | Pigment 8 | 0.26 | 0.19 |
| Dispersion liquid 9 | Pigment 9 | 0.19 | 0.13 |
| Dispersion liquid 10 | Pigment 1 | 0.22 | 0.16 |
| Dispersion liquid 11 | Pigment 1 | 0.24 | 0.17 |
| Dispersion liquid 12 | Pigment 1 | 0.28 | 0.18 |
| Dispersion liquid 13 | Pigment 1 | 0.33 | 0.23 |

In regard to dispersion liquid 14, since the filter caused clogging in the middle of the filtration and all of the dispersion liquid could not filtered, an evaluation could not be conducted.

Next, a method of manufacturing an electrophotographic photoconductor using the aforementioned dispersion liquid for applying a charge generation layer is explained.

Example 23

Coating liquid for underlying layer 1, coating liquid for underlying layer 2, coating liquid for charge generation layer, coating liquid for charge transportation layer, and coating liquid for crosslinked-type charge transportation layer which had the following compositions, were applied and dried on an aluminum cylinder with a diameter of 100 mm (JIS 1050) in order, so that an underlying layer 1 with 0.8 μm, an underlying layer 2 with 3.0 μm, a charge generation layer, a charge transportation layer with 19 μm, and a crosslinked-type charge transportation layer with 5 μm were stacked to manufacture an electrophotographic photoconductor. This is referred to as electrophotographic photoconductor 37. The applied film of the crosslinked-type charge transportation layer was cured by performing light irradiation on the conditions of a metal halide lamp: 160 W/cm, an irradiation intensity: 500 mW/cm$^2$, and irradiation time period: 60 seconds after air-drying for 20 minutes from spray coating. Herein, after the application of each layer, drying to the touch was performed and, subsequently, drying by heating was performed for 20 minutes at 130° C. for the underlying layer 1, at 130° C. for the underlying layer 2, at 90° C. for the charge generation layer, at 135° C. for the charge transportation layer, and at 130° C. for the crosslinked-type charge transportation layer. Also, the film thickness of the charge generation layer was adjusted such that the transmittance of the charge generation layer was 20% at 780 nm. In regard to the transmittance of the charge generation layer, the application of coating liquid for charge generation layer of the following composition on the aluminum cylinder on which a polyethylene terephthalate film was wound, was performed on the same condition as the manufacture of a photoconductor, and the transmittance at 780 nm was evaluated by a commercially available spectrophotometer (Shimadzu: UV-3100), while a polyethylene terephthalate film on which no charge generation layer was applied was a comparative object.

| Coating liquid for underlying layer 1 | |
|---|---|
| N-methoxymethylated nylon (FR101 produced by Namariichi Co., Ltd.) | 5 parts |
| Methanol | 70 parts |
| n-butanol | 30 parts |

| Coating liquid for underlying layer 2 | |
|---|---|
| Titanium oxide (CR-EL produced by Ishihara Sangyo Kaisha, Ltd., average primary particle diameter: approximately 0.25 μm) | 70 parts |
| Alkyd resin [Beckolite M6401-50-S (Solid content 50%), produced by Dainippon Ink and Chemicals, Incorporated] | 14 parts |
| Melamine resin [Superbeckamine L-121-60 (Solid content 60%) produced by Dainippon Ink and Chemicals, Incorporated] | 8 parts |
| 2-butanone | 80 parts |
| The volume ratio of the inorganic pigment to the binder resins is approximately 2/1. Also, the weight ratio of the alkyd resin to the melamine resin is approximately 1.5/1. | |

Coating liquid for charge generation layer

The aforementioned dispersion liquid 1 was used.

| Coating liquid for charge transportation layer | |
|---|---|
| Polycarbonate (TS-2050 produced by Teijin Chemicals Ltd.) | 10 parts |
| Charge transportation material of the following structural formula | 7 parts |

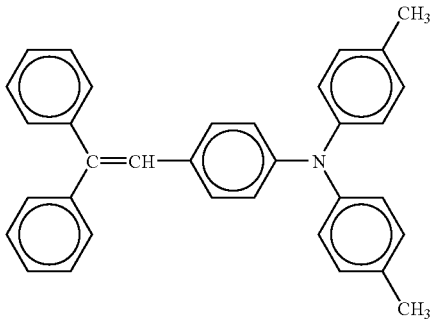

| | |
|---|---|
| Tetrahydrofuran | 80 parts |
| Tetrahydrofuran solution of silicone oil (KF50 (100 cs) produced by Shin-Etsu Chemical Co., Ltd.) | 0.2 parts |

-continued

| Coating liquid for crosslinked-type charge transportation layer | |
|---|---|
| Three-or-more-functional radical-polymerizable monomer having no charge transporting structure (Trimethylolpropane triacrylate (KAYARAD TMPTA produced by Nippon Kayaku Co., Ltd.) Molecular weight: 296, Number of functional groups: 3 functionalities, Molecular weight/Number of functional groups = 99) | 10 parts |
| One-functional radical-polymerizable compound having a charge transporting structure (Illustrated compound No. 54) | 10 parts |
| Photo-polymerization initiator (1-hydroxycyclohexyl phenyl ketone (Irgacure 184 produced by Ciba Speciality Chemicals)) | 1 part |
| Tetrahydrofuran | 100 parts |

Examples 24 through 35

An electrophotographic photoconductors 38 through 49 were manufactured similar to example 23 in all except that dispersion liquid 1 being coating liquid for charge generation layer used in example 23 was changed to dispersion liquids 2 through 13 as listed in Table 7, respectively.

Comparison 15

An electrophotographic photoconductor 50 was manufactured similar to example 31 in all except that the underlying layer 1 was not provided in example 31.

Comparison 16

An electrophotographic photoconductor 51 was manufactured similar to example 31 in all except that the underlying layer 2 was not provided in example 31.

Example 36

An electrophotographic photoconductor 52 was manufactured similar to example 31 in all except that the film thickness of the underlying layer 1 was made be 1.3 μm in example 31.

Example 37

An electrophotographic photoconductor 53 was manufactured similar to example 31 in all except that the film thickness of the underlying layer 1 was made be 2.0 μm in example 31.

Example 38

An electrophotographic photoconductor 54 was manufactured similar to example 31 in all except that the coating liquid for underlying layer 2 was changed to the following composition in example 31.

| Coating liquid for underlying layer 2 | |
|---|---|
| Titanium oxide (CR-EL produced by Ishihara Sangyo Kaisha, Ltd., average particle diameter: approximately 0.25 μm) | 90 parts |

-continued

| Coating liquid for underlying layer 2 | |
|---|---|
| Alkyd resin [Beckolite M6401-50-S (Solid content 50%), produced by Dainippon Ink and Chemicals, Incorporated] | 14 parts |
| Melamine resin [Superbeckamine G-821-60 (Solid content 60%) produced by Dainippon Ink and Chemicals, Incorporated] | 10 parts |
| 2-butanone | 100 parts |

The volume ratio of the inorganic pigment to the binder resins is approximately 2.3/1. Also, the weight ratio of the alkyd resin to the melamine resin is approximately 1.2/1.

Example 39

An electrophotographic photoconductor 55 was manufactured similar to example 36 in all except that the coating liquid for underlying layer 2 was changed to the following composition in example 36.

| Coating liquid for underlying layer 2 | |
|---|---|
| Tin oxide (S-1 produced by Mitsubishi Kinzoku Kogyo Co., Ltd.) | 60 parts |
| Alkyd resin [Beckolite M6401-50-S (Solid content 50%), produced by Dainippon Ink and Chemicals, Incorporated] | 14 parts |
| Melamine resin [Superbeckamine L-121-60 (Solid content 60%) produced by Dainippon Ink and Chemicals, Incorporated] | 10 parts |
| 2-butanone | 70 parts |

The volume ratio of the inorganic pigment to the binder resins is approximately 1.2/1. Also, the weight ratio of the alkyd resin to the melamine resin is approximately 1.2/1.

Example 40

An electrophotographic photoconductor 56 was manufactured similar to example 39 in all except that 10 μm of the underlying layer 2 was formed on the electrically conductive support and 0.6 μm of the underlying layer 1 was stacked thereon in example 39.

Example 41

An electrophotographic photoconductor 57 was manufactured similar to example 31 in all except that the coating liquid for underlying layer 2 was changed to the following composition in example 31.

| Coating liquid for underlying layer 2 | |
|---|---|
| Titanium oxide (CR-EL produced by Ishihara Sangyo Kaisha, Ltd., average primary particle diameter: approximately 0.25 μm) | 50 parts |
| Titanium oxide (PT-401M produced by Ishihara Sangyo Kaisha, Ltd., average primary particle diameter: approximately 0.07 μm) | 30 parts |
| Alkyd resin [Beckolite M6401-50-S (Solid content 50%), produced by Dainippon Ink and Chemicals, Incorporated] | 16 parts |
| Melamine resin [Superbeckamine L-145-60 (Solid content 60%) produced by Dainippon Ink and Chemicals, Incorporated] | 9 parts |
| 2-butanone | 80 parts |

The volume ratio of the inorganic pigment to the binder resins is approximately 2/1. Also, the weight ratio of the alkyd resin to the melamine resin is approximately 1.5/1. D2/D1 is 0.28 and the mixture ratio of the inorganic pigments is approximately 0.38.

Example 42

An electrophotographic photoconductor 58 was manufactured similar to example 31 in all except that the coating liquid for underlying layer 2 was changed to the following composition in example 31.

| Coating liquid for underlying layer 2 | |
|---|---|
| Titanium oxide (CR-EL produced by Ishihara Sangyo Kaisha, Ltd., average primary particle diameter: approximately 0.25 μm) | 40 parts |
| Titanium oxide (TTO-F1 produced by Ishihara Sangyo Kaisha, Ltd., average primary particle diameter: approximately 0.04 μm) | 40 parts |
| Alkyd resin [Beckolite M6401-50-S (Solid content 50%), produced by Dainippon Ink and Chemicals, Incorporated] | 16 parts |
| Melamine resin [Superbeckamine L-145-60 (Solid content 60%) produced by Dainippon Ink and Chemicals, Incorporated] | 9 parts |
| 2-butanone | 80 parts |

The volume ratio of the inorganic pigment to the binder resins is approximately 2/1. Also, the weight ratio of the alkyd resin to the melamine resin is approximately 1.5/1. D2/D1 is 0.16 and the mixture ratio of the inorganic pigments is approximately 0.5.

Example 43

An electrophotographic photoconductor 59 was manufactured similar to example 31 in all except that the coating liquid for underlying layer 1 was changed to the following composition in example 31.

| Coating liquid for underlying layer 1 | |
|---|---|
| N-methoxymethylated nylon (FR101 produced by Namariichi Co., Ltd.) | 5 parts |
| Methanol solution of tartaric acid (Solid content 10%) | 2 parts |
| Methanol | 70 parts |
| n-butanol | 30 parts |

Example 44

An electrophotographic photoconductor 60 was manufactured similar to example 31 in all except that the coating liquid for underlying layer 1 was changed to the following composition in example 31.

| Coating liquid for underlying layer 1 | |
|---|---|
| N-methoxymethylated nylon (FR101 produced by Namariichi Co., Ltd.) | 5 parts |
| Melamine resin [Superbeckamine L-121-60 (Solid content 60%) produced by Dainippon Ink and Chemicals, Incorporated] | 8 parts |
| Methanol solution of tartaric acid (Solid content 10%) | 2 parts |
| Methanol | 120 parts |
| n-butanol | 50 parts |

Example 45

An electrophotographic photoconductor 61 was manufactured similar to example 31 in all except that the coating liquid for underlying layer 1 was changed to the following composition and the film thickness thereof was made be 0.5 μm in example 31.

| Coating liquid for underlying layer 1 | |
|---|---|
| Copolymer nylon (Amilan CM8000 produced by Toray Industries, Inc.) | 5 parts |
| Methanol | 70 parts |
| n-butanol | 30 parts |

Example 46

An electrophotographic photoconductor 62 was manufactured similar to example 45 in all except that the film thickness of the underlying layer 1 was changed to 1.0 μm in example 45.

Example 47

An electrophotographic photoconductor 63 was manufactured similar to example 31 in all except that the coating liquid for underlying layer 1 was changed to the following composition and the film thickness thereof was made be 0.5 μm in example 31.

| Coating liquid for underlying layer 1 | |
|---|---|
| Alkyd resin [Beckolite M6401-50-S (Solid content 50%), produced by Dainippon Ink and Chemicals, Incorporated] | 14 parts |
| Melamine resin [Superbeckamine G-821-60 (Solid content 60%) produced by Dainippon Ink and Chemicals, Incorporated] | 10 parts |
| 2-butanone | 100 parts |

Example 48

An electrophotographic photoconductor 64 was manufactured similar to example 46 in all except that the coating liquid for underlying layer 2 was changed to the following composition in example 46.

| Coating liquid for underlying layer 2 | |
|---|---|
| Titanium oxide (CR-EL produced by Ishihara Sangyo Kaisha, Ltd.) | 90 parts |
| Alkyd resin [Beckolite M6401-50-S (Solid content 50%), produced by Dainippon Ink and Chemicals, Incorporated] | 14 parts |
| Melamine resin [Superbeckamine G-821-60 (Solid content 60%) produced by Dainippon Ink and Chemicals, Incorporated] | 10 parts |
| 2-butanone | 100 parts |

The volume ratio of the inorganic pigment to the binder resins is approximately 2.3/1. Also, the weight ratio of the alkyd resin to the melamine resin is approximately 1.2/1.

Example 49

An electrophotographic photoconductor 65 was manufactured similar to example 45 in all except that 10 μm of an underlying layer 2 of the following composition was formed on the electrically conductive support and 0.5 μm of the underlying layer 1 was stacked thereon in example 45.

| Coating liquid for underlying layer 2 | |
|---|---|
| Tin oxide (S-1 produced by Mitsubishi Kinzoku Kogyo Co., Ltd.) | 80 parts |
| Alkyd resin [Beckolite M6401-50-S (Solid content 50%), produced by Dainippon Ink and Chemicals, Incorporated] | 18 parts |
| Melamine resin [Superbeckamine L-121-60 (Solid content 60%) produced by Dainippon Ink and Chemicals, Incorporated] | 6 parts |
| 2-butanone | 80 parts |

The volume ratio of the inorganic pigment to the binder resins is approximately 2.1/1. Also, the weight ratio of the alkyd resin to the melamine resin is approximately 2.5/1.

Example 50

An electrophotographic photoconductor 66 was manufactured similar to example 31 in all except that the coating liquid for charge transportation layer was changed to the following composition in example 31.

| Coating liquid for charge transportation layer | |
|---|---|
| Polymeric charge transportation material of the following composition (weight-average molecular weight: approximately 135000) | 10 parts |

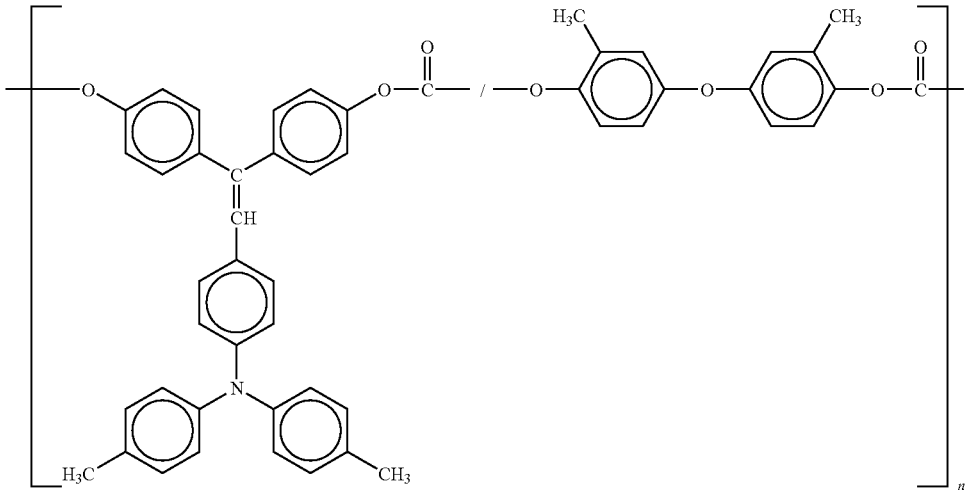

| | |
|---|---|
| Methylene chloride | 100 parts |

Comparison 17

An electrophotographic photoconductor 67 was manufactured similar to example 31 in all except that the crosslinked-type charge transportation layer was instead changed to a charge transportation layer containing an inorganic pigment of the following composition and the film thickness thereof was made be 6.0 μm in example 31.

| Coating liquid for a charge transportation layer containing an inorganic pigment | |
|---|---|
| Alumina (average primary particle diameter: 0.4 μm, Sumicorundum AA-03 produced by Sumitomo Chemical Co., Ltd.) | 2 parts |
| Wetting dispersing agent (Solid content 50%, BYK-P104 produced by BYK-Chemie) | 0.025 parts |
| Polycarbonate (TS-2050 produced by TEIJIN CHEMICALS LTD., viscosity-average molecular weight: 50000) | 10 parts |
| Charge transportation material of the following structural formula | 7 parts |

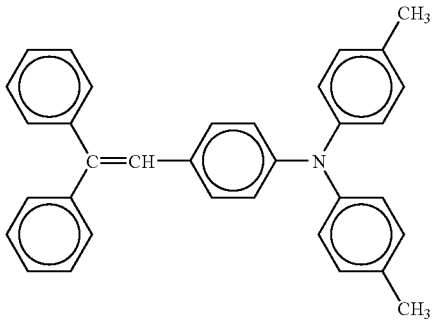

| | |
|---|---|
| Cyclohexanone | 500 parts |
| Tetrahydrofuran | 150 parts |

Comparison 18

An electrophotographic photoconductor 68 was manufactured similar to example 31 in all except that the film thickness of the charge transportation layer was made be 24 μm and the crosslinked-type charge transportation layer provided on the top surface was not formed in example 31.

Example 51

An electrophotographic photoconductor 69 was manufactured similar to example 31 in all except that the film thickness of the crosslinked-type charge transportation layer was made be 8 μm and the film thickness of the charge transportation layer was made be 16 μm in example 31.

Example 52

An electrophotographic photoconductor 70 was manufactured similar to example 31 in all except that the three-or-more-functional radical-polymerizable monomer having no charge transporting structure contained in coating liquid for crosslinked-type charge transportation layer was changed to the following radical-polymerizable monomer in example 31.

| | |
|---|---|
| Three-or-more-functional radical-polymerizable monomer having no charge transporting structure (Penta-erythritol tetraacrylate (SR-295 by produced by Kayaku Sartomer Co., Ltd.) Molecular weight: 352, Number of functional groups: 4 functionalities, Molecular weight/Number of functional groups = 88) | 10 parts |

Comparison 19

An electrophotographic photoconductor 71 was manufactured similar to example 31 in all except that the three-or-more-functional radical-polymerizable monomer having no charge transporting structure contained in coating liquid for crosslinked-type charge transportation layer was changed to 10 parts of two-functional radical-polymerizable monomer having no charge transporting structure and the film thickness of the crosslinked-type charge transportation layer was made be 6.0 μm in example 31.

| | |
|---|---|
| Two-functional radical-polymerizable monomer having no charge transporting structure<br>1,6-hexanediol diacrylate (produced by Wako Pure Chemical Industries, Ltd.)<br>Molecular weight: 226, Number of functional groups: 2 functionalities, Molecular weight/umber of functional groups = 113 | 10 parts |

Example 53

An electrophotographic photoconductor 72 was manufactured similar to example 31 in all except that the three-or-more-functional radical-polymerizable monomer having no charge transporting structure contained in coating liquid for crosslinked-type charge transportation layer was changed to the following monomer and the film thickness of the crosslinked-type charge transportation layer was made be 6.5 μm in example 31.

| | |
|---|---|
| Three-or-more-functional radical-polymerizable monomer having no charge transporting structure<br>Caprolactone-modified di-penta-erythritol hexaacrylate<br>(KAYARAD DPCA-120 produced by Nippon Kayaku Co., Ltd.)<br>Molecular weight: 1947, Number of functional groups: 6 functionalities, Molecular weight/Number of functional groups = 325 | 10 parts |

Comparison 20

An electrophotographic photoconductor 73 was manufactured similar to example 31 in all except that the one-functional radical-polymerizable compound having a charge transporting structure contained in coating liquid for crosslinked-type charge transportation layer was changed to 10 parts of two-functional radical-polymerizable compound having a charge transporting structure reprsented by the following structural formula and the film thickness of the crosslinked-type charge transportation layer was made be 6.2 μm in example 31.

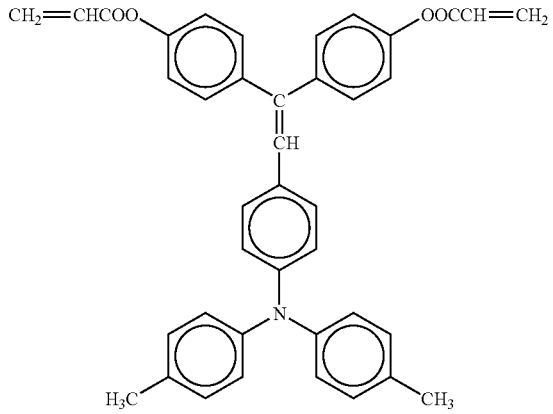

Comparison 21

An electrophotographic photoconductor 74 was manufactured similar to example 31 in all except that the one-functional radical-polymerizable compound having a charge transporting structure being a component of coating liquid for crosslinked-type charge transportation layer was not contained but was changed to 20 parts of the three-or-more-functional radical-polymerizable monomer having no charge transporting structure, and the film thickness of the crosslinked-type charge transportation layer was made be 4.0 μm in example 31.

Comparison 22

An electrophotographic photoconductor 75 was manufactured similar to example 31 in all except that the one-functional radical-polymerizable compound having a charge transporting structure being a component of coating liquid for crosslinked-type charge transportation layer was not contained but, instead, 10 parts of the low-molecular-weight charge transportation material used for the coating liquid for charge transportation layer was contained, and the film thickness of the crosslinked-type charge transportation layer was made be 6.5 μm in example 31.

Comparison 23

An electrophotographic photoconductor 76 was manufactured similar to example 31 in all except that the film thickness of the charge transportation layer was made be 19 μm and coating liquid for protective layer of the following composition was applied and dried on the charge transportation layer so as to provide a protective layer with 5 μm in example 31.

| Coating liquid for protective layer | |
|---|---|
| Methyltrimethyoxysilane | 100 parts |
| 3% acetic acid | 20 parts |
| Charge transportation compound of the following structure | 35 parts |

-continued

| Coating liquid for protective layer |
|---|
| 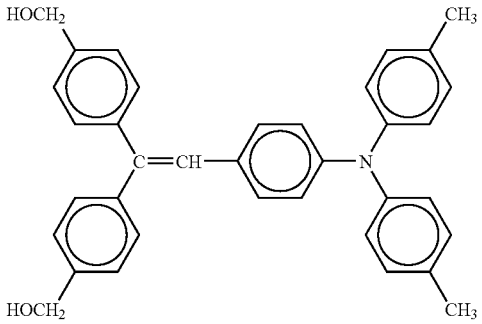 |

Comparison 24

An electrophotographic photoconductor 77 was manufactured similar to example 31 in all except that the coating liquid for crosslinked-type charge transportation layer was changed to the following coating liquid for protective layer and the film thickness thereof was made be 6.0 μm in example 31.

| Coating liquid for protective layer | |
|---|---|
| Polymeric charge transportation material of the following composition (weight-average molecular weight: approximately 135000) | 10 parts |
| 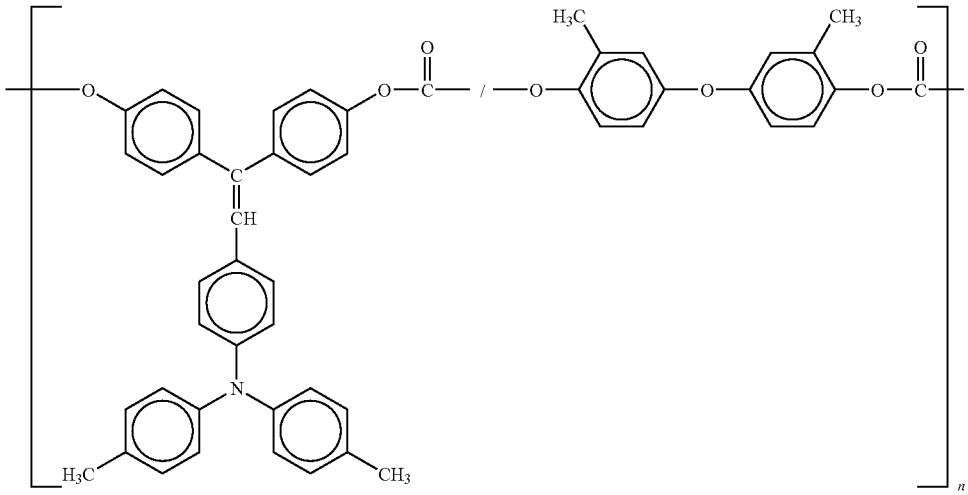 | |
| Tetrahydrofuran | 100 parts |

In regard to electrophotographic photoconductors 37 through 77 manufactured as described above, the appearances were visually observed so as to judge the presence or absence of a crack or film peeling. Next, as a test of solubility to an organic solvent, a drop of tetrahydrofuran (abbreviated as THF below) or dichloromethane was dropped and the change of a surface shape was observed after air-drying.

The results are shown in Table 8.

| Example/ Comparison | Photo-conductor No. | Surface observation | Solubility test THF | Solubility test Dichloro-methane |
|---|---|---|---|---|
| Example 23 | 37 | Good | Insoluble | Insoluble |
| Example 24 | 38 | Good | Insoluble | Insoluble |
| Example 25 | 39 | Good | Insoluble | Insoluble |
| Example 26 | 40 | Good | Insoluble | Insoluble |
| Example 27 | 41 | Good | Insoluble | Insoluble |
| Example 28 | 42 | Good | Insoluble | Insoluble |
| Example 29 | 43 | Good | Insoluble | Insoluble |
| Example 30 | 44 | Good | Insoluble | Insoluble |
| Example 31 | 45 | Good | Insoluble | Insoluble |
| Example 32 | 46 | Good | Insoluble | Insoluble |
| Example 33 | 47 | Good | Insoluble | Insoluble |
| Example 34 | 48 | Good | Insoluble | Insoluble |
| Example 35 | 49 | Good | Insoluble | Insoluble |
| Comparison 15 | 50 | Good | Insoluble | Insoluble |
| Comparison 16 | 51 | Good | Insoluble | Insoluble |
| Example 36 | 52 | Good | Insoluble | Insoluble |
| Example 37 | 53 | Good | Insoluble | Insoluble |
| Example 38 | 54 | Good | Insoluble | Insoluble |
| Example 39 | 55 | Good | Insoluble | Insoluble |
| Example 40 | 56 | Good | Insoluble | Insoluble |
| Example 41 | 57 | Good | Insoluble | Insoluble |
| Example 42 | 58 | Good | Insoluble | Insoluble |

-continued

| Example/ Comparison | Photo-conductor No. | Surface observation | Solubility test THF | Solubility test Dichloro-methane |
|---|---|---|---|---|
| Example 43 | 59 | Good | Insoluble | Insoluble |
| Example 44 | 60 | Good | Insoluble | Insoluble |
| Example 45 | 61 | Good | Insoluble | Insoluble |

-continued

| Example/ Comparison | Photo-conductor No. | Surface observation | Solubility test THF | Solubility test Dichloro-methane |
|---|---|---|---|---|
| Example 46 | 62 | Good | Insoluble | Insoluble |
| Example 47 | 63 | Good | Insoluble | Insoluble |
| Example 48 | 64 | Good | Insoluble | Insoluble |
| Example 49 | 65 | Good | Insoluble | Insoluble |
| Example 50 | 66 | Good | Insoluble | Insoluble |
| Comparison 17 | 67 | Good | Soluble | Soluble |
| Comparison 18 | 68 | Good | Soluble | Soluble |
| Example 51 | 69 | Good | Insoluble | Insoluble |
| Example 52 | 70 | Good | Insoluble | Insoluble |
| Comparison 19 | 71 | Good | Slightly soluble | Slightly soluble |
| Example 53 | 72 | Good | Insoluble | Insoluble |
| Comparison 20 | 73 | A crack was generated. | Insoluble | Insoluble |
| Comparison 21 | 74 | Good | Insoluble | Insoluble |
| Comparison 22 | 75 | Clouding was generated by precipitation of charge transportation material. | Soluble | Soluble |
| Comparison 23 | 76 | Good | Insoluble | Insoluble |
| Comparison 24 | 77 | Good | Soluble | Soluble |

It is understood that, in regard to the photoconductors having a crosslinked-type charge transportation layer according to the present invention, a crack or film peeling was not generated at the time of formation of the crosslinked-type charge transportation layer and they were good in appearance. Also, it was confirmed that insolubility was exhibited in the solubility test. On the other hand, a crack was generated in the electrophotographic photocoductor for which a two-functional radical-polymerizable compound having a charge transporting structure was used as a component of the crosslinked-type charge transportation layer. Also, when the one-functional radical-polymerizable compound having a charge transporting structure was not contained but a low-molecular-weight charge transportation material was not contained, clouding was generated and solubility was exhibited in the solubility test.

Electrophotographic photoconductors 37 through 77 manufactured as described above were installed in the image formation apparatus shown in FIG. 11. Herein, a scorotron was used as a charging member, semiconductor laser of 780 nm (image writing by a polygon mirror) was used as an image-wise-light-exposure light source, and a transcription belt was used as a transcription member. The linear velocity of the photoconductor in the image formation apparatus was 362 mm/sec. The evaluation of an initial electric potential at an exposed portion (VL) and image evaluation were performed using this image formation apparatus. In regard to the image evaluation, an applied voltage was adjusted such that an electric potential at a dark portion (VD) was 800 (−V) (electric field strength 30 through 35 V/μm) and a development bias was set to be 550 (−V). Subsequently, 1,000,000 copies of printing tests were performed and image evaluation was performed. For the evaluation after the tests of running 1,000,000 copies of printings, an applied voltage was adjusted such that an electric potential at a dark portion (VD) was 800 (−V) (electric field strength 30 through 35 V/μm) or 900 (−V) (electric field strength 35 through 40 V/μm) and a development bias was set to be 550 (−V) or 650 (−V), respectively. Environment for evaluation was 25° C. and 50% RH. Herein, image evaluation level was represented by the following four levels, ◎: very good level, ○: non-problematic level although some image quality degradation was found, Δ: level in which an image defect was apparently recognized, and X: level in which the influence of an image defect is high and image quality was very bad. These results are shown in Table 9.

| Example/ Comparison | Photo conductor No. | Charge generation layer dispersion liquid | 25° C. 50% RH Initial VL (−V) | Initial Image evaluation | After 1,000,000 copies of printings Image evaluation (−800 V) | Image evaluation (−900 V) | Abrasion loss (μm) |
|---|---|---|---|---|---|---|---|
| Example 23 | 37 | Dispersion liquid 1 | 160 | ◎ Good | Δ Background contamination | Δ Background contamination | 2.0 |
| Example 24 | 38 | Dispersion liquid 2 | 170 | ◎ Good | Δ Background contamination | Δ Background contamination | 2.0 |
| Example 25 | 39 | Dispersion liquid 3 | 140 | ◎ Good | Δ Background contamination | Δ Background contamination | 2.0 |
| Example 26 | 40 | Dispersion liquid 4 | 150 | ◎ Good | Δ Background contamination | Δ Background contamination | 2.1 |
| Example 27 | 41 | Dispersion liquid 5 | 150 | ◎ Good | Δ Background contamination | Δ Background contamination | 2.0 |
| Example 28 | 42 | Dispersion liquid 6 | 160 | ◎ Good | Δ Background contamination | Δ Background contamination | 2.0 |
| Example 29 | 43 | Dispersion liquid 7 | 165 | ◎ Good | Δ Background contamination | Δ Background contamination | 2.0 |
| Example 30 | 44 | Dispersion liquid 8 | 150 | ◎ Good | Δ Background contamination | Δ Background contamination | 2.0 |

-continued

| Example/ Comparison | Photo conductor No. | Charge generation layer dispersion liquid | 25° C. 50% RH Initial VL (−V) | Initial Image evaluation | After 1,000,000 copies of printings Image evaluation (−800 V) | Image evaluation (−900 V) | Abrasion loss (μm) |
|---|---|---|---|---|---|---|---|
| Example 31 | 45 | Dispersion liquid 9 | 150 | ◎ Good | ◎ Good | ◎ Good | 2.0 |
| Example 32 | 46 | Dispersion liquid 10 | 150 | ◎ Good | ◎ Good | ◎ Good | 2.0 |
| Example 33 | 47 | Dispersion liquid 11 | 150 | ◎ Good | ◎ Good | ◎ Good | 2.0 |
| Example 34 | 48 | Dispersion liquid 12 | 150 | ◎ Good | Δ Background contamination | Δ Background contamination | 2.0 |
| Example 35 | 49 | Dispersion liquid 13 | 150 | ◎ Good | Δ Background contamination | Δ Background contamination | 2.0 |
| Comparison 15 | 50 | Dispersion liquid 9 | 150 | ○ Background contamination | X Background contamination | X Background contamination | 2.1 |
| Comparison 16 | 51 | Dispersion liquid 9 | 185 | X Moire ○ Concentration reduction | Evaluation termination | | |
| Example 36 | 52 | Dispersion liquid 9 | 155 | ◎ Good | ◎ Good | ◎ Good | 2.0 |
| Example 37 | 53 | Dispersion liquid 9 | 170 | ◎ Good | ○ Concentration reduction | ○ Concentration reduction | 1.9 |
| Example 38 | 54 | Dispersion liquid 9 | 145 | ◎ Good | ◎ Good | ◎ Good | 2.0 |
| Example 39 | 55 | Dispersion liquid 9 | 130 | ◎ Good | ◎ Good | ○ Background contamination | 2.0 |
| Example 40 | 56 | Dispersion liquid 9 | 130 | ◎ Good | ○ Background contamination | ○ Background contamination | 2.0 |
| Example 41 | 57 | Dispersion liquid 9 | 150 | ◎ Good | ◎ Good | ◎ Good | 2.0 |
| Example 42 | 58 | Dispersion liquid 9 | 160 | ○ Moire | ○ Moire | ○ Moire | 2.1 |
| Example 43 | 59 | Dispersion liquid 9 | 145 | ◎ Good | ◎ Good | ◎ Good | 2.0 |
| Example 44 | 60 | Dispersion liquid 9 | 155 | ◎ Good | ◎ Good | ◎ Good | 1.9 |
| Example 45 | 61 | Dispersion liquid 9 | 160 | ◎ Good | ◎ Good | ○ Background contamination | 2.0 |
| Example 46 | 62 | Dispersion liquid 9 | 180 | ◎ Good | ○ Concentration reduction | ○ Concentration reduction | 2.0 |
| Example 47 | 63 | Dispersion liquid 9 | 170 | ◎ Good | ○ Concentration reduction | ○ Concentration reduction | 2.0 |
| Example 48 | 64 | Dispersion liquid 9 | 170 | ◎ Good | ◎ Good | ○ Concentration reduction | 2.1 |
| Example 49 | 65 | Dispersion liquid 9 | 135 | ◎ Good | ○ Background contamination | ○ Background contamination | 2.0 |
| Example 50 | 66 | Dispersion liquid 9 | 165 | ◎ Good | ◎ Good | ◎ Good | 1.7 |

-continued

| Example/ Comparison | Photo conductor No. | Charge generation layer dispersion liquid | 25° C. 50% RH Initial VL (−V) | Initial Image evaluation | After 1,000,000 copies of printings Image evaluation (−800 V) | Image evaluation (−900 V) | Abrasion loss (μm) |
|---|---|---|---|---|---|---|---|
| Comparison 17 | 67 | Dispersion liquid 9 | 140 | ◎ Good | Δ Background contamination Δ Filming | Δ Background contamination Δ Filming | 3.5 |
| Comparison 18 | 68 | Dispersion liquid 9 | 125 | ◎ Good | X Background contamination (Termination at 300,000 copies) | X Background contamination (Termination at 300,000 copies) | 4.5 (300,000 copies) |
| Example 51 | 69 | Dispersion liquid 9 | 170 | ◎ Good | ◎ Good | ◎ Good | 2.0 |
| Example 52 | 70 | Dispersion liquid 9 | 145 | ◎ Good | ◎ Good | ◎ Good | 1.8 |
| Comparison 19 | 71 | Dispersion liquid 9 | 120 | ◎ Good | X Background contamination (Termination at 300,000 copies) | X Background contamination (Termination at 300,000 copies) | 4.1 (300,000 copies) |
| Example 53 | 72 | Dispersion liquid 9 | 145 | ◎ Good | ○ Background contamination | ○ Background contamination | 4.9 |
| Comparison 20 | 73 | Dispersion liquid 9 | 130 | X Crack vestige | Evaluation termination | | |
| Comparison 21 | 74 | Dispersion liquid 9 | 260 | Δ Concen-tration reduction | Evaluation termination | | |
| Comparison 22 | 75 | Dispersion liquid 9 | 165 | Δ Back-ground contami-nation | Evaluation termination | | |
| Comparison 23 | 76 | Dispersion liquid 9 | 110 | ◎ Good | Δ Resolution reduction | Δ Resolution reduction | 2.4 |
| Comparison 24 | 77 | Dispersion liquid 9 | 130 | ◎ Good | X Background contamination (Termination at 600,000 copies) | X Background contamination (Termination at 600,000 copies) | 5.2 (600,000 copies) |

It was confirmed that, even though a test of running 100,000 copies of printings was carried out, a very stable image with little background contamination could be obtained in regard to the electrophotographic photoconductor according to the present invention. Also, it could be confirmed that the influence of filming, image deletion, etc. was not found while the abrasion of a photoconductor surface was little, and image concentration was also stable, so that a good image would be maintained for the long term. On the other hand, when the charge generation material does not have a particular crystallographic type indicated in the present invention or the crystal particle size was larger than 0.25 μm, obvious background contamination occurred after the running, and, as the result of performing observation with enlargement, it was confirmed that there was a positional relationship between the background contamination and a crude large particle contained in the charge generation layer of the photoconductor. Particularly, the surface area of the background contamination caused by a crude large particle contained in the charge generation layer was large and the background contamination was conspicuous even though the number of it was small, so that the level of image was very poor. If the underlying layer was a single layer, the increase of background contamination, the generation of Moire, the image concentration reduction caused by the elevation of a residual electric potential, etc., were caused, and the stability of image quality was substantially lowered. In the present invention, the generation of Moire and ackground contamination was simultaneously suppressed by stacking at least two layers being an underlying layer containing no inorganic pigment and an underlying layer containing an inorganic pigment, and the durability such that it could be durable to 1,000,000 copies of printings was attained. Also, even though a protective layer was formed on the surface of a photoconductor, a side effect such that wear resistance was insufficient, the generation of filming was facilitated, the elevation of a residual electric potential was caused, etc., was frequently found, but the drastic improvement of the wear resistance was realized without that side effect and consequently, a significant improvement was made in regard to the background contamination, by forming a crosslinked-type charge transportation layer for the present invention, so that a highly durable and highly stable electrophotographic photoconductor in which an image with a high image quality was maintained even after 1,000,000 copies of printings and an image formation apparatus using it was provided.

It was apparent that, in the present invention, the variation of a electric potential at an light-exposed portion was seldom found even after 1,000,000 copies of printings, the wear resistance was drastically improved, and the effect of suppressing background contamination was continued, by using a titanyl phthalocyanine which had a particular crystallographic type and in which the average particle size of primary particles was equal to or less than 25 μm and, further, making the underlying layer be plural ones, and stacking a particular crosslinked-type charge transportation layer on a photoconductor surface. On the other hand, it was apparent that in the case of satisfying none of those conditions, background contamination occurred early, the elevation of an electric potential at a light-exposed portion became very high, or the reduction of resolution was caused, so that the high durability of a photoconductor and image formation apparatus using it could not be realized.

Finally, whether 7.3° being a Bragg angle θ of a peak at the smallest angle, which is a characteristic of a titanyl phthalocyanine crystal used for the present invention, is identical to the smallest angle 7.5° of a publicly known material or not is considered.

Comparison Synthesis Example 9

A titanyl phthalocyanine crystal was obtained by performing treatment similar to comparison synthesis example 1 except that the crystal transformation solvent was changed from methylene chloride to 2-butanone in comparison synthesis example 1.

Figure 17:
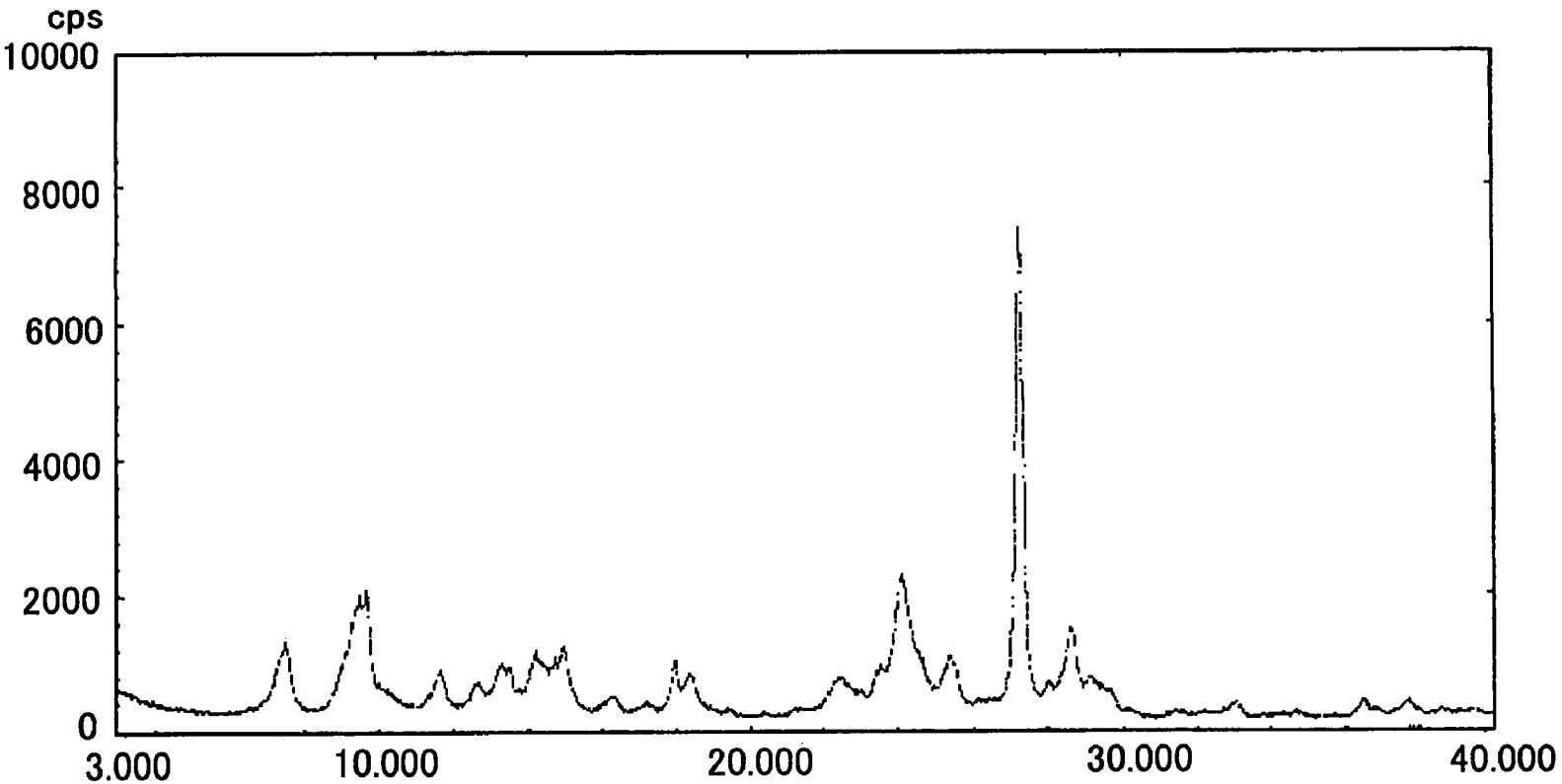
FIG. 17 is a drawing of an XD spectrum of titanyl phthalocyanine crystal obtained in comparison synthesis example 9.

Similarly to the case of comparison synthesis example 1, the XD spectrum of a titanyl phthalocyanine crystal prepared in comparison synthesis example 9 was measured. This is shown in FIG. 17. It was found from FIG. 17 that the smallest angle on the XD spectrum of a titanyl phthalocyanine crystal prepared in comparison synthesis example 9 is different from the smallest angle (7.3°) in regard to a titanyl phthalocyanine prepared in comparison synthesis example 1 and lay in 7.5°.

Measurement Example 1

3% by weight of one prepared similarly to a titanyl phthalocyanine (having a maximum diffraction peak at 7.5°) described in Japanese Laid-Open Patent Application No. 61-239248 was added into titanyl phthalocyanine (the smallest angle 7.3°) obtained in synthesis example 1, mixing was made in a mortar, and a X-ray diffraction spectrum was measured similarly to the previous one. The X-ray diffraction spectrum of measurement example 1 is shown in FIG. 18.

Measurement Example 2

Figure 19:
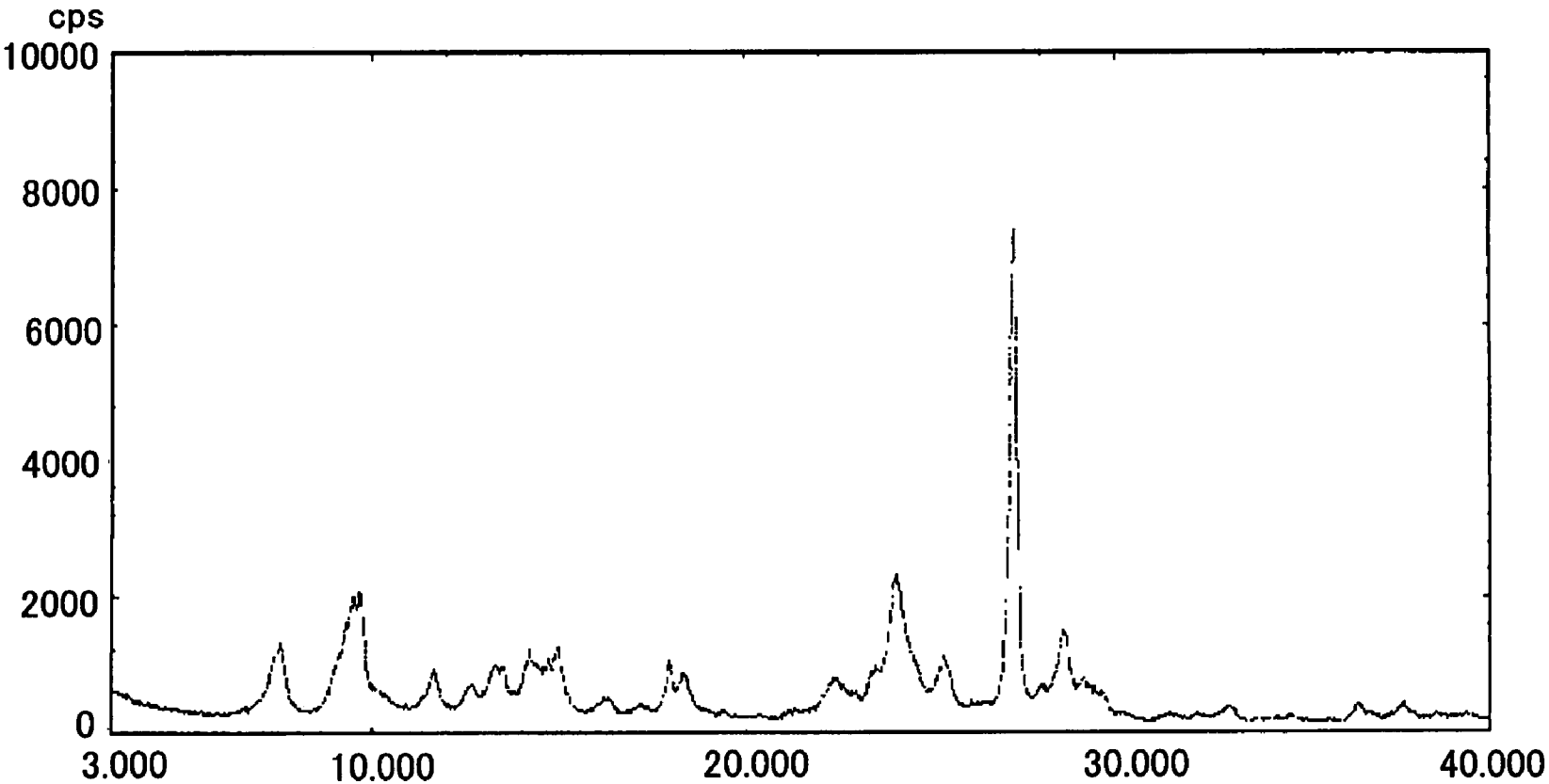
FIG. 19 is a drawing of an X-ray diffraction spectrum in measurement example 2.

3% by weight of one prepared similarly to a titanyl phthalocyanine (having a maximum diffraction peak at 7.5°) described in Japanese Laid-Open Patent Application No. 61-239248 was added into titanyl phthalocyanine (the smallest angle 7.5°) obtained in comparison synthesis example 9, mixing was made in a mortar, and a X-ray diffraction spectrum was measured similarly to the previous one. The X-ray diffraction spectrum of measurement example 2 is shown in FIG. 19.

Figure 18:
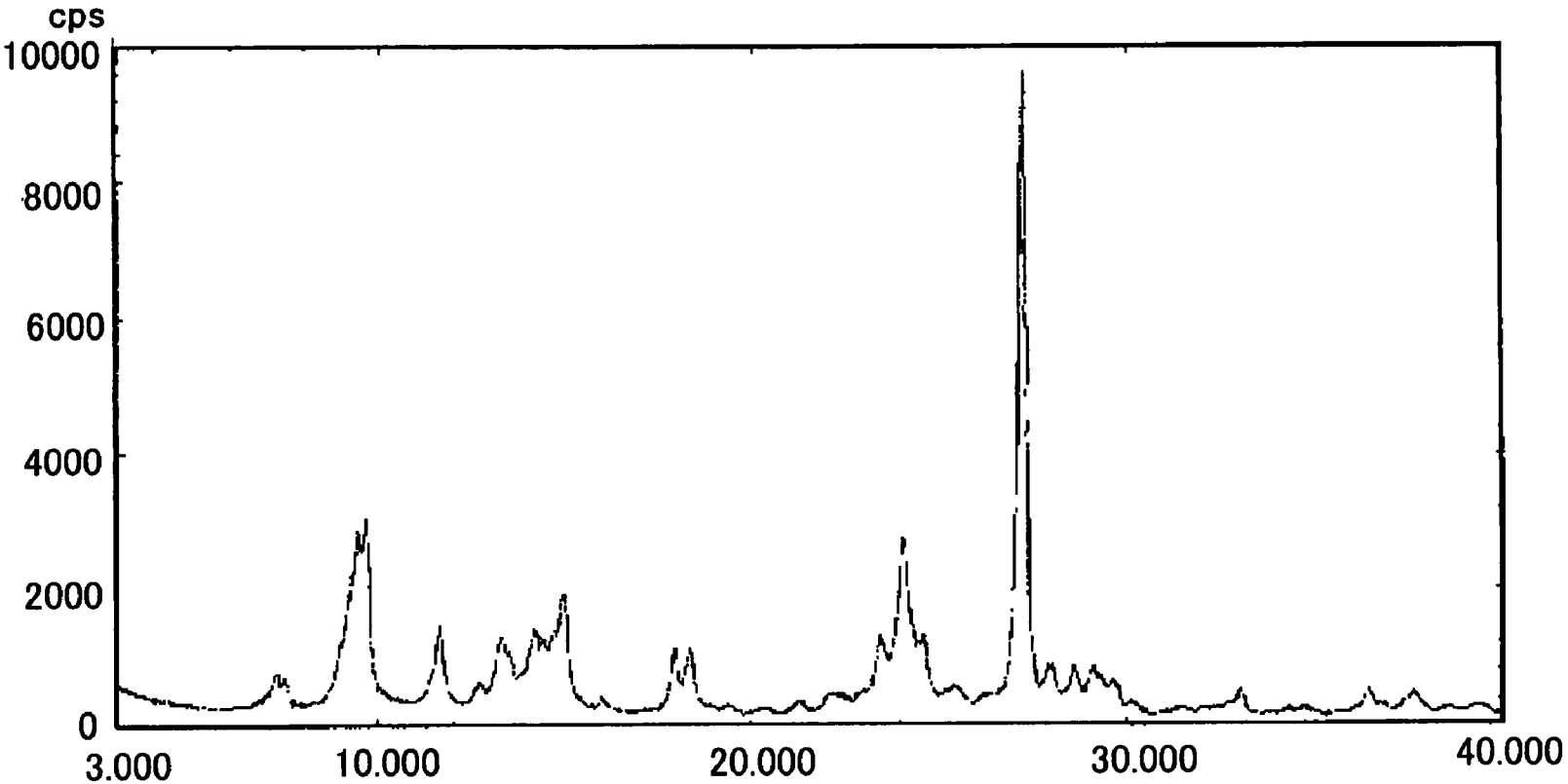
FIG. 18 is a drawing of an X-ray diffraction spectrum in measurement example 1.

It was found that two independent peaks of 7.3° and 7.5° were present on the lower angle side and, at least, the peaks at 7.3° and 7.5° were different, in the spectrum of FIG. 18. In the other hand, a peak on a smaller angle side was present only at 7.5° in the spectrum of FIG. 19, which was obviously different from the spectrum of FIG. 18.

From the matters mentioned above, it was found that a peak at the smallest angle 7.3° in regard to a titanyl phthalocyanine crystal which was preferably used for the present invention was different from a peak at 7.5° in regard to a publicly known titanyl phthalocyanine crystal.

Thus, for a charge generation layer, a titanyl phthalocyanine crystal which, at least, has a maximum diffraction peak at 27.2°, further has main peaks at 9.4°, 9.6°, and 24.0°, has a peak at 7.3° as a diffraction peak at a smallest angle side, has no peak between the peak at 7.3° and the peak at 9.4°, and further has no peak at 26.3°, in regard to a diffraction peak (±0.2°) at a Bragg angle 2θ of CuKα line (wavelength of 1.542 Å), can be used as a charge generation material. Further, the average particle size of primary particles of the titanyl phthalocyanine crystal having this particular crystallographic type is made be equal to or less than 0.25 μm at the time of crystal synthesis or by a dispersion filteration treatment. As mentioned above, by making an underlying layer be plural ones or stacking an underlying layer that contains N-methoxymethylated nylon, the charge injection from an electrically conductive support is suppressed so as to enhance the effect of suppressing background contamination significantly and background contamination caused by the aggregation or lowering of purity of a charge generation layer formed thereon can be also suppressed. That is, the elevation of a residual electric potential or a side effect to environmental dependence can be reduced and the durability against background contamination can be drastically improved by suppressing both factors of background contamination in the underlying layer and the charge generation layer simultaneously.

INDUSTRIAL APPLICABILITY

Due to a photoconductor according to the present invention, miniaturization and speeding up of an image formation apparatus can be realized, since the generation of background contamination can be suppressed even in repeated use over a long term, a change of an electric potential at a light-exposed portion over time is also very little, and the generation of an image defect such as image deletion and filming can be also suppressed, so that an image with high image quality can be stably output for a long term. Particularly, it can be effectively used for a tandem-type full-color image formation apparatus or high-speed image formation apparatus, in which the requirements for the durability and stability of image quality of a photoconductor are high.

The invention claimed is:

1. An electrophotographic photoconductor comprising at least an underlying layer, a photoconductive layer, and a crosslinked-type charge transportation layer being stacked on an electrically conductive support in order, wherein the underlying layer comprises at least two layers comprising a layer comprising an inorganic pigment and a layer comprising no inorganic pigment, and the crosslinked-type charge transportation layer is formed by curing at least a three-or-more-functional radical-polymerizable monomer having no charge transporting structure and a one-functional radical-polymerizable compound having a charge transporting structure.

2. The electrophotographic photoconductor as claimed in claim 1, wherein the photoconductive layer comprises a stacked-layer structure configured such that a charge generation layer and a charge transportation layer are stacked in order.

3. The electrophotographic photoconductor as claimed in claim 1, wherein the layer comprising no inorganic pigment in the underlying layer comprises a polyamide resin.

4. The electrophotographic photoconductor as claimed in claim 3, wherein the polyamide resin is an N-methoxymethylated nylon.

5. The electrophotographic photoconductor as claimed in claim 4, wherein the N-methoxymetylated nylon is crosslinked by heating.

6. The electrophotographic photoconductor as claimed in claim 1, wherein a layer thickness of the layer comprising no inorganic pigment in the underlying layer is less than 1.0 μm.

7. The electrophotographic photoconductor as claimed in claim 1, wherein the layer comprising an inorganic pigment in the underlying layer comprises a metal oxide as the inorganic pigment.

8. The electrophotographic photoconductor as claimed in claim 1, wherein the layer comprising an inorganic pigment in the underlying layer comprises a thermosetting resin as a binder resin.

9. The electrophotographic photoconductor as claimed in claim 1, wherein a film thickness of the layer comprising an inorganic pigment is greater than a film thickness of the layer comprising no inorganic pigment in the underlying layer.

10. The electrophotographic photoconductor as claimed in claim 1, wherein the layer comprising no inorganic pigment in the underlying layer is formed directly on the electrically conductive support and the layer comprising an inorganic pigment is stacked thereon.

11. The electrophotographic photoconductor as claimed in claim 1, wherein the crosslinked-type charge transportation layer is insoluble in an organic solvent.

12. The electrophotographic photoconductor as claimed in claim 1, wherein a functional group(s) of the three-or-more-functional radical-polymerizable monomer having no charge transporting structure used for the crosslinked-type charge transportation layer is/are an acryloyloxy group and/or a methacryloyloxy group.

13. The electrophotographic photoconductor as claimed in claim 1, wherein a ratio of a molecular weight to the number of a functional group(s) (molecular weight/the number of functional group(s)) in regard to the three-or-more-functional radical-polymerizable monomer having no charge transporting structure used for the crosslinked-type charge transportation layer is equal to or less than 250.

14. The electrophotographic photoconductor as claimed in claim 1, wherein a functional group of the one-functional radical-polymerizable compound having a charge transporting structure used for the crosslinked-type charge transportation layer is an acryloyloxy group or a methacryloyloxy group.

15. The electrophotographic photoconductor as claimed in claim 1, wherein the charge transporting structure of the one-functional radical-polymerizable compound having a charge transporting structure used for the crosslinked-type charge transportation layer is a triarylamine structure.

16. The electrophotographic photoconductor as claimed in claim 1, wherein the one-functional radical-polymerizable compound having a charge transporting structure used for the crosslinked-type charge transportation layer is at least one kind of compound represented by the following general formula (1) or (2);

General formula (1)

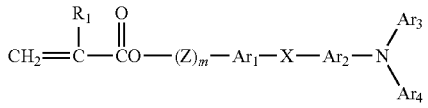

General formula (2)

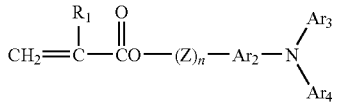

wherein in the formulas, $R_1$ represents a hydrogen atom, a halogen atom, an alkyl group that may have a substituent, an aralkyl group that may have a substituent, an aryl group that may have a substituent, a cyano group, a nitro group, an alkoxy group, —$COOR_7$ ($R_7$ represents a hydrogen atom, an alkyl group that may have a substituent, an aralkyl group that may have a substituent, or an aryl group that may have a substituent), a carbonyl halide group, or —$CONR_8R_9$ ($R_8$ and $R_9$ represent hydrogen atoms, halogen atoms, alkyl groups that may have a substituent, aralkyl groups that may have a substituent, or aryl groups that may have a substituent, and may be identical to or different from each other), and $Ar_1$ and $Ar_2$ represent substituted or non-substituted arylene groups and may be identical or different, $Ar_3$ and $Ar_4$ represent substituted or non-substituted aryl groups and may be identical or different, X represents a single bond, a substituted or non-substituted alkylene group, a substituted or non-substituted cycloalkylene group, a substituted or non-substituted alkylene ether group, an oxygen atom, a sulfur atom, or a vinylene group, Z represents a substituted or non-substituted alkylene group, a substituted or non-substituted alkylene ether group, or an alkyleneoxycarbonyl group, and m and n represent integers of 0 through 3.

17. The electrophotographic photoconductor as claimed in claim 1, wherein the one-functional radical-polymerizable compound having a charge transporting structure used for the crosslinked-type charge transportation layer is at least one kind of compound represented by the following general formula (3);

General formula (3)

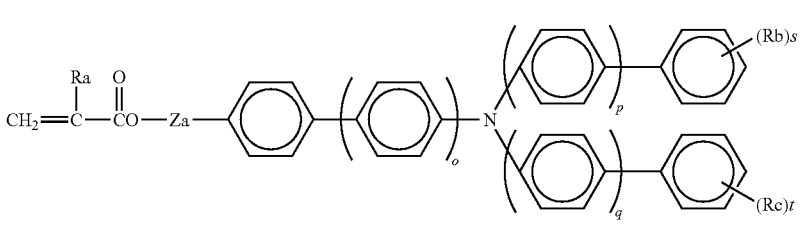

wherein in the formula, each of o, p, and q represents an integer of 0 or 1, Ra represents a hydrogen atom or a methyl group, and Rb and Rc are substituents other than hydrogen atoms, represent alkyl groups in which the number of carbon(s) is 1 through 6, and may be different in the case of a plural number, s and t represent integers of 0 through 3, and Za represents a single bond, a methylene group, an ethylene group,

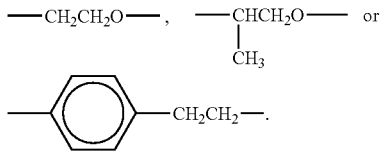

18. The electrophotographic photoconductor as claimed in claim 1, wherein a component ratio of the three-or-more-functional radical-polymerizable monomer having no charge transporting structure used for the crosslinked-type charge transportation layer is 30 through 70% by weight of a total quantity of the crosslinked-type charge transportation layer.

19. The electrophotographic photoconductor as claimed in claim 1, wherein a component ratio of the one-functional radical-polymerizable compound having a charge transporting structure used for the crosslinked-type charge transportation layer is 30 through 70% by weight of a total quantity of the crosslinked-type charge transportation layer.

20. The electrophotographic photoconductor as claimed in claim 1, wherein curing of the crosslinked-type charge transportation layer is conducted by heating or light energy irradiation.

21. An image formation apparatus comprising, a charging device, a light exposure device, a development device, a transfer device, and an electrophotographic photoconductor as claimed in claim 1.

22. The image formation apparatus as claimed in claim 21, wherein a plurality of image formation elements comprising at least the charging device, the light exposure device, the development device, the transfer device, and the electrophotographic photoconductor are arranged.

23. The image formation apparatus as claimed in claim 21, wherein a linear velocity of the photoconductor at the time of image formation is equal to or greater than 250 mm/sec.

24. The image formation apparatus as claimed in claim 21, wherein the image formation apparatus comprises a process cartridge for image formation apparatus configured such that at least the electrophotographic photoconductor and at least one device selected from the charging device, the light exposure device, development device, and cleaning device are integrated and the process cartridge for image formation apparatus is attachable to and detachable from a body of the apparatus.

25. A process cartridge for image formation apparatus comprising at least the electrophotographic photoconductor as claimed in claim 1.

26. An electrophotographic photoconductor comprising at least plural underlying layers, a photoconductive layer, and a crosslinked-type charge charge transportation layer being stacked on an electrically conductive support in order, wherein the photoconductive layer comprises a titanyl phthalocyanine crystal having at least a maximum diffraction peak at 27.2°, further having main peaks at 9.4°, 9.6°, and 24.0°, having a peak at 7.3° as a diffraction peak at a smallest angle side, having no peak between the peak at 7.3° and the peak at 9.4°, and further having no peak at 26.3°, in regard to a diffraction peak (±0.2°) at a Bragg angle 2θ of a CuKα ray (wavelength of 1.542 Å) and having an average particle size of primary particles being equal to or less than 0.25 μm, and the crosslinked-type charge transporation layer is formed by curing at least a three-or-more-functional radical-polymerizable monomer having no charge transporting structure and a one-functional radical-polymerizable compound having a charge transporting structure.

27. The electrophotographic photoconductor as claimed in claim 26, wherein the photoconductive layer comprises a stacked-layer structure configured such that a charge generation layer and a charge transportation layer are stacked in order.

28. The electrophotographic photoconductor as claimed in claim 26, wherein dispersion of titanyl phthalocyanine crystal particles is conducted until an average particle size thereof is equal to or less than 0.25 μm and a standard deviation thereof is equal to or less than 0.2 μm, then, filtration is conducted with a filter whose effective pore size is equal to or less than 3 μm, and the photosensitive layer is applied.

29. The electrophotographic photoconductor as claimed in claim 26, wherein the titanyl phthalocyanine crystal is provided by conducting crystal transformation of an amorphous titanyl phthalocyanine or low crystalline titanyl phthalocyanine having at least a maximum diffraction peak at 7.0°through 7.5°, a half value width of which diffraction peak is equal to or greater than 1°, in regard to a diffraction peak (±0.2°) at a Bragg angle 2θ of a CuKα ray (wavelength of 1.542 Å) and comprising primary particles with an average particle size equal to or less than 0.1 μm, with an organic solvent under the presence of water, and separation and filtration of post-crystal-transformation titanyl phthalocyanine with an organic solvent before an average particles size of post-crystal-transformation primary particles grows to be greater than 0.25 μm.

30. The electrophotographic photoconductor as claimed in claim 26, wherein the crosslinked-type charge transportation layer is insoluble in an organic solvent.

31. The electrophotographic photoconductor as claimed in claim 26, wherein a functional group(s) of the three-or-more-functional radical-polymerizable monomer having no charge transporting structure used for the crosslinked-type charge transportation layer is/are an acryloyloxy group and/or a methacryloyloxy group.

32. The electrophotographic photoconductor as claimed in claim 26, wherein a ratio of a molecular weight to the number of a functional group(s) (molecular weight/the number of functional group(s)) in regard to the three-or-more-functional radical-polymerizable monomer having no charge transporting structure used for the crosslinked-type charge transportation layer is equal to or less than 250.

33. The electrophotographic photoconductor as claimed in claim 26, wherein a functional group of the one-functional radical-polymerizable compound having a charge transporting structure used for the crosslinked-type charge transportation layer is an acryloyloxy group or a methacryloyloxy group.

34. The electrophotographic photoconductor as claimed in claim 26, wherein the charge transporting structure of the one-functional radical-polymerizable compound having a charge transporting structure used for the crosslinked-type charge transportation layer is a triarylamine structure.

35. The electrophotographic photoconductor as claimed in claim 26, wherein the one-functional radical-polymerizable compound having a charge transporting structure used for the crosslinked-type charge transportation layer is at least one kind of compound represented by the following general formula (1) or (2):

General formula (1)

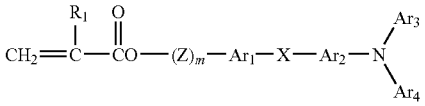

General formula (2)

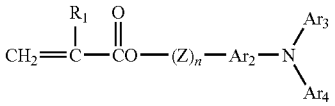

wherein in the formulas, $R_1$ represents a hydrogen atom, a halogen atom, an alkyl group that may have a substituent, an aralkyl group that may have a substituent, an aryl group that may have a substituent, a cyano group, a nitro group, an alkoxy group, —$COOR_7$ ($R_7$ represents a hydrogen atom, an alkyl group that may have a substituent, an aralkyl group that may have a substituent, or an aryl group that may have a substituent), a carbonyl halide group, or —$CONR_8R_9$ ($R_8$ and $R_9$ represent hydrogen atoms, halogen atoms, alkyl groups that may have a substituent, aralkyl groups that may have a substituent, or aryl groups that may have a substituent, and may be identical to or different from each other), and $Ar_1$ and $Ar_2$ represent substituted or non-substituted arylene groups and may be identical or different, $Ar_3$ and $Ar_4$ represent substituted or non-substituted aryl groups and may be identical or different, X represents a single bond, a substituted or non-substituted alkylene group, a substituted or non-substituted cycloalkylene group, a substituted or non-substituted alkylene ether group, an oxygen atom, a sulfur atom, or a vinylene group, Z represents a substituted or non-substituted alkylene group, a substituted or non-substituted alkylene ether group, or an alkyleneoxycarbonyl group, and m and n represent integers of 0 through 3.

36. The electrophotographic photoconductor as claimed in claim 26, wherein the one-functional radical-polymerizable compound having a charge transporting structure used for the crosslinked-type charge transportation layer is at least one kind of compound represented by the following general formula (3):

General formula (3)

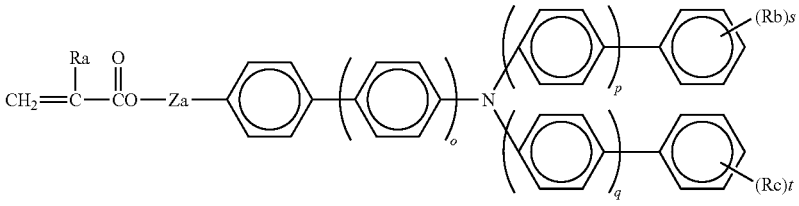

wherein in the formula, each of o, p, and q represents an integer of 0 or 1, Ra represents a hydrogen atom or a methyl group, and Rb and Rc are substituents other than hydrogen atoms, represent alkyl groups in which the number of carbon(s) is 1 through 6, and may be different in the case of a plural number, s and t represent integers of 0 through 3, and Za represents a single bond, a methylene group, an ethylene group,

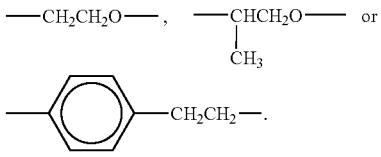

37. The electrophotographic photoconductor as claimed in claim 26, wherein a component ratio of the three-or-more-functional radical-polymerizable monomer having no charge transporting structure used for the crosslinked-type charge transportation layer is 30 through 70% by weight of a total quantity of the crosslinked-type charge transportation layer.

38. The electrophotographic photoconductor as claimed in claim 26, wherein a component ratio of the one-functional radical-polymerizable compound having a charge transporting structure used for the crosslinked-type charge transportation layer is 30 through 70% by weight of a total quantity of the crosslinked-type charge transportation layer.

39. The electrophotographic photoconductor as claimed in claim 26, wherein curing of the crosslinked-type charge transportation layer is conducted by heating or light energy irradiation.

40. The electrophotographic photoconductor as claimed in claim 26, wherein at least one layer of the plural underlying layers comprises a polyamide resin.

41. The electrophotographic photoconductor as claimed in claim 40, wherein the polyamide resin is an N-methoxymethylated nylon.

42. The electrophotographic photoconductor as claimed in claim 41, wherein the N-methoxylmethylated nylon is crosslinked by heating.

43. The electrophotographic photoconductor as claimed in claim 26, wherein at least one layer of the plural underlying layers comprises an inorganic pigment and a binder resin.

44. The electrophotographic photoconductor as claimed in claim 43, wherein the inorganic pigment is a metal oxide.

45. The electrophotographic photoconductor as claimed in claim 43, wherein the binder resin comprises a thermosetting resin.

46. The electrophotographic photoconductor as claimed in claim 40, wherein an underlying layer comprising the polyamide resin is formed directly on the electrically conductive support and an underlying layer comprising the inorganic pigment and the binder resin is stacked thereon.

47. An image formation apparatus comprising at least a charging device, a light exposure device, a development device, a transfer device and the electrophotographic photoconductor as claimed in claim 26.

48. The image formation apparatus as claimed in claim 47, wherein a plurality of image formation elements comprising at least the charging device, the light exposure device, the development device, the transfer device, and the electrophotographic photoconductor are arranged.

49. The image formation apparatus as claimed in claim 47, comprising a process cartridge for image formation apparatus configured such that at least the electrophographic photoconductor and at least one device selected from the charging device, the light exposure device, the development device, and a cleaning device are integrated and the process cartridge for image formation apparatus is attachable to and detachable from a body of the apparatus.

50. A process cartridge for image formation apparatus comprising at least the electrophotographic photoconductor as claimed in claim 26.

* * * * *